US008579668B2

(12) United States Patent
Minoura et al.

(10) Patent No.: US 8,579,668 B2
(45) Date of Patent: Nov. 12, 2013

(54) VESSEL PROPULSION APPARATUS

(75) Inventors: Minoru Minoura, Shizuoka (JP); Yuki Nakashima, Shizuoka (JP); Kenichi Yamada, Shizuoka (JP); Nobuharu Oota, Shizuoka (JP); Shimpei Kojima, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 50 days.

(21) Appl. No.: 13/454,233

(22) Filed: Apr. 24, 2012

(65) Prior Publication Data

US 2012/0276793 A1 Nov. 1, 2012

(30) Foreign Application Priority Data

Apr. 28, 2011 (JP) ..... 2011-101756
Mar. 7, 2012 (JP) ..... 2012-050906

(51) Int. Cl.
*B63H 11/11* (2006.01)

(52) U.S. Cl.
USPC ..... 440/41; 440/43

(58) Field of Classification Search
USPC ..... 440/38, 40, 41, 42, 43
See application file for complete search history.

(56) References Cited

U.S. PATENT DOCUMENTS

| | | | | |
|---|---|---|---|---|
| 6,428,370 | B1 * | 8/2002 | Jones | 440/38 |
| 6,652,332 | B1 | 11/2003 | Westhoff | |
| 6,875,064 | B2 | 4/2005 | Westhoff et al. | |
| 7,029,342 | B2 * | 4/2006 | Mallea | 440/41 |
| 7,029,344 | B2 * | 4/2006 | Tsumiyama et al. | 440/41 |
| 7,217,165 | B2 | 5/2007 | Roos | |
| 7,347,752 | B2 * | 3/2008 | Morvillo | 440/41 |
| 2011/0159752 | A1 | 6/2011 | Ota et al. | |

* cited by examiner

*Primary Examiner* — Lars A Olson
(74) *Attorney, Agent, or Firm* — Keating & Bennett, LLP

(57) ABSTRACT

A vessel propulsion apparatus includes a nozzle, a deflector, and a forward bucket (hereinafter referred to as "F bucket"). In a state in which the F bucket is in a closed position and the deflector is positioned at a left side, water jetted obliquely rearward to the left from the deflector is guided by the F bucket in a left guiding direction that is tilted further to the left than a direction of jetting of water from the deflector. In a state in which the F bucket is in the closed position and the deflector is positioned at a right side, water jetted obliquely rearward to the right from the deflector is guided by the F bucket in a right guiding direction that is tilted further to the right than the direction of jetting of water from the deflector.

27 Claims, 65 Drawing Sheets

FIG. 7
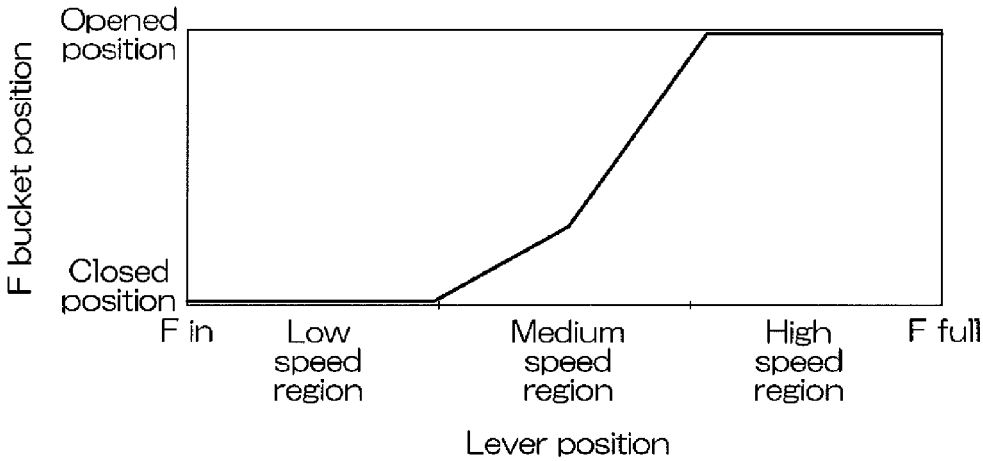
FIG. 8A Reverse
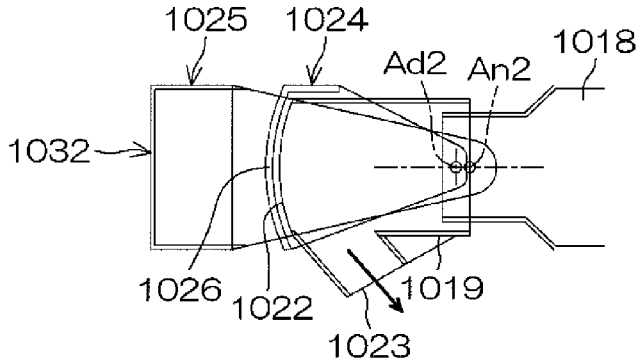
FIG. 8B Neutral
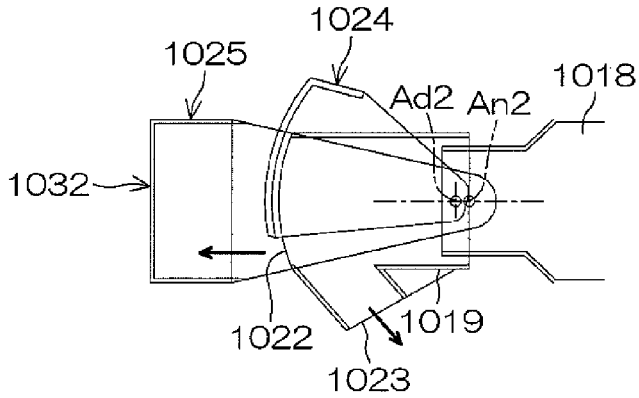

FIG. 8C Forward/low speed state
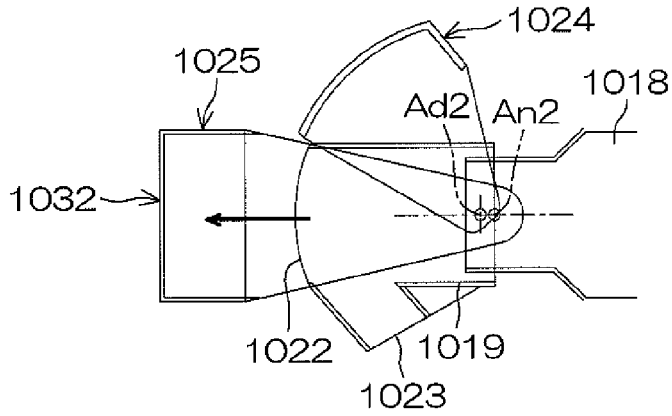
FIG. 8D Forward/medium speed state
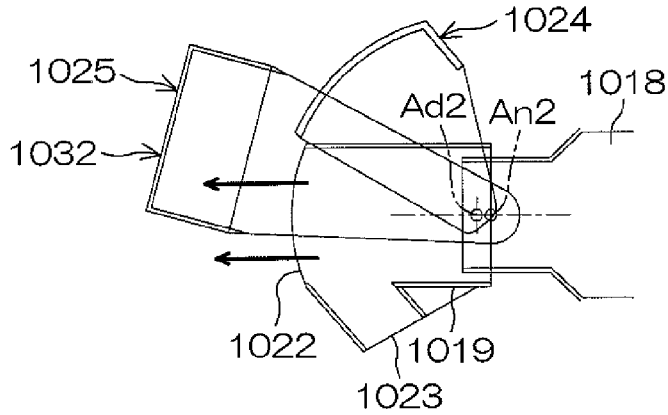
FIG. 8E Forward/high speed state
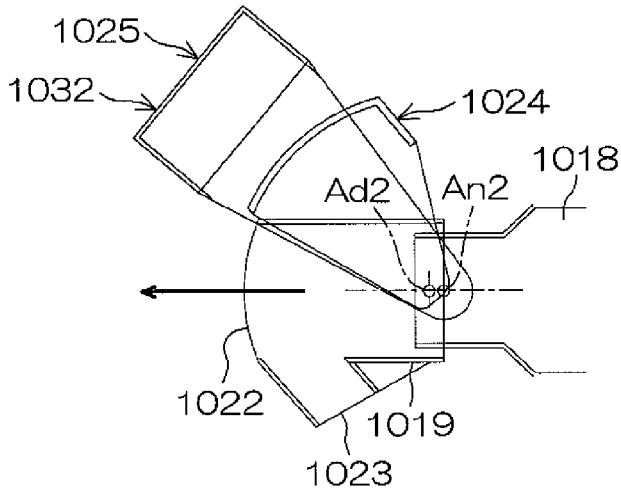

FIG. 12A Reverse
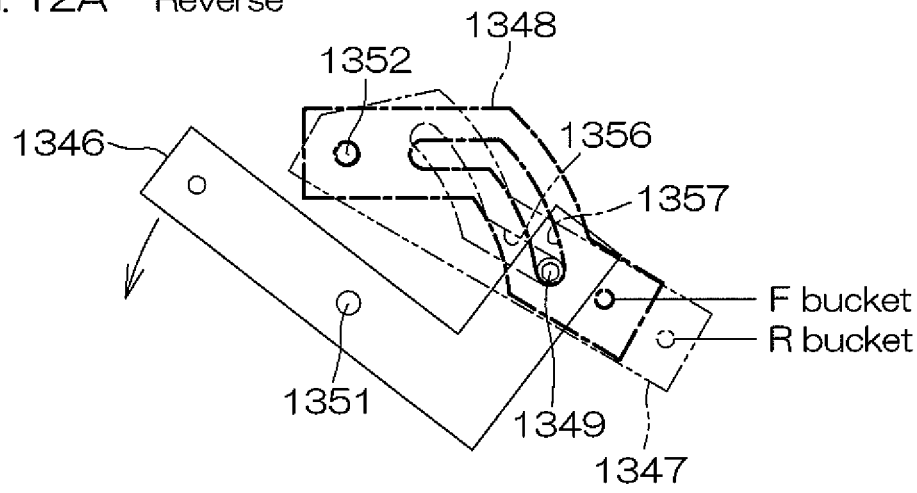
FIG. 12B Neutral
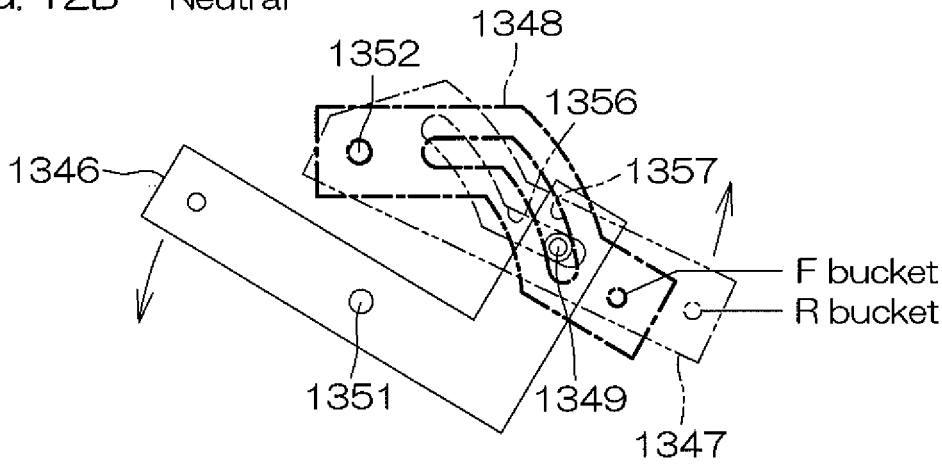

FIG. 12C Forward/low speed state
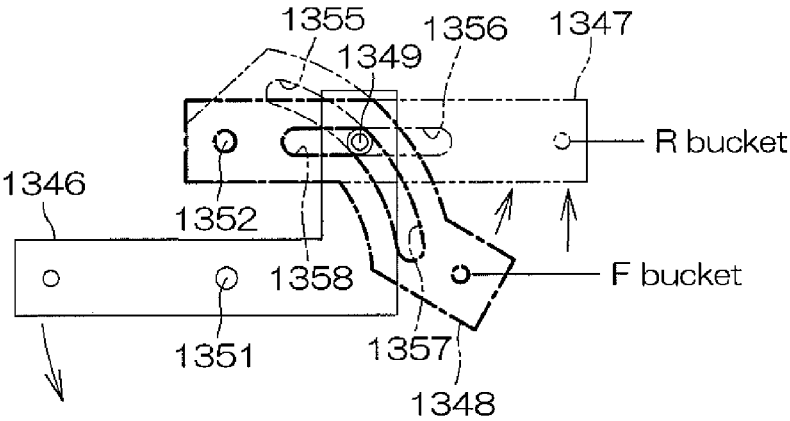
FIG. 12D Forward/medium speed state
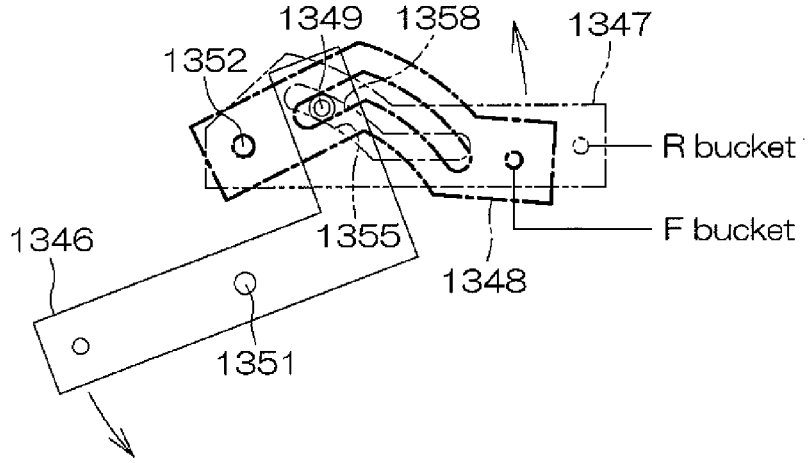
FIG. 12E Forward/high speed state
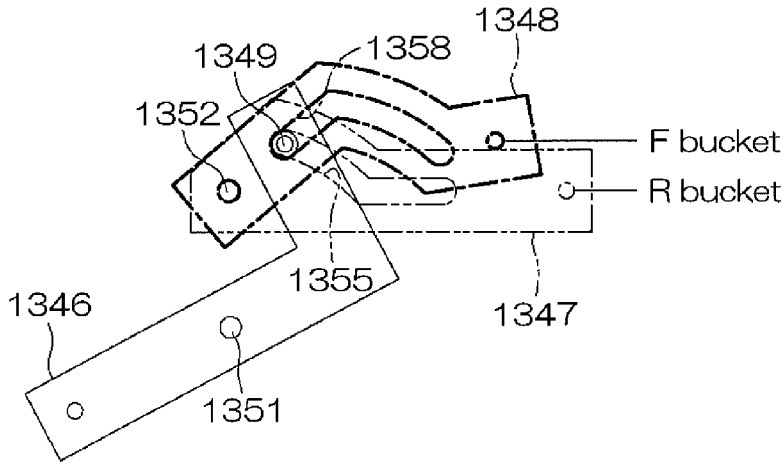

FIG. 15A Reverse
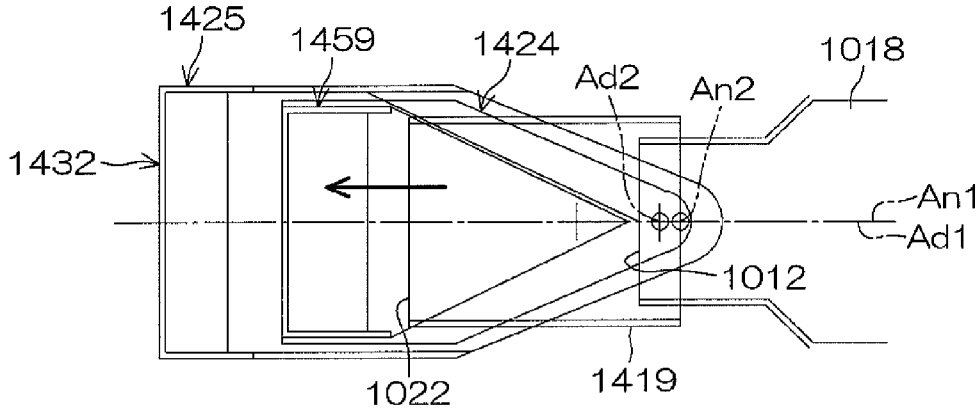
FIG. 15B Neutral
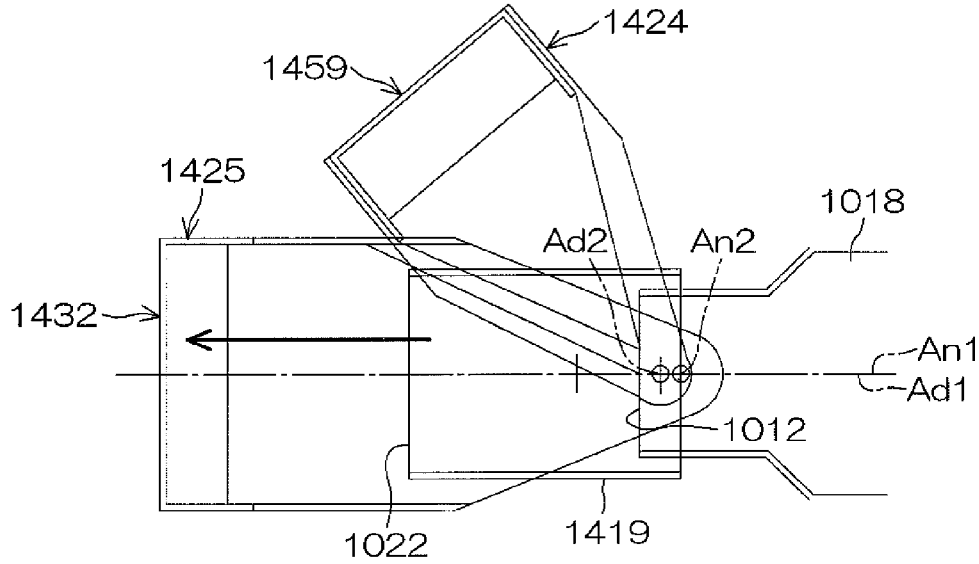

FIG. 15C Forward/low speed state
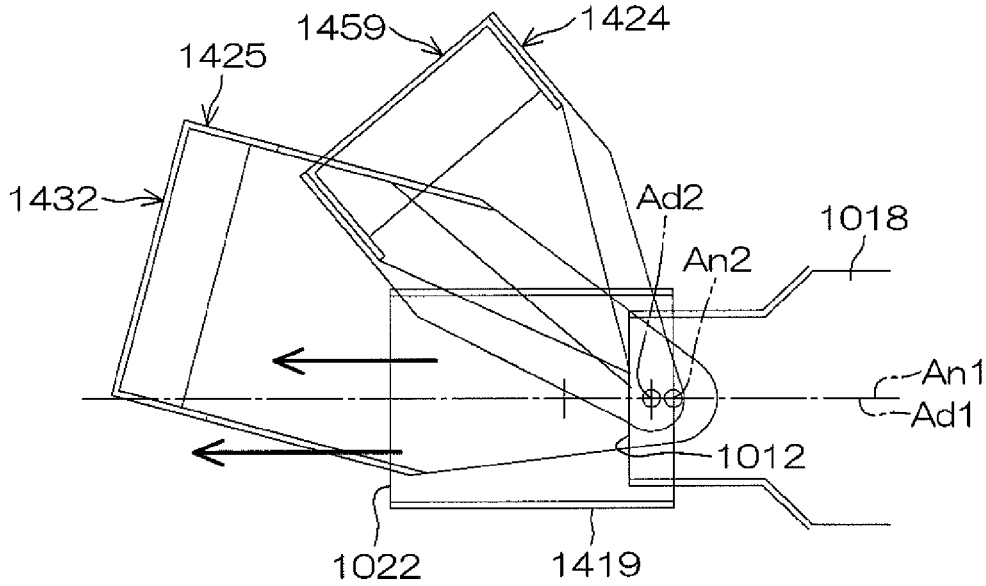
FIG. 15D Forward/high speed state
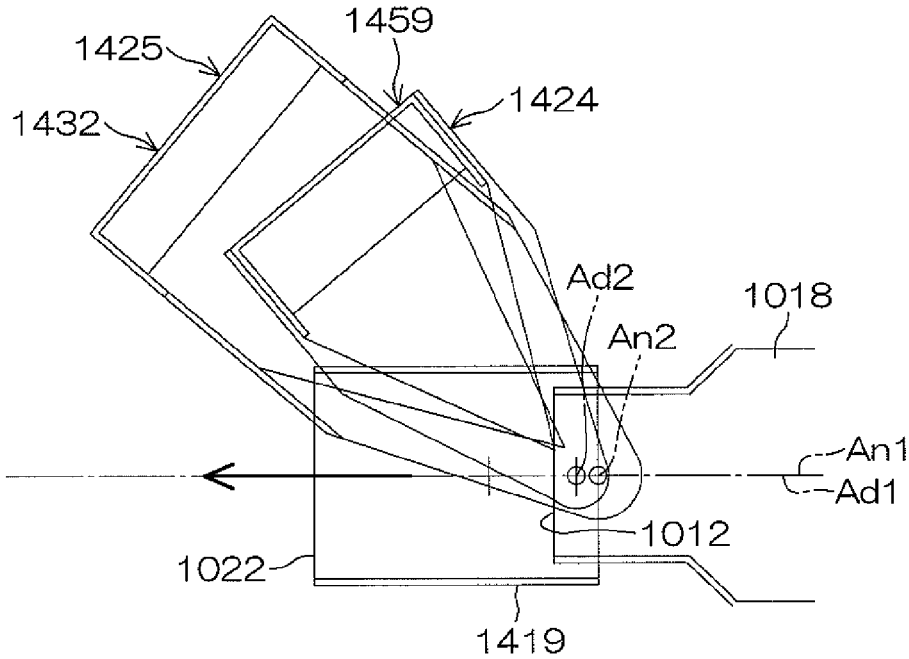

FIG. 17B
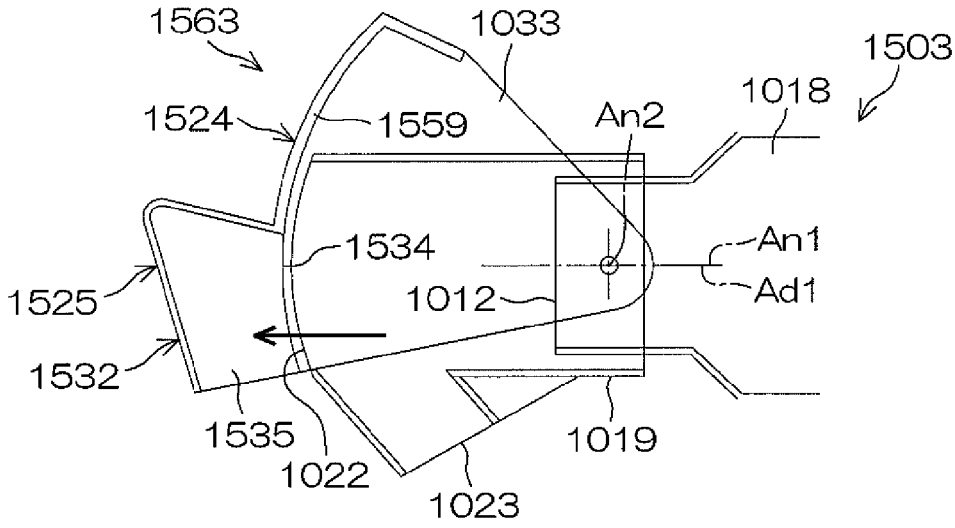
FIG. 18A Reverse
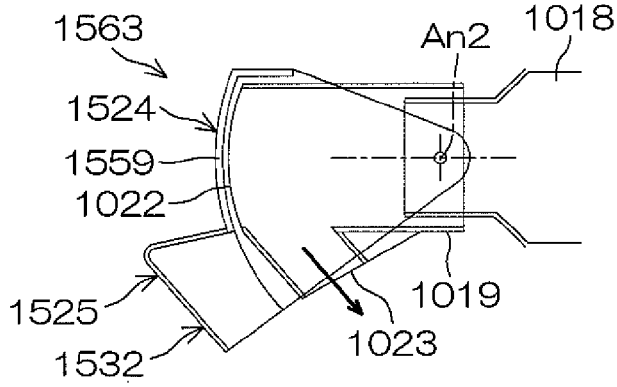
FIG. 18B Neutral
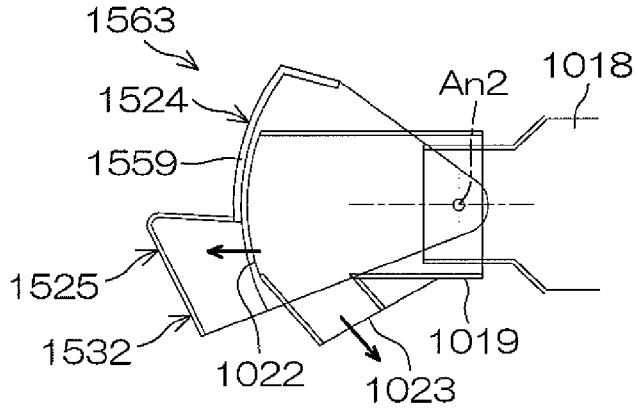

FIG. 18C Forward/low speed state
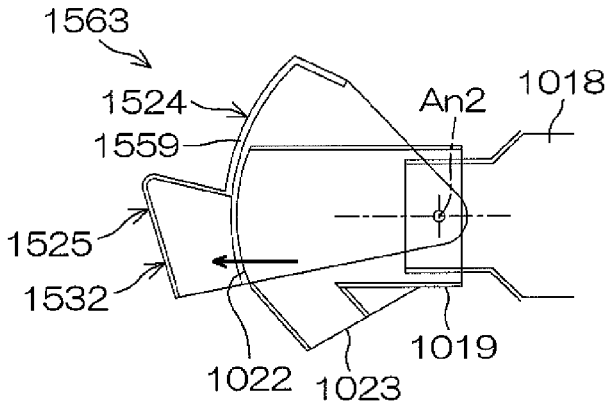
FIG. 18D Forward/medium speed state
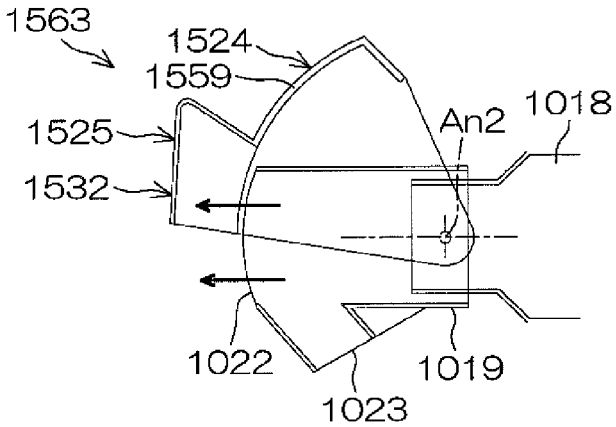
FIG. 18E Forward/high speed state
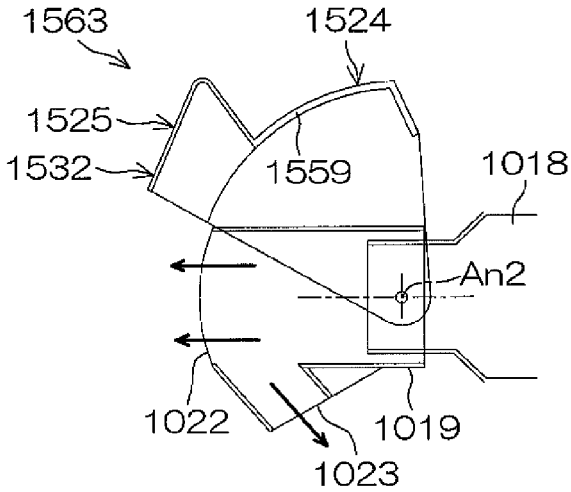

FIG. 20A Reverse
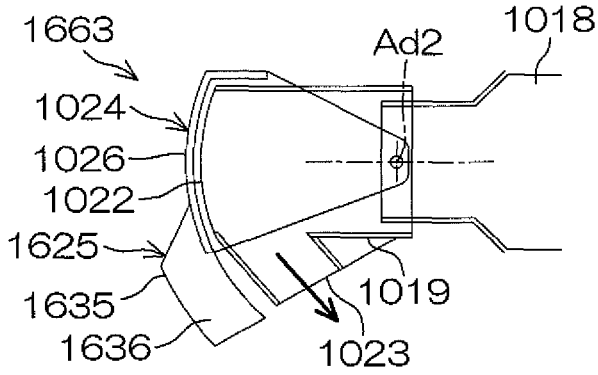
FIG. 20B Neutral
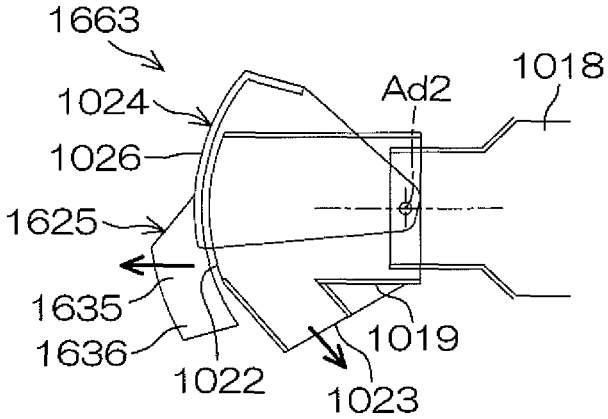

FIG. 20C Forward/low speed state
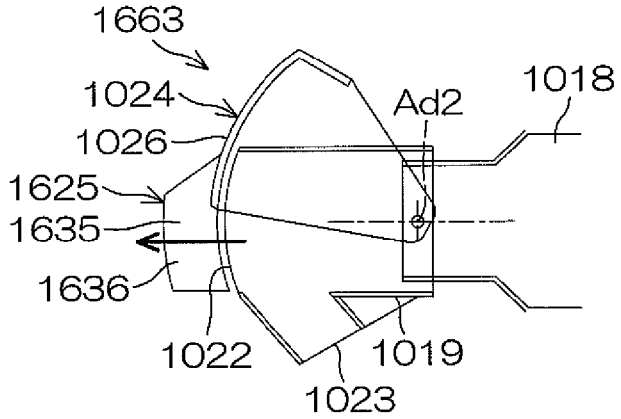
FIG. 20D Forward/medium speed state
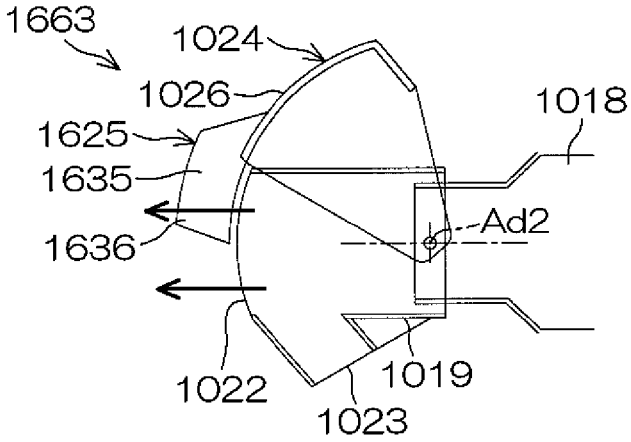
FIG. 20E Forward/high speed state
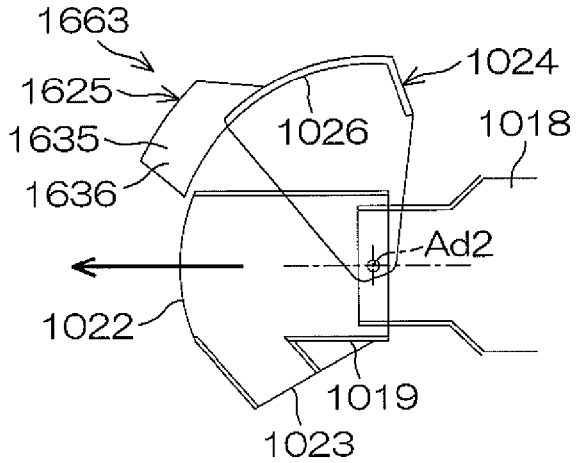

FIG. 25A Reverse
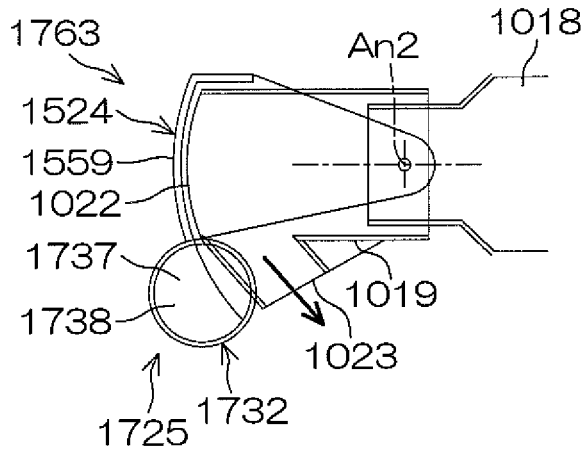
FIG. 25B Neutral
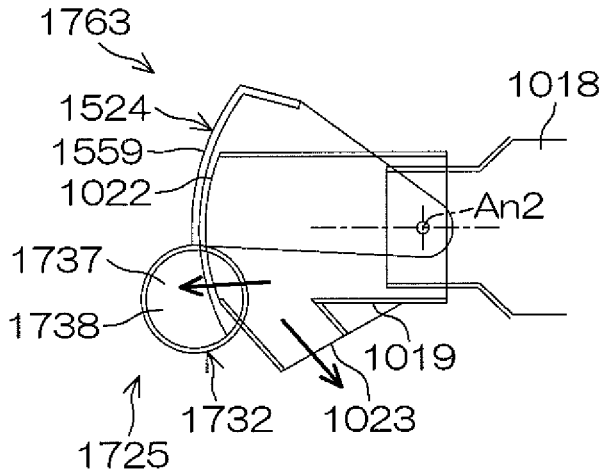

FIG. 25C Forward/low speed state
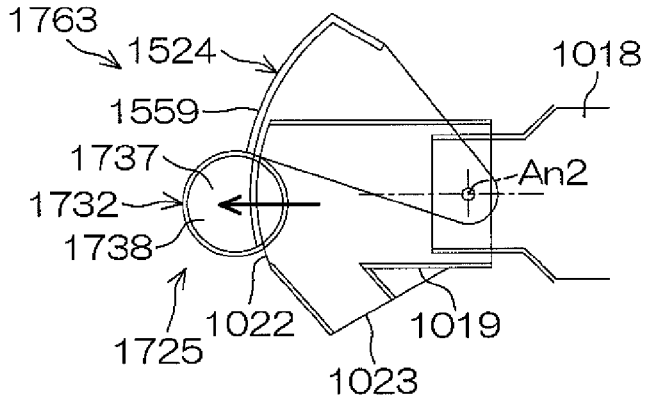
FIG. 25D Forward/medium speed state
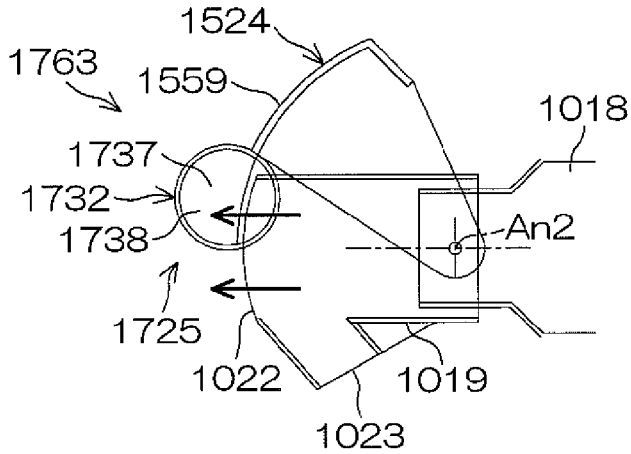
FIG. 25E Forward/high speed state
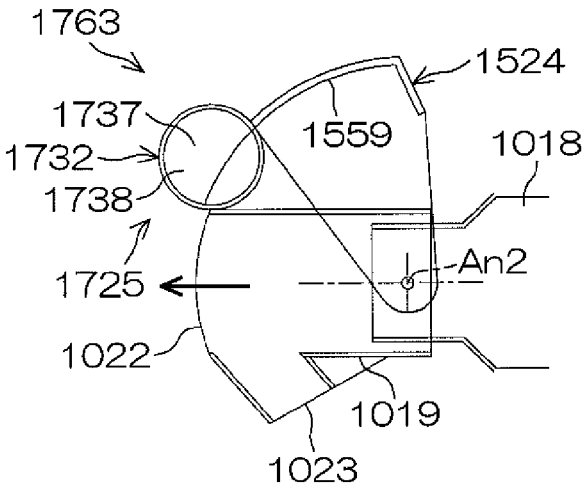

FIG. 30A Reverse
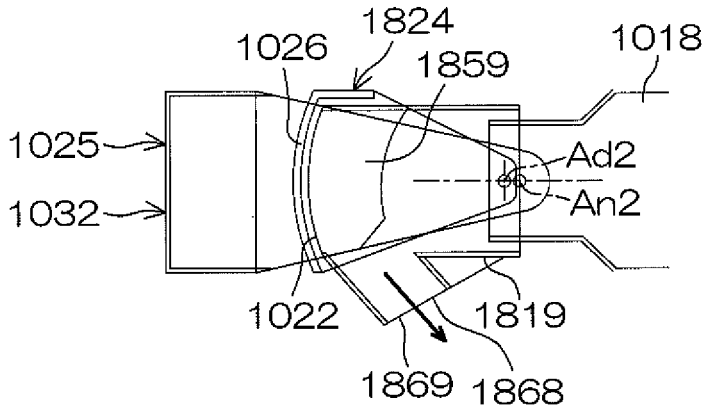
FIG. 30B Neutral
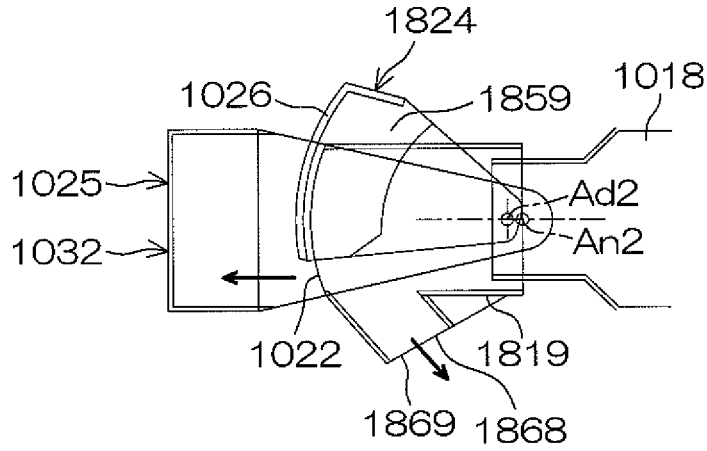

FIG. 30C Forward/low speed state
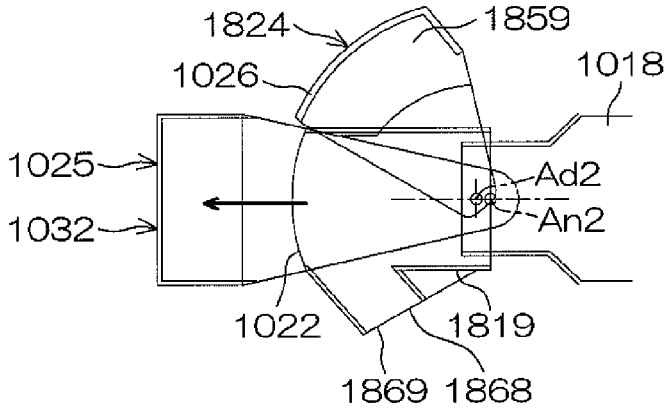
FIG. 30D Forward/medium speed state
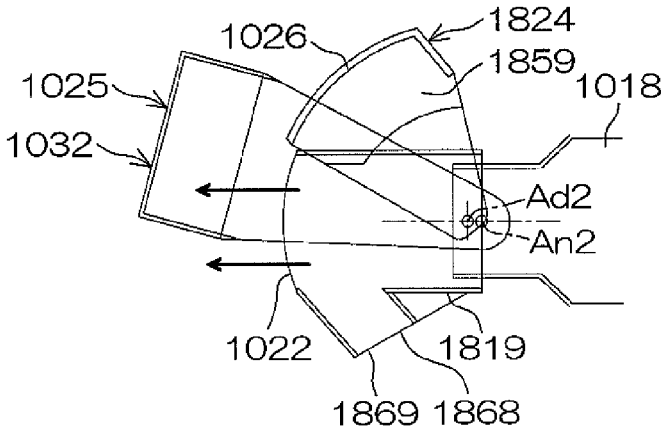
FIG. 30E Forward/high speed state
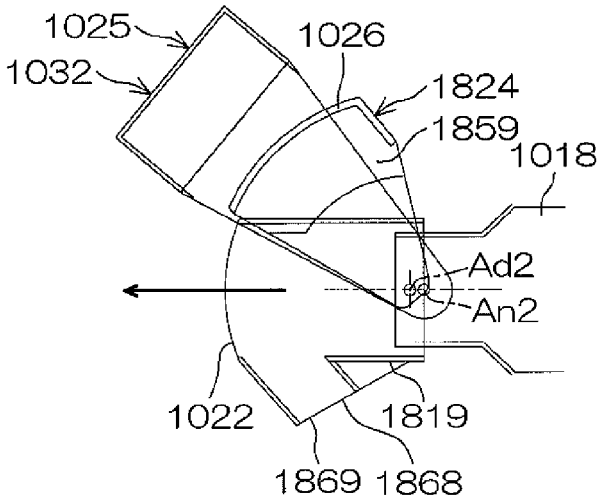

FIG. 34A Reverse
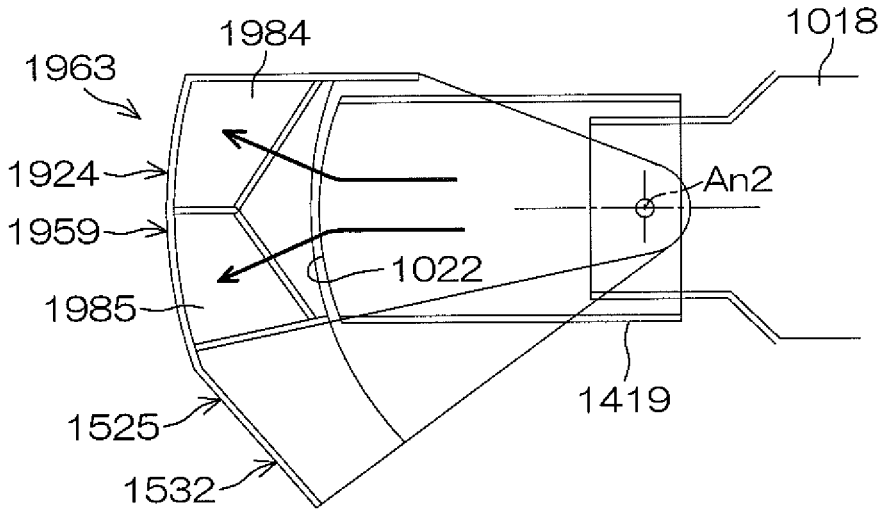
FIG. 34B Neutral
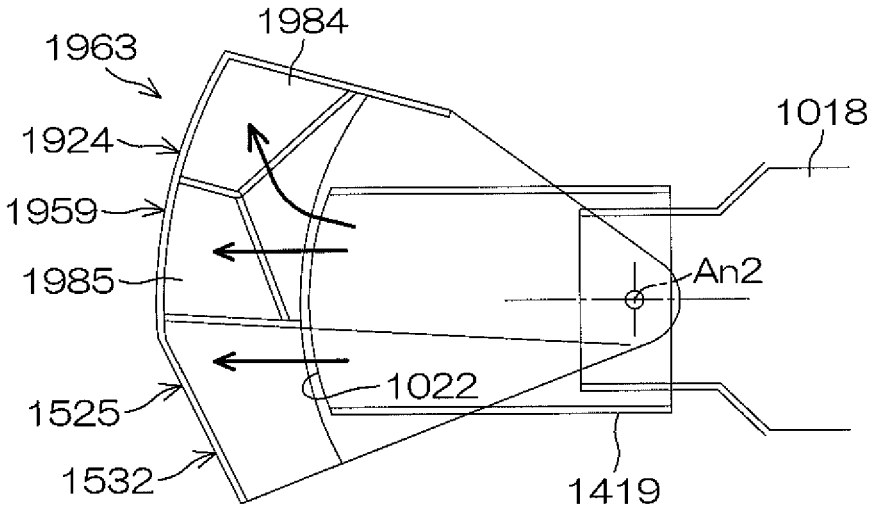

FIG. 34C Forward/low speed state
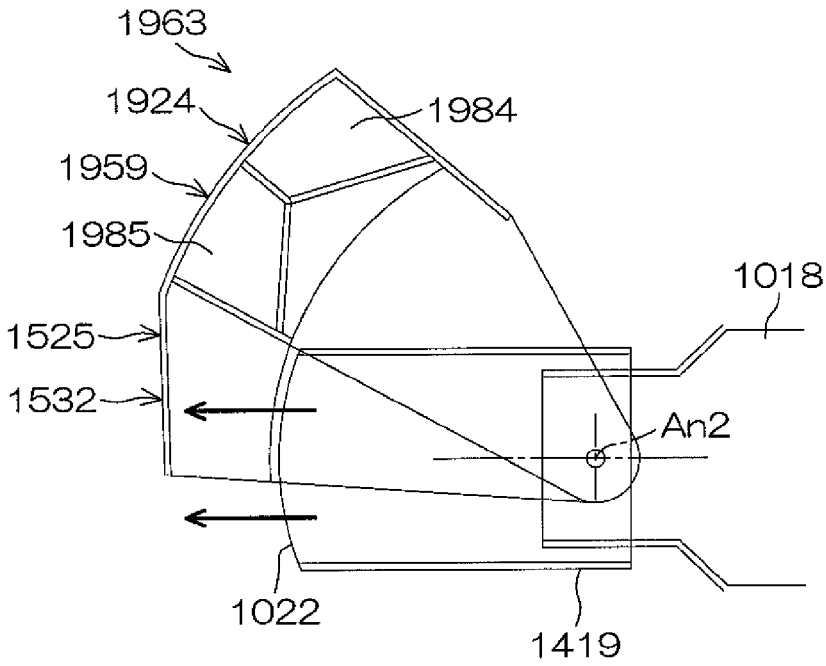
FIG. 34D Forward/high speed state
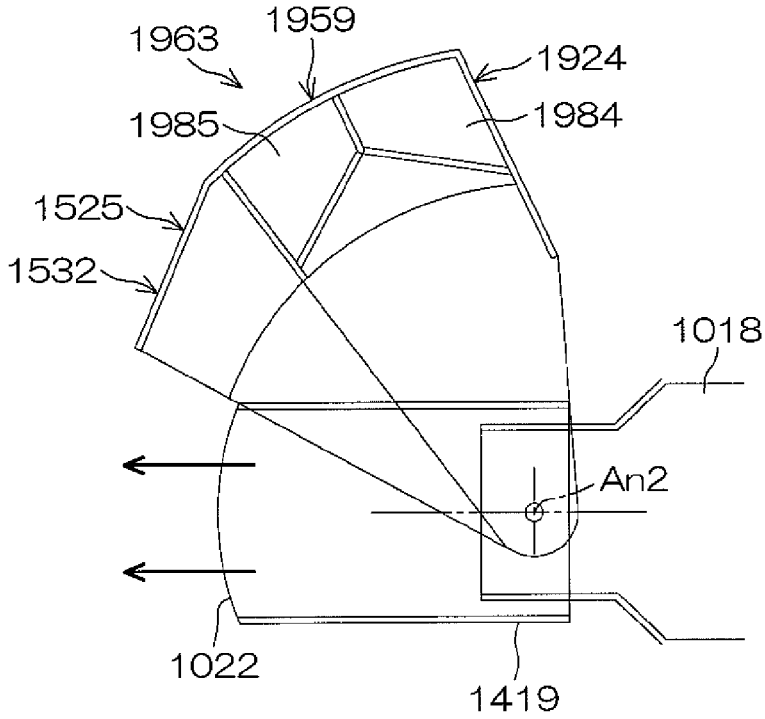

FIG. 43
| Bucket | Side view | Rear view |
|---|---|---|
| Opened position | 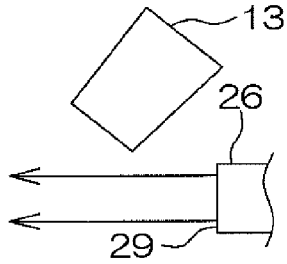 | 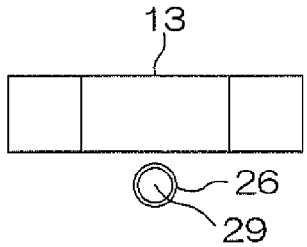 |
| Neutral position | 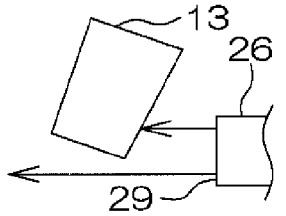 | 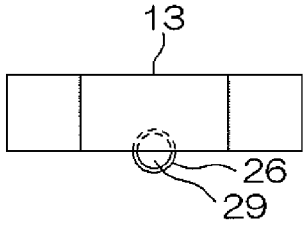 |
| Closed position | 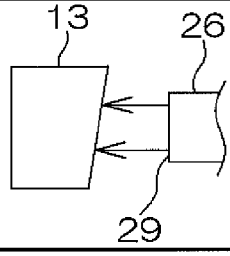 | 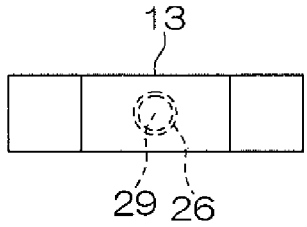 |

VESSEL PROPULSION APPARATUS

BACKGROUND OF THE INVENTION

1. Field of the Invention

The present invention relates to a vessel propulsion apparatus.

2. Description of the Related Art

A known vessel includes a vessel propulsion apparatus that propels the vessel by sucking in water from a hull bottom and jetting the water rearward.

For example, a conventional vessel described in U.S. Pat. No. 7,217,165 includes a jet pump including a steering nozzle and a reverse deflector. A jetting direction of water jetted rearward from an opening of the steering nozzle is changed in right and left directions by the steering nozzle. The reverse deflector moves up and down between a forward drive position (raised position) at which the opening of the steering nozzle is opened and a reverse drive position (reverse position) at which the opening of the steering nozzle is closed by the reverse deflector. When the reverse deflector is positioned at a neutral position between the raised position and the reverse position, a portion of the opening of the steering nozzle is closed by the reverse deflector.

When in a state in which the reverse deflector is positioned at the neutral position, water is jetted obliquely rearward to the right from the steering nozzle, a portion of the water stream is blocked by the reverse deflector. That is, a portion of the water stream is blocked by the reverse deflector and flows obliquely forward to the right and the remaining portion flows obliquely rearward to the right without being blocked by the reverse deflector. A thrust in an obliquely rearward direction and a thrust in an obliquely forward direction are thereby generated. The neutral position is a position at which a front/rear direction component of the thrust in the obliquely rearward direction and a front/rear direction component of the thrust in the obliquely forward direction are balanced and a thrust (resultant force) that moves a stern in a left direction is generated. Thus, when in the state in which the reverse deflector is positioned at the neutral position, water is jetted obliquely rearward to the right from the steering nozzle, the vessel turns to the right on the spot.

SUMMARY OF THE INVENTION

The inventors of preferred embodiments of the present invention described and claimed in the present application conducted an extensive study and research regarding a vessel propulsion apparatus, such as the one described above, and in doing so, discovered and first recognized new unique challenges and previously unrecognized possibilities for improvements as described in greater detail below.

Specifically, for example, when a vessel operator docks a vessel, the vessel operator lowers an output of a vessel propulsion apparatus and decelerates the vessel. Thereafter, the vessel operator causes the vessel to turn to the right or the left while making the vessel be driven forward or in reverse at low speed to move the vessel to a target position while adjusting an attitude of the vessel. As the vessel increases in size, a greater thrust is required to make the vessel turn. Especially, in a case where the vessel is to be turned by mutual cancellation of a front/rear direction component of a thrust in an obliquely rearward direction and a front/rear direction component of a thrust in an obliquely forward direction as in the conventional vessel described in U.S. Pat. No. 7,217,165, a greater force must be output from an engine that drives a jet pump. However, when the vessel is low in speed, that is, when the engine is low in rotation speed, the thrust is small and the turning operation of the vessel is slow. It is thus difficult to move the vessel quickly to the target position.

In order to overcome the previously unrecognized and unsolved challenges described above, a preferred embodiment of the present invention provides a vessel propulsion apparatus that includes a nozzle, a deflector, and a forward bucket (hereinafter referred to as "F bucket"). The nozzle jets water rearward. The deflector is rotatable to the right and left around a substantially vertical D axis and between a right maximum steering position and a left maximum steering position. The deflector defines an outlet by which water jetted rearward from the nozzle is jetted in a rearward direction or an obliquely rearward direction tilted to the right or left with respect to the rearward direction. The F bucket is rotatable up and down around a substantially horizontal F axis and between a closed position of covering at least a portion of the outlet of the deflector in a rear view and an opened position of not covering the outlet.

In a state in which the F bucket is positioned at the closed position and the deflector is positioned at a right side relative to a straight drive position between the right maximum steering position and the left maximum steering position, water jetted obliquely rearward to the right from the outlet is guided in a right guiding direction by the F bucket. Further, in a state in which the F bucket is positioned at the closed position and the deflector is positioned at a left side relative to the straight drive position, water jetted obliquely rearward to the left from the outlet is guided in a left guiding direction by the F bucket. The right guiding direction is a right direction or an obliquely rearward right direction that is tilted further to the right than a direction of jetting of water from the outlet, and the left guiding direction is a left direction or an obliquely rearward left direction that is tilted further to the left than the direction of jetting of water from the outlet.

With this arrangement of the present preferred embodiment of the present invention, water jetted rearward from the nozzle passes through the deflector and is jetted rearward from the outlet of the deflector. The F bucket is rotatable up and down around the substantially horizontal F axis and between the closed position of covering at least a portion of the outlet of the deflector in a rear view and the opened position of not covering the outlet.

In a state in which the F bucket is positioned at the opened position, the outlet is not covered and the water jetted from the outlet flows rearward without being blocked by the F bucket. The deflector is rotatable to the right and left around the substantially vertical D axis and between the right maximum steering position and the left maximum steering position. The right maximum steering position and the left maximum steering position are positions at which water is jetted from the outlet in obliquely rearward directions that are tilted to the right and left with respect to the rearward direction. The straight drive position between the right maximum steering position and the left maximum steering position is a position at which water is jetted in the rearward direction from the outlet. The direction of jetting of water from the outlet changes in accordance with the movement of the deflector around the D axis. A water stream that flows rearward from the nozzle is thus tilted to the right or left by the deflector.

On the other hand, in the state in which the F bucket is positioned at the closed position and the deflector is positioned at the right side relative to the straight drive position, the water jetted obliquely rearward to the right from the outlet is guided in the right guiding direction by the F bucket. Also, in the state in which the F bucket is positioned at the closed position and the deflector is positioned at the left side relative to the straight drive position, the water jetted obliquely rearward to the left from the outlet is guided in the left guiding direction by the F bucket. The right guiding direction is the right direction or an obliquely rearward right direction that is tilted further to the right than the direction of jetting of water from the outlet, and the left guiding direction is the left direction or an obliquely rearward left direction that is tilted further to the left than the direction of jetting of water from the outlet. The water stream flowing rearward from the deflector is thus tilted further to the right or left by the F bucket.

A water stream that is tilted to the right by the deflector is thus tilted further to the right by the F bucket, and a water stream that is tilted to the left by the deflector is thus tilted further to the left by the F bucket. A thrust having a larger lateral direction component (right direction component or left direction component) than that when the F bucket is positioned at the opened position is thus generated. A force that turns the vessel can thus be made large while suppressing a force that moves the vessel in the forward direction. Vessel maneuverability at low speed can thereby be improved. Moreover, the thrust having the lateral direction component is generated by the F bucket guiding the water stream and thus energy loss is low in comparison to a case where thrusts cancel each other out. Energy can thus be used efficiently.

The F axis may be an axis that is fixed with respect to the nozzle. That is, the F axis may be an axis that does not move relative to the nozzle.

Also, in a state in which the F bucket is positioned at the closed position and the deflector is positioned at the straight drive position, the water jetted rearward from the outlet may be divided to the right and left at equal flow rates by the F bucket. In this case, a right branch stream flowing in the right guiding direction and a left branch stream flowing in the left guiding direction are generated by the F bucket.

Also, in the state in which the F bucket is positioned at the closed position and the deflector is positioned at the right side relative to the straight drive position, the F bucket causes the right branch stream to have a greater flow rate than the left branch stream. Further, in the state in which the F bucket is positioned at the closed position and the deflector is positioned at the left side relative to the straight drive position, the F bucket causes the left branch stream to have a greater flow rate than the right branch stream.

Also, the F bucket may include an apex portion disposed on a central axis of the deflector positioned at the straight drive position, a right guide extending obliquely rearward to the right from the apex portion, and a left guide extending obliquely rearward to the left from the apex portion. In this case, a water stream flowing to the right side of the apex portion is guided in the right guiding direction by the right guide, and a water stream flowing to the left side of the apex portion is guided in the left guiding direction by the left guide. The water stream flowing rearward from the deflector is thereby tilted to the right and left.

Also, the vessel propulsion apparatus may further include a reverse bucket (hereinafter referred to as "R bucket") that is rotatable up and down around a substantially horizontal R axis independently of the F bucket. That is, the R bucket may be arranged so as not to move in linkage with the R bucket. Water flowing into the deflector from the nozzle is guided forward by the R bucket.

Also, the R bucket may be rotatable up and down around the R axis that is fixed with respect to the deflector. That is, the R axis may be an axis that is fixed with respect to the deflector and does not move relative to the deflector.

Also, the vessel propulsion apparatus may further include an R bucket that is rotatable around the F axis together with the F bucket. That is, the R bucket may be integral with the F bucket or may be fixed to the F bucket. Water flowing into the deflector from the nozzle is guided forward by the R bucket. The R bucket may be disposed above the F bucket.

Also, the F bucket may include a right guide by which water, jetted rearward from a right end portion of the outlet in a state in which the F bucket is positioned at the closed position, is guided in the left guiding direction. Further, the F bucket may include a left guide by which water, jetted rearward from a left end portion of the outlet in a state in which the F bucket is positioned at the closed position, is guided in the right guiding direction.

Also, the vessel propulsion apparatus may further include an R bucket that is rotatable up and down around the F axis together with the right guide and the left guide. That is, the R bucket may be integral with the right guide and the left guide or may be fixed to the right guide and the left guide. Water flowing into the deflector from the nozzle is guided forward by the R bucket.

Another preferred embodiment of the present invention provides a vessel propulsion apparatus that includes a jet pump, a power source, an F bucket, and an R bucket. The jet pump includes a nozzle that jets water rearward, and a deflector defining an outlet by which water jetted rearward from the nozzle is jetted rearward. The deflector is rotatable to the right and left around a substantially vertical D axis and between a right maximum steering position and a left maximum steering position. The power source drives the jet pump. The power source may be one of either an internal combustion engine or an electric motor or may be an internal combustion engine and an electric motor, for example. A device besides an internal combustion engine and an electric motor may be used as the power source.

The F bucket guides water that flows into the deflector from the nozzle. The water that flows into the deflector from the nozzle is guided by the R bucket in a manner such that a thrust in a reverse drive direction is generated. The R bucket and the F bucket are rotatable around mutually different axes. Specifically, the F bucket is rotatable up and down around a substantially horizontal F axis and between a closed position of covering at least a portion of the outlet of the deflector in a rear view and an opened position of not covering the outlet. The R bucket is rotatable up and down around a substantially horizontal R axis and between a closed position of covering at least a portion of the outlet of the deflector in a rear view and an opened position of not covering the outlet. The R bucket and the F bucket are thus rotatable up and down in a mutually independent manner.

The R bucket may be disposed in front of the F bucket. The F axis may be an axis that is fixed with respect to the nozzle, and the R axis may be an axis that is fixed with respect to the deflector.

Also, in a state in which the F bucket is positioned at the closed position and the deflector is positioned at aright side relative to a straight drive position, water jetted obliquely rearward to the right from the outlet may be guided in a right guiding direction by the F bucket. Also, in a state in which the F bucket is positioned at the closed position and the deflector is positioned at a left side relative to the straight drive position, the water jetted obliquely rearward to the left from the outlet may be guided in a left guiding direction by the F bucket.

Also, in a state in which the F bucket is positioned at the closed position and the deflector is positioned at the straight drive position, water jetted rearward from the outlet may be divided to the right and left at equal flow rates by the F bucket. In this case, a right branch stream flowing in the right guiding direction and a left branch stream flowing in the left guiding direction are generated by the F bucket.

Also, in the state in which the F bucket is positioned at the closed position and the deflector is positioned at the right side relative to the straight drive position, the F bucket causes the right branch stream to have a greater flow rate than the left branch stream. Further, in the state in which the F bucket is positioned at the closed position and the deflector is positioned at the left side relative to the straight drive position, the F bucket causes the left branch stream to have a greater flow rate than the right branch stream.

Also, the vessel propulsion apparatus may further include an actuator that rotates the F bucket up or down around the F axis. In this case, the vessel propulsion apparatus may further include a controller that is arranged and programmed to control the actuator based on a parameter related to operation of the power source. The controller may control the actuator based on a plurality of parameters or may control the actuator based on a single parameter.

For example, in a case where the vessel propulsion apparatus further includes an operation member operated by a vessel operator to adjust an output of the power source, the controller may control the actuator based on a position of the operation member. That is, the position of the operation member may be included in the parameter.

Also, the power source may be an internal combustion engine that includes a throttle valve that changes a supply flow rate of intake air. In this case, the controller may control the actuator based on an opening degree of the throttle valve. That is, the opening degree of the throttle valve may be included in the parameter.

Also, the controller may control the actuator based on a rotation speed of the power source. That is, the rotation speed of the power source may be included in the parameter.

Also, the F bucket may be arranged to rotate to the opened position side by receiving water jetted rearward from the outlet. In this case, the vessel propulsion apparatus may further include an urging member that generates a restorative force that corresponds to a movement amount of the F bucket from the closed position and returns the F bucket to the closed position.

Also, the vessel propulsion apparatus may further include an operation member that is movable among a first position, a second position, and a third position and is operated by a vessel operator. In this case, the first position may be a reverse drive shift switching position at which the vessel propulsion apparatus is switched to generate a thrust in a reverse drive direction. The second position may be a forward drive shift switching position at which the vessel propulsion apparatus is switched to generate a thrust in a forward drive direction. In this case, the third position may be a position at which the operation member is positioned when the vessel propulsion apparatus generates a thrust in the forward drive direction. Specifically, the third position may be a forward drive fully opened position at which the output of the vessel propulsion apparatus is greatest and the vessel propulsion apparatus generates a thrust in the forward drive direction or may be a position between the second position and the forward drive fully opened position.

In a case where the vessel propulsion apparatus includes the operation member, the vessel propulsion apparatus may further include a bucket moving device that moves the F bucket and the R bucket based on the position of the operation member. In this case, the bucket moving device may move at least one of the F bucket and the R bucket such that when the operation member moves from the first position to the second position, the R bucket moves from the closed position to the opened position. Further, the bucket moving device may move at least one of either of the F bucket and the R bucket such that when the operation member moves from the second position to the third position, the F bucket moves from the closed position to the opened position.

Also, the vessel propulsion apparatus may further include a controller that controls the power source. In this case, the controller may keep the output of the power source fixed regardless of the operation of the operation member in a state in which the operation member is positioned between the first position and the second position. Further, the controller may increase the output of the power source in accordance with a movement amount of the operation member from the second position in a state in which the operation member is positioned between the second position and the third position.

Yet another preferred embodiment of the present invention provides a vessel propulsion apparatus that includes a pair of nozzles, a pair of deflectors, and a pair of F buckets. The pair of nozzles are respectively disposed at right and left sides of a width direction center of a hull (hull center). The pair of nozzles jet water rearward. The pair of deflectors are respectively coupled to the pair of nozzles. The pair of deflectors are rotatable to the right and left around substantially vertical D axes and between right maximum steering positions and left maximum steering positions. The pair of deflectors define outlets by which water jetted rearward from the nozzles are jetted in rearward directions or in obliquely rearward directions that are tilted to the right or left with respect to the rearward directions. The pair of F buckets are respectively disposed at right and left sides of the width direction center of the hull. The pair of F buckets are rotatable up and down around substantially horizontal F axes and between closed positions of covering at least a portion of the outlets of the deflectors in a rear view and opened positions of not covering the outlets. Water flowing into the respective deflectors from the nozzles is guided by the pair of F buckets such that thrusts in forward drive directions are generated.

In a state in which the pair of F buckets are positioned at the closed positions and the pair of deflectors are positioned at the right sides relative to straight drive positions, water jetted obliquely rearward to the right from the outlet at the right side is guided in a right guiding direction by the F bucket at the right side. Further, in this state, water jetted obliquely rearward to the right from the outlet at the left side is guided by the F bucket at the left side in a direction between a direction of jetting of water from the outlet at the straight drive position and the right direction. The right guiding direction is the right direction or an obliquely rearward right direction that is tilted further to the right than the direction of jetting of water from the outlet.

Also, in a state in which the pair of F buckets are positioned at the closed positions and the pair of deflectors are positioned at the left sides relative to the straight drive positions, water jetted obliquely rearward to the left from the outlet at the left side is guided in a left guiding direction by the F bucket at the left side. Further, in this state, water jetted obliquely rearward to the left from the outlet at the right side is guided by the F bucket at the right side in a direction between a direction of jetting of water from the outlet at the straight drive position and the left direction. The left guiding direction is the left direction or an obliquely rearward left direction that is tilted further to the left than the direction of jetting of water from the outlet.

Also, the F bucket at the right side may be rotatable up and down around the F axis that is fixed with respect to the nozzle at the right side, and the F bucket at the left side may be rotatable up and down around the F axis that is fixed with respect to the nozzle at the left side.

Also, in the state in which the pair of F buckets are positioned at the closed positions and the pair of deflectors are positioned at the right sides relative to the straight drive positions, at least a portion of the water jetted rearward from the outlet at the right side may be guided by the F bucket at the right side. In this case, a right branch stream flowing in the right guiding direction is generated by the F bucket at the right side.

Also, in the state in which the pair of F buckets are positioned at the closed positions and the pair of deflectors are positioned at the left sides relative to the straight drive positions, at least a portion of the water jetted rearward from the outlet at the left side may be guided by the F bucket at the left side. In this case, a left branch stream flowing in the left guiding direction is generated by the F bucket at the left side.

Also, in a state in which the pair of F buckets are positioned at the closed positions and the pair of deflectors are positioned at the straight drive positions, the pair of F buckets causes the right branch stream and the left branch stream to have equal flow rates.

Also, in the state in which the pair of F buckets are positioned at the closed positions and the pair of deflectors are positioned at the right sides relative to the straight drive positions, the pair of F buckets causes the right branch stream to have a greater flow rate than the left branch stream. Further, in the state in which the pair of F buckets are positioned at the closed positions and the pair of deflectors are positioned at the left sides relative to the straight drive positions, the pair of F buckets causes the left branch stream to have a greater flow rate than the right branch stream.

Also, the vessel propulsion apparatus may further include a pair of R buckets by which water flowing into the respective deflectors from the nozzles is guided such that thrusts in reverse drive directions are generated. The pair of R buckets may be disposed at right and left sides respectively of the width direction center of the hull. In this case, the F bucket at the right side may be disposed below the R bucket at the right side and may rotate around the F axis together with the R bucket at the right side. That is, the F bucket and the R bucket that are disposed at the same side with respect to the width direction center of the hull may be aligned vertically such that the F bucket is positioned below the R bucket and may be integrally rotatable around the F axis.

Each of the pair of F buckets may have a shape that is right/left asymmetrical. In this case, the pair of F buckets may be disposed symmetrically with respect to the width direction center of the hull. Further, an entirety of the pair of F buckets may have a shape that is right/left symmetrical.

Yet another preferred embodiment of the present invention provides a vessel propulsion apparatus that includes a jet pump and a bucket. The jet pump is arranged to jet water rearward from the outlet of the jet pump and to change a direction of jetting of water from the outlet to the right and left. The bucket is arranged to move between a closed position of covering the outlet when the outlet is viewed from the rear and an opened position of not covering the outlet when the outlet is viewed from the rear. Further, the bucket includes a right fixed guide, a left fixed guide, a right movable guide, and a left movable guide. The right fixed guide is arranged such that at the closed position, it is positioned at the rear of the outlet and at least a portion of water jetted from the outlet is thereby guided in a right direction. The left fixed guide is arranged such that at the closed position, it is positioned at the rear of the outlet and at least a portion of water jetted from the outlet is thereby guided in a left direction. The right movable guide is disposed further to the right than the right fixed guide and is arranged to move between a forward drive position at which water guided by the right fixed guide is guided in an obliquely rearward direction and a reverse drive position at which water guided by the right fixed guide is guided in an obliquely forward direction. The left movable guide is disposed further to the left than the left fixed guide and is arranged to move between a forward drive position at which water guided by the left fixed guide is guided in an obliquely rearward direction and a reverse drive position at which water guided by the left fixed guide is guided in an obliquely forward direction.

With this arrangement of the present preferred embodiment of the present invention, a thrust that propels a vessel is generated by the jet pump jetting water rearward from the outlet. In a state in which the bucket is positioned at the opened position, the outlet is not covered by the bucket and thus the water jetted rearward from the jet pump flows rearward without being blocked by the bucket. Thus, in this state, by the jet pump changing the direction of jetting of water from the outlet to the right or left, a thrust that turns the vessel, that is, a thrust having a lateral direction component (right direction component or left direction component) is generated. On the other hand, in a state in which the bucket is positioned at the closed position, the outlet is covered by the bucket and water jetted rearward from the jet pump is blocked by the bucket and is guided in any one of an obliquely forward direction, an obliquely rearward direction, or a direction between the two directions.

Specifically, when water is jetted from the outlet of the jet pump in the state in which the bucket is positioned at the closed position, the jetted water is guided in the right direction by the right fixed guide. The water guided by the right fixed guide is then guided by the right movable guide, disposed further to the right than the right fixed guide, in a direction that is in accordance with the position of the right movable guide between the forward drive position and the reverse drive position. That is, the water guided by the right movable guide is guided in any one of an obliquely forward direction, an obliquely rearward direction, or a direction between the two directions. The bucket then jets the water in the direction guided by the right movable guide. Likewise, by the left movable guide, disposed further to the left than the left fixed guide, water guided by the left fixed guide is guided in a direction that is in accordance with the position of the left movable guide between the forward drive position and the reverse drive position. The bucket then jets the water in the direction guided by the left movable guide.

A thrust in an obliquely forward direction, an obliquely rearward direction, or a lateral direction (right direction or left direction) is thus generated by the fixed guides and the movable guides guiding water streams in the above manner. The vessel can thereby be turned to the right or the left while being driven forward or driven in reverse at low speed. Further, the vessel can be turned rightward or leftward on the spot. Moreover, a thrust with a lateral direction component is generated by the fixed guides and the movable guides guiding the water stream and thus in comparison to the case where thrusts are made to cancel each other out, the thrust generated by the jet pump can be used efficiently. The lateral direction component of the thrust can thus be increased. Vessel maneuverability at low speed can thereby be improved.

The right movable guide may include a right plate. The left movable guide may include a left plate.

The right movable guide may include a right nozzle. The left movable guide may include a left nozzle.

Also, the right movable guide may be arranged to be rotatable between a forward drive position and a reverse drive position around a right rotating shaft extending in an up/down direction at the closed position. In this case, the right movable guide may be arranged to change the direction in which water is guided in accordance with the rotation around the right rotating shaft. Also, the left movable guide may be arranged to be rotatable between a forward drive position and a reverse drive position around a left rotating shaft extending in the up/down direction at the closed position. In this case, the left movable guide may be arranged to change the direction in which water is guided in accordance with the rotation around the left rotating shaft.

Also, the right plate may be arranged to be rotatable between a forward drive position and a reverse drive position around a right rotating shaft extending in the up/down direction at the closed position. In this case, the right plate may include a left end portion arranged to contact the right fixed guide at the reverse drive position. Also, the left plate may be arranged to be rotatable between a forward drive position and a reverse drive position around a left rotating shaft extending in the up/down direction at the closed position. In this case, the left plate may include aright end portion arranged to contact the left fixed guide at the reverse drive position.

Also, the vessel propulsion apparatus may further include a symmetrical movement mechanism arranged to move the right movable guide and the left movable guide while maintaining the right movable guide and the left movable guide in a positional relationship that is symmetrical with respect to a center of the vessel propulsion apparatus in a right/left direction.

Also, the jet pump may include a nozzle arranged to guide water rearward, and a deflector by which the water guided by the nozzle is jetted rearward from the outlet. In this case, the nozzle may be arranged so as not to move with respect to the hull. The deflector may be arranged to change the jetting direction to the right and left by rotating around a deflector rotation axis, extending in the up/down direction, with respect to the hull.

Also, the bucket may be arranged to rotate with respect to the jet pump between the closed position and the opened position around a bucket rotation axis extending in the right/left direction.

Also, the bucket may be arranged such that water guided by the right movable guide is jetted obliquely downward and such that water guided by the left movable guide is jetted obliquely downward.

Yet another preferred embodiment of the present invention provides a vessel propulsion apparatus that includes a jet pump and a bucket. The jet pump is arranged to jet water rearward from the outlet of the jet pump and to change a direction of jetting of water from the outlet to the right and left. The bucket is arranged to move between a closed position of covering the outlet when the outlet is viewed from the rear and an opened position of not covering the outlet when the outlet is viewed from the rear. Further, the bucket is arranged to divide a water stream from the outlet into a right branch stream including a right direction component and a left branch stream including a left direction component at the closed position such that when the jetting direction is tilted to the right, a flow rate of the right branch stream is greater than a flow rate of the left branch stream. Further, the bucket is arranged to divide the water stream from the outlet into the right branch stream and the left branch stream at the closed position such that when the jetting direction is tilted to the left, the flow rate of the left branch is greater than the flow rate of the right branch stream. Further, the bucket is arranged to be capable of changing the directions of the right branch stream and the left branch stream at the closed position to an obliquely forward direction having a front direction component, an obliquely rearward direction having a rear direction component, and a lateral direction not having a front/rear direction component.

Yet another preferred embodiment of the present invention provides a vessel that includes the vessel propulsion apparatus and a hull to which the vessel propulsion apparatus is attached.

The vessel may further include a bucket position changing device and a guide position changing device. The bucket position changing device may include a bucket position operation member operated by a vessel operator. In this case, the bucket position changing device may be arranged to change the position of the bucket in accordance with operation of the bucket position operation member. Also, the guide position changing device may include a guide position operation member operated by a vessel operator. In this case, the guide position changing device may be arranged to change the positions of the right movable guide and the left movable guide in accordance with operation of the guide position operation member.

Also, the vessel may further include an operation member operated by the vessel operator, a detecting device detecting a position of the operation member, a guide moving device moving the right movable guide and the left movable guide, and a controller arranged and programmed to control the guide moving device. In this case, the operation member may be arranged to tilt forward, rearward, rightward, and leftward. The detecting device may be arranged to detect the tilting of the operation member. The guide moving device may be arranged to move the right movable guide between the forward drive position and the reverse drive position and move the left movable guide between the forward drive position and the reverse drive position. The controller may be programmed to acquire a detection value of the detecting device and control the guide moving device in accordance with the detection value.

Yet another preferred embodiment of the present invention provides a vessel propulsion apparatus that includes a jet pump, a jetting direction operation member, a jetting direction changing device, and a bucket. The jet pump is arranged to jet water rearward from an outlet of the jet pump. The jetting direction operation member is operated between a first position and a second position by a vessel operator. The jetting direction changing device is arranged to change a jetting direction of water jetted from the outlet right and left in accordance with operation of the jetting direction operation member.

The bucket is arranged to move between a closed position of covering the outlet when the outlet is viewed from the rear and an opened position of not covering the outlet when the outlet is viewed from the rear. The bucket includes a right guide arranged to be positioned at the rear of the outlet at the closed position and arranged to guide, in an obliquely forward right direction, at least a portion of the water jetted from the outlet. Further, the bucket includes a left guide arranged to be positioned at the rear of the outlet at the closed position and arranged to guide, in an obliquely forward left direction, at least a portion of the water jetted from the outlet.

In a case where the bucket is positioned at the opened position, the jetting direction changing device changes the jetting direction of the jet pump to the left when the jetting direction operation member is operated to the first position. Further, in this case, the jetting direction changing device changes the jetting direction of the jet pump to the right when the jetting direction operation member is operated to the second position.

On the other hand, in a case where the bucket is positioned at the closed position, the jetting direction changing device changes the jetting direction of the jet pump to the right when the jetting direction operation member is operated to the first position. Further, in this case, the jetting direction changing device changes the jetting direction of the jet pump to the left when the jetting direction operation member is operated to the second position.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 7 is a graph of an example of a relationship of a movement amount of a lever from a forward drive shift switching position and a position of the F bucket.

FIG. 8A is a schematic side view for describing an example of a relationship of a position of the lever and positions of the R bucket and the F bucket.

FIG. 8B is a schematic side view for describing an example of a relationship of the position of the lever and the positions of the R bucket and the F bucket.

FIG. 8C is a schematic side view for describing an example of a relationship of the position of the lever and the positions of the R bucket and the F bucket.

FIG. 8D is a schematic side view for describing an example of a relationship of the position of the lever and the positions of the R bucket and the F bucket.

FIG. 8E is a schematic side view for describing an example of a relationship of the position of the lever and the positions of the R bucket and the F bucket.

FIG. 12A is a schematic side view for describing an example of operation of the link mechanism.

FIG. 12B is a schematic side view for describing an example of operation of the link mechanism.

FIG. 12C is a schematic side view for describing an example of operation of the link mechanism.

FIG. 12D is a schematic side view for describing an example of operation of the link mechanism.

FIG. 12E is a schematic side view for describing an example of operation of the link mechanism.

FIG. 15A is a schematic side view for describing an example of a relationship of a position of the lever and positions of the R bucket and the F bucket.

FIG. 15B is a schematic side view for describing an example of a relationship of the position of the lever and the positions of the R bucket and the F bucket.

FIG. 15C is a schematic side view for describing an example of a relationship of the position of the lever and the positions of the R bucket and the F bucket.

FIG. 15D is a schematic side view for describing an example of a relationship of the position of the lever and the positions of the R bucket and the F bucket.

FIG. 17B is a schematic side view for describing the flow of water in a state in which the F bucket is positioned at the rear of the deflector.

FIG. 18A is a schematic side view for describing an example of a relationship of a position of the lever and positions of the R bucket and the F bucket.

FIG. 18B is a schematic side view for describing an example of a relationship of the position of the lever and the positions of the R bucket and the F bucket.

FIG. 18C is a schematic side view for describing an example of a relationship of the position of the lever and the positions of the R bucket and the F bucket.

FIG. 18D is a schematic side view for describing an example of a relationship of the position of the lever and the positions of the R bucket and the F bucket.

FIG. 18E is a schematic side view for describing an example of a relationship of the position of the lever and the positions of the R bucket and the F bucket.

FIG. 20A is a schematic side view for describing an example of a relationship of a position of the lever and positions of the R bucket and the F bucket.

FIG. 20B is a schematic side view for describing an example of a relationship of the position of the lever and the positions of the R bucket and the F bucket.

FIG. 20C is a schematic side view for describing an example of a relationship of the position of the lever and the positions of the R bucket and the F bucket.

FIG. 20D is a schematic side view for describing an example of a relationship of the position of the lever and the positions of the R bucket and the F bucket.

FIG. 20E is a schematic side view for describing an example of a relationship of the position of the lever and the positions of the R bucket and the F bucket.

FIG. 25A is a schematic side view for describing an example of a relationship of a position of the lever and positions of the R bucket and the F bucket.

FIG. 25B is a schematic side view for describing an example of a relationship of the position of the lever and the positions of the R bucket and the F bucket.

FIG. 25C is a schematic side view for describing an example of a relationship of the position of the lever and the positions of the R bucket and the F bucket.

FIG. 25D is a schematic side view for describing an example of a relationship of the position of the lever and the positions of the R bucket and the F bucket.

FIG. 25E is a schematic side view for describing an example of a relationship of the position of the lever and the positions of the R bucket and the F bucket.

FIG. 30A is a schematic side view for describing an example of a relationship of a position of the lever and positions of the R bucket and the F bucket.

FIG. 30B is a schematic side view for describing an example of a relationship of the position of the lever and the positions of the R bucket and the F bucket.

FIG. 30C is a schematic side view for describing an example of a relationship of the position of the lever and the positions of the R bucket and the F bucket.

FIG. 30D is a schematic side view for describing an example of a relationship of the position of the lever and the positions of the R bucket and the F bucket.

FIG. 30E is a schematic side view for describing an example of a relationship of the position of the lever and the positions of the R bucket and the F bucket.

FIG. 34A is a schematic side view for describing an example of a relationship of a position of the lever and positions of the R bucket and the F bucket.

FIG. 34B is a schematic side view for describing an example of a relationship of the position of the lever and the positions of the R bucket and the F bucket.

FIG. 34C is a schematic side view for describing an example of a relationship of the position of the lever and the positions of the R bucket and the F bucket.

FIG. 34D is a schematic side view for describing an example of a relationship of the position of the lever and the positions of the R bucket and the F bucket.

FIG. 43 shows schematic side views for describing an example of positional relationships of the bucket and a deflector.

DETAILED DESCRIPTION OF THE PREFERRED EMBODIMENTS

Figures below show vessels in a stationary state of floating still on water. In the description that follows, "front/rear direction," "right/left direction," and "up/down direction" are directions based on a hull in the stationary state. Further, in the following description, "reverse" and "forward" are expressed as "R" and "F," respectively. For example, an "R bucket" signifies a "reverse bucket."

First Preferred Embodiment

Figure 1:
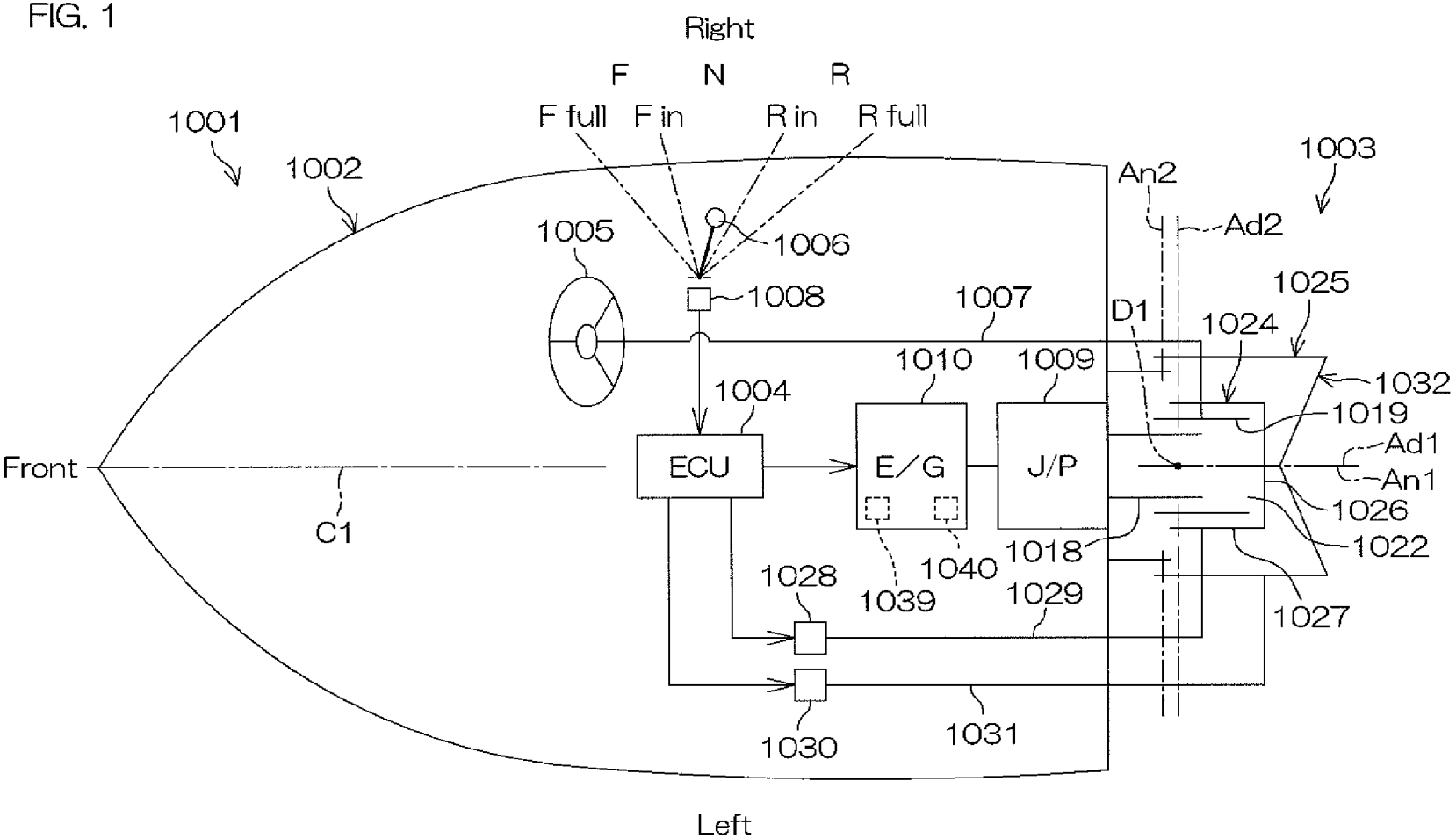
FIG. 1 is a schematic plan view of a vessel according to a first preferred embodiment of the present invention.
Figure 2:
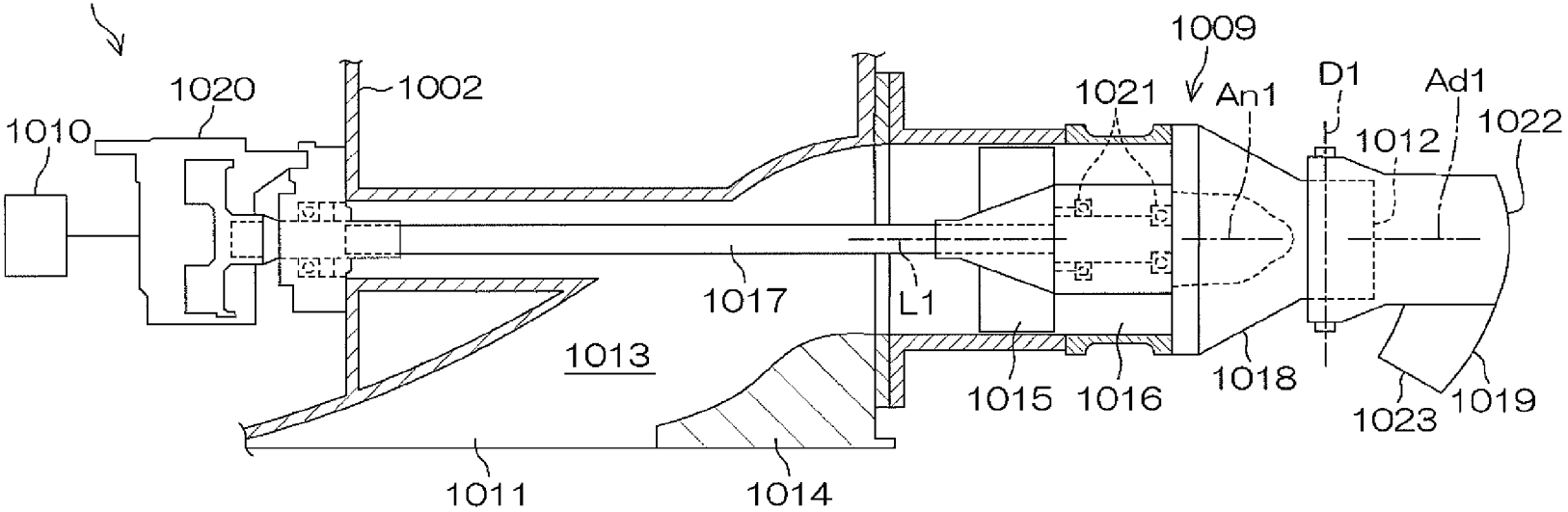
FIG. 2 is a partial sectional view of a vessel propulsion apparatus according to the first preferred embodiment of the present invention.
Figure 3:
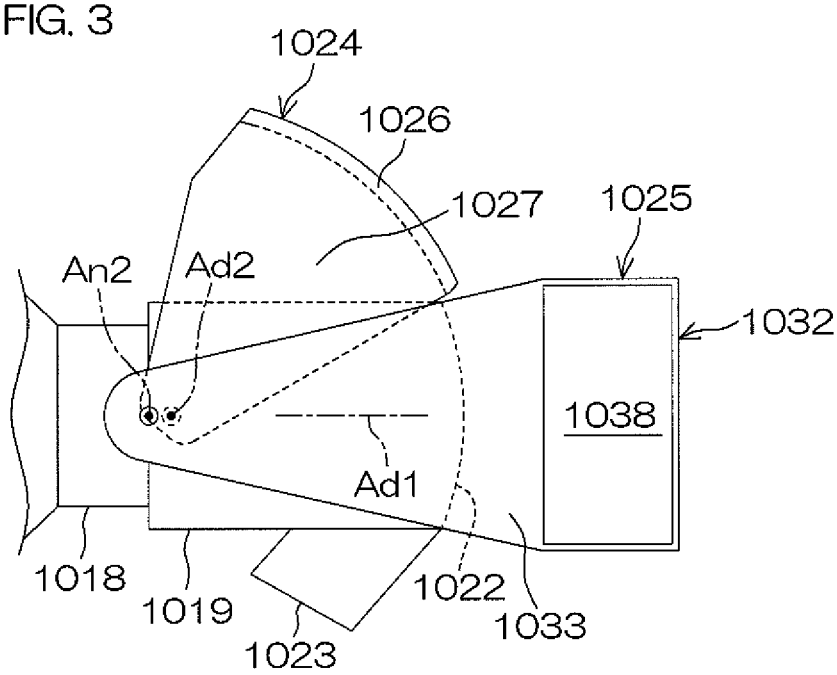
FIG. 3 is a schematic side view of an R bucket and an F bucket.
Figure 4:
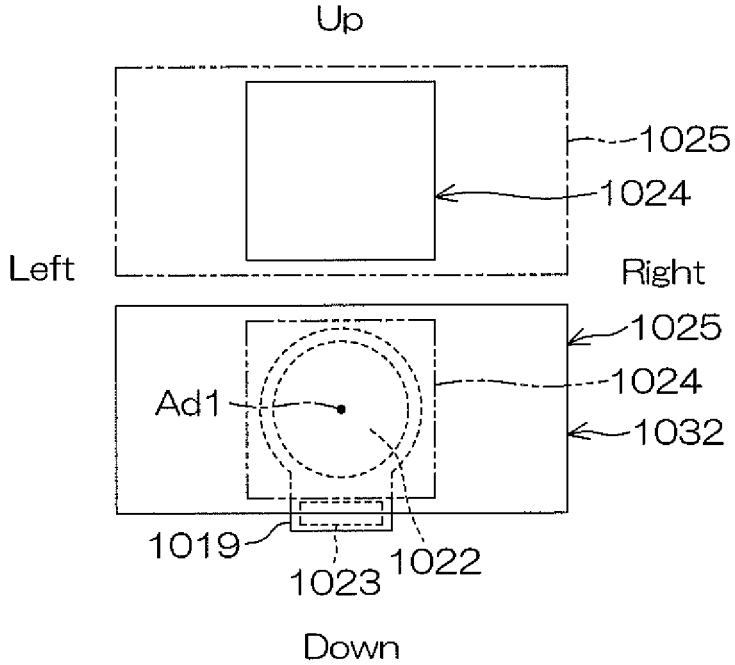
FIG. 4 is a schematic rear view of the R bucket and the F bucket.

FIG. 1 is a schematic plan view of a vessel 1001 according to a first preferred embodiment of the present invention. FIG. 2 is a partial sectional view of a vessel propulsion apparatus 1003 according to the first preferred embodiment of the present invention. FIG. 3 is a schematic side view of an R bucket 1024 and an F bucket 1025. FIG. 4 is a schematic rear view of the R bucket 1024 and the F bucket 1025. Illustrations of the R bucket 1024 and the F bucket 1025 are omitted in FIG. 2.

As shown in FIG. 1, the vessel 1001 includes a hull 1002, the vessel propulsion apparatus 1003 that drives the hull 1002 forward and in reverse, and an ECU 1004 (electronic control unit) that controls the vessel propulsion apparatus 1003. Further, the vessel 1001 includes a handle 1005 operated by a vessel operator to change a turning angle of the vessel 1001 and a lever 1006 operated by the vessel operator to change an output of the vessel propulsion apparatus 1003.

As shown in FIG. 1, the vessel propulsion apparatus 1003 is disposed at a central portion of a rear portion of the hull 1002. A center in a right/left direction of the vessel propulsion apparatus 1003 is matched with a hull center C1 (a vertical plane passing through a width direction center of the hull 1002). The vessel propulsion apparatus 1003 preferably is a jet propulsion apparatus that jets water forward or rearward. The handle 1005 is coupled to the vessel propulsion apparatus 1003 preferably by a steering cable 1007. The handle 1005 is movable between a right maximum steering position and a left maximum steering position. A tilt angle of a water stream with respect to a front/rear direction is changed by operation of the handle 1005. Also, a position of the lever 1006 is detected by a lever position detecting device 1008. The ECU 1004 changes the output of the vessel propulsion apparatus 1003 (engine 1010) based on a detection value of the lever position detecting device 1008.

As shown in FIG. 1, the lever 1006 is rotatable forward and rearward around its lower end portion as a center. The lever 1006 is tilted forward or rearward with a substantially vertical position as a center by the vessel operator. A neutral position N is, for example, the position at which the lever 1006 is substantially vertical. When the lever 1006 is tilted forward from the neutral position N to a shift switching position Fin (forward drive shift switching position), the vessel propulsion apparatus 1003 is switched to generate a thrust in a forward drive direction. Also, when the lever 1006 is tilted rearward from the neutral position N to a shift switching position Rin (reverse drive shift switching position), the vessel propulsion apparatus 1003 is switched to generate a thrust in a reverse drive direction. A region between the shift switching position Fin and the shift switching position Rin is an N region (neutral region) in which the ECU 1004 keeps the output of the vessel propulsion apparatus 1003 fixed.

As shown in FIG. 1, when the lever 1006 is tilted further forward from the shift switching position Fin toward a fully opened position Ffull (forward drive fully opened position), the ECU 1004 increases the output of the vessel propulsion apparatus 1003 in accordance with a tilt amount of the lever 1006. Likewise, when the lever 1006 is tilted further rearward from the shift switching position Rin toward a fully opened position Rfull (reverse drive fully opened position), the ECU 1004 increases the output of the vessel propulsion apparatus 1003 in accordance with the tilt amount of the lever 1006. The region from the shift switching position Fin to the fully opened position Ffull is an F region (forward region) in which the ECU 1004 causes the vessel propulsion apparatus 1003 to generate a thrust in the forward drive direction. Also, the region from the shift switching position Rin to the fully opened position Rfull is an R region (reverse region) in which the ECU 1004 causes the vessel propulsion apparatus 1003 to generate a thrust in the reverse drive direction.

As shown in FIG. 2, the vessel propulsion apparatus 1003 includes a jet pump 1009 by which water sucked in from a hull bottom is jetted rearward, and an engine 1010 that drives the jet pump 1009. The engine 1010 is an example of a power source that drives the jet pump 1009. The jet pump 1009 may be driven by an electric motor or by the engine 1010 and the electric motor or by a device besides the engine 1010 and the electric motor. The engine 1010 is disposed in an interior of the hull 1002. The engine 1010 is controlled by the ECU 1004. The jet pump 1009 is disposed at the rear of the engine 1010.

As shown in FIG. 2, the jet pump 1009 defines an inlet 1011 that opens at the hull bottom, an outlet 1012 that opens rearward further at the rear than the inlet 1011, and a flow passage 1013 connecting the inlet 1011 and the outlet 1012. The jet pump 1009 includes a duct 1014 defining the inlet 1011 and a portion of the flow passage 1013, a moving vane 1015 and a stationary vane 1016 disposed in the flow passage 1013, and a driveshaft 1017 coupled to the moving vane 1015. Further, the jet pump 1009 includes a nozzle 1018 defining the outlet 1012 and a deflector 1019 by which a direction of a water stream flowing rearward from the nozzle 1018 is tilted to the right and left. The nozzle 1018 extends in the front/rear direction along the hull center C1.

As shown in FIG. 2, the driveshaft 1017 extends in the front/rear direction. A front end portion of the driveshaft 1017 is coupled to the engine 1010 via a coupling 1020, and a rear end portion of the driveshaft 1017 is rotatably supported via a plurality of bearings 1021. The moving vane 1015 is coupled to the driveshaft 1017. The stationary vane 1016 is disposed at the rear of the moving vane 1015 and the nozzle 1018 is disposed at the rear of the stationary vane 1016. The moving vane 1015 includes a plurality of blades disposed so as to surround a rotation axis L1 (central axis of the driveshaft 1017). Likewise, the stationary vane includes a plurality of blades disposed so as to surround the rotation axis L1. The moving vane 1015 is rotatable around the rotation axis L1 with respect to the flow passage 1013 and the stationary vane 1016 is fixed with respect to the flow passage 1013.

The moving vane 1015 is driven around the rotation axis L1 together with the driveshaft 1017 by the engine 1010. When the moving vane 1015 is driven to rotate, water is sucked into the flow passage 1013 from the inlet 1011 and the water sucked into the flow passage 1013 is fed from the moving vane 1015 to the stationary vane 1016. By the water fed by the moving vane 1015 passing through the stationary vane 1016, water stream twisting that results from the rotation of the moving vane 1015 is reduced and the water stream is flow-rectified. The flow-rectified water is thus fed from the stationary vane 1016 to the outlet 1012. The nozzle 1018 has a tubular shape extending in the front/rear direction and an inner diameter of a rear end portion of the nozzle 1018 is smaller than an inner diameter of a front end portion of the nozzle 1018. The outlet 1012 is defined by the rear end portion of the nozzle 1018. Water fed into the nozzle 1018 is thus jetted rearward from the outlet 1012 after being accelerated by the nozzle 1018.

As shown in FIG. 2, the deflector 1019 has a tubular shape extending rearward from the nozzle 1018. A central axis Ad1 of the deflector 1019 is disposed at the same height as a central axis An1 of the nozzle 1018. The outlet 1012 of the nozzle 1018 is disposed inside the deflector 1019. The deflector 1019 defines an F outlet 1022 that is opened rearward and an R outlet 1023 that is opened obliquely forward. The F outlet 1022 is disposed at the rear of the outlet 1012, and the R outlet 1023 is disposed in front than the F outlet 1022. The F outlet 1022 and the R outlet 1023 are disposed on the central axis Ad1 of the deflector 1019 in a plan view.

The deflector 1019 includes a main flow passage extending along the central axis Ad1 of the deflector 1019 and a lower flow passage extending downward from the main flow passage. The outlet 1012 of the nozzle 1018 is disposed in the main flow passage. The F outlet 1022 is connected to the main flow passage and the R outlet 1023 is connected to the main flow passage via the lower flow passage. The F outlet 1022 is opened or closed by an R bucket 1024 to be described below. When water is jetted rearward from the nozzle 1018 in a state in which the F outlet 1022 is open, the water flowing into the deflector 1019 is jetted rearward from the F outlet 1022. A thrust in the forward drive direction is thereby generated. On the other hand, when water is jetted rearward from the nozzle 1018 in a state in which the F outlet 1022 is closed, the water flowing into the deflector 1019 is jetted obliquely forward from the R outlet 1023. A thrust in the reverse drive direction is thereby generated.

As shown in FIG. 2, the deflector 1019 is coupled to the nozzle 1018 in a manner enabling rotation to the right and left around a substantially vertical D axis D1 that extends in the up/down direction. The nozzle 1018 is fixed to the hull 1002 and does not move with respect to the hull 1002. The deflector 1019 is thus rotatable around the D axis D1 with respect to the nozzle 1018. The deflector 1019 is rotated to the right or left around the D axis D1 in accordance with operation of the handle 1005 by the vessel operator. When the deflector 1019 is rotated to the right or left around the D axis D1, a jetting direction of water jetted from the deflector 1019 is changed to the right or left. A turning angle of the vessel 1001 is thereby changed.

The deflector 1019 is rotatable around the D axis D1 and between a right maximum steering position and a left maximum steering position. The right maximum steering position is a position at which the direction of jetting of water from the deflector 1019 is tilted furthest to the right, and the left maximum steering position is a position at which the direction of jetting of water from the deflector 1019 is tilted furthest to the left. The right maximum steering position and the left maximum steering position are in a right/left symmetrical positional relationship. The deflector 1019 is rotatable to the right and left with respect to the nozzle 1018 with a straight drive position, intermediate the right maximum steering position and the left maximum steering position, as a center. The straight drive position is a position at which the central axis Ad1 of the deflector 1019 extends in the front/rear direction in a plan view and the F outlet 1022 jets water in the rearward direction in a plan view. The deflector 1019 is coupled to the handle 1005 via the steering cable 1007. The position of the deflector 1019 is associated with the position of the handle 1005. For example, when the handle 1005 is positioned at the right maximum steering position, the deflector 1019 is positioned at the right maximum steering position. A tilt angle (angle in a plan view) of the jetting direction with respect to the central axis An1 of the nozzle 1018 when the deflector 1019 is positioned at a maximum steering position is, for example, approximately 30 degrees.

As shown in FIG. 1, the vessel propulsion apparatus 1003 further includes the R bucket 1024 by which water that flows rearward inside the deflector 1019 is guided forward and the F bucket 1025 by which the water that flows rearward inside the deflector 1019 is tilted to the right and left.

As shown in FIG. 1, the R bucket 1024 is disposed in front of the F bucket 1025. The R bucket 1024 is coupled to the deflector 1019. The R bucket 1024 rotates to the right and left around the D axis D1 together with the deflector 1019. The R bucket 1024 includes a lid portion 1026 that opens and closes the F outlet 1022 and a pair of right and left R arms 1027 that support the lid portion 1026. The pair of R arms 1027 are disposed across an interval in the right/left direction. The pair of R arms 1027 extend forward from a right end portion and a left end portion of the lid portion 1026. A front end portion of each R arm 1027 is coupled to the deflector 1019. The front end portion of each R arm 1027 is rotatable up and down with respect to the deflector 1019 around a substantially horizontal rotation axis Ad2. The R bucket 1024 is thus rotatable up and down with respect to the deflector 1019 around the rotation axis Ad2. The rotation axis Ad2 is an axis that is orthogonal or substantially orthogonal to the central axis Ad1 of the deflector 1019 and is fixed with respect to the deflector 1019.

Also, as shown in FIG. 1, the F bucket 1025 is coupled to the hull 1002. The F bucket 1025 may be coupled directly to the hull 1002 or may be coupled to a member fixed to the hull 1002. The F bucket 1025 is rotatable up and down with respect to the hull 1002 around a substantially horizontal rotation axis An2 that extends in the right/left direction. The nozzle 1018 is fixed to the hull 1002. The F bucket 1025 is thus rotatable up and down with respect to the nozzle 1018. The rotation axis An2 is an axis that is fixed with respect to the nozzle 1018.

As shown in FIG. 1, the vessel propulsion apparatus 1003 includes an R actuator 1028 that rotates the R bucket 1024 around the rotation axis Ad2 and an R cable 1029 that transmits a power of the R actuator 1028 to the R bucket 1024. Further, the vessel propulsion apparatus 1003 includes an F actuator 1030 that rotates the F bucket 1025 around the rotation axis An2 and an F cable 1031 that transmits a power of the F actuator 1030 to the F bucket 1025. The R actuator 1028 may drive the R bucket 1024 via a transmission member besides the R cable 1029, such as a rod, gear, or a wrapping transmission, or may drive the R bucket 1024 directly. That is, the R actuator 1028 may be an actuator that is disposed on the rotation axis Ad2 and directly drives the R bucket 1024. Likewise, the F actuator 1030 may drive the F bucket 1025 via a transmission member besides the F bucket 1025 or may drive the F bucket 1025 directly. The ECU 1004 controls the R actuator 1028 and the F actuator 1030 based on the detection value of the lever position detecting device 1008. The R bucket 1024 and the F bucket 1025 are thus positioned at positions that are in accordance with the position of the lever 1006.

As shown in FIG. 3 and FIG. 4, the R bucket 1024 is rotatable up and down around the rotation axis Ad2 and between a closed position (position indicated by alternate long and two short dashed lines in FIG. 4) and an opened position (position indicated by solid lines). The closed position is a position at which the R bucket 1024 covers the entire of the F outlet 1022 in a rear view, and the opened position is a position at which the R bucket 1024 does not cover the F outlet 1022 in a rear view. Thus, when the R bucket 1024 is positioned at the closed position, the F outlet 1022 is closed, and when the R bucket 1024 is positioned at the opened position, the F outlet 1022 is opened. The R bucket 1024 is positioned at any position from the closed position to the opened position by operation of the lever 1006. For example, the R bucket 1024 is positioned at an intermediate position (see FIG. 8B) between the closed position and the opened position by operation of the lever 1006. The intermediate position is a position at which the R bucket 1024 covers only a portion of the F outlet 1022 in a rear view.

Also, as shown in FIG. 3 and FIG. 4, the F bucket 1025 is rotatable up and down around the rotation axis An2 and between a closed position (position indicated by solid lines) and an opened position (position indicated by alternate long and two short dashed lines in FIG. 4). The closed position is a position at which the F bucket 1025 covers the entire F outlet 1022 in a rear view, and the opened position is a position at which the F bucket 1025 does not cover the F outlet 1022 in a rear view. The closed position of the F bucket 1025 is a position further to the rear than the closed position of the R bucket 1024. Thus, even when the F bucket 1025 is positioned at the closed position, the F bucket 1025 only faces the F outlet 1022 across an interval in the front/rear direction and the F outlet 1022 is not blocked. The F bucket 1025 is positioned at any position from the closed position to the opened position by operation of the lever 1006. For example, the F bucket 1025 is positioned at an intermediate position (see FIG. 8D) between the closed position and the opened position by operation of the lever 1006. The intermediate position is a position at which the F bucket 1025 covers only a portion of the F outlet 1022 in a rear view.

Figure 5A:
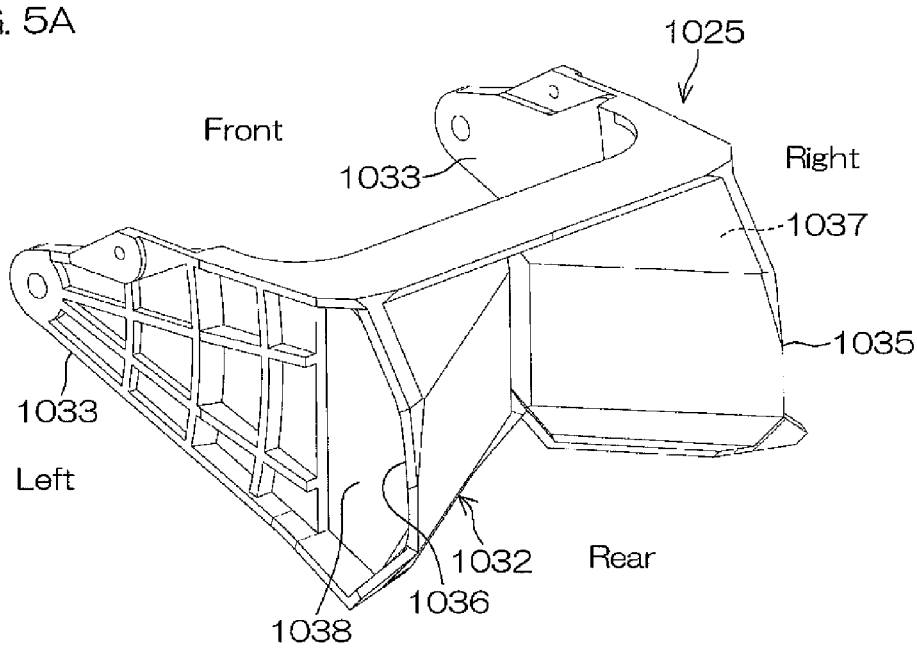
FIG. 5A is a perspective view of the F bucket as viewed from an obliquely rearward left upper side.
Figure 5B:
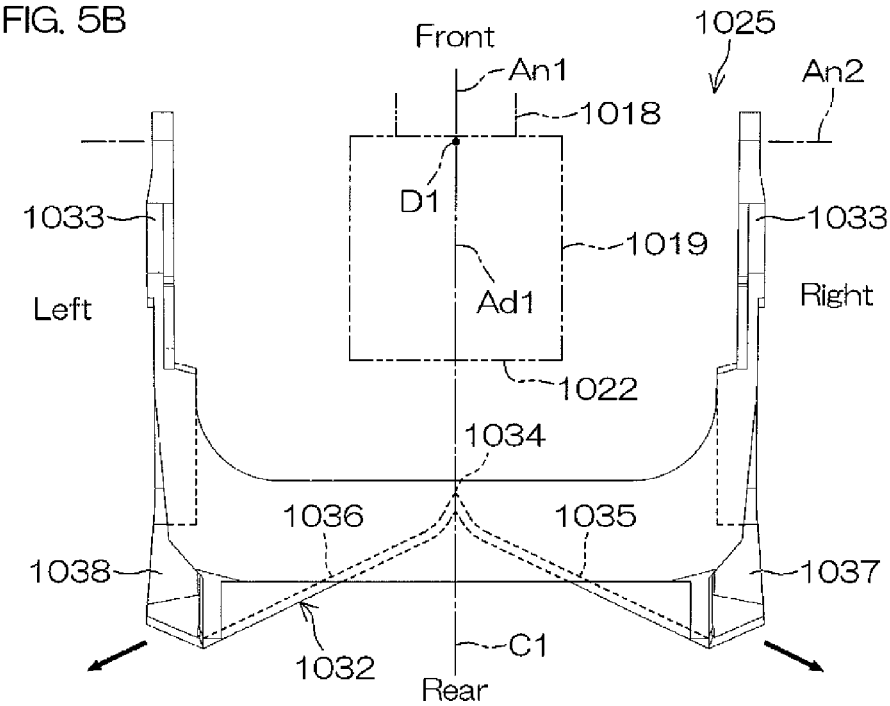
FIG. 5B is a plan view of the F bucket.

FIG. 5A is a perspective view of the F bucket 1025 as viewed from an obliquely rearward left upper side. FIG. 5B is a plan view of the F bucket 1025.

As shown in FIG. 5B, the F bucket 1025 has, in a plan view, a U-shaped configuration that is opened forward. The F bucket 1025 is right/left symmetrical. The F bucket 1025 surrounds the deflector 1019 in a plan view. The F bucket 1025 includes an F guide 1032 disposed at the rear of the deflector 1019 and a pair of right and left F arms 1033 that support the F guide 1032. The F guide 1032 is disposed further to the rear than the closed position of the R bucket 1024. The pair of F arms 1033 are disposed across an interval in the right/left direction. The deflector 1019 is disposed between the pair of F arms 1033 in a plan view. The interval between the pair of F arms 1033 in the right/left direction is set so that regardless of which steering position the deflector 1019 is positioned at, the deflector 1019 and the R bucket 1024 do not contact the pair of F arms 1033 (see FIG. 6B).

As shown in FIG. 5B, the F guide 1032 has, in a plan view, a right/left symmetrical V-shaped configuration that is opened rearward. The F guide 1032 includes an F apex portion 1034 disposed on the central axis Ad1 of the deflector 1019 positioned at the straight drive position, an F right guide 1035 extending obliquely rearward to the right from the F apex portion 1034, and an F left guide 1036 extending obliquely rearward to the left from the F apex portion 1034. A front end of the F guide 1032 (front end of the F apex portion 1034) is positioned further to the rear than the D axis D1 and the nozzle 1018. The F right guide 1035 has a shape with which the F left guide 1036 is right/left inverted, and the F right guide 1035 and the F left guide 1036 are disposed right/left symmetrically.

As shown in FIG. 5A, the right side F arm 1033 extends forward from a right end portion of the F right guide 1035, and the left side F arm 1033 extends forward from a left end portion of the F left guide 1036. A front end portion of each F arm 1033 is coupled to the hull 1002. The front end portion of each F arm 1033 is rotatable up and down around the rotation axis An2 with respect to the hull 1002. As shown in FIG. 5B, the right side F arm 1033 and the right end portion of the F right guide 1035 define an F right outlet 1037 that is opened rightward, and the left side F arm 1033 and the left end portion of the F left guide 1036 define an F left outlet 1038 that is opened leftward.

As shown in FIG. 5B, by the F right guide 1035, water jetted rearward from the deflector 1019 (F outlet 1022) is guided in a right guiding direction (direction of a thick line arrow pointing to the right). The right guiding direction is a direction that is tilted further to the right than the direction of jetting of water from the F outlet 1022 at the right maximum steering position. The right guiding direction may be an obliquely rearward right direction or may be the right direction. In FIG. 5B, a case where the right guiding direction is an obliquely rearward right direction is shown. A water stream guided by the F right guide 1035 is jetted in the right guiding direction from the F right outlet 1037. That is, the water jetted from the F outlet 1022 is jetted in a direction that is tilted further to the right than the direction of jetting of water from the F outlet 1022.

Likewise, as shown in FIG. 5B, by the F left guide 1036, water jetted rearward from the deflector 1019 (F outlet 1022) is guided in a left guiding direction (direction of a thick line arrow pointing to the left). The left guiding direction is a direction that is right/left inverted. The left guiding direction is a direction that is tilted further to the left than the direction of jetting of water from the F outlet 1022 at the left maximum steering position. The left guiding direction may be an obliquely rearward left direction or may be the left direction. In FIG. 5B, a case where the left guiding direction is an obliquely rearward left direction is shown. A water stream guided by the F left guide 1036 is jetted in the left guiding direction from the F left outlet 1038. That is, the water jetted from the F outlet 1022 is jetted in a direction that is tilted further to the left than the direction of jetting of water from the F outlet 1022.

The right guiding direction and the left guiding direction are directions that are further tilted to the right and left than the directions of jetting of water from the F outlet 1022 at the maximum steering positions. In a state in which the F bucket 1025 is positioned at the closed position or an intermediate position and the deflector 1019 is positioned at the right side or the left side relative to the straight drive position, a forward drive direction thrust that turns the hull 1002 rightward or leftward is generated. Aright/left direction component of this thrust is greater than that in a case where the F bucket 1025 is not used and a front/rear direction component of the thrust is less than that in the case where the F bucket 1025 is not used.

Figure 6A:
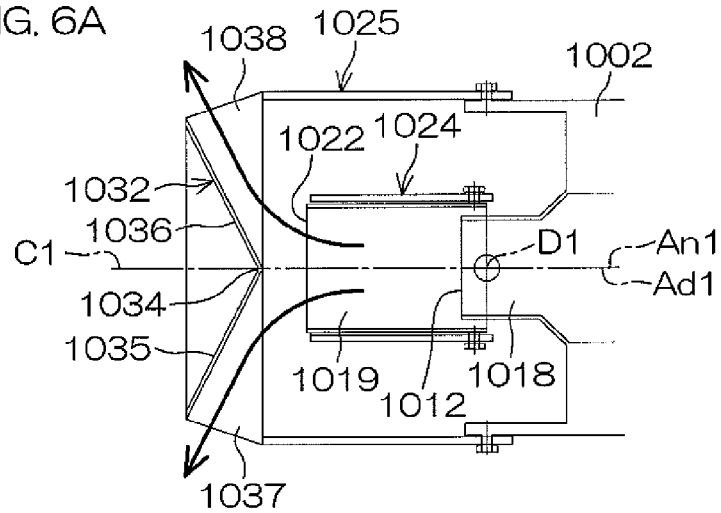
FIG. 6A is a schematic plan view for describing water flow in a state in which the F bucket is positioned at a closed position and a deflector is positioned at a straight drive position.
Figure 6B:
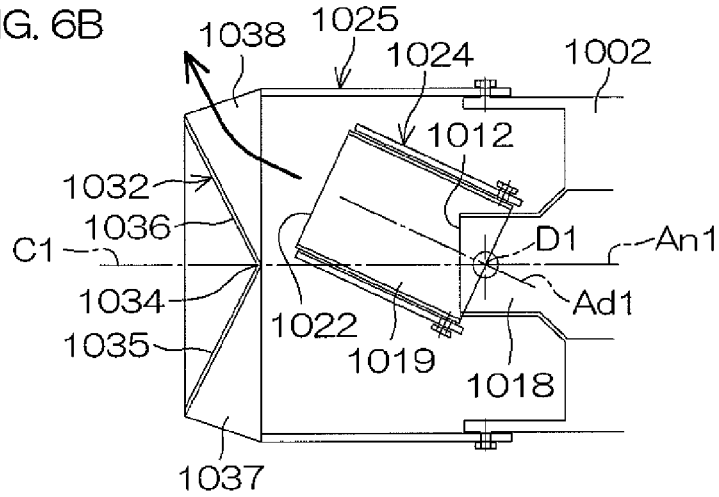
FIG. 6B is a schematic plan view for describing water flow in a state in which the F bucket is positioned at the closed position and the deflector is positioned at a left side.
Figure 6C:
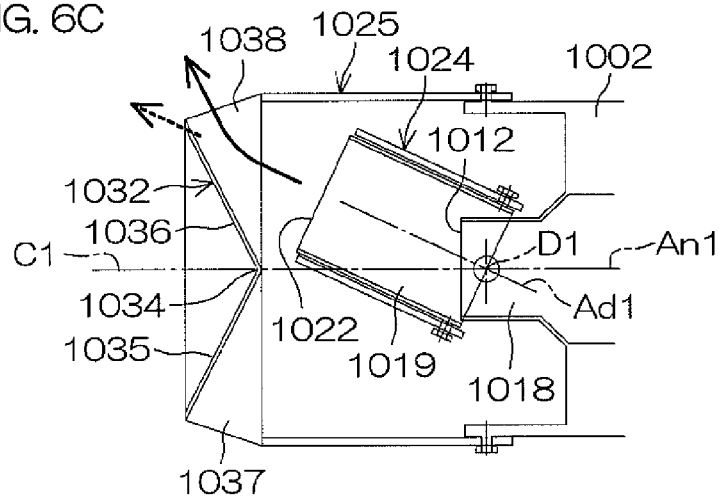
FIG. 6C is a schematic plan view for describing water flow in a state in which the F bucket is positioned at an intermediate position and the deflector is positioned at the left side.

FIG. 6A is a schematic plan view for describing water flow in a state in which the F bucket 1025 is positioned at the closed position and the deflector 1019 is positioned at the straight drive position. FIG. 6B is a schematic plan view for describing water flow in a state in which the F bucket 1025 is positioned at the closed position and the deflector 1019 is positioned at the left maximum steering position. FIG. 6C is a schematic plan view for describing water flow in a state in which the F bucket 1025 is positioned at an intermediate position and the deflector 1019 is positioned at the left maximum steering position. In FIG. 6A to FIG. 6C, the vessel propulsion apparatus 1003 is shown in a transparent state. Thick line arrows shown in FIG. 6A to FIG. 6C indicate directions of water streams.

As shown in FIG. 6A, in the state in which the F bucket 1025 is positioned at the closed position and the deflector 1019 is positioned at the straight drive position, water jetted rearward from the F outlet 1022 is divided to the right and left at equal flow rates by the F guide 1032. Specifically, water that flows to the right side relative to the F apex portion 1034 is guided in the right guiding direction by the F right guide 1035 and water that flows to the left side relative to the F apex portion 1034 is guided in the left guiding direction by the F left guide 1036. A right branch stream flowing in the right guiding direction and a left branch stream flowing in the left guiding direction are thus generated by the F bucket 1025. The flow rates of the right branch stream and the left branch stream are equal in this state. The right direction component of thrust and the left direction component of thrust thus cancel each other out and only the front direction component of thrust remains. A forward drive direction thrust that drives the hull 1002 straight in the forward direction is thus generated.

On the other hand, when as shown in FIG. 6B, the F bucket 1025 is positioned at the closed position and the deflector 1019 is positioned at the left side (left side relative to the straight drive position), the flow rate of water flowing to the left side relative to the F apex portion 1034 is greater than the flow rate of water flowing to the right side relative to the F apex portion 1034. Thus, in this state, the F guide 1032 causes the left branch stream to have a greater flow rate than the right branch stream. Particularly, in a state in which the deflector 1019 is positioned at the left maximum steering position (shown in FIG. 6B), all of the water jetted from the F outlet 1022 flows to the left side relative to the F apex portion 1034. Thus, in this state, only the left branch stream is generated. A forward drive direction thrust that turns the hull 1002 leftward in a plan view is thus generated. In a state in which the deflector 1019 is oppositely positioned at the right side (right side relative to the straight drive position), the right branch stream is generated to have a greater flow rate than the left branch stream. A forward drive direction thrust that turns the hull 1002 rightward in a plan view is thus generated.

Also, when as shown in FIG. 6C, the F bucket 1025 is positioned at the intermediate position, just a portion of the water jetted rearward from the F outlet 1022 is guided by the F guide 1032 in at least one of either of the right guiding direction and the left guiding direction. The remaining portion passes below the F bucket 1025 without being blocked by the F bucket 1025 and generates a rearward branch stream that flows in the direction of jetting of water from the F outlet 1022 (see FIG. 8D). Thus, in the state in which the F bucket 1025 is positioned at the intermediate position, the rearward branch stream is generated in addition to at least one of either of the right branch stream and the left branch stream. A forward drive direction thrust having a larger front direction component than that generated when the F bucket 1025 is positioned at the closed position is thus generated.

FIG. 7 is a graph of an example of a relationship of the movement amount of the lever 1006 from the shift switching position Fin and the position of the F bucket 1025.

The ECU 1004 controls the F actuator 1030, for example, based on the movement amount of the lever 1006 from the shift switching position Fin toward the fully opened position Ffull and thereby causes the F bucket 1025 to rotate up or down around the rotation axis An2.

Specifically, as shown in FIG. 7, in a low speed region (a region inside an F region in which the movement amount of the lever 1006 from the shift switching position Fin is small), even when the vessel operator moves the lever 1006, the ECU 1004 holds the F bucket 1025 at the closed position without moving it. In a medium speed region (a region inside the F region in which the movement amount of the lever 1006 from the shift switching position Fin is greater than the low speed region), the ECU 1004 raises the F bucket 1025 in accordance with the movement amount of the lever 1006. In the medium speed region, a movement proportion of the F bucket 1025 may be fixed or may change as shown in FIG. 7. In a high speed region (region inside the F region in which the movement amount of the lever 1006 from the shift switching position Fin is greater than the medium speed region), even when the vessel operator moves the lever 1006, the ECU 1004 holds the F bucket 1025 at the opened position without moving it as in the low speed region. The ECU 1004 may raise the F bucket 1025 in accordance with the movement amount of the lever 1006 not only in the medium speed region but also in the low speed region and the high speed region as well. For example, in any region between the shift switching position Fin and the fully opened position Ffull, the ECU 1004 may move the F bucket 1025 at a fixed movement proportion in accordance with the movement amount of the lever 1006.

The ECU 1004 is not restricted to controlling the F actuator 1030 based on the position of the lever 1006 and may perform control based on a parameter related to operation of the engine 1010 besides the position of the lever 1006. Specifically, the ECU 1004 may control the F actuator 1030 based on an opening degree of a throttle valve 1039 (see FIG. 1) that changes a supply flow rate of intake air. Also, the ECU 1004 may control the F actuator 1030 based on a detection value of a rotation speed detecting device 1040 (see FIG. 1), that is, based on a rotation speed of the engine 1010.

The rotation speed of the engine 1010 at the shift switching position Fin is, for example, about 1300 rpm (idling speed), and the rotation speed of the engine 1010 at a boundary position of the low speed region and the medium speed region (low/medium boundary position) is, for example, about 2000 rpm. The rotation speed of the engine 1010 at a boundary position of the medium speed region and the high speed region (medium/high boundary position) is, for example, about 4000 rpm, and the rotation speed of the engine 1010 at the fully opened position Ffull is, for example, about 7000 rpm. The ECU 1004 may thus move the F bucket 1025 in accordance with these numerical values.

FIG. 8A to FIG. 8E are schematic side views for describing an example of a relationship of the position of the lever 1006 and the positions of the R bucket 1024 and the F bucket 1025. In FIG. 8A to FIG. 8E, the vessel propulsion apparatus 1003 is shown in a transparent state. Thick line arrows shown in FIG. 8A to FIG. 8E indicate directions of water streams.

In a state in which the lever 1006 is positioned in the R region, the ECU 1004 positions both the R bucket 1024 and the F bucket 1025 at the closed positions as shown in FIG. 8A. When the R bucket 1024 is positioned at the closed position, the F outlet 1022 of the deflector 1019 is closed and thus the water flowing into the deflector 1019 from the nozzle 1018 is jetted forward and obliquely downward from the R outlet 1023 of the deflector 1019. A thrust in the reverse drive direction is thus generated.

As shown in FIG. 8B, in a state in which the lever 1006 is positioned in the N region, the ECU 1004 positions the R bucket 1024 at an intermediate position and positions the F bucket 1025 at the closed position. When the R bucket 1024 is positioned at the intermediate position, only a portion of the F outlet 1022 is closed. Thus, a portion of the water flowing into the deflector 1019 from the nozzle 1018 is jetted forward and obliquely downward from the R outlet 1023 of the deflector 1019. The remaining portion is guided in at least one of either of the right guiding direction and the left guiding direction by the F bucket 1025. The position of the R bucket 1024 in the state in which the lever 1006 is positioned in the N region may be a fixed position that does not change regardless of which position in the N region the lever 1006 is positioned at or may change in accordance with the position of the lever 1006 in the N region. For example, the ECU 1004 may change the position of the R bucket 1024 in a continuous manner in accordance with the movement amount of the lever 1006 from the shift switching position Fin or the shift switching position Rin.

In a state in which the R bucket 1024 and the F bucket 1025 are positioned at an intermediate position and the closed position, respectively, and the deflector 1019 is positioned at the straight drive position, the right branch stream and the left branch stream are generated in addition to a forward branch stream that flows in the forward direction from the R outlet 1023. The flow rates of the right branch stream and the left branch stream are equal in this state and thus the right direction component of thrust and the left direction component of thrust cancel each other out and only the front direction component of thrust remains. The forward branch stream that flows in the forward direction from the R outlet 1023 generates a rear direction component of thrust. The position of the R bucket 1024 in the state in which the lever 1006 is positioned in the N region is set so that the front direction component of thrust and the rear direction component of thrust cancel each other out. Thus, in this state, no thrust (resultant force) in any direction is generated. On the other hand, in a state in which the deflector 1019 is positioned at the right side or the left side, a thrust having a right direction component or a left direction component is generated. Thus, in this state, a force that rotates the hull 1002 around a vertical axis passing through the hull 1002 is generated and the vessel 1001 turns on the spot.

In a state in which the lever 1006 is positioned in the low speed region (position inside the F region), the ECU 1004 positions the R bucket 1024 at the opened position and positions the F bucket 1025 at the closed position as shown in FIG. 8C. When the R bucket 1024 is positioned at the opened position, the entire F outlet 1022 of the deflector 1019 is opened and thus all of the water jetted from the F outlet 1022 is guided in at least one of either of the right guiding direction and the left guiding direction by the F bucket 1025.

In a state in which the lever 1006 is positioned in the medium speed region (position inside the F region), the ECU 1004 positions the R bucket 1024 at the opened position and positions the F bucket 1025 at an intermediate position as shown in FIG. 8D. A portion of the water jetted rearward from the deflector 1019 is thus guided in at least one of either of the right guiding direction and the left guiding direction by the F bucket 1025. The remaining portion passes below the F bucket 1025 and flows rearward. A thrust in the forward drive direction having a greater rear direction component than that generated when the lever 1006 is positioned in the low speed region is thus generated.

In a state in which the lever 1006 is positioned in the high speed region (position inside the F region), the ECU 1004 positions both the R bucket 1024 and the F bucket 1025 at the opened positions as shown in FIG. 8E. All of the water jetted rearward from the deflector 1019 thus passes below the F bucket 1025 and flows rearward. A thrust in the forward drive direction having a greater rear direction component than that generated when the lever 1006 is positioned in the medium speed region is thus generated.

As described above, with the first preferred embodiment, the vessel propulsion apparatus 1003 includes the F bucket 1025 by which the water flowing into the deflector 1019 from the nozzle 1018 is guided so that a thrust in the forward drive direction is generated. The F bucket 1025 is rotatable up and down around a substantially horizontal rotation axis An2 and between a closed position of covering the entire F outlet 1022 in a rear view and an opened position of not covering the F outlet 1022.

In the state in which the F bucket 1025 is positioned at the opened position, the F outlet 1022 is not covered and the water jetted from the F outlet 1022 flows rearward without being blocked by the F bucket 1025. The deflector 1019 is rotatable to the right and left around the substantially vertical D axis D1 and between the right maximum steering position and the left maximum steering position. The direction of jetting of water from the F outlet 1022 changes in accordance with the movement of the deflector 1019 around the D axis D1. The water stream that flows rearward from the nozzle 1018 is thus tilted to the right or left by the deflector 1019.

On the other hand, when the F bucket 1025 is positioned at the closed position and the deflector 1019 is positioned at the right side, the water jetted obliquely rearward to the right from the F outlet 1022 is guided in the right guiding direction by the F bucket 1025. Also, when the F bucket 1025 is positioned at the closed position and the deflector 1019 is positioned at the left side, the water jetted obliquely rearward to the left from the F outlet 1022 is guided in the left guiding direction by the F bucket 1025. The right guiding direction is the right direction or an obliquely rearward right direction that is tilted further to the right than the direction of jetting of water from the F outlet 1022, and the left guiding direction is the left direction or an obliquely rearward left direction that is tilted further to the left than the direction of jetting of water from the F outlet 1022. The water stream flowing rearward from the deflector 1019 is thus tilted further to the right or left by the F bucket 1025.

A water stream that is tilted to the right by the deflector 1019 is thus tilted further to the right by the F bucket 1025, and a water stream that is tilted to the left by the deflector 1019 is thus tilted further to the left by the F bucket 1025. A thrust having a larger lateral direction component (right direction or left direction component) than that generated when the F bucket 1025 is positioned at the opened position is thus generated. A force that turns the vessel 1001 can thus be made large while suppressing a force that moves the vessel 1001 in the forward direction. Vessel maneuverability at low speed can thereby be improved. Moreover, the thrust having the lateral direction component is generated by the F bucket 1025 guiding the water stream and thus energy loss is low in comparison to a case where thrusts cancel each other out. Energy can thus be used efficiently.

Second Preferred Embodiment

Figure 9:
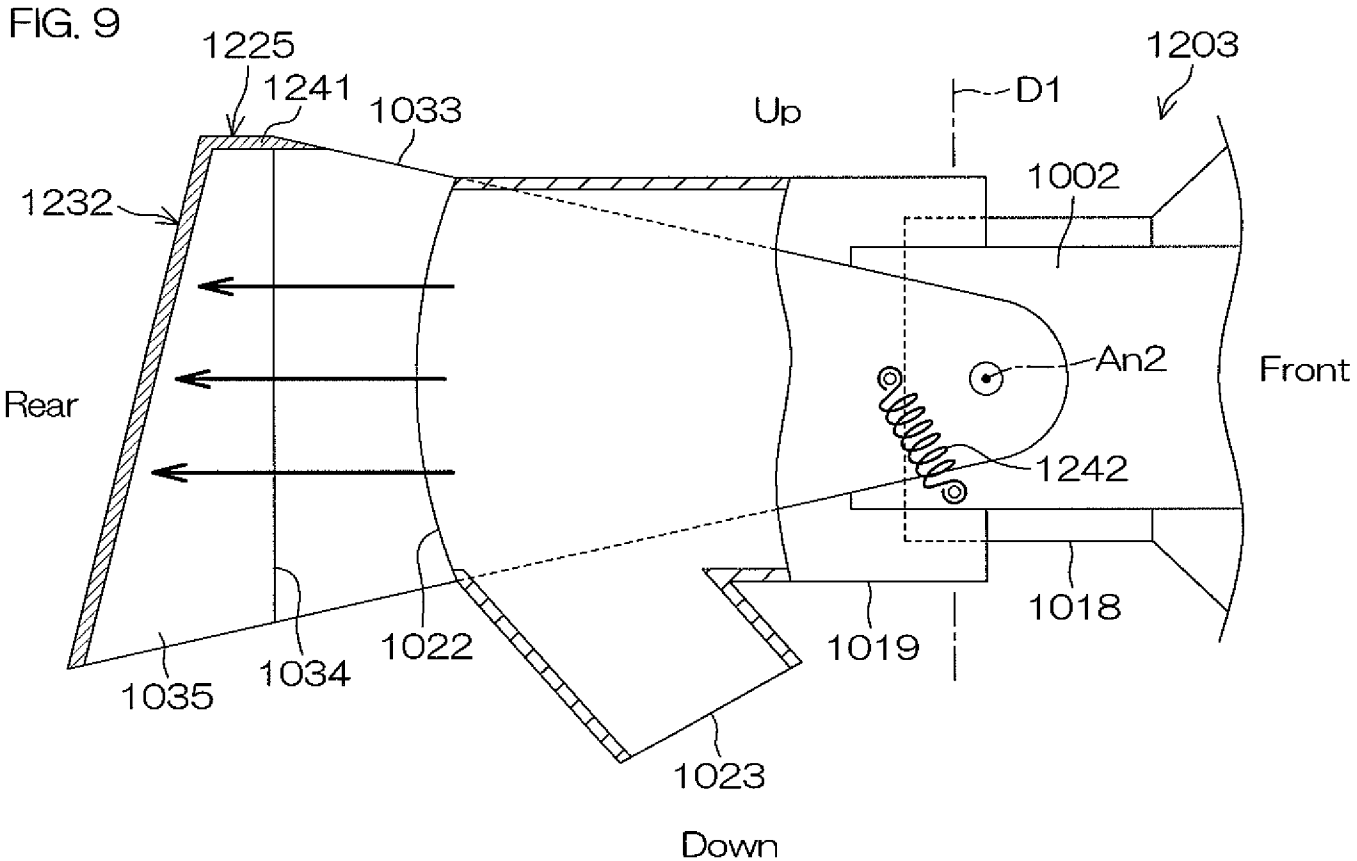
FIG. 9 is a schematic partial sectional view of a vessel propulsion apparatus according to a second preferred embodiment of the present invention.
Figure 10A:
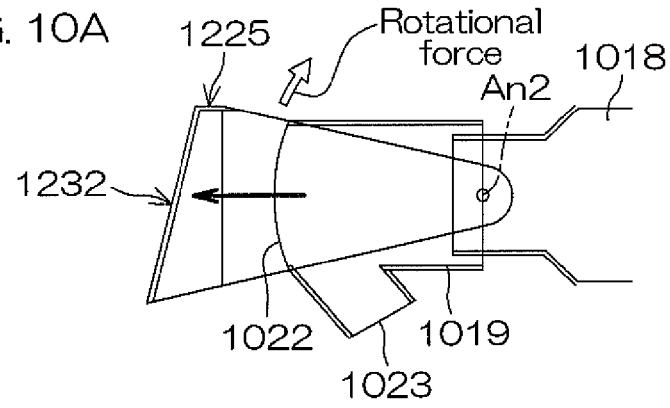
FIG. 10A is a schematic side view for describing an example of an operation when an F bucket is pushed upward by a water stream.
Figure 10B:
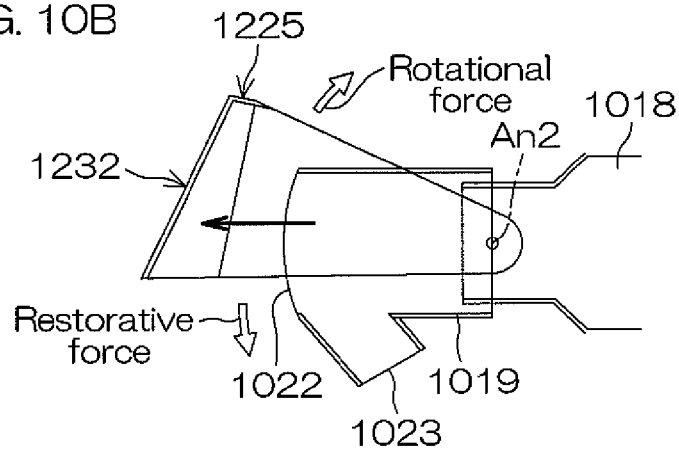
FIG. 10B is a schematic side view for describing an example of an operation when the F bucket is pushed upward by a water stream.
Figure 10C:
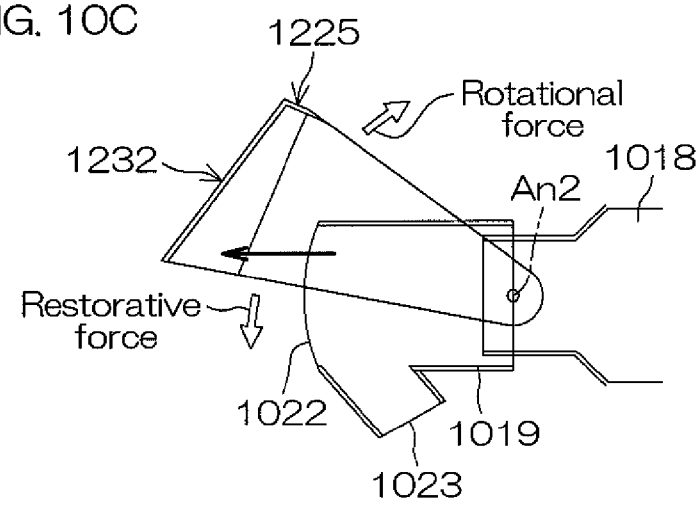
FIG. 10C is a schematic side view for describing an example of an operation when the F bucket is pushed upward by a water stream.

A second preferred embodiment of the present invention shall now be described. In FIG. 9 to FIG. 10C below, elements and components equivalent to those shown in FIG. 1 to FIG. 8E are provided with the same reference symbols as in FIG. 1, etc., and description thereof shall be omitted.

FIG. 9 is a schematic partial sectional view of a vessel propulsion apparatus 1203 according to the second preferred embodiment of the present invention. FIG. 10A to FIG. 10C are schematic side views for describing an example of an operation when an F bucket 1225 is pushed upward by a water stream. In FIG. 9 and FIG. 10, illustration of the R bucket 1024 is omitted. In FIG. 10A to FIG. 10C, the vessel propulsion apparatus 1203 is shown in a transparent state. Thick line arrows shown in FIG. 10A to FIG. 10C indicate directions of water streams.

With the exception of the F bucket, the vessel propulsion apparatus 1203 according to the second preferred embodiment preferably has the same arrangement as the vessel propulsion apparatus 1003 according to the first preferred embodiment. That is, as shown in FIG. 9, the vessel propulsion apparatus 1203 includes the F bucket 1225 in place of the F bucket 1025 according to the first preferred embodiment.

As shown in FIG. 9, the F bucket 1225 includes an F guide 1232 disposed at the rear of the deflector 1019 and a pair of right and left F arms 1033 that support the F guide 1232. A principal point of difference between the F guide 1232 according to the second preferred embodiment and the F guide 1032 according to the first preferred embodiment is that the F guide 1232 is tilted downward from the front to rear. Further, the F bucket 1225 includes a protective wall 1241 extending forward from an upper end of the F guide 1232.

As shown in FIG. 9, the vessel propulsion apparatus 1203 further includes an urging member 1242 that maintains the F bucket 1225 at the closed position. The urging member 1242 may include a coil spring or may include a member made of rubber or made of resin, for example. One end portion of the urging member 1242 is attached to the F bucket 1225 and the other end portion of the urging member 1242 is attached to the hull 1002. When the F bucket 1225 moves to the opened position side, the urging member 1242 deforms elastically and a restorative force that corresponds to a movement amount from the closed position is generated. A force that returns the F bucket 1225 to the closed position (restorative force of the urging member 1242) is thus generated and the F bucket 1225 is returned to the closed position.

As shown in FIG. 10A, the water jetted rearward from the deflector 1019 (F outlet 1022) collides against the F guide 1232 and is guided in at least one of either the right guiding direction or the left guiding direction. The F guide 1232 is tilted downward and thus when the water stream collides against the F guide 1232, a rotational force that rotates the F bucket 1225 to the opened position side is generated. Further, water that flows upward along the F guide 1232 collides against the protective wall 1241 extending forward from the upper end of the F guide 1232 and thus an even greater rotational force is generated. As shown in FIG. 10B, the F bucket 1225 is moved to the opened position side by the rotational force. At the same time, the restorative force of the urging member 1242 is applied to the F bucket 1225.

The rotational force that rotates the F bucket 1225 increases as the momentum (hydraulic pressure) of the water jetted from the deflector 1019 becomes stronger. Thus, as shown in FIG. 10C, as the momentum of the water jetted from the deflector 1019 strengthens, the F bucket 1225 is moved closer to the opened position side. On the other hand, when the momentum of the water jetted from the deflector 1019 weakens, the rotational force applied to the F bucket 1225 weakens and the F bucket 1225 is returned to the closed position side by the restorative force of the urging member 1242. The F bucket 1225 is thus positioned at a position at which the rotational force and the restorative force are balanced. When the jetting of water from the deflector 1019 is stopped, the rotational force is eliminated and the F bucket 1225 is returned to the closed position by the restorative force of the urging member 1242. The F bucket 1225 is thus positioned at a position that is in accordance with the momentum of the water jetted from the deflector 1019.

Third Preferred Embodiment

A third preferred embodiment of the present invention shall now be described. In FIG. 11A to FIG. 12E below, elements and components portions equivalent to those shown in FIG. 1 to FIG. 10C are provided with the same reference symbols as in FIG. 1, etc., and description thereof shall be omitted.

Figure 11A:
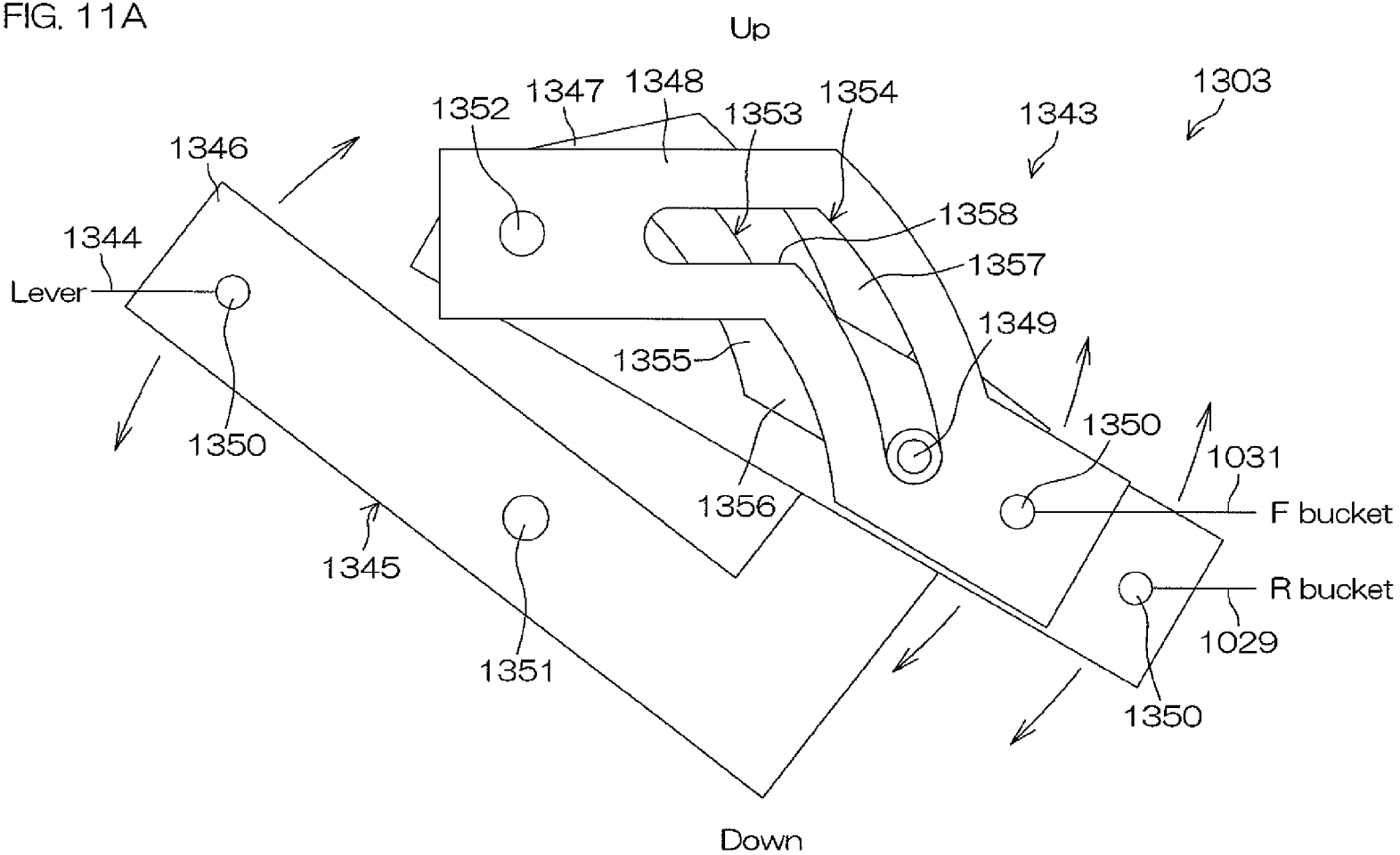
FIG. 11A is a schematic side view of a bucket moving device according to a third preferred embodiment of the present invention.
Figure 11B:
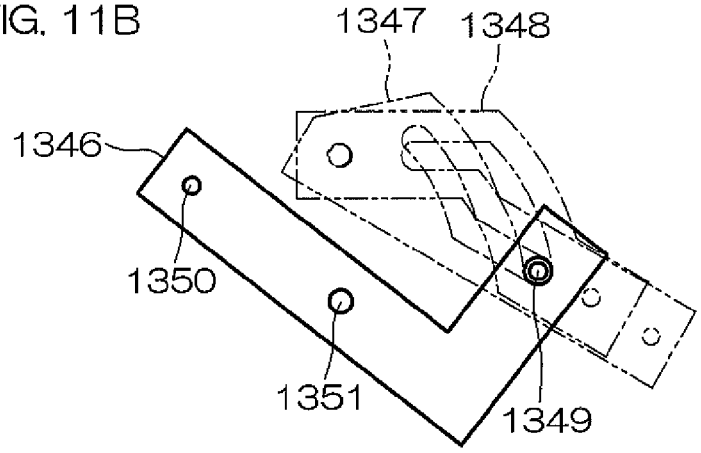
FIG. 11B is a schematic side view of a link mechanism.
Figure 11C:
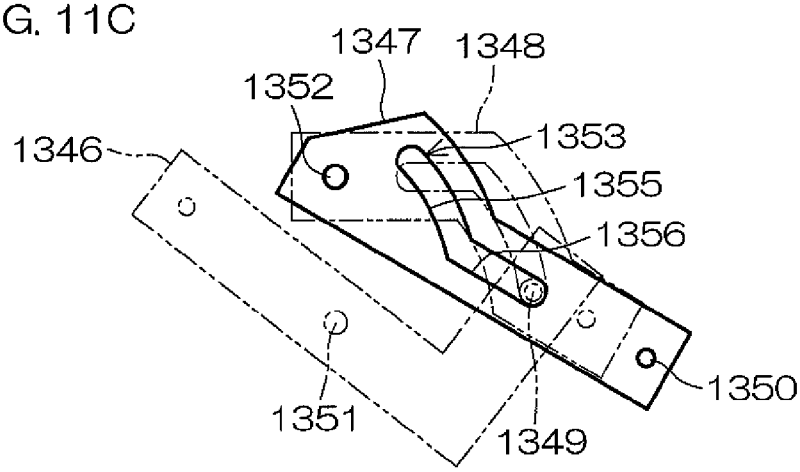
FIG. 11C is a schematic side view of a link mechanism.
Figure 11D:
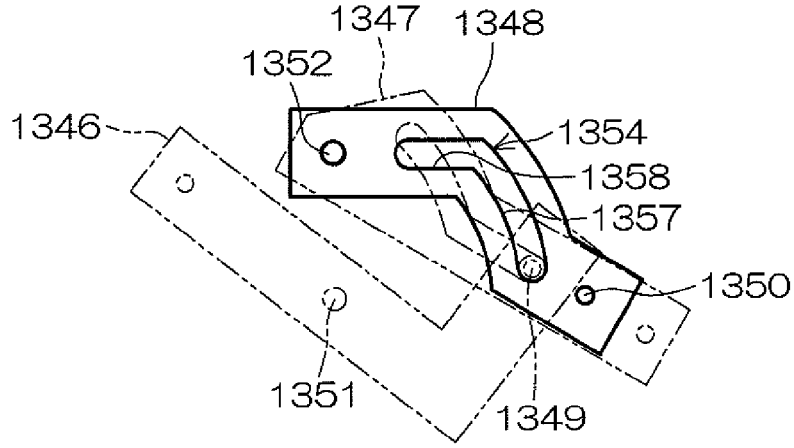
FIG. 11D is a schematic side view of a link mechanism.

FIG. 11A is a schematic side view of a bucket moving device 1343 according to the third preferred embodiment of the present invention. FIG. 11B to FIG. 11D are schematic side views of a link mechanism 1345. Specifically, FIG. 11B is a schematic side view of a driving link 1346. FIG. 11C is a schematic side view of an R driven link 1347, and FIG. 11D is a schematic side view of an F driven link 1348. In FIG. 11A to 11D, states where the link mechanism 1345 are maintained in an attitude in common are shown.

With the exception of the R actuator and the F actuator, a vessel propulsion apparatus 1303 according to the third preferred embodiment preferably has the same arrangement as the vessel propulsion apparatus 1003 according to the first preferred embodiment. That is, as shown in FIG. 11A, the vessel propulsion apparatus 1303 includes the bucket moving device 1343 that moves the R bucket 1024 and the F bucket 1025 in place of the R actuator 1028 and the F actuator 1030 according to the first preferred embodiment.

As shown in FIG. 11A, the bucket moving device 1343 includes three cables (an operation cable 1344, the R cable 1029, and the F cable 1031) and a link mechanism 1345. The R bucket 1024 is coupled to the link mechanism 1345 by the R cable 1029 and the F bucket 1025 is coupled to the link mechanism 1345 by the F cable 1031. The lever 1006 is coupled by the operation cable 1344 to the link mechanism 1345. The link mechanism 1345 may be integral with the R bucket 1024 and the F bucket 1025. In this case, the bucket moving device 1343 does not have to include the R cable 1029 and the F cable 1031. Also, the link mechanism 1345 may be integral with the lever 1006. In this case, the bucket moving device 1343 does not have to include the operation cable 1344. Operation of the lever 1006 is transmitted to the R bucket 1024 and the F bucket 1025 via the link mechanism 1345. The operation cable 1344 is not restricted to being coupled to the lever 1006 and may be coupled to an actuator controlled by the ECU 1004 based on the position of the lever 1006.

As shown in FIG. 11A, the link mechanism 1345 includes three links (the driving link 1346, the R driven link 1347, and the F driven link 1348) and a joint 1349 that couples the links 1346 to 1348. Each of the links 1346 to 1348 preferably has a plate-shaped configuration, for example. Each of the links 1346 to 1348 includes a cable attachment portion 1350. The operation cable 1344, the R cable 1029, and the F cable 1031 are attached to the driving link 1346, the R driven link 1347, and the F driven link 1348, respectively.

As shown in FIG. 11A, the driving link 1346 is supported by a first rotating shaft 1351 extending in a direction orthogonal or substantially orthogonal to the driving link 1346. The R driven link 1347 and the F driven link 1348 are supported by a rotating shaft in common (second rotating shaft 1352) extending in a direction orthogonal or substantially orthogonal to the R driven link 1347 and the F driven link 1348. The driving link 1346 is rotatable around the first rotating shaft 1351 with respect to the hull 1002, and the R driven link 1347 and the F driven link 1348 are rotatable around the second rotating shaft 1352 with respect to the hull 1002.

The R driven link 1347 is rotatable up and down around the second rotating shaft 1352 and between an upper position (see FIG. 12C and FIG. 12D) and a lower position (see FIG. 12A). Likewise, the F driven link 1348 is rotatable up and down around the second rotating shaft 1352 and between an upper position (see FIG. 12E) and a lower position (see FIG. 12A to FIG. 12C). The upper position and the lower position of the R driven link 1347 are respectively associated with the opened position and the closed position of the R bucket 1024, and the upper position and the lower position of the F driven link 1348 are respectively associated with the opened position and the closed position of the F bucket 1025. Thus, when the R driven link 1347 is positioned at the upper position, the R bucket 1024 is positioned at the opened position.

As shown in FIG. 11B, the joint 1349 is coupled to the driving link 1346. The joint 1349 is a cylindrical pin projecting in a direction orthogonal or substantially orthogonal to the driving link 1346. The joint 1349 rotates around the first rotating shaft 1351 together with the driving link 1346. As shown in FIG. 11C, the joint 1349 is fitted in an R slide hole 1353 provided in the R driven link 1347. Further, as shown in FIG. 11D, the joint 1349 is fitted in an F slide hole 1354 provided in the F driven link 1348. The R slide hole 1353 and the F slide hole 1354 are slots penetrating through the driven links in a thickness direction. The joint 1349 is movable in a longitudinal direction of the R slide hole 1353 with respect to the R driven link 1347 and movable in a longitudinal direction of the F slide hole 1354 with respect to the F driven link 1348.

As shown in FIG. 11C, the R slide hole 1353 includes an R arcuate portion 1355 having a radius substantially equal to a rectilinear distance from the joint 1349 to the first rotating shaft 1351 and an R rectilinear portion 1356 extending rectilinearly from an end portion (end portion in the longitudinal direction) of the R arcuate portion 1355. As shown in FIG. 11D, the F slide hole 1354 has an F arcuate portion 1357 having a radius substantially equal to a rectilinear distance from the joint 1349 to the first rotating shaft 1351 and an F rectilinear portion 1358 extending rectilinearly from an end portion (end portion in the longitudinal direction) of the F arcuate portion 1357. The R rectilinear portion 1356 extends from the end portion of the R arcuate portion 1355 to an outer side of the R arcuate portion 1355, and the F rectilinear portion 1358 extends from the end portion of the F arcuate portion 1357 to an inner side of the F arcuate portion 1357.

As can be understood from referencing FIGS. 11C and 11D together, the R slide hole 1353 and the F slide hole 1354 are overlapped partially in a manner such that the R arcuate portion 1355 and the F arcuate portion 1357 are not overlapped. Likewise, the R slide hole 1353 and the F slide hole 1354 are overlapped partially in a manner such that the R rectilinear portion 1356 and the F rectilinear portion 1358 are not overlapped. In a state in which the joint 1349 is positioned inside the F arcuate portion 1357, the joint 1349 is positioned inside the R rectilinear portion 1356.

FIG. 12A to FIG. 12E are schematic side views for describing an example of operations of the link mechanism 1345.

In a state in which the lever 1006 (see FIG. 1) is positioned at the shift switching position Rin, both driven links (the R driven link 1347 and the F driven link 1348) are positioned at the lower positions as shown in FIG. 12A. The R bucket 1024 and the F bucket 1025 are thus positioned at the closed positions. Further, in this state, the F arcuate portion 1357 is positioned on a circle centered on the first rotating shaft 1351. The joint 1349 is positioned inside the R rectilinear portion 1356 and inside the F arcuate portion 1357.

As shown in FIG. 12B, when the vessel operator moves the lever 1006 from the shift switching position Rin into the N region, the operation of the lever 1006 is transmitted to the driving link 1346 by the operation cable 1344 and the driving link 1346 rotates around the first rotating shaft 1351. In this process, the joint 1349 rotates around the first rotating shaft 1351 together with the driving link 1346 and pushes up the R driven link 1347 while moving along the R rectilinear portion 1356. The R driven link 1347 thus rotates around the second rotating shaft 1352 and the R bucket 1024 moves from the closed position to the opened position side. That is, the R bucket 1024 moves from the closed position to an intermediate position.

Meanwhile, the F arcuate portion 1357 is positioned on the circle centered on the first rotating shaft 1351 and thus the joint 1349 only moves along the F arcuate portion 1357 and does not push up the F driven link 1348. The F driven link 1348 thus does not rotate around the second rotating shaft 1352 and the F bucket 1025 does not move from the closed position. That is, in the region (N region) from the shift switching position Rin to the shift switching position Fin, even when the lever 1006 is operated, only the R bucket 1024 moves and the F bucket 1025 does not move.

As shown in FIG. 12C, when the lever 1006 is positioned at the shift switching position Fin, the R driven link 1347 is positioned at the upper position. The R bucket 1024 is thus positioned at the opened position. In this process, the joint 1349 is positioned at a junction portion of the R arcuate portion 1355 and the R rectilinear portion 1356 and positioned at the junction portion of the F arcuate portion 1357 and the F rectilinear portion 1358. Further, not only the F arcuate portion 1357 but the R arcuate portion 1355 is also positioned on the circle centered on the first rotating shaft 1351.

As shown in FIG. 12D, the R arcuate portion 1355 is positioned on the circle centered on the first rotating shaft 1351 and thus even when the vessel operator moves the lever 1006 from the shift switching position Fin to the fully opened position Ffull side, the joint 1349 only moves along the R arcuate portion 1355 and does not push up the R driven link 1347. The R bucket 1024 thus does not move. Meanwhile, the joint 1349 pushes up the F driven link 1348 while moving along the F rectilinear portion 1358. The F driven link 1348 thus rotates around the second rotating shaft 1352 and the F bucket 1025 moves from the closed position to the opened position side. That is, the F bucket 1025 moves from the closed position to an intermediate position.

As shown in FIG. 12E, when the vessel operator moves the lever 1006 further to the fully opened position Ffull side, the joint 1349 reaches an end portion of the F rectilinear portion 1358 and the F driven link 1348 is positioned at the upper position. The F bucket 1025 is thus positioned at the opened position. Both buckets (the R bucket 1024 and the F bucket 1025) are thereby positioned at the opened position.

Fourth Preferred Embodiment

A fourth preferred embodiment of the present invention shall now be described. In FIG. 13A to FIG. 15D below, elements and components equivalent to those shown in FIG. 1 to FIG. 12E are provided with the same reference symbols as in FIG. 1, etc., and description thereof shall be omitted.

Figure 13A:
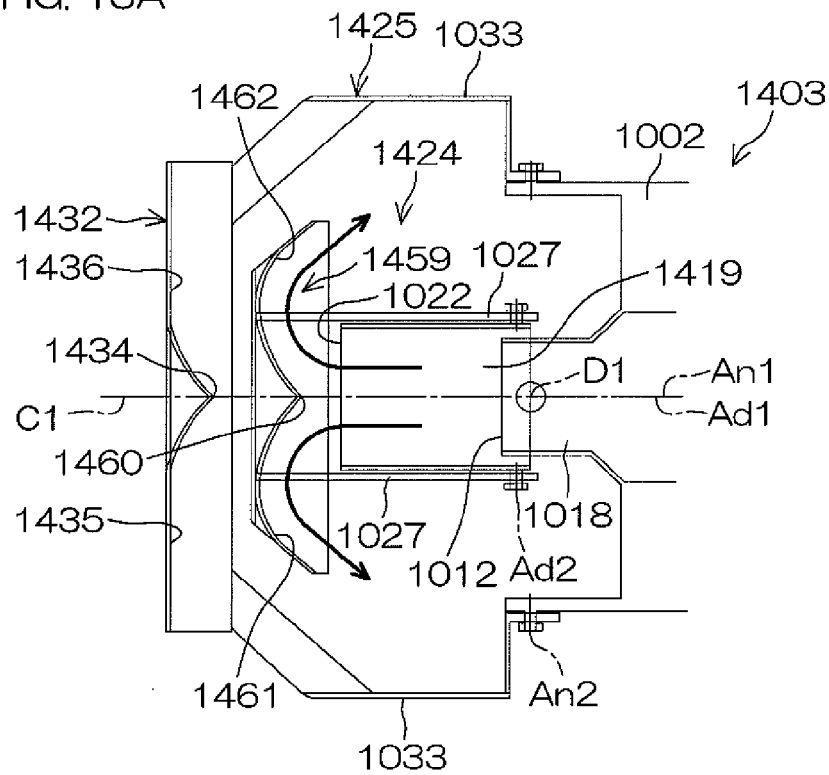
FIG. 13A is a schematic plan view of a vessel propulsion apparatus according to a fourth preferred embodiment of the present invention.
Figure 13B:
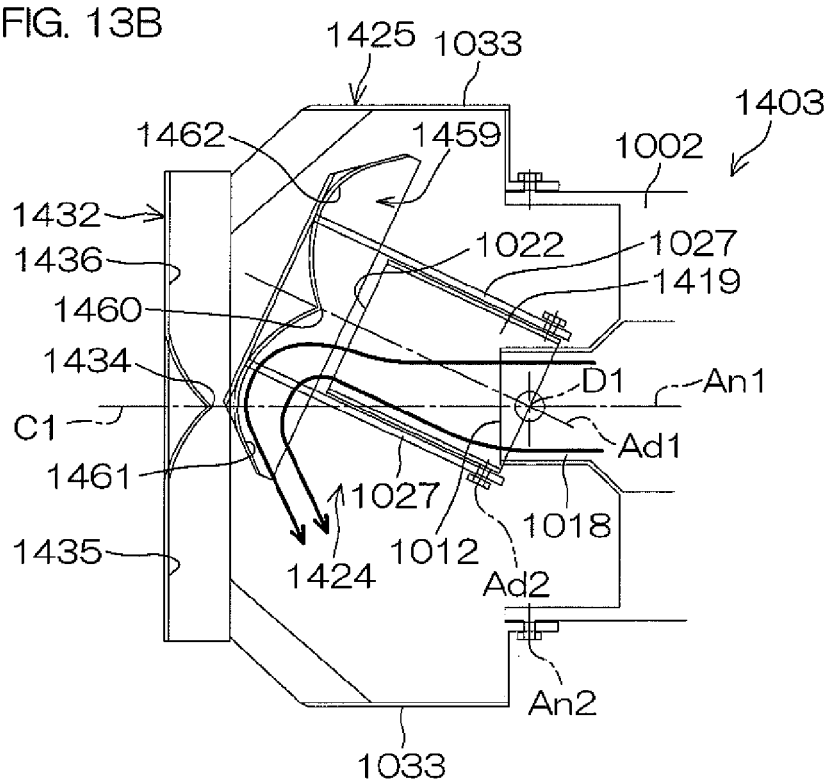
FIG. 13B is a schematic plan view for describing water flow in a state in which an R bucket is positioned at a closed position and a deflector is positioned at a left side.

FIG. 13A is a schematic plan view for describing water flow in a state in which an R bucket 1424 is positioned at a closed position and a deflector 1419 is positioned at a straight drive position. FIG. 13B is a schematic plan view for describing water flow in a state in which the R bucket 1424 is positioned at the closed position and the deflector 1419 is positioned at a left side. In FIG. 13A and FIG. 13B, a vessel propulsion apparatus 1403 is shown in a transparent state. Thick line arrows shown in FIG. 13A and FIG. 13B indicate directions of water streams.

With the exception of the deflector, the R bucket, and the F bucket, the vessel propulsion apparatus 1403 according to the fourth preferred embodiment preferably has the same arrangement as the vessel propulsion apparatus 1003 according to the first preferred embodiment. That is, the vessel propulsion apparatus 1403 includes the deflector 1419, the R bucket 1424, and an F bucket 1425 in place of the deflector 1019, the R bucket 1024, and the F bucket 1025 according to the first preferred embodiment. Besides the point that the R outlet 1023 (see FIG. 2) is not provided, the deflector 1419 preferably has the same arrangement as the deflector 1019 according to the first preferred embodiment.

The R bucket 1424 is coupled to the deflector 1419. The R bucket 1424 is disposed in front of the F bucket 1425. The R bucket 1424 rotates to the right or left around the D axis D1 together with the deflector 1419. The R bucket 1424 is rotatable up and down around the rotation axis Ad2 with respect to the deflector 1419. The R bucket 1424 is rotatable up and down around the rotation axis Ad2 and between the closed position and an opened position.

The R bucket 1424 includes an R guide 1459 disposed at the rear of the deflector 1419 and a pair of right and left R arms 1027 that support the R guide 1459. The R guide 1459 is disposed at the rear of the F outlet 1022. The closed position of the R bucket 1424 is a position at which the R guide 1459 faces the F outlet 1022 across an interval in the front/rear direction. The pair of R arms 1027 are disposed across an interval in the right/left direction. The deflector 1419 is disposed between the pair of R arms 1027 in a plan view.

The R guide 1459 has a W-shaped configuration that is right/left symmetrical and is opened forward in a plan view. The R guide 1459 includes an R apex portion 1460 disposed on the central axis Ad1 of the deflector 1419. Further, the R guide 1459 has a U-shaped R right guide 1461 that extends obliquely rearward to the right from the R apex portion 1460 and then changes in direction to obliquely forward to the right, and a U-shaped R left guide 1462 that extends obliquely rearward to the left from the R apex portion 1460 and then changes in direction to obliquely forward to the left. The R right guide 1461 has a shape with which the R left guide 1462 is right/left inverted, and the R right guide 1461 and the R left guide 1462 are disposed right/left symmetrically.

As shown in FIG. 13A, when the R bucket 1424 is positioned at the closed position and the deflector 1419 is positioned at the straight drive position, the water jetted rearward from the F outlet 1022 is divided to the right and left at equal flow rates by the R guide 1459. Specifically, water that flows to the right side relative to the R apex portion 1460 is guided in an obliquely forward right direction by the R right guide 1461 and water that flows to the left side relative to the R apex portion 1460 is guided in an obliquely forward left direction by the R left guide 1462. Aright branch stream flowing in the obliquely forward right direction and a left branch stream flowing in the obliquely forward left direction are thus generated by the R bucket 1424. The obliquely forward right direction and the obliquely forward left direction are symmetrical directions with respect to the central axis Ad1 of the deflector 1419. Further, in this state, the flow rates of the right branch stream and the left branch stream are equal. The right direction component of thrust and the left direction component of thrust thus cancel each other out and only the rear direction component of thrust remains. A reverse drive direction thrust that drives the hull 1002 straight in the rearward direction is thus generated.

Also, when the R bucket 1424 is positioned at the closed position and the deflector 1419 is positioned at the left side as shown in FIG. 13B, the flow rate of water flowing to the right side relative to the R apex portion 1460 is greater than the flow rate of water flowing to the left side relative to the R apex portion 1460. The R guide 1459 thus causes the right branch stream to have a greater flow rate than the left branch stream. A reverse drive direction thrust that turns the hull 1002 rightward is thus generated. In a state in which the deflector 1419 is oppositely positioned at the right side, the left branch stream has a greater flow rate than the right branch stream. A reverse drive direction thrust that turns the hull 1002 leftward is thus generated.

The water jetted rearward from the deflector 1419 is thus changed forward in direction and jetted in at least one of either of the obliquely forward right direction and the obliquely forward left direction by the R bucket 1424. Tilt angles of the obliquely forward right direction and the obliquely forward left direction with respect to the central axis An1 of the nozzle 1018 change in accordance with the movement of the deflector 1419 around the D axes D1. However, at any steering position, the tilt angles of the obliquely forward right direction and the obliquely forward left direction are greater than the tilt angle of the central axis Ad1 of the deflector 1419 with respect to the central axis An1 of the nozzle 1018. A thrust having a greater right/left direction component is thus generated. A force that turns the vessel 1001 in the reverse drive state can thus be made large.

Figure 14A:
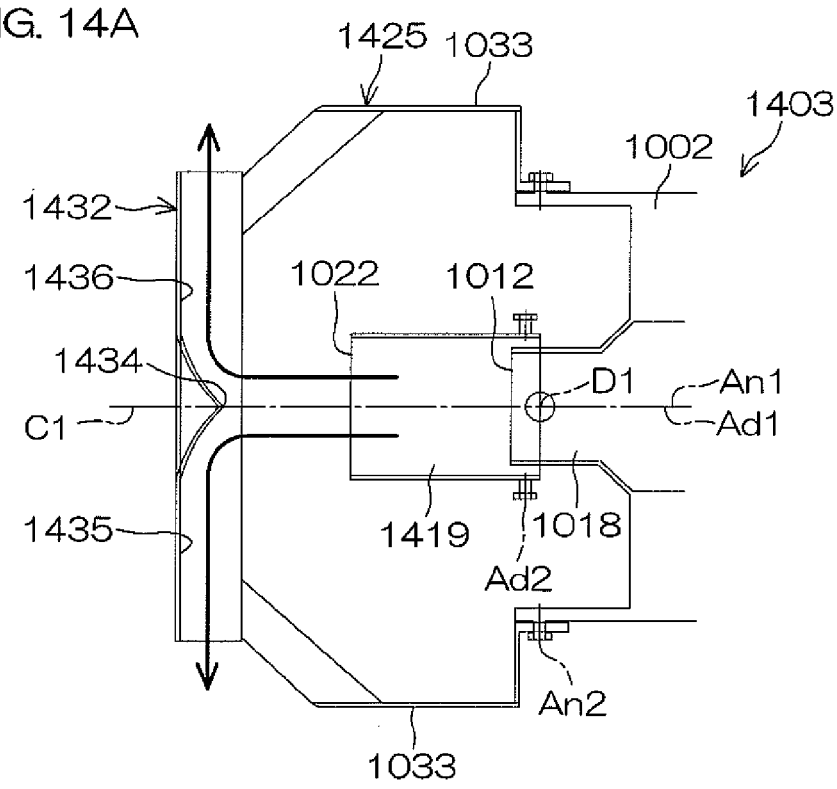
FIG. 14A is a schematic plan view for describing water flow in a state in which the F bucket is positioned at the closed position and the deflector is positioned at a straight drive position.
Figure 14B:
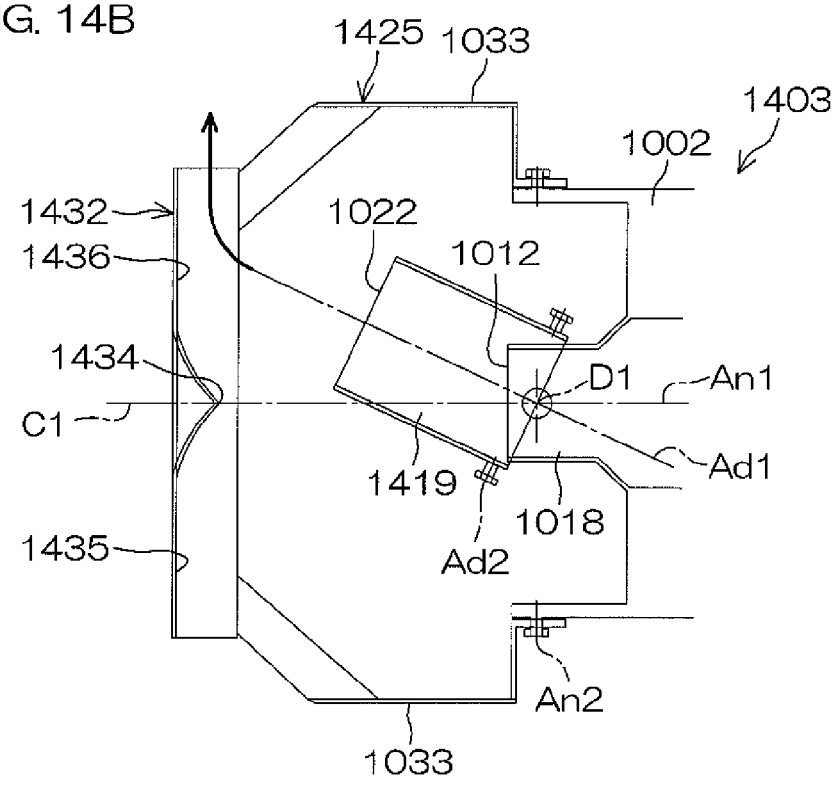
FIG. 14B is a schematic plan view for describing water flow in a state in which the F bucket is positioned at the closed position and the deflector is positioned at the left side.

FIG. 14A is a schematic plan view for describing water flow in a state in which the F bucket 1425 is positioned at the closed position and the deflector 1419 is positioned at the straight drive position. FIG. 14B is a schematic plan view for describing water flow in a state in which the F bucket 1425 is positioned at the closed position and the deflector 1419 is positioned at the left side. In FIG. 14A and FIG. 14B, the vessel propulsion apparatus 1403 is shown in a transparent state. Thick line arrows shown in FIG. 14A and FIG. 14B indicate directions of water streams.

The F bucket 1425 is coupled to the hull 1002. The F bucket 1425 is rotatable up and down around the rotation axis An2 with respect to the hull 1002. The F bucket 1425 is rotatable up and down around the rotation axis An2 and between a closed position and an opened position.

The F bucket 1425 has a U-shaped configuration that is opened forward in a plan view. The F bucket 1425 is right/left symmetrical. The F bucket 1425 surrounds the deflector 1419 and the R bucket 1424 in a plan view (see FIG. 13A). The F bucket 1425 includes an F guide 1432 disposed at the rear of the deflector 1419 and the pair of right and left F arms 1033 that support the F guide 1432. The F guide 1432 is disposed further to the rear than the closed position of the R bucket 1424. The pair of F arms 1033 are disposed across an interval in the right/left direction. The deflector 1419 and the R bucket 1424 are disposed between the pair of F arms 1033 in a plan view. The interval between the pair of F arms 1033 in the right/left direction is set so that regardless of which steering position the deflector 1419 is positioned at, the deflector 1419 and the R bucket 1424 do not contact the pair of F arms 1033 (see FIG. 13B).

The F guide 1432 has a right/left symmetrical V-shaped configuration that is opened rearward in a plan view. The F guide 1432 includes an F apex portion 1434 disposed on the central axis Ad1 of the deflector 1419 positioned at the straight drive position, an F right guide 1435 extending obliquely rearward to the right from the F apex portion 1434, and an F left guide 1436 extending obliquely rearward to the left from the F apex portion 1434. The F right guide 1435 has a shape with which the F left guide 1436 is right/left inverted, and the F right guide 1435 and the F left guide 1436 are disposed right/left symmetrically. The right side F arm 1033 extends forward from the F right guide 1435, and the left side F arm 1033 extends forward from the F left guide 1436. The front end portion of each F arm 1033 is coupled to the hull 1002. The front end portion of each F arm 1033 is rotatable up and down around the rotation axis An2 with respect to the hull 1002.

Water jetted rearward from the deflector 1419 is guided in a right guiding direction by the F right guide 1435. The water guided by the F right guide 1435 is jetted in the right guiding direction from the F bucket 1425. Likewise, water jetted rearward from the deflector 1419 is guided in a left guiding direction by the F left guide 1436. Water guided by the F left guide 1436 is jetted in the left guiding direction from the F bucket 1425. In FIG. 14A, a case where the right guiding direction is the right direction and the left guiding direction is the left direction is shown. The water jetted rearward from the deflector 1419 is thus guided by the F bucket 1425 and jetted directly laterally from the F bucket 1425.

As shown in FIG. 14A, in the state in which the F bucket 1425 is positioned at the closed position and the deflector 1419 is positioned at the straight drive position, the water jetted rearward from the F outlet 1022 is divided to the right and left at equal flow rates by the F guide 1432. Specifically, water that flows to the right side relative to the F apex portion 1434 is guided in the right guiding direction by the F right guide 1435 and water that flows to the left side relative to the F apex portion 1434 is guided in the left guiding direction by the F left guide 1436. A right branch stream flowing in the right guiding direction and a left branch stream flowing in the left guiding direction are thus generated by the F bucket 1425. The flow rates of the right branch stream and the left branch stream are equal in this state. The right direction component of thrust and the left direction component of thrust thus cancel each other out. Thus, in this state, no thrust (resultant force) in any direction is generated.

Also, when the F bucket 1425 is positioned at the closed position and the deflector 1419 is positioned at the left side as shown in FIG. 14B, the flow rate of water flowing to the left side relative to the F apex portion 1434 is greater than the flow rate of water flowing to the right side relative to the F apex portion 1434. The F guide 1432 thus causes the left branch stream to have a greater flow rate than the right branch stream. Particularly, in a state in which the deflector 1419 is positioned at the left maximum steering position (shown in FIG. 14B), all of the water jetted from the F outlet 1022 flows to the left side relative to the F apex portion 1434. Thus, in this state, only the left branch stream is generated. In a state in which the deflector 1419 is oppositely positioned at the right side, the right branch stream has a greater flow rate than the left branch stream. A thrust that turns the hull 1002 rightward is thus generated and the vessel 1001 turns rightward on the spot.

Also, when the F bucket 1425 is positioned at an intermediate position between the closed position and the opened position (see FIG. 15C), just a portion of the water jetted rearward from the F outlet 1022 is guided by the F guide 1432 in at least one of either of the right guiding direction and the left guiding direction. The remaining portion passes below the F bucket 1425 without being blocked by the F bucket 1425 and generates a rearward branch stream that flows in the direction of jetting of water from the F outlet 1022. Thus, when water is jetted rearward from the F outlet 1022 in the state in which the F bucket 1425 is positioned at an intermediate position, the rearward branch stream is generated in addition to at least one of either of the right branch stream and the left branch stream.

FIG. 15A to FIG. 15D are schematic side views for describing an example of a relationship of the position of the lever 1006 and the positions of the R bucket 1424 and the F bucket 1425. In FIG. 15A to FIG. 15D, the vessel propulsion apparatus 1403 is shown in a transparent state. Thick line arrows shown in FIG. 15A to FIG. 15D indicate directions of water streams.

In the state in which the lever 1006 (see FIG. 1) is positioned in the R region, the ECU 1004 (see FIG. 1) positions both the R bucket 1424 and the F bucket 1425 at the closed positions as shown in FIG. 15A. When the R bucket 1424 is positioned at the closed position, the R guide 1459 is positioned at the rear of the F outlet 1022 and thus all of the water jetted from the F outlet 1022 is guided by the R bucket 1424 in at least one of either of an obliquely forward right direction and an obliquely forward left direction. A thrust in the reverse drive direction is thus generated.

As shown in FIG. 15B, in a state in which the lever 1006 is positioned in the N region, the ECU 1004 positions the R bucket 1424 at the opened position and positions the F bucket 1425 at the closed position. When the F bucket 1425 is positioned at the closed position, the F guide 1432 is positioned at the rear of the F outlet 1022 and thus all of the water jetted from the F outlet 1022 is guided by the F bucket 1425 in at least one of either of the right guiding direction and the left guiding direction.

As shown in FIG. 15C, in a state in which the lever 1006 is positioned in the low speed region (position inside the F region), the ECU 1004 positions the R bucket 1424 at the opened position and positions the F bucket 1425 at an intermediate position. In the state in which the F bucket 1425 is positioned at the intermediate position, only a portion of the water jetted rearward from the F outlet 1022 is guided by the F guide 1432 in at least one of either of the right guiding direction and the left guiding direction. The remaining portion passes below the F bucket 1425 without being blocked by the F bucket 1425 and generates the rearward branch stream that flows in the direction of jetting of water from the F outlet 1022.

In a state in which the lever 1006 is positioned in the high speed region (in the fourth preferred embodiment, a position inside the F region at which the movement amount of the lever 1006 is greater than that in the low speed region), the ECU 1004 positions both the R bucket 1424 and the F bucket 1425 at the opened positions as shown in FIG. 15D. All of the water jetted rearward from the deflector 1419 thus passes below the F bucket 1425 and flows rearward. A thrust in the forward drive direction having a greater rear direction component than that generated when the lever 1006 is positioned in the low speed region is thus generated.

Fifth Preferred Embodiment

A fifth preferred embodiment of the present invention shall now be described. In FIG. 16A to FIG. 18E below, elements and components equivalent to respective portions shown in FIG. 1 to FIG. 15D are provided with the same reference symbols as in FIG. 1, etc., and description thereof shall be omitted.

Figure 16A:
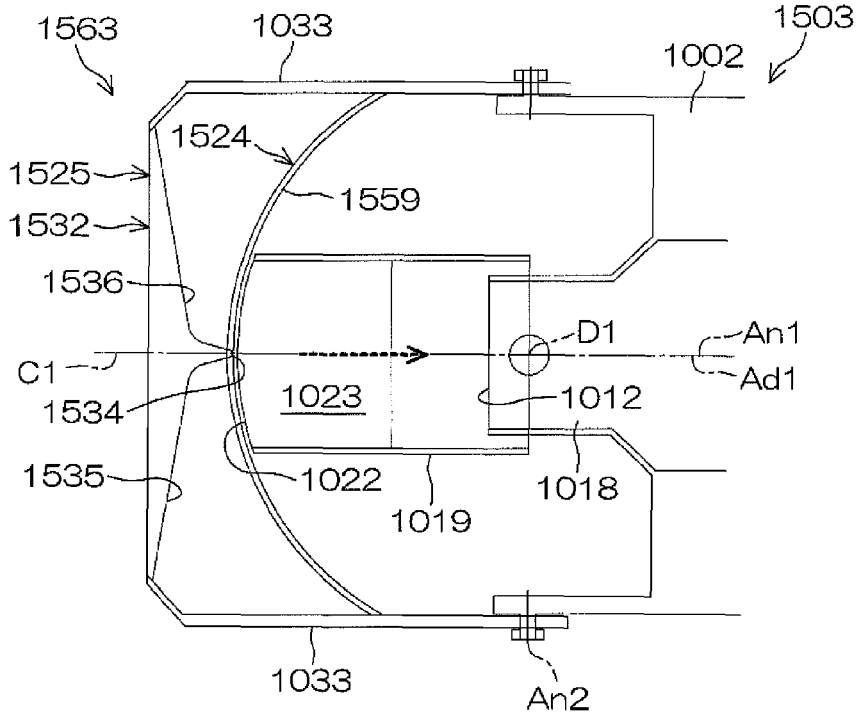
FIG. 16A is a schematic plan view of a vessel propulsion apparatus according to a fifth preferred embodiment of the present invention.
Figure 16B:
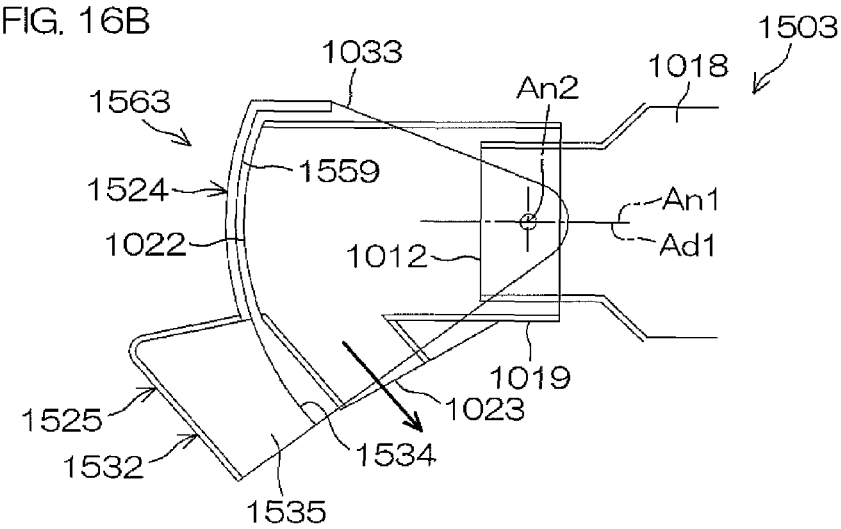
FIG. 16B is a schematic side view of the vessel propulsion apparatus according to the fifth preferred embodiment of the present invention.
Figure 16C:
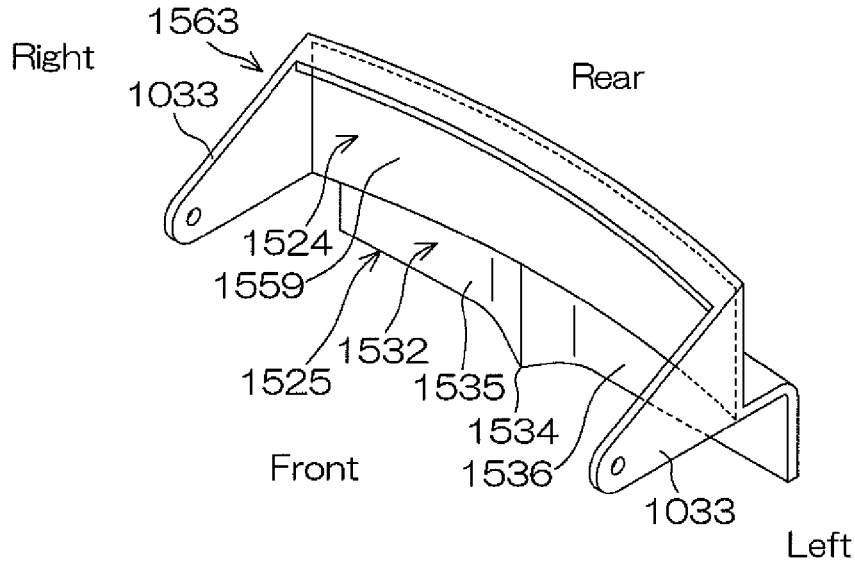
FIG. 16C is a perspective view of an R bucket as viewed from an obliquely forward left upper side.

FIG. 16A is a schematic plan view for describing water flow in a state in which an R bucket 1524 is disposed at the rear of the deflector 1019. FIG. 16B is a schematic side view for describing the water flow in the state in which the R bucket 1524 is disposed at the rear of the deflector 1019. FIG. 16C is a perspective view of the R bucket 1524 as viewed from an obliquely forward left upper side. In FIG. 16A and FIG. 16B, a vessel propulsion apparatus 1503 is shown in a transparent state. Thick line arrows shown in FIG. 16A and FIG. 16B indicate directions of water streams.

With the exception of the R bucket and the F bucket, the vessel propulsion apparatus 1503 according to the fifth preferred embodiment preferably has the same arrangement as the vessel propulsion apparatus 1003 according to the first preferred embodiment. That is, as shown in FIG. 16C, the vessel propulsion apparatus 1503 includes a bucket 1563 in place of the R bucket 1024 and the F bucket 1025 according to the first preferred embodiment.

As shown in FIG. 16A, the bucket 1563 is coupled to the hull 1002. The bucket 1563 is rotatable up and down around the rotation axis An2 with respect to the hull 1002. The bucket 1563 is rotatable up and down around the rotation axis An2 and between a closed position at which the bucket 1563 covers the entire F outlet 1022 in a rear view and an opened position at which the bucket 1563 does not cover the F outlet 1022 in a rear view. The bucket 1563 is coupled to the F cable 1031 (see FIG. 1). The ECU 1004 (see FIG. 1) controls the F actuator 1030 (see FIG. 1) coupled to the F cable 1031 to rotate the bucket 1563 up and down around the rotation axis An2.

As shown in FIG. 16B, the bucket 1563 includes the R bucket 1524 by which water flowing rearward inside the deflector 1019 is guided forward and an F bucket 1525 by which water flowing rearward inside the deflector 1019 is tilted to the right and left. The R bucket 1524 is disposed above the F bucket 1525. The R bucket 1524 rotates up and down around the rotation axis An2 together with the F bucket 1525. The F bucket 1525 may be integral with the R bucket 1524 or may be a separate member from the R bucket 1524 that is fixed to the R bucket 1524.

As shown in FIG. 16A, the bucket 1563 further includes the pair of right and left F arms 1033 that support the R bucket 1524 and the F bucket 1525. The pair of F arms 1033 are disposed across an interval in the right/left direction. The pair of F arms 1033 extend from a right end portion and a left end portion of the R bucket 1524. A front end portion of each F arm 1033 is coupled to the hull 1002. The front end portion of each F arm 1033 is rotatable up and down around the rotation axis An2 with respect to the hull 1002. The deflector 1019 is disposed between the pair of F arms 1033 in a plan view. The interval between the pair of F arms 1033 in the right/left direction is set so that regardless of which steering position the deflector 1019 is positioned at, the deflector 1019 does not contact the pair of F arms 1033.

As shown in FIG. 16A, the R bucket 1524 includes an R guide 1559 having an arcuate shape that is opened forward in a plan view. The R guide 1559 is right/left symmetrical. A transverse section of the R guide 1559 has an arcuate shape extending in the right/left direction along an arcuate locus along which the F outlet 1022 passes. Also, as shown in FIG. 16B, a vertical section of the R guide 1559 has an arcuate shape extending along the up/down direction along the F outlet 1022.

As shown in FIG. 16B, when in a state in which the deflector 1019 is positioned at the straight drive position, the bucket 1563 is positioned at the closed position, the entire F outlet 1022 is closed by the R guide 1559. Further, as shown in FIG. 16A, the R guide 1559 extends in the right/left direction along the arcuate locus along which the F outlet 1022 passes and thus, regardless of which steering position the deflector 1019 is positioned at, the state in which the entire F outlet 1022 is closed by the R guide 1559 is maintained. Thus, in the state in which the bucket 1563 is positioned at the closed position, regardless of which steering position the deflector 1019 is positioned at, water flowing into the deflector 1019 from the nozzle 1018 is guided forward by the R guide 1559 and is jetted downward and obliquely forward from the R outlet 1023. A thrust in the reverse drive direction is thereby generated.

Figure 17A:
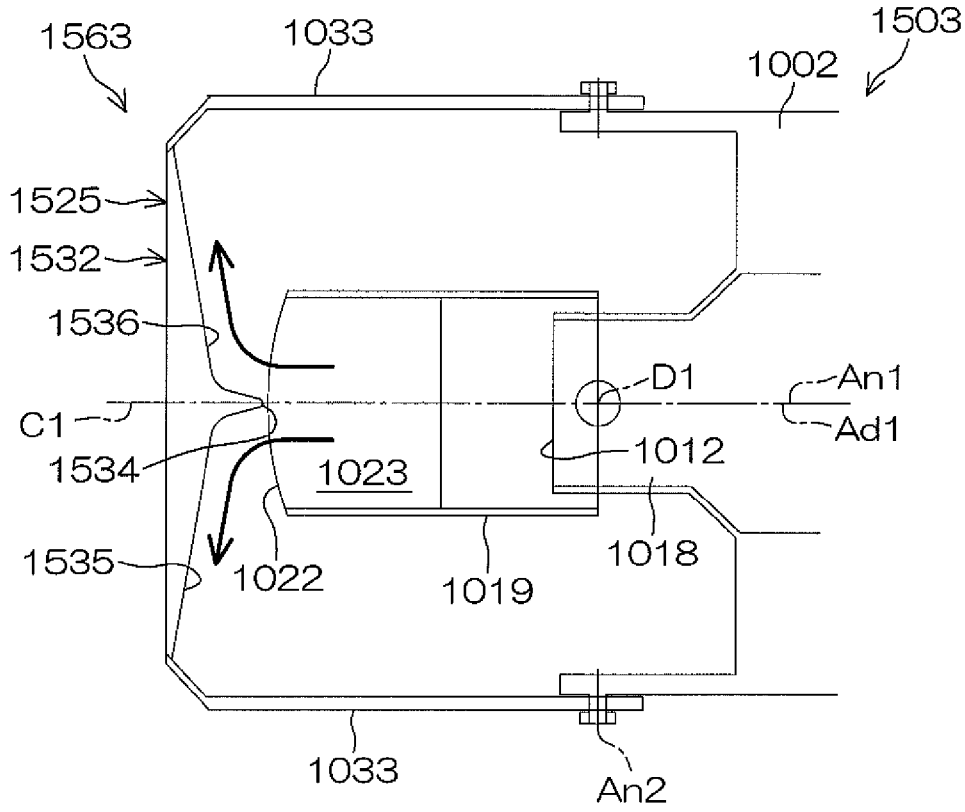
FIG. 17A is a schematic plan view for describing water flow in a state in which an F bucket is positioned at the rear of a deflector.

FIG. 17A is a schematic plan view for describing water flow in a state in which the F bucket 1525 is positioned at the rear of a deflector 1019. FIG. 17B is a schematic side view for describing the flow of water in the state in which the F bucket 1525 is positioned at the rear of the deflector 1019. In FIG. 17A and FIG. 17B, the vessel propulsion apparatus 1503 is shown in a transparent state. Thick line arrows shown in FIG. 17A and FIG. 17B indicate directions of water streams.

As shown in FIG. 17A, the F bucket 1525 includes a V-shaped F guide 1532 that is opened rearward in a plan view. The F guide 1532 is right/left symmetrical. The F guide 1532 includes an F apex portion 1534 disposed on the central axis Ad1 of the deflector 1019 positioned at the straight drive position, an F right guide 1535 extending obliquely rearward to the right from the F apex portion 1534, and an F left guide 1536 extending obliquely rearward to the left from the F apex portion 1534. The F right guide 1535 has a shape with which the F left guide 1536 is right/left inverted, and the F right guide 1535 and the F left guide 1536 are disposed right/left symmetrically. As shown in FIG. 16C, a right side of the F right guide 1535 is open and a left side of the F left guide 1536 is open.

As shown in FIG. 17B, in a state in which the bucket 1563 is positioned between the closed position and the opened position, at least a portion of the F guide 1532 faces the F outlet 1022. In this state, water jetted rearward from the F outlet 1022 is guided in a right guiding direction by the F right guide 1535. The water guided by the F right guide 1535 is jetted in the right guiding direction from the bucket 1563. Likewise in this state, water jetted rearward from the F outlet 1022 is guided in a left guiding direction by the F left guide 1536. The water guided by the F left guide 1536 is jetted in the left guiding direction from the bucket 1563. In FIG. 17A, the right guiding direction is an obliquely rearward right direction and the left guiding direction is an obliquely rearward left direction.

FIG. 18A to FIG. 18E are schematic side views for describing an example of a relationship of the position of the lever 1006 and the positions of the R bucket 1524 and the F bucket 1525. In FIG. 18A to FIG. 18E, the vessel propulsion apparatus 1503 is shown in a transparent state. Thick line arrows shown in FIG. 18A to FIG. 18E indicate directions of water streams. The position of the R bucket 1524 shown in FIG. 18A is the closed position of the R bucket 1524, and the position of the R bucket 1524 shown in FIG. 18D is the opened position of the R bucket 1524. The position of the F bucket 1525 shown in FIG. 18C is the closed position of the F bucket 1525, and the position of the F bucket 1525 shown in FIG. 18E is the opened position of the F bucket 1525.

In a state in which the lever 1006 (see FIG. 1) is positioned in the R region, the ECU 1004 (see FIG. 1) positions the bucket 1563 at a reverse position (corresponding to the closed position) as shown in FIG. 18A. The reverse position is a position at which the R bucket 1524 closes the entire F outlet 1022. Thus, in this state, the water flowing into the deflector 1019 from the nozzle 1018 is jetted forward and obliquely downward from the R outlet 1023 of the deflector 1019. A thrust in the reverse drive direction is thus generated.

As shown in FIG. 18B, in a state in which the lever 1006 is positioned in the N region, the ECU 1004 positions the bucket 1563 at a neutral position. The neutral position is a position at the opened position side relative to the reverse position, and at this position, only a portion of the F outlet 1022 is closed by the R bucket 1524 and the remaining portion of the F outlet 1022 faces the F bucket 1525. Thus, in this state, a portion of the water flowing into the deflector 1019 from the nozzle 1018 is jetted forward and obliquely downward from the R outlet 1023 of the deflector 1019. The remaining portion is guided in at least one of either of the right guiding direction and the left guiding direction by the F bucket 1525.

In a state in which the lever 1006 is positioned in the low speed region (positioned inside the F region), the ECU 1004 positions the bucket 1563 at a low speed position as shown in FIG. 18C. The low speed position is a position at the opened position side relative to the neutral position, and at this position, only a portion of the F outlet 1022 is closed by the R bucket 1524 and the remaining portion of the F outlet 1022 faces the F bucket 1525. An opening area (area of the portion not closed by the R bucket 1524) of the F outlet 1022 at the low speed position is greater than the opening area at the neutral position. A thrust having a greater front direction component than that generated when the lever 1006 is positioned in the N region is thus generated.

In a state in which the lever 1006 is positioned in the medium speed region (position inside the F region), the ECU 1004 positions the bucket 1563 at a medium speed position as shown in FIG. 18D. The medium speed position is a position at the opened position side relative to the low speed position, and at this position, the entire F outlet 1022 is open and only a portion of the F outlet 1022 faces the F bucket 1525. Thus, in this state, all of the water flowing into the deflector 1019 from the nozzle 1018 is jetted rearward from the F outlet 1022. A portion of the jetted water passes below the bucket 1563. The remaining portion is guided by the F bucket 1525 in at least one of either of the right guiding direction and the left guiding direction. A thrust having a greater front direction component than that generated when the lever 1006 is positioned in the low speed region is thus generated.

In a state in which the lever 1006 is positioned in the high speed region (position inside the F region), the ECU 1004 positions the bucket 1563 at a high speed position (corresponding to the opened position) as shown in FIG. 18E. At the high speed position, the entire F outlet 1022 is open and the F bucket 1525 does not face the F outlet 1022. Thus, all of the water flowing into the deflector 1019 from the nozzle 1018 passes below the bucket 1563. A thrust having a greater front direction component than that generated when the lever 1006 is positioned in the medium speed region is thus generated.

Sixth Preferred Embodiment

A sixth preferred embodiment of the present invention shall now be described. In FIG. 19A to FIG. 20E below, elements and components equivalent to those shown in FIG. 1 to FIG. 18E are provided with the same reference symbols as in FIG. 1, etc., and description thereof shall be omitted.

Figure 19A:
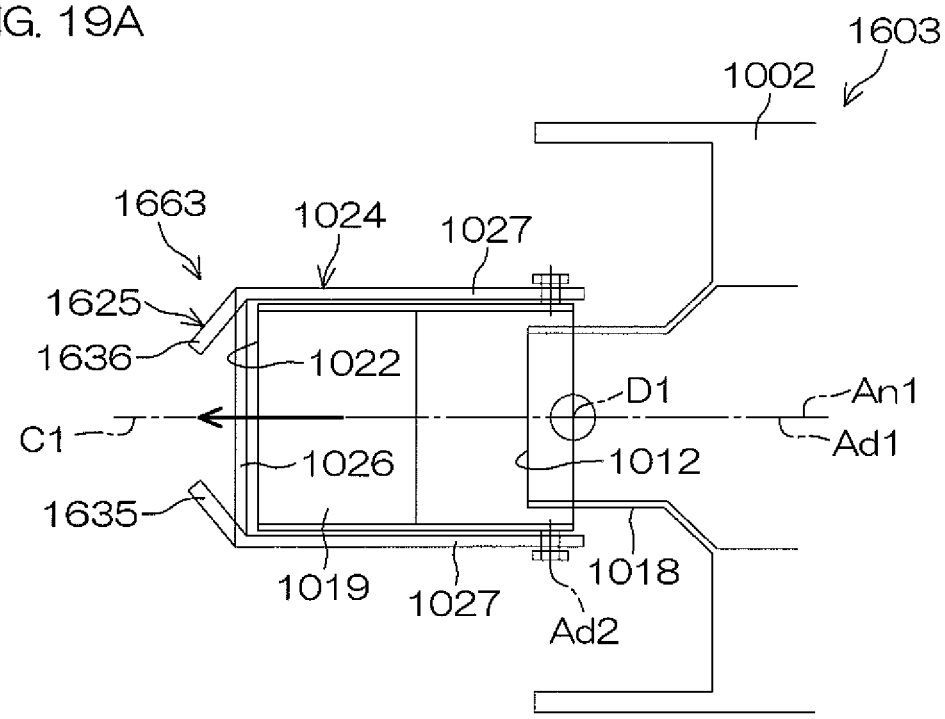
FIG. 19A is a schematic plan view of a vessel propulsion apparatus according to a sixth preferred embodiment of the present invention.
Figure 19B:
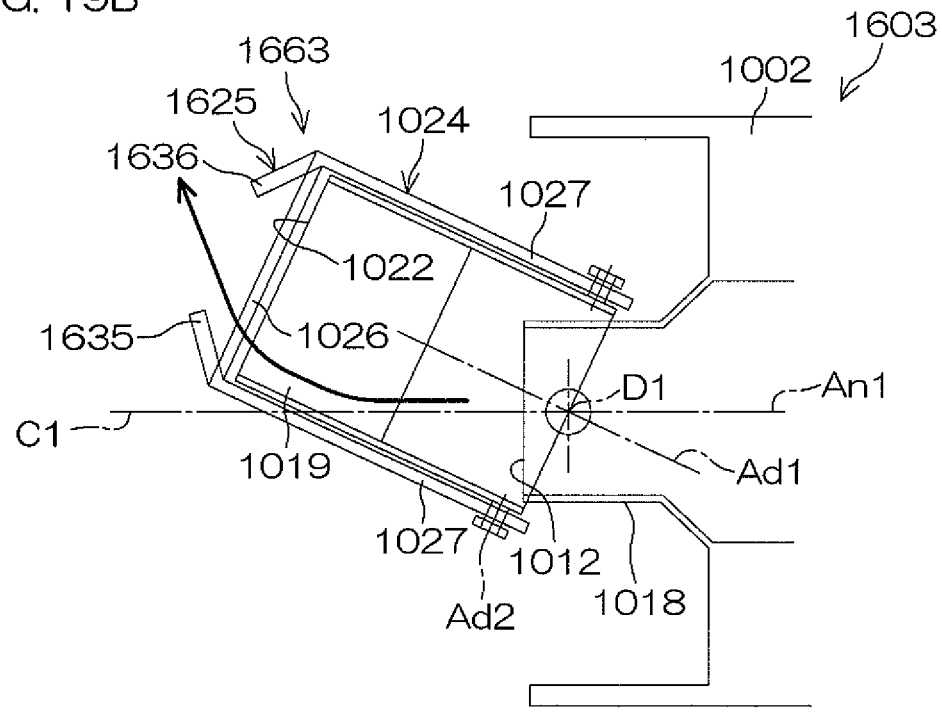
FIG. 19B is a schematic plan view for describing water flow in a state in which an F bucket is positioned at the rear of a deflector and the deflector is positioned at a left side.
Figure 19C:
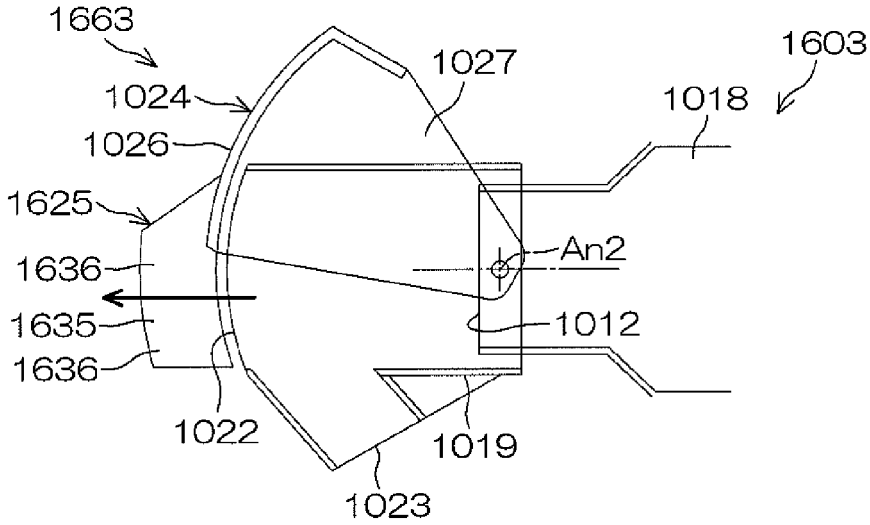
FIG. 19C is a schematic side view for describing water flow in a state in which the F bucket is positioned at the rear of the deflector.
Figure 19D:
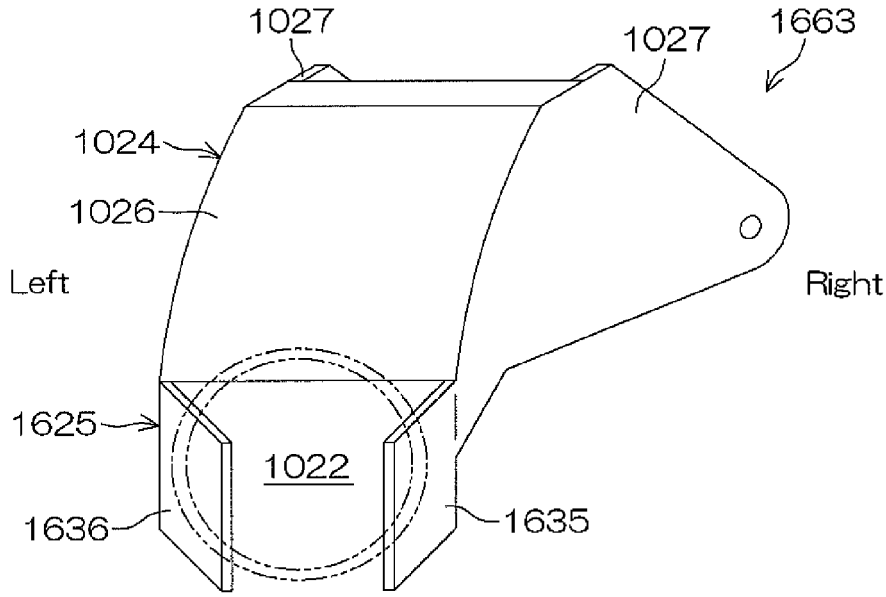
FIG. 19D is a schematic perspective view of a bucket as viewed from an obliquely rearward right side.

FIG. 19A is a schematic plan view for describing water flow in a state in which an F bucket 1625 is positioned at the rear of the deflector 1019 and the deflector 1019 is positioned at the straight drive position. FIG. 19B is a schematic plan view for describing water flow in a state in which the F bucket 1625 is positioned at the rear of the deflector 1019 and the deflector 1019 is positioned at the left side. FIG. 19C is a schematic side view for describing water flow in a state in which the F bucket 1625 is positioned at the rear of the deflector 1019. FIG. 19D is a schematic perspective view of a bucket 1663 as viewed from an obliquely rearward right side. In FIG. 19A to FIG. 19C, a vessel propulsion apparatus 1603 is shown in a transparent state. Thick line arrows shown in FIG. 19A to FIG. 19C indicate directions of water streams.

With the exception of the R bucket and the F bucket, the vessel propulsion apparatus 1603 according to the sixth preferred embodiment preferably has the same arrangement as the vessel propulsion apparatus 1003 according to the first preferred embodiment. That is, as shown in FIG. 19D, the vessel propulsion apparatus 1603 includes the bucket 1663 in place of the R bucket 1024 and the F bucket 1025 according to the first preferred embodiment.

As shown in FIG. 19D, the bucket 1663 includes the R bucket 1024 according to the first preferred embodiment and an F bucket 1625 by which a water stream flowing rearward from the deflector 1019 is tilted to the right or left. As shown in FIG. 19A, the R bucket 1024 is coupled to the deflector 1019. The F bucket 1625 moves together with the R bucket 1024. The bucket 1663 rotates to the right or left around the D axis D1 together with the deflector 1019. The bucket 1663 is rotatable up and down around the rotation axis Ad2 with respect to the deflector 1019.

As shown in FIG. 19C, the bucket 1663 is rotatable up and down around the rotation axis Ad2 and between a closed position at which the bucket 1663 covers the entire F outlet 1022 in a rear view and an opened position at which the bucket 1663 does not cover the F outlet 1022 in a rear view. The bucket 1663 is coupled to the F cable 1031 (see FIG. 1). The ECU 1004 (see FIG. 1) controls the actuator 1030 (see FIG. 1) coupled to the F cable 1031 to rotate the bucket 1663 up and down around the rotation axis Ad2.

As shown in FIG. 19D, the F bucket 1625 includes an F right guide 1635 and an F left guide 1636 that extend downward from the R bucket 1024. The F right guide 1635 extends rearward from a right end portion of the R bucket 1024 and the F left guide 1636 extends rearward from a left end portion of the R bucket 1024. As shown in FIG. 19A, the F right guide 1635 and the F left guide 1636 face each other across an interval in the right/left direction. The F right guide 1635 and the F left guide 1636 are disposed in a V-shaped configuration such that the interval between the two narrows with distance away from the deflector 1019.

As shown in FIG. 19C, in a state in which the bucket 1663 is positioned between the closed position and the opened position, at least a portion of the F bucket 1625 faces the F outlet 1022. As shown in FIG. 19A, in this state, the F right guide 1635 faces a right end portion of the F outlet 1022 and the F left guide 1636 faces a left end portion of the F outlet 1022. In the state in which the F bucket 1625 faces the F outlet 1022, water jetted rearward from the right end portion of the F outlet 1022 is guided in a left guiding direction by the F right guide 1635. Likewise, in the state in which the F bucket 1625 faces the F outlet 1022, water jetted rearward from the left end portion of the F outlet 1022 is guided in a right guiding direction by the F left guide 1636.

Specifically, as shown in FIG. 19A, in the state in which the F bucket 1625 faces the F outlet 1022 and the deflector 1019 is positioned at the straight drive position, a large portion of the water flowing into the deflector 1019 from the nozzle 1018 flows rearward inside the deflector 1019 and along the central axis Ad1 of the deflector 1019. The water is then jetted rearward from a central portion (central portion in the right/left direction) of the F outlet 1022. A large portion of the water jetted from the F outlet 1022 passes between the F right guide 1635 and the F left guide 1636 and flows rearward.

On the other hand, as shown in FIG. 19B, in the state in which the F bucket 1625 faces the F outlet 1022 and the deflector 1019 is positioned at the left side, a large portion of the water flowing into the deflector 1019 flows rearward inside the deflector 1019 along a right end portion of the deflector 1019. The water is then jetted rearward from the right end portion of the F outlet 1022. The F right guide 1635 faces the right end portion of the F outlet 1022. A large portion of the water jetted from the F outlet 1022 is thus guided in the left guiding direction by the F right guide 1635. A left branch stream flowing in the left guiding direction is thereby generated by the F right guide 1635. In a state in which the deflector 1019 is oppositely positioned at the right side, a large portion of the water flowing into the deflector 1019 is jetted from the left end portion of the F outlet 1022 and is guided in the right guiding direction by the F left guide 1636. A left branch stream flowing in the right guiding direction is thereby generated by the F left guide 1636.

FIG. 20A to FIG. 20E are schematic side views for describing an example of a relationship of the position of the lever 1006 and the positions of the R bucket 1024 and the F bucket 1625. In FIG. 20A to FIG. 20E, the vessel propulsion apparatus 1603 is shown in a transparent state. Thick line arrows shown in FIG. 20A to FIG. 20E indicate directions of water streams. The position of the R bucket 1024 shown in FIG. 20A is the closed position of the R bucket 1024, and the position of the R bucket 1024 shown in FIG. 20D is the opened position of the R bucket 1024. The position of the F bucket 1625 shown in FIG. 20C is the closed position of the F bucket 1625, and the position of the F bucket 1625 shown in FIG. 20E is the opened position of the F bucket 1625.

In a state in which the lever 1006 (see FIG. 1) is positioned in the R region, the ECU 1004 (see FIG. 1) positions the bucket 1663 at a reverse position (corresponding to the closed position) as shown in FIG. 20A. The reverse position is a position at which the R bucket 1024 closes the entire F outlet 1022. Thus, in this state, the water flowing into the deflector 1019 from the nozzle 1018 is jetted forward and obliquely downward from the R outlet 1023 of the deflector 1019. A thrust in the reverse drive direction is thus generated.

As shown in FIG. 20B, in a state in which the lever 1006 is positioned in the N region, the ECU 1004 positions the bucket 1663 at a neutral position. The neutral position is a position at the opened position side relative to the reverse position, and at this position, only a portion of the F outlet 1022 is closed by the R bucket 1024 and the remaining portion of the F outlet 1022 faces the F bucket 1625. Thus, in this state, a portion of the water flowing into the deflector 1019 from the nozzle 1018 is jetted forward and obliquely downward from the R outlet 1023 of the deflector 1019. The remaining portion is guided in at least one of either of the right guiding direction and the left guiding direction by the F bucket 1625.

In a state in which the lever 1006 is positioned in the low speed region (position inside the F region), the ECU 1004 positions the bucket 1663 at a low speed position as shown in FIG. 20C. The low speed position is a position at the opened position side relative to the neutral position, and at this position, only a portion of the F outlet 1022 is closed by the R bucket 1024 and the remaining portion of the F outlet 1022 faces the F bucket 1625. The opening area of the F outlet 1022 at the low speed position is greater than the opening area at the neutral position. A thrust having a greater front direction component than that generated when the lever 1006 is positioned in the N region is thus generated.

In a state in which the lever 1006 is positioned in the medium speed region (position inside the F region), the ECU 1004 positions the bucket 1663 at a medium speed position as shown in FIG. 20D. The medium speed position is a position at the opened position side relative to the low speed position, and at this position, the entire F outlet 1022 is open and only a portion of the F outlet 1022 faces the F bucket 1625. Thus, in this state, all of the water flowing into the deflector 1019 from the nozzle 1018 is jetted rearward from the F outlet 1022. A portion of the jetted water passes below the bucket 1663. The remaining portion is guided by the F bucket 1625 in at least one of either of the right guiding direction and the left guiding direction. A thrust having a greater front direction component than that generated when the lever 1006 is positioned in the low speed region is thus generated.

In a state in which the lever 1006 is positioned in the high speed region (position inside the F region), the ECU 1004 positions the bucket 1663 at a high speed position (corresponding to the opened position) as shown in FIG. 20E. At the high speed position, the entire F outlet 1022 is open and the F bucket 1625 does not face the F outlet 1022. Thus, all of the water flowing into the deflector 1019 from the nozzle 1018 passes below the F bucket 1663. A thrust having a greater front direction component than that generated when the lever 1006 is positioned in the medium speed region is thus generated.

Seventh Preferred Embodiment

A seventh preferred embodiment of the present invention shall now be described. In FIG. 21 to FIG. 25E below, elements and components equivalent to those shown in FIG. 1 to FIG. 20E are provided with the same reference symbols as in FIG. 1, etc., and description thereof shall be omitted.

Figure 21:
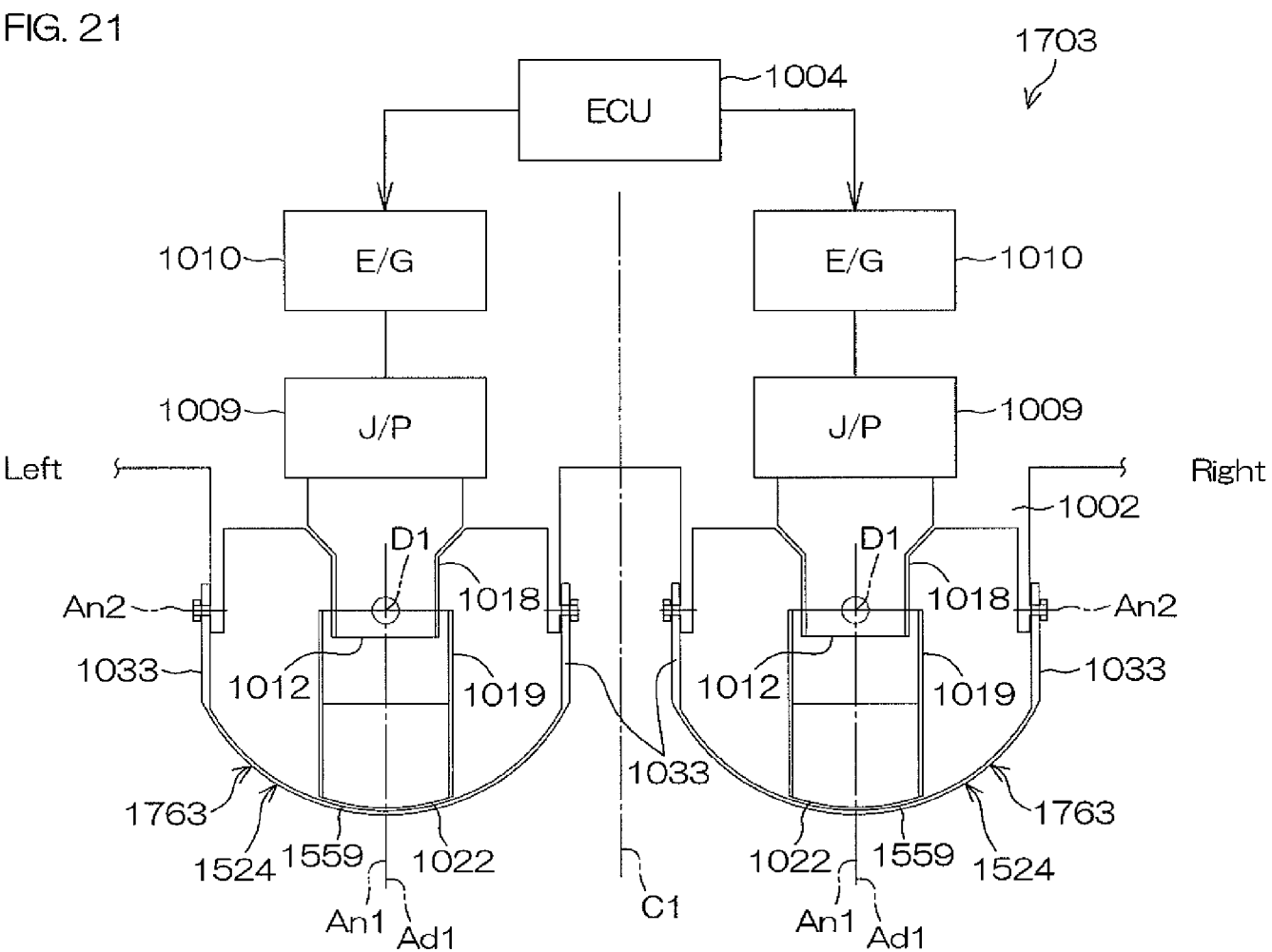
FIG. 21 is a schematic plan view of a vessel propulsion apparatus according to a seventh preferred embodiment of the present invention.

FIG. 21 is a schematic plan view of a vessel propulsion apparatus 1703 according to the seventh preferred embodiment of the present invention.

The vessel propulsion apparatus 1703 according to the seventh preferred embodiment includes two jet pumps 1009 disposed at right and left sides respectively of the hull center C1, two engines 1010 respectively driving the two jet pumps 1009, and the ECU 1004 controlling the two engines 1010. Each jet pump 1009 includes the nozzle 1018 and the deflector 1019. The vessel propulsion apparatus 1703 thus includes a pair of nozzles 1018 and a pair of deflectors 1019. The vessel propulsion apparatus 1703 also includes a pair of buckets 1763 by each of which water flowing into a deflector 1019 from a nozzle 1018 is guided to generate a thrust in the forward drive direction or the reverse drive direction.

The pair of nozzles 1018 are disposed at right and left sides respectively of the hull center C1. The pair of deflectors 1019 are respectively disposed at the rear of the pair of nozzles 1018. The pair of buckets 1763 are respectively disposed at the rear of the pair of deflectors 1019. Thus, the pair of deflectors 1019 are disposed at right and left sides respectively of the hull center C1 and the pair of buckets 1763 are disposed at right and left sides respectively of the hull center C1. The pair of deflectors 1019 are respectively coupled to the pair of nozzles 1018. The right side deflector 1019 is rotatable to the right and left around a D axis D1 that is fixed with respect to the right side nozzle 1018, and the left side deflector 1019 is rotatable to the right and left around a D axis D1 that is fixed with respect to the left side nozzle 1018. The pair of deflectors 1019 are arranged, for example, to rotate to the right or left integrally in the same direction and by the same movement amount.

Each bucket 1763 is coupled to the hull 1002. Each bucket 1763 is rotatable up and down around a rotation axis An2 with respect to the hull 1002. The nozzle 1018 is fixed to the hull 1002 and does not move with respect to the hull 1002. Each bucket 1763 is thus rotatable up and down around the rotation axis An2 with respect to the nozzle 1018. The right side bucket 1763 is rotatable up and down around the rotation axis An2 that is fixed with respect to the right side nozzle 1018, and the left side bucket 1763 is rotatable up and down around the rotation axis An2 that is fixed with respect to the left side nozzle 1018. Each bucket 1763 is rotatable up and down around the rotation axis An2 and between a closed position of covering the entire F outlet 1022 in a rear view and an opened position of not covering the F outlet 1022. The ECU 1004 controls the F actuator 1030 (see FIG. 1) to rotate the pair of buckets 1763 up or down, for example, integrally in the same direction and by the same movement amount.

Figure 22A:
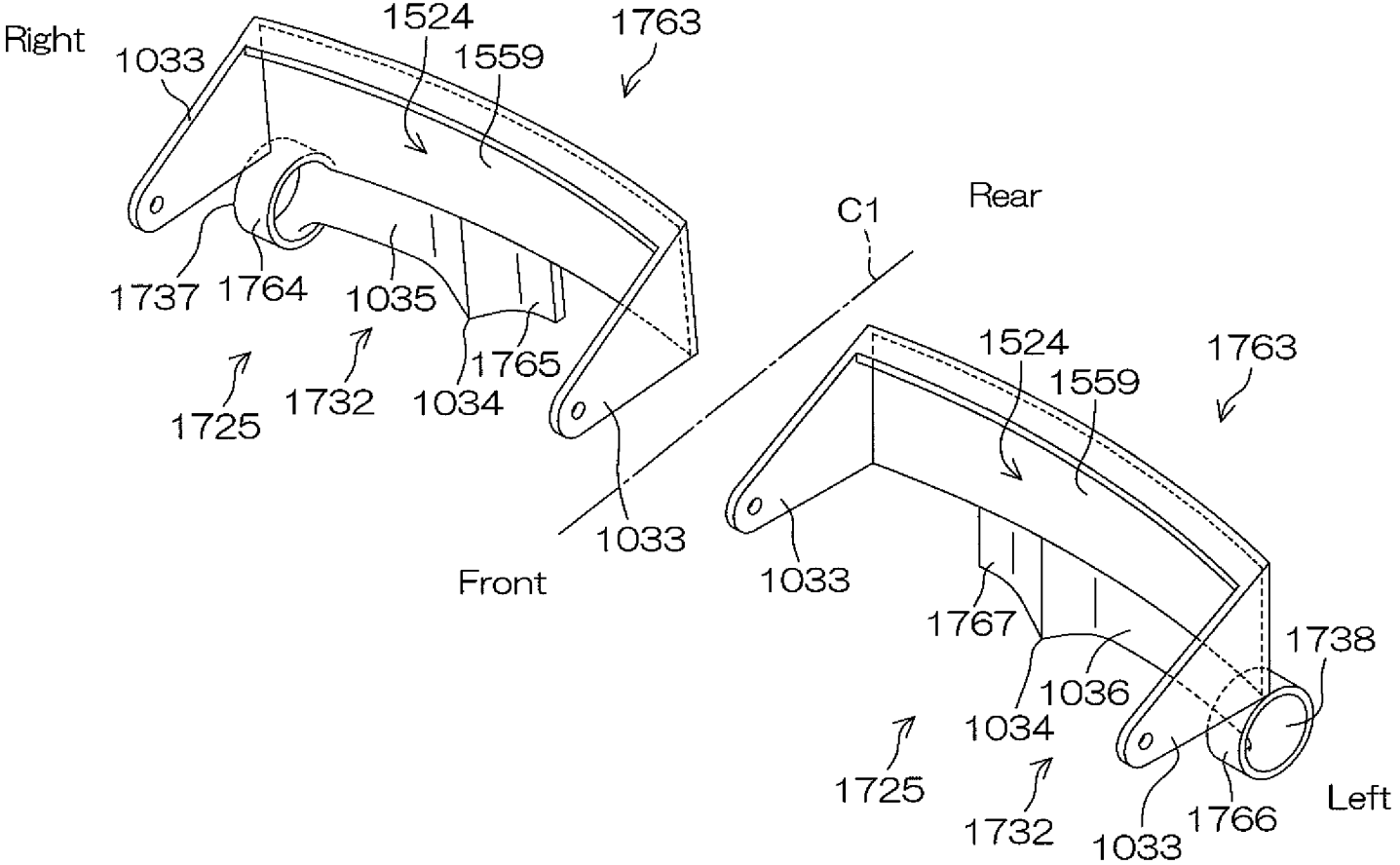
FIG. 22A is a perspective view of buckets as viewed from an obliquely forward left upper side.
Figure 22B:
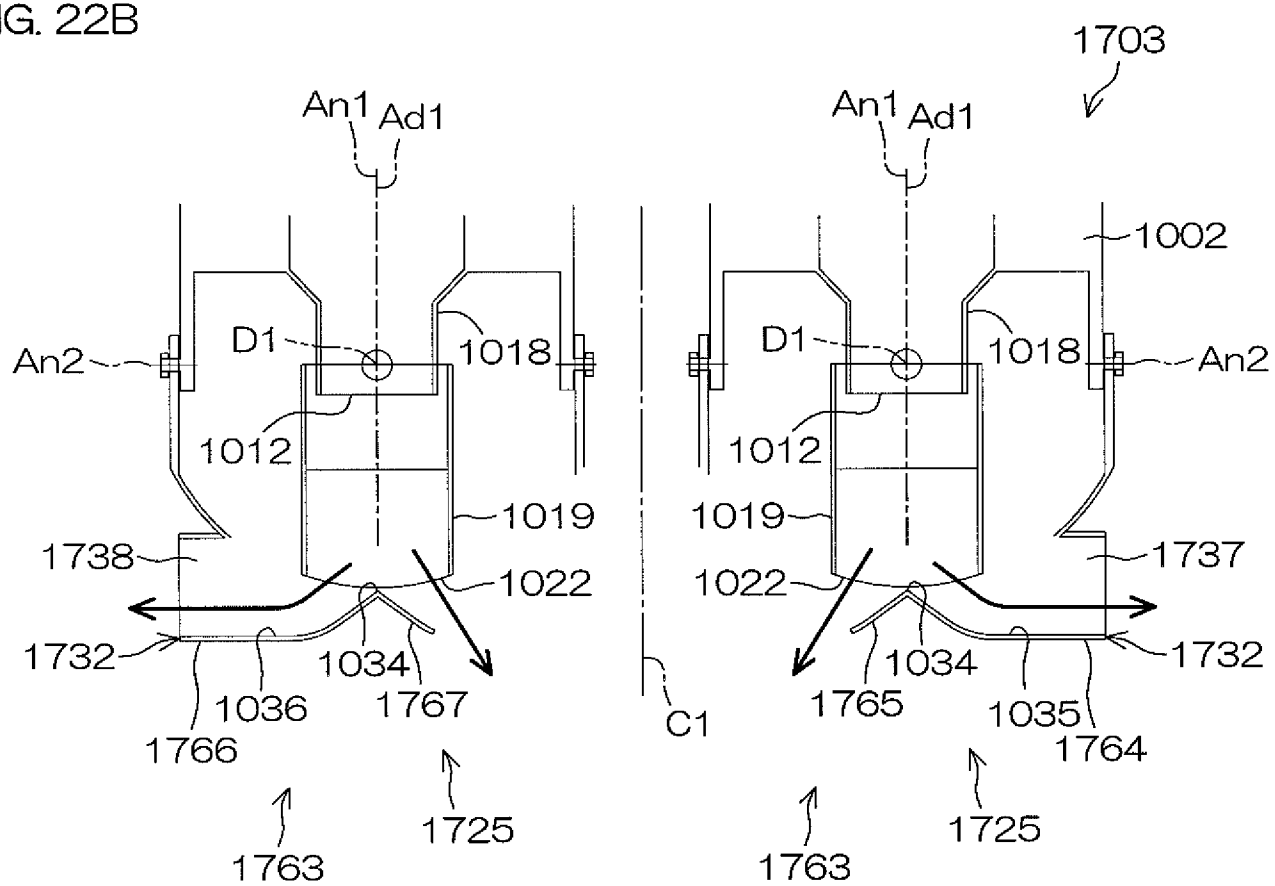
FIG. 22B is a schematic plan view of the vessel propulsion apparatus in a state in which a pair of F buckets are respectively positioned at the rear of a pair of deflectors and the pair of deflectors are positioned at straight drive positions.

FIG. 22A is a schematic perspective view of the buckets 1763 as viewed from an obliquely forward left upper side. FIG. 22B is a schematic plan view of the vessel propulsion apparatus 1703 in a state in which a pair of F buckets 1725 are respectively positioned at the rear of the pair of deflectors 1019 and the pair of deflectors 1019 are positioned at straight drive positions. In FIG. 22B, the vessel propulsion apparatus 1703 is shown in a transparent state. Thick line arrows shown in FIG. 22B indicate directions of water streams.

As shown in FIG. 22A, each bucket 1763 has a right/left asymmetrical shape. The right side bucket 1763 has a shape with which the shape of the left side bucket 1763 is right/left inverted. The pair of buckets 1763 are disposed right/left symmetrically with respect to the hull center C. The pair of buckets 1763 thus have a right/left symmetrical shape as a whole. Each bucket 1763 includes the R bucket 1524 according to the fifth preferred embodiment, the F bucket 1725 that guides water so as to generate a thrust in the forward drive direction, and the pair of right and left F arms 1033 that support the R bucket 1524 and the F bucket 1725.

As shown in FIG. 22A, the right side R bucket 1524 is disposed above the right side F bucket 1725. The right side R bucket 1524 and the right side F bucket 1725 are integrally rotatable around the rotation axis An2. Likewise, the left side R bucket 1524 is disposed above the left side F bucket 1725. The left side R bucket 1524 and the left side F bucket 1725 are integrally rotatable around the rotation axis An2. The F bucket 1725 may be integral with the R bucket 1524 defining the bucket 1763 as a unitary common structural member or may be a separate member from the R bucket 1524 that is fixed to the R bucket 1524.

As shown in FIG. 22B, each F bucket 1725 includes an F guide 1732 by which the water jetted rearward from the deflector 1019 is guided in one of either of a right guiding direction and a left guiding direction. Each F guide 1732 has a right/left asymmetrical shape. Water jetted rearward from the deflector 1019 is guided in the right guiding direction by the F guide 1732 of the right side bucket 1763 and water jetted rearward from the deflector 1019 is guided in the left guiding direction by the F guide 1732 of the left side bucket 1763.

As shown in FIG. 22B, the right side F guide 1732 includes the F apex portion 1034 disposed on the central axis Ad1 of the deflector 1019 positioned at the straight drive position and the F right guide 1035 extending obliquely rearward to the right from the F apex portion 1034. Further, the F guide 1732 includes a tubular right jetting portion 1764 coupled to a right end portion of the F right guide 1035 and a left auxiliary guide 1765 extending obliquely rearward to the left from the F apex portion 1034. A length in the right/left direction of the left auxiliary guide 1765 is shorter than that of the F right guide 1035. Water jetted rearward from the deflector 1019 is guided in the right guiding direction by the F right guide 1035. The right jetting portion 1764 defines an F right outlet 1737 by which water guided by the F right guide 1035 is jetted in the right guiding direction. In the seventh preferred embodiment, the right guiding direction is set, for example, to the right direction.

In likewise manner, the left side F guide 1732 includes the F apex portion 1034 disposed on the central axis Ad1 of the deflector 1019 positioned at the straight drive position and the F left guide 1036 extending obliquely rearward to the left from the F apex portion 1034. Further, the F guide 1732 includes a tubular left jetting portion 1766 coupled to a left end portion of the F left guide 1036 and a right auxiliary guide 1767 extending obliquely rearward to the right from the F apex portion 1034. A length in the left/right direction of the right auxiliary guide 1767 is shorter than that of the F left guide 1036. Water jetted rearward from the deflector 1019 is guided in the left guiding direction by the F left guide 1036. The left jetting portion 1766 defines an F left outlet 1738 by which water guided by the F left guide 1036 is jetted in the left guiding direction. In the seventh preferred embodiment, the left guiding direction is set, for example, to the left direction.

Figure 23A:
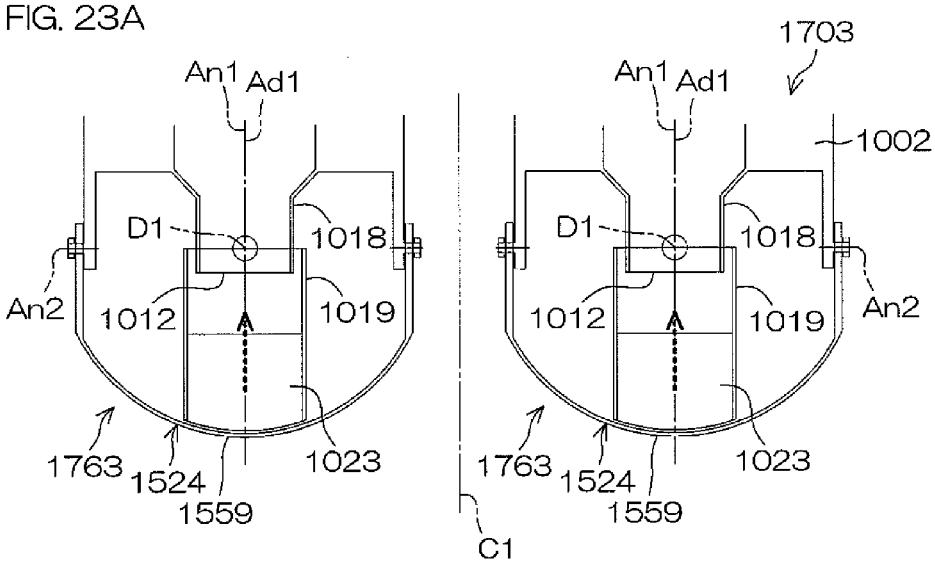
FIG. 23A is a schematic plan view for describing water flow in a state in which a pair of R buckets are respectively positioned at the rear of the pair of deflectors and the pair of deflectors are positioned at the straight drive positions.
Figure 23B:
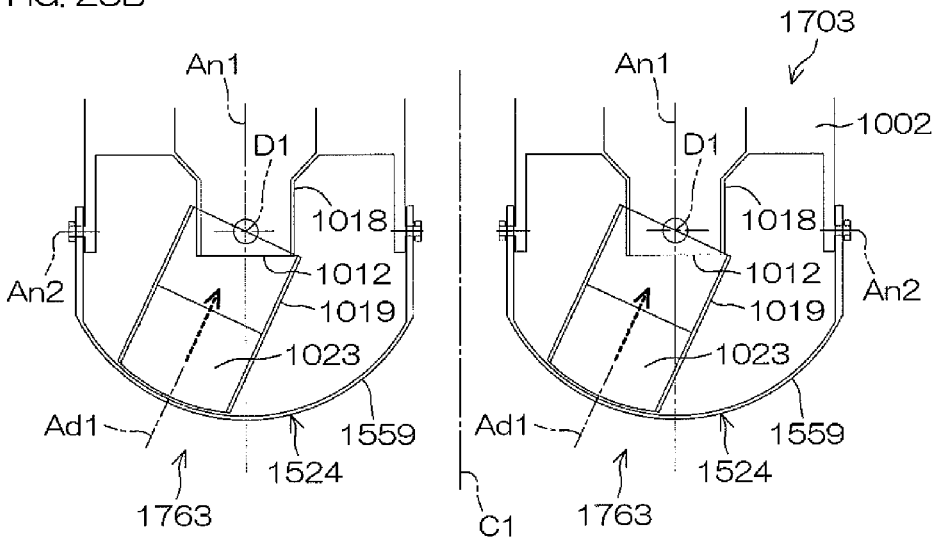
FIG. 23B is a schematic plan view for describing water flow in a state in which the pair of R buckets are respectively positioned at the rear of the pair of deflectors and the pair of deflectors are positioned at a left side.

FIG. 23A is a schematic plan view for describing water flow in a state in which the pair of R buckets 1524 are respectively positioned at the rear of the pair of deflectors 1019 and the pair of deflectors 1019 are positioned at the straight drive positions. FIG. 23B is a schematic plan view for describing water flow in a state in which the pair of R buckets 1524 are respectively positioned at the rear of the pair of deflectors 1019 and the pair of deflectors 1019 are positioned at a left side. In FIG. 23A and FIG. 23B, the vessel propulsion apparatus 1703 is shown in a transparent state. Thick line arrows shown in FIG. 23A and FIG. 23B indicate directions of water streams.

When, in the state in which the pair of deflectors 1019 are positioned at the straight drive positions, the pair of buckets 1763 are positioned at the reverse positions (corresponding to the closed position) as shown in FIG. 23A, the pair of R buckets 1524 are respectively positioned at the rear of the pair of deflectors 1019. The entire F outlets 1022 are thereby closed by the R guides 1559. Each R guide 1559 extends in the right/left direction along an arcuate locus along which the F outlet 1022 passes. Thus, as shown in FIG. 23A and FIG. 23B, regardless of which steering position the deflectors 1019 are positioned at, the state in which the entire F outlets 1022 are closed by the R guides 1559 is maintained.

Thus, in the state in which the pair of buckets 1763 are positioned at the reverse positions, the water flowing respectively into the deflectors 1019 from the nozzles 1018 is guided by the R guides 1559 regardless of which steering position the deflectors 1019 are positioned at. The water flowing into the two deflectors 1019 is thereby respectively jetted forward from the two R outlets 1023. Water is thus jetted in the same direction from the two deflectors 1019, thereby forming two water streams flowing forward in parallel. A thrust in the reverse drive direction is thereby generated.

Figure 24A:
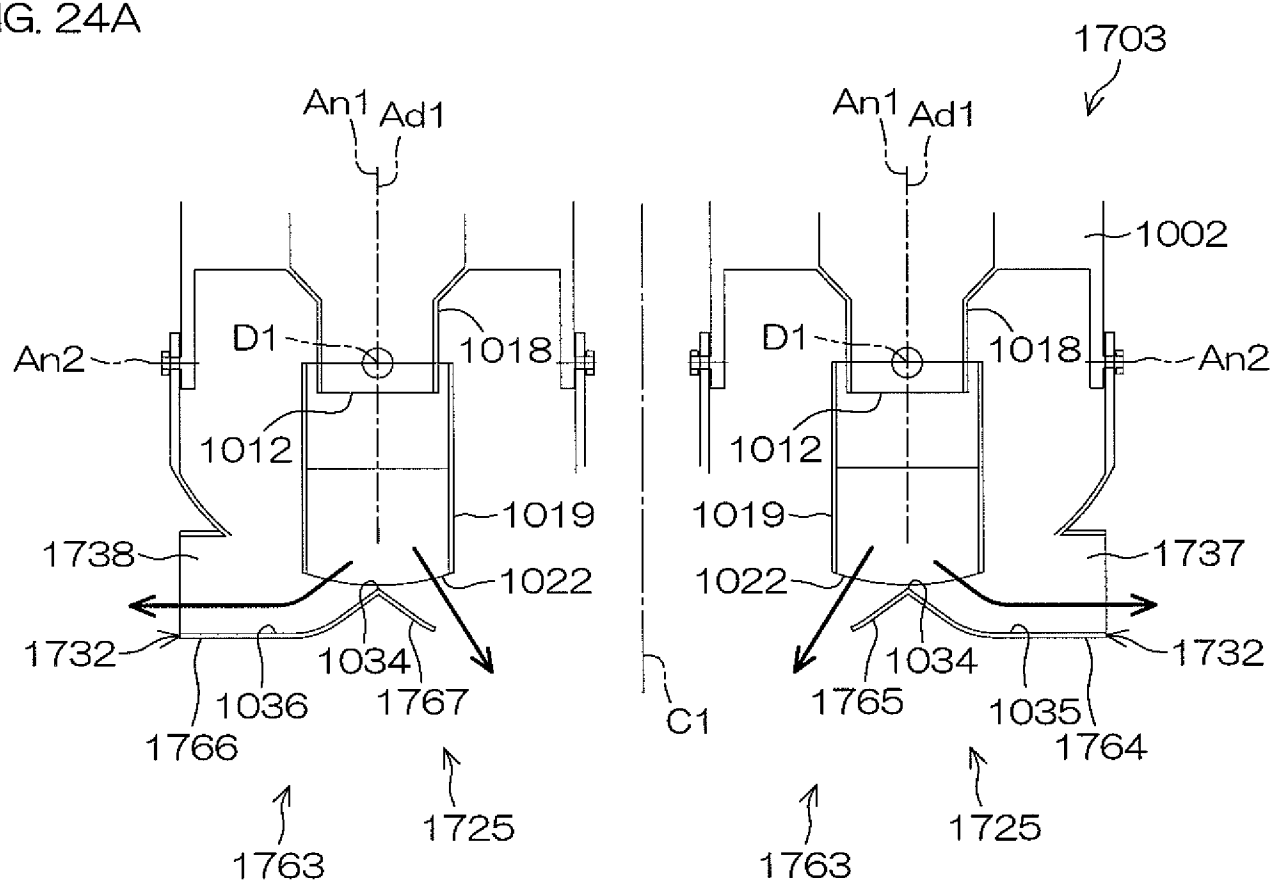
FIG. 24A is a schematic plan view for describing water flow in a state in which the pair of F buckets are respectively positioned at the rear of the pair of deflectors and the pair of deflectors are positioned at the straight drive positions.
Figure 24B:
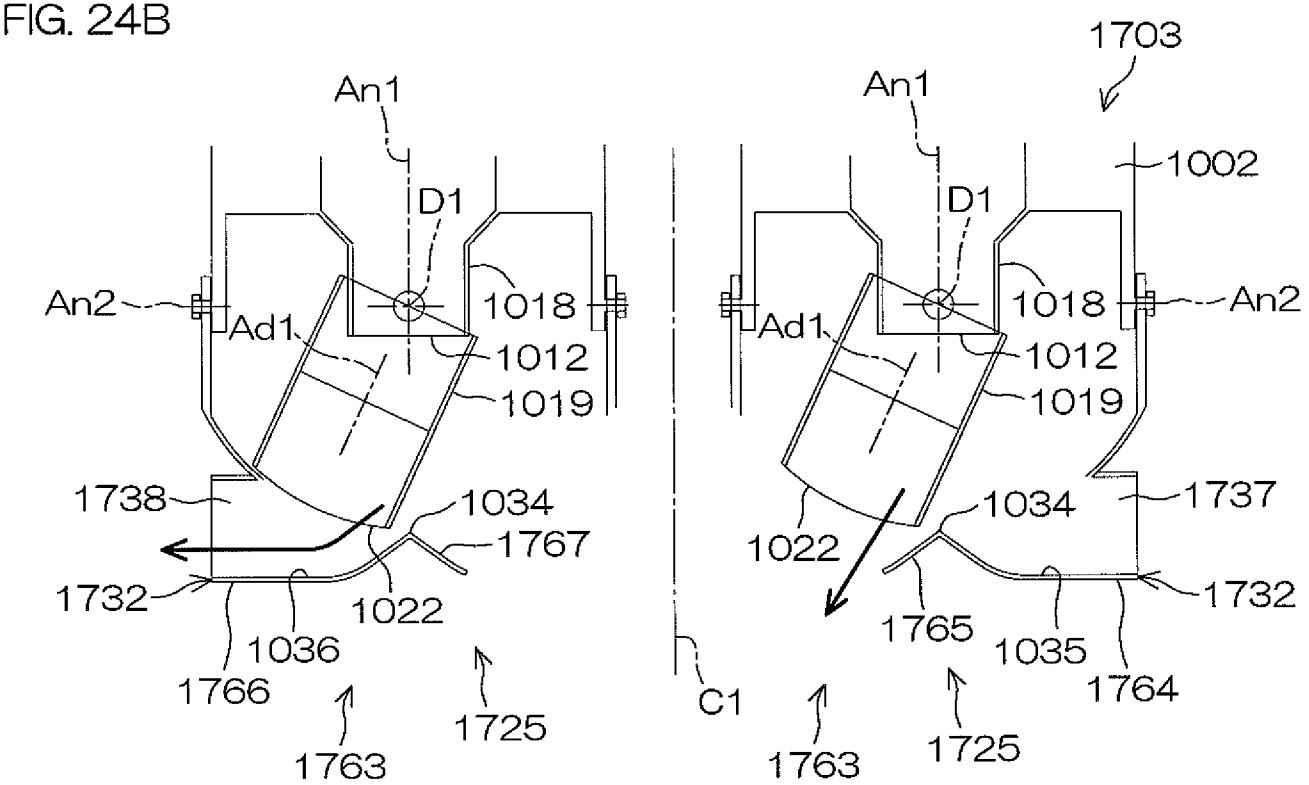
FIG. 24B is a schematic plan view for describing water flow in a state in which the pair of F buckets are respectively positioned at the rear of the pair of deflectors and the pair of deflectors are positioned at a left side.

FIG. 24A is a schematic plan view for describing water flow in a state in which the pair of F buckets 1725 are respectively positioned at the rear of the pair of deflectors 1019 and the pair of deflectors 1019 are positioned at the straight drive positions. FIG. 24B is a schematic plan view for describing water flow in a state in which the pair of F buckets 1725 are respectively positioned at the rear of the pair of deflectors 1019 and the pair of deflectors 1019 are positioned at the left side. In FIG. 24A and FIG. 24B, the vessel propulsion apparatus 1703 is shown in a transparent state. Thick line arrows shown in FIG. 24A and FIG. 24B indicate directions of water streams.

As shown in FIG. 24A, in a state in which the pair of buckets 1763 are positioned between the closed positions and the opened positions, the F guides 1732 face the F outlets 1022. When water is jetted rearward from the nozzles 1018 in the state in which the pair of buckets 1763 are positioned between the closed positions and the opened positions and the pair of deflectors 1019 are positioned at the straight drive positions, right branch streams and left branch streams have an equal flow rate.

Specifically, as shown in FIG. 24A, water that flows to the right side relative to the F apex portion 1034 inside the right side deflector 1019 is guided in the right guiding direction by the F right guide 1035 and jetted in the right guiding direction from the F right outlet 1737. Also, water that flows to the left side relative to the F apex portion 1034 inside the right side deflector 1019 is guided by the left auxiliary guide 1765 in a left intermediate direction between the direction of jetting of water from the F outlet 1022 and the left direction and is jetted in the left intermediate direction from the bucket 1763. Aright branch stream flowing in the right guiding direction and a left intermediate branch stream flowing in the left intermediate direction are thereby generated.

Meanwhile, as shown in FIG. 24A, water that flows to the left side relative to the F apex portion 1034 inside the left side deflector 1019 is guided in the left guiding direction by the F left guide 1036 and jetted in the left guiding direction from the F left outlet 1738. Also, water that flows to the right side relative to the F apex portion 1034 inside the left side deflector 1019 is guided by the right auxiliary guide 1767 in a right intermediate direction between the direction of jetting of water from the F outlet 1022 and the right direction and is jetted in the right intermediate direction from the bucket 1763. A left branch stream flowing in the left guiding direction and a right intermediate branch stream flowing in the right intermediate direction are thereby generated.

Thus, in the state in which each deflector 1019 is positioned at the straight drive position, the water jetted from the right side F outlet 1022 is divided to the right and left at equal flow rates and the right branch stream and the left intermediate branch stream have an equal flow rate. Further, in this state, the water jetted from the left side F outlet 1022 is divided to the right and left at equal flow rates and the left branch stream and the right intermediate branch stream have an equal flow rate. The flow rate of water flowing into the right side deflector 1019 from the right side nozzle 1018 and the flow rate of the water flowing into the left side deflector 1019 from the left side nozzle 1018 are equal. The right branch stream and the left branch stream have equal flow rates.

Also, as shown in FIG. 24B, in the state in which the pair of buckets 1763 are positioned between the closed positions and the opened positions and the pair of deflectors 1019 are positioned at the left side, the left branch stream has a greater flow rate than the right branch stream. Specifically, in this state, the flow rate of water flowing to the left side relative to the F apex portion 1034 in the right side deflector 1019 is greater than the flow rate of water flowing to the right side relative to the F apex portion 1034 in the right side deflector 1019. The flow rate of the right branch stream is thus decreased in comparison to the state in which the deflector 1019 is positioned at the straight drive position. Particularly, in a state in which the deflector 1019 is positioned at the left maximum steering position, all of the water jetted from the right side F outlet 1022 is guided in the left intermediate direction and the right branch stream is not generated.

Further, in the above state, the flow rate of water flowing to the left side relative to the F apex portion 1034 in the left side deflector 1019 is greater than the flow rate of water flowing to the right side relative to the F apex portion 1034 in the left side deflector 1019. The flow rate of the left branch stream is thus increased in comparison to the state in which the deflector 1019 is positioned at the straight drive position. Particularly, in the state in which the deflector 1019 is positioned at the left maximum steering position, all of the water jetted from the left side F outlet 1022 is guided in the left guiding direction and only the left branch stream is generated.

Thus, in the state in which the pair of deflectors 1019 are positioned at the left side, the left branch stream has a greater flow rate than the right branch stream. A forward drive direction thrust that turns the hull 1002 leftward is thus generated.

When the pair of deflectors 1019 are oppositely positioned at the right side, the right branch stream has a greater flow rate than the left branch stream. A forward drive direction thrust that turns the hull 1002 rightward is thus generated.

FIG. 25A to FIG. 25E are schematic side views for describing an example of a relationship of the position of the lever 1006 and the positions of the R bucket 1524 and the F bucket 1725. In FIG. 25A to FIG. 25E, the vessel propulsion apparatus 1703 is shown in a transparent state. Thick line arrows shown in FIG. 25A to FIG. 25E indicate directions of water streams. The position of the R bucket 1524 shown in FIG. 25A is the closed position of the R bucket 1524, and the position of the R bucket 1524 shown in FIG. 25D is the opened position of the R bucket 1524. The position of the F bucket 1725 shown in FIG. 25C is the closed position of the F bucket 1725, and the position of the F bucket 1725 shown in FIG. 25E is the opened position of the F bucket 1725.

In a state in which the lever 1006 (see FIG. 1) is positioned in the R region, the ECU 1004 (see FIG. 1) positions the pair of buckets 1763 at reverse positions (corresponding to the closed position) as shown in FIG. 25A. The reverse positions are positions at which the R buckets 1524 close the entire F outlets 1022. Thus, in this state, the water flowing into the deflectors 1019 from the nozzles 1018 is jetted forward and obliquely downward from the R outlets 1023 of the deflectors 1019.

As shown in FIG. 25B, in a state in which the lever 1006 is positioned in the N region, the ECU 1004 positions the pair of buckets 1763 at neutral positions. The neutral positions are positions at the opened position side relative to the reverse positions, and at each of these positions, only a portion of the F outlet 1022 is closed by the R bucket 1524 and the remaining portion of the F outlet 1022 faces the F bucket 1725. Thus, in this state, a portion of the water flowing into each deflector 1019 from the nozzle 1018 is jetted forward and obliquely downward from the R outlet 1023 of the deflector 1019. The remaining portion is guided by the F bucket 1725.

In a state in which the lever 1006 is positioned in the low speed region (position inside the F region), the ECU 1004 positions the pair of buckets 1763 at low speed positions as shown in FIG. 25C. The low speed positions are positions at the opened position side relative to the neutral positions, and at each of these positions, only a portion of the F outlet 1022 is closed by the R bucket 1524 and the remaining portion of the F outlet 1022 faces the F bucket 1725. The opening area of the F outlet 1022 at the low speed position is greater than the opening area at the neutral position. A thrust having a greater front direction component than that generated when the lever 1006 is positioned in the N region is thus generated.

In a state in which the lever 1006 is positioned in the medium speed region (position inside the F region), the ECU 1004 positions the pair of buckets 1763 at medium speed positions as shown in FIG. 25D. The medium speed positions are positions at the opened position side relative to the low speed positions, and at each of these positions, the entire F outlet 1022 is open and only a portion of the F outlet 1022 faces the F bucket 1725. Thus, in this state, all of the water flowing into the deflector 1019 from the nozzle 1018 is jetted rearward from the F outlet 1022. A portion of the jetted water passes below the bucket 1763. The remaining portion is guided by the F bucket 1725. A thrust having a greater front direction component than that generated when the lever 1006 is positioned in the low speed region is thus generated.

In a state in which the lever 1006 is positioned in the high speed region (position inside the F region), the ECU 1004 positions the pair of buckets 1763 at high speed positions (corresponding to the opened position) as shown in FIG. 25E. At each of the high speed positions, the entire F outlet 1022 is open and the F bucket 1725 does not face the F outlet 1022. Thus, all of the water flowing into the deflector 1019 from the nozzle 1018 passes below the bucket 1763. A thrust having a greater front direction component than that generated when the lever 1006 is positioned in the medium speed region is thus generated.

Eighth Preferred Embodiment

An eighth preferred embodiment of the present invention shall now be described. In FIG. 26A to FIG. 30E below, elements and components equivalent to those shown in FIG. 1 to FIG. 25E are provided with the same reference symbols as in FIG. 1, etc., and description thereof shall be omitted.

Figure 26A:
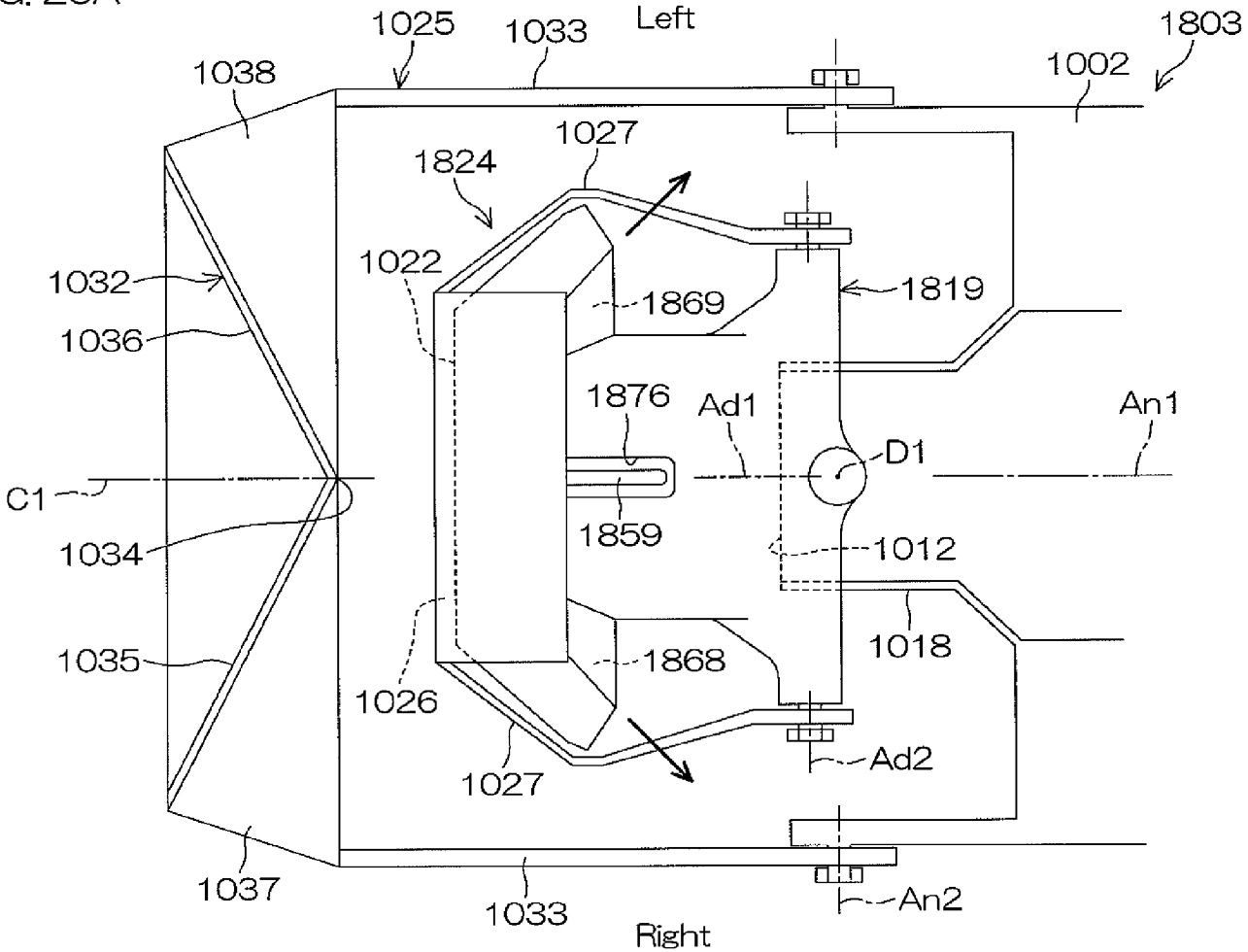
FIG. 26A is a schematic plan view of a vessel propulsion apparatus according to an eighth preferred embodiment of the present invention.
Figure 26B:
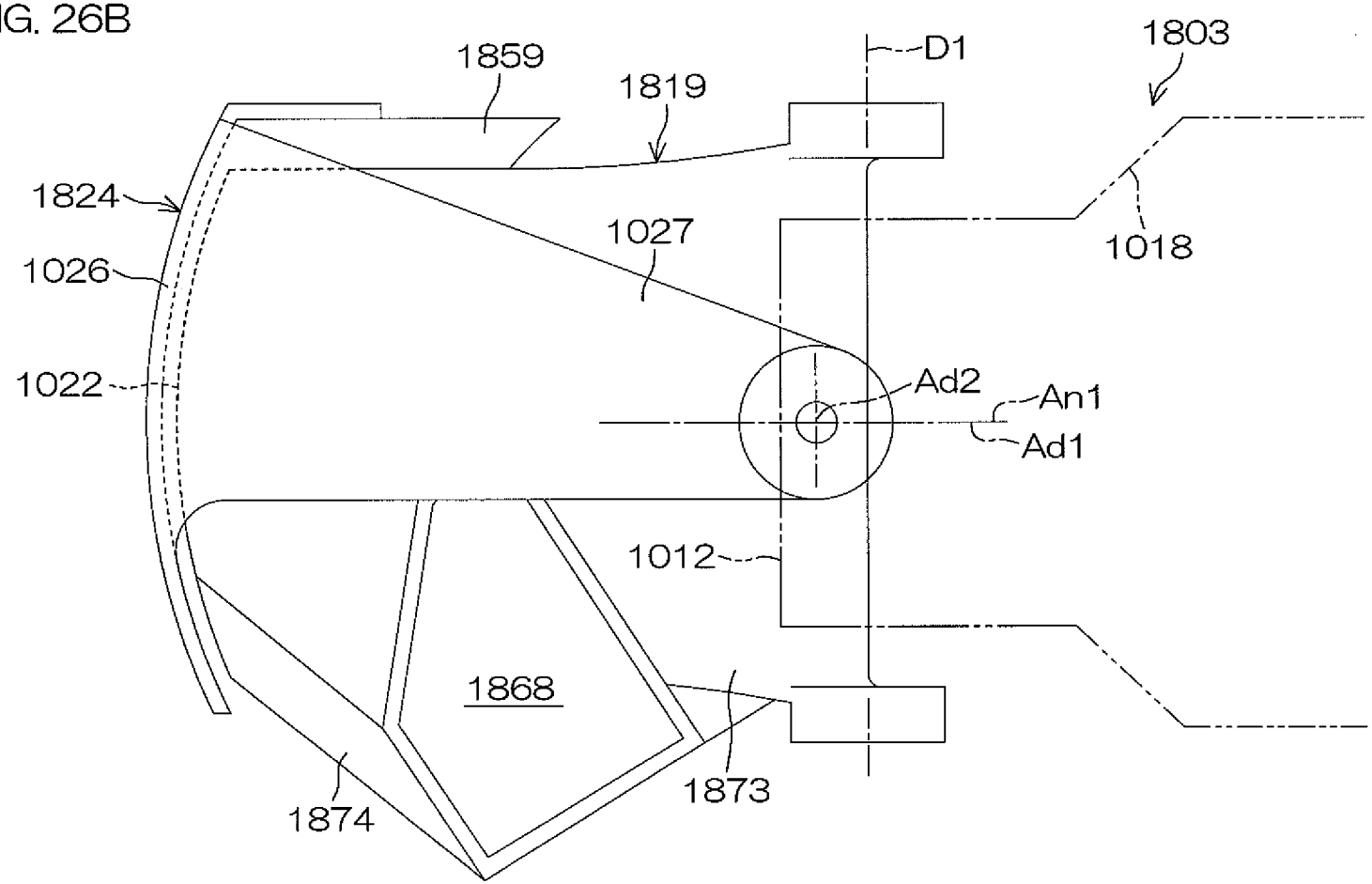
FIG. 26B is a schematic side view of the vessel propulsion apparatus according to the eighth preferred embodiment of the present invention.

FIG. 26A is a schematic plan view of a vessel propulsion apparatus 1803 according to the eighth preferred embodiment of the present invention. FIG. 26B is a schematic side view of the vessel propulsion apparatus 1803 according to the eighth preferred embodiment of the present invention. The thick line arrows shown in FIG. 26A indicate directions of water streams. In FIG. 26B, illustration of the F bucket 1025 is omitted.

With the exception of the deflector and R bucket, the vessel propulsion apparatus 1803 according to the eighth preferred embodiment preferably has the same arrangement as the vessel propulsion apparatus 1003 according to the first preferred embodiment. That is, the vessel propulsion apparatus 1803 includes a deflector 1819 and an R bucket 1824 in place of the deflector 1019 and the R bucket 1024 according to the first preferred embodiment.

The deflector 1819 has a tubular shape extending rearward from the nozzle 1018. The outlet 1012 of the nozzle 1018 is disposed inside the deflector 1819. The deflector 1819 defines an F outlet 1022 that is opened rearward, an R right outlet 1868 that is opened obliquely forward to the right, and an R left outlet 1869 that is opened obliquely forward to the left. The F outlet 1022 is disposed at the rear of the outlet 1012, and the R right outlet 1868 and the R left outlet 1869 are disposed further in front than the F outlet 1022. The R right outlet 1868 and the R left outlet 1869 are disposed right/left symmetrically with respect to the central axis Ad1 of the deflector 1819. The R right outlet 1868 jets water in an obliquely forward right direction and the R left outlet 1869 jets water in an obliquely forward left direction. The obliquely forward right direction is a direction with which the obliquely forward left direction is right/left inverted.

The R bucket 1824 is rotatable up and down around the rotation axis Ad2 and between a closed position at which the R bucket 1824 covers the entire F outlet 1022 in a rear view and an opened position at which the R bucket 1824 does not cover the F outlet 1022 in a rear view. When water is jetted rearward from the nozzle 1018 in a state in which the F outlet 1022 is not covered by the R bucket 1824, the water flowing into the deflector 1819 is jetted rearward from the F outlet 1022. A forward drive direction thrust is thereby generated. On the other hand, when water is jetted rearward from the nozzle 1018 in a state in which the F outlet 1022 is covered by the R bucket 1824, the water flowing into the deflector 1819 is jetted forward from at least one of either of the R right outlet 1868 and the R left outlet 1869. A reverse drive direction thrust is thereby generated.

The deflector 1819 is coupled to the nozzle 1018 in a manner enabling rotation to the right and left around the D axis D1. The nozzle 1018 is fixed to the hull 1002 and does not move with respect to the hull 1002. The deflector 1819 is thus rotatable around the D axis D1 with respect to the nozzle 1018. The deflector 1819 is rotated to the right or left around the D axis D1 in accordance with operation of the handle 1005 (see FIG. 1) by the vessel operator. When the deflector 1819 is rotated to the right or left around the D axis D1, the jetting direction of water jetted from the deflector 1819 is changed to the right or left.

The deflector 1819 is rotatable around the D axis D1 and between a right maximum steering position and a left maximum steering position. The deflector 1819 is rotatable to the right and left with respect to the nozzle 1018 with a straight drive position, intermediate the right maximum steering position and the left maximum steering position, as a center. The deflector 1819 is coupled to the handle 1005 (see FIG. 1) via the steering cable 1007 (see FIG. 1). The position of the deflector 1819 is associated with the position of the handle 1005. For example, when the handle 1005 is positioned at the right maximum steering position, the deflector 1819 is positioned at the right maximum steering position.

Figure 27A:
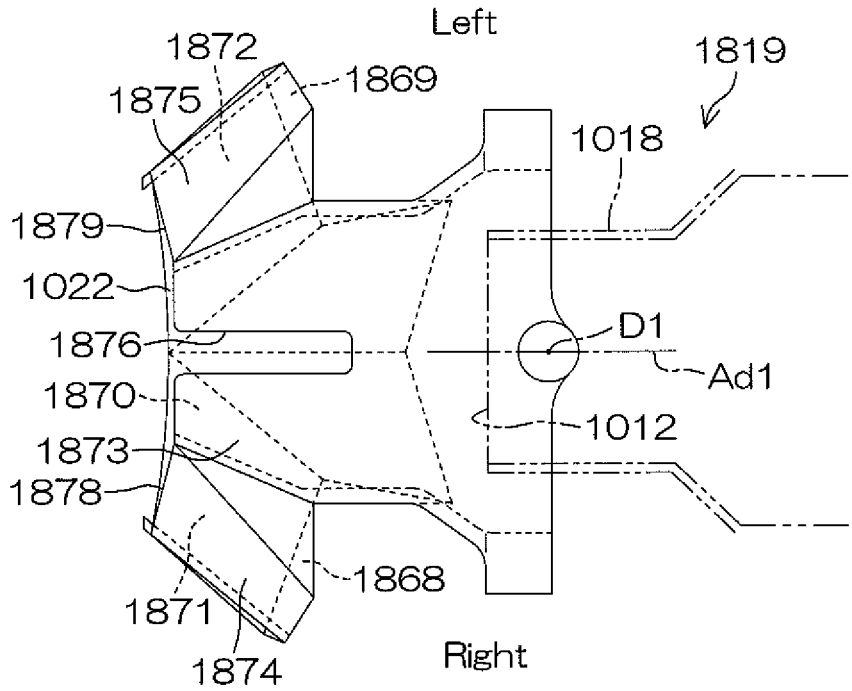
FIG. 27A is a schematic plan view of a deflector.
Figure 27B:
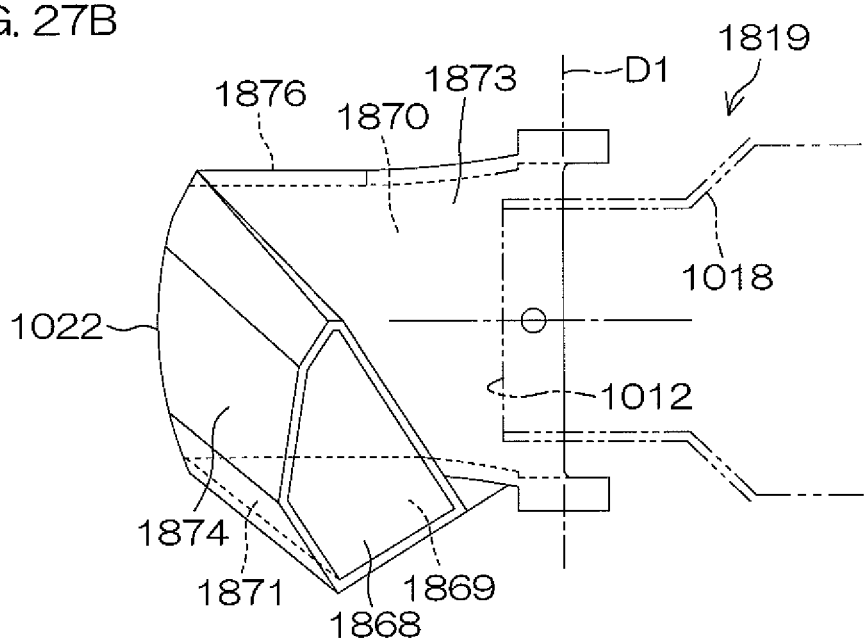
FIG. 27B is a schematic side view of the deflector.
Figure 27C:
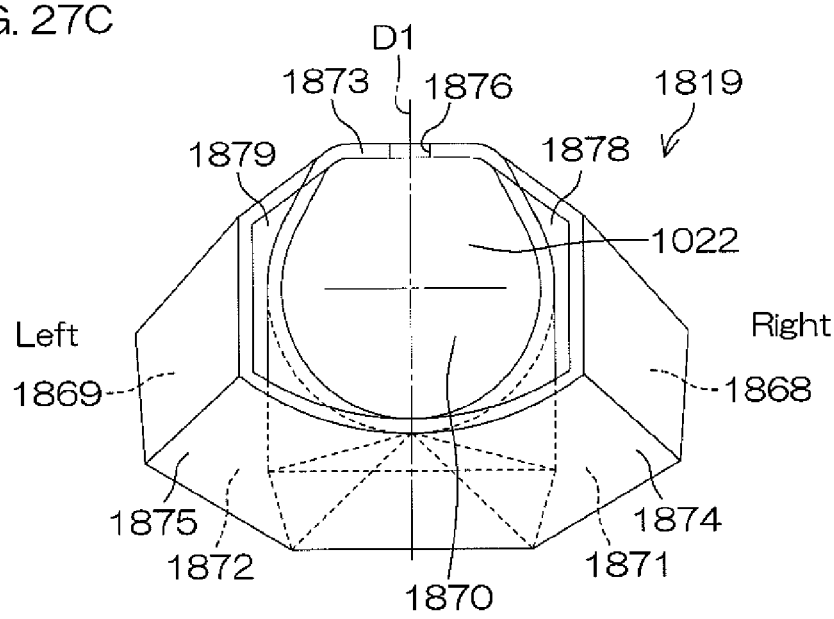
FIG. 27C is a schematic rear view of the deflector.

FIG. 27A is a schematic plan view of the deflector 1819. FIG. 27B is a schematic side view of the deflector 1819. FIG. 27C is a schematic rear view of the deflector 1819.

As shown in FIG. 27A, the deflector 1819 includes a main flow passage 1870 by which water jetted from the nozzle 1018 is guided rearward toward the F outlet 1022. Further, the deflector 1819 includes a right flow passage 1871 extending obliquely forward and downward to the right from the main flow passage 1870 to the R right outlet 1868 and a left flow passage 1872 extending obliquely forward and downward to the left from the main flow passage 1870 to the R left outlet 1869. The deflector 1819 includes a central tubular portion 1873 extending along the central axis Ad1 of the deflector 1819, a right tubular portion 1874 disposed at the right side relative to the central tubular portion 1873, and a left tubular portion 1875 disposed at the left side relative to the central tubular portion 1873. The main flow passage 1870, the right flow passage 1871, and the left flow passage 1872 are defined by the central tubular portion 1873, the right tubular portion 1874, and the left tubular portion 1875, respectively.

As shown in FIG. 27A, the main flow passage 1870 is right/left symmetrical. The right flow passage 1871 has a shape with which the left flow passage 1872 is right/left inverted, and the right flow passage 1871 and the left flow passage 1872 are respectively disposed right/left symmetrically at the right and left sides of the main flow passage 1870. In a plan view, the right flow passage 1871 and the left flow passage 1872 extend in a V-shape so as to spread forward from a rear end of the main flow passage 1870. The right flow passage 1871 may be a flow passage that branches from the main flow passage 1870 or may be a flow passage that is independent of the main flow passage 1870 (a flow passage that is not continuous with the main flow passage 1870). The same applies to the left flow passage 1872.

As shown in FIG. 27A, the central tubular portion 1873 extends rearward from the nozzle 1018. The central tubular portion 1873 includes an upper wall including a slit 1876. The slit 1876 extends forward from a rear end of the central tubular portion 1873. The slit 1876 extends along the central axis Ad1 of the deflector 1819 in a plan view. A front end portion of the central tubular portion 1873 is coupled to the nozzle 1018. The front end portion of the central tubular portion 1873 is rotatable to the right and left around the D axis D1 with respect to the nozzle 1018. The right tubular portion 1874 and the left tubular portion 1875 rotate to the right and left around the D axis D1 together with the central tubular portion 1873. The right tubular portion 1874 may be a member integral with the central tubular portion 1873 or may be a separate member from the central tubular portion 1873 that is fixed to the central tubular portion 1873. The same applies to the left tubular portion 1875.

As shown in FIG. 27A and FIG. 27C, the central tubular portion 1873 is right/left symmetrical. The right tubular portion 1874 has a shape with which the left tubular portion 1875 is right/left inverted and the right tubular portion 1874 and the left tubular portion 1875 are respectively disposed right/left symmetrically at the right and left sides of the central tubular portion 1873. As shown in FIG. 27A, the right tubular portion 1874 extends obliquely forward and downward to the right from a right side of a rear end portion of the central tubular portion 1873. The front end of the right tubular portion 1874 is disposed further to the rear than a front end of the central tubular portion 1873. Likewise, the left tubular portion 1875 extends obliquely forward and downward to the left from a left side of the rear end portion of the central tubular portion 1873. The front end of the left tubular portion 1875 is disposed further to the rear than the front end of the central tubular portion 1873.

As shown in FIG. 27A, the front end and the rear end of the central tubular portion 1873 are open. The outlet 1012 of the nozzle 1018 is disposed inside the central tubular portion 1873. As shown in FIG. 27C, a rear end of the right tubular portion 1874 is opened at a right side of the F outlet 1022, and a rear end of the left tubular portion 1875 is opened at a left side of the F outlet 1022. The rear end of the right tubular portion 1874 defines a right inlet 1878 that is opened rearward at the right side of the F outlet 1022, and the rear end of the left tubular portion 1875 defines a left inlet 1879 that is opened rearward at the left side of the F outlet 1022.

Also, as shown in FIG. 27A, the front end of the right tubular portion 1874 is opened at a position further forward than the rear end of central tubular portion 1873, and the front end of the left tubular portion 1875 is opened at a position further forward than the rear end of central tubular portion 1873. The front end of the right tubular portion 1874 defines the R right outlet 1868 and the front end of the left tubular portion 1875 defines the R left outlet 1869. The rear end of the central tubular portion 1873 defines the F outlet 1022. As shown in FIG. 27B, an upper end of the F outlet 1022 is disposed above the R right outlet 1868 and the R left outlet 1869, and a lower end of the F outlet 1022 is disposed at a height between upper ends and lower ends of the R right outlet 1868 and the R left outlet 1869.

Figure 28A:
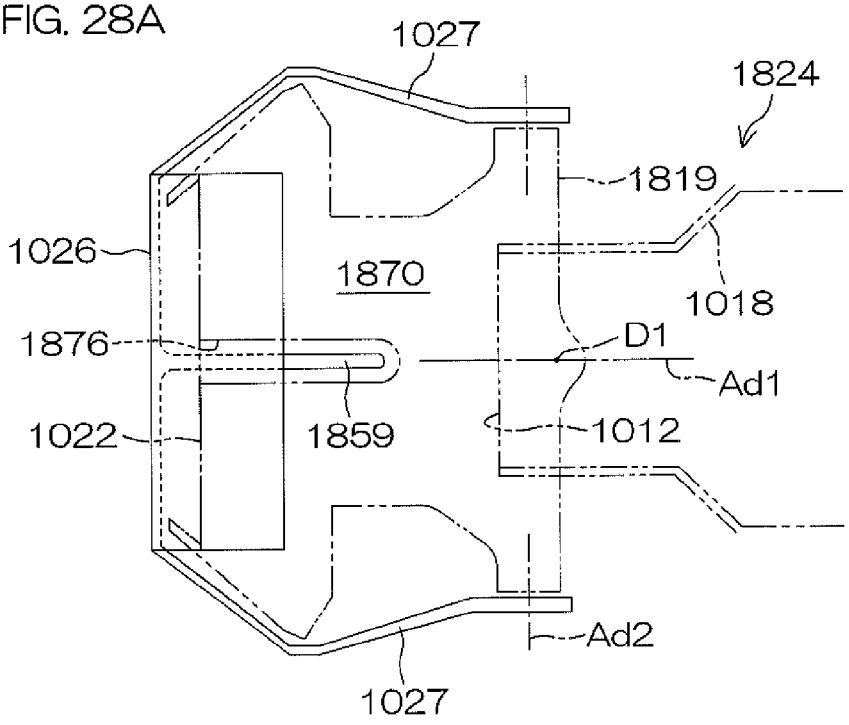
FIG. 28A is a schematic plan view of an R bucket.
Figure 28B:
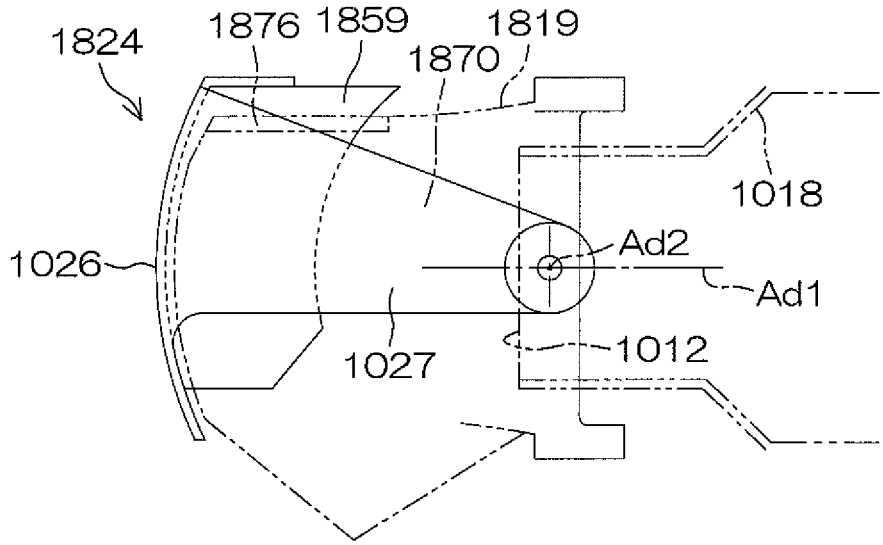
FIG. 28B is a schematic side view of the R bucket.
Figure 28C:
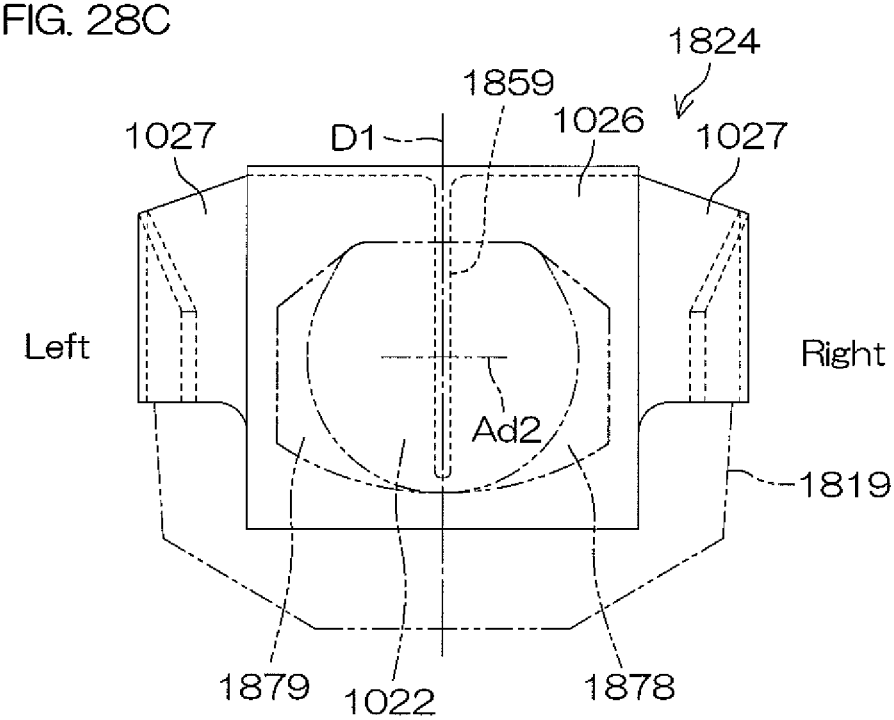
FIG. 28C is a schematic rear view of the R bucket.

FIG. 28A is a schematic plan view of the R bucket 1824. FIG. 28B is a schematic side view of the R bucket 1824. FIG. 28C is a schematic rear view of the R bucket 1824.

The R bucket 1824 is disposed in front of the F bucket 1025 (see FIG. 26A). As shown in FIG. 28A, the R bucket 1824 is coupled to the deflector 1819. The R bucket 1824 rotates right and left around the D axis D1 together with the deflector 1819. The R bucket 1824 is right/left symmetrical. The R bucket 1824 includes the lid portion 1026 that opens and closes the F outlet 1022, the pair of right and left R arms 1027 that support the lid portion 1026, and a plate-shaped R guide 1859 that extends forward from the lid portion 1026. The pair of R arms 1027 are disposed across an interval in the right/left direction. The pair of R arms 1027 extend forward from the right end portion and the left end portion of the lid portion 1026. The front end portion of each R arm 1027 is coupled to the deflector 1819. The front end portion of each R arm 1027 is rotatable up and down with respect to the deflector 1819 around the rotation axis Ad2. The R bucket 1824 is thus rotatable up and down with respect to the deflector 1819 around the rotation axis Ad2. The rotation axis Ad2 is an axis that is fixed with respect to the deflector 1819.

The R bucket 1824 is rotatable up and down around the rotation axis Ad2 with respect to the deflector 1819 and between a closed position and an opened position. As shown in FIG. 28C, in a state in which the R bucket 1824 is positioned at the closed position, the entire F outlet 1022 is covered by the lid portion 1026. Further, in this state, the entire right inlet 1878 and left inlet 1879 are also covered by the lid portion 1026. On the other hand, in a state in which the R bucket 1824 is positioned at the opened position, the entire lid portion 1026 is positioned above the F outlet 1022, the right inlet 1878, and the left inlet 1879 (see FIG. 30E). The entire F outlet 1022, right inlet 1878, and left inlet 1879 are thus open.

As shown in FIG. 28, the R guide 1859 is a plate-shaped member that extends forward from the lid portion 1026. The R guide 1859 is a portion of the R bucket 1824. The R guide 1859 rotates up and down around the rotation axis Ad2 together with the lid portion 1026. The R guide 1859 may be integral with the lid portion 1026 or may be a separate member from the lid portion 1026 that is fixed to the lid portion 1026. Also, the R guide 1859 does not have to be a portion of the R bucket 1824. For example, the R guide 1859 may be fixed to the deflector 1819 and does not have to rotate up and down together with the lid portion 1026 around the rotation axis Ad2.

As shown in FIG. 28A, the R guide 1859 extends forward from a width direction center of a front surface of the lid portion 1026. In a plan view, the R guide 1859 is disposed on the central axis Ad1 of the deflector 1819. A front end of the R guide 1859 is disposed further to the rear than the D axis D1 and the nozzle 1018. The R guide 1859 extends in the up/down direction. The R guide 1859 is thus supported by the lid portion 1026 in an upright attitude. The R guide 1859 enters into an interior (main flow passage 1870) of the central tubular portion 1873 through the F outlet 1022. Further, the R guide 1859 enters into the interior of the central tubular portion 1873 through the slit 1876. The R guide 1859 divides the F outlet 1022 and the main flow passage 1870 equally to the right and left.

As shown in FIG. 28B, the R guide 1859 is movable up and down inside the slit 1876. The R guide 1859 enters and exits the main flow passage 1870 through the slit 1876 (see FIG. 30C to FIG. 30E). That is, when the R bucket 1824 moves to the opened position side, the R guide 1859 moves to the upper side and a volume of a portion (portion of the R guide 1859) entering inside the main flow passage 1870 decreases. When the R bucket 1824 is positioned at the opened position, all or nearly all of the R guide 1859 is positioned outside the main flow passage 1870.

Figure 29A:
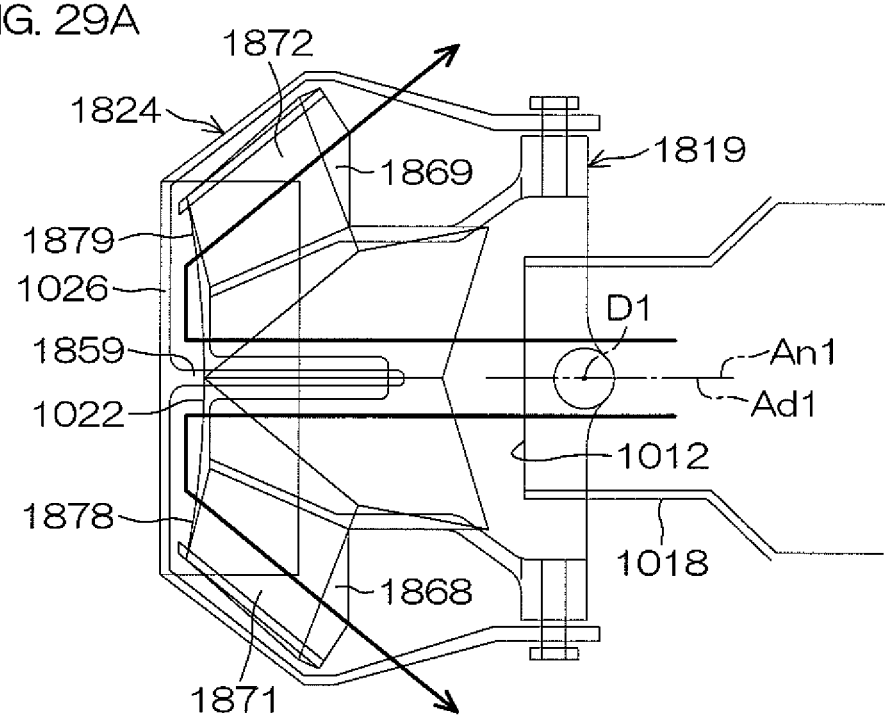
FIG. 29A is a schematic plan view for describing water flow in a state in which the R bucket is positioned at a closed position and the deflector is positioned at a straight drive position.
Figure 29B:
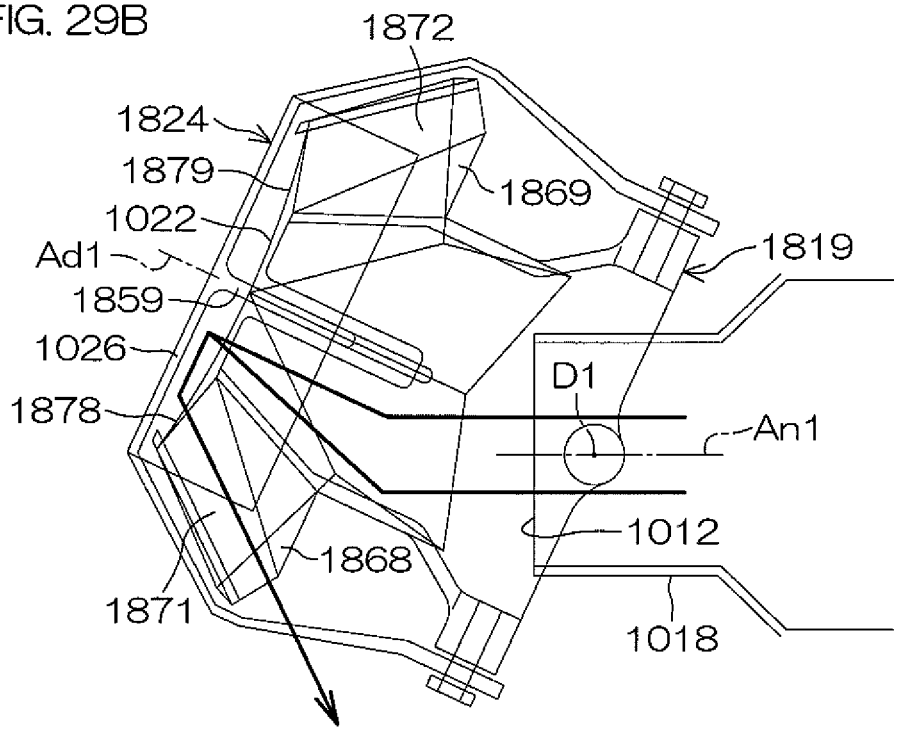
FIG. 29B is a schematic plan view for describing water flow in a state in which the R bucket is positioned at the closed position and the deflector is positioned at a left side.

FIG. 29A is a schematic plan view for describing water flow in a state in which the R bucket 1824 is positioned at a closed position and the deflector 1819 is positioned at a straight drive position. FIG. 29B is a schematic plan view for describing water flow in a state in which the R bucket 1824 is positioned at the closed position and the deflector 1819 is positioned at a left side. In FIG. 29A and FIG. 29B, the vessel propulsion apparatus 1803 is shown in a transparent state. Thick line arrows shown in FIG. 29A to FIG. 29B indicate directions of water streams.

As shown in FIG. 29A, in the state in which the R bucket 1824 is positioned at the closed position, the entire F outlet 1022, right inlet 1878, and left inlet 1879 are covered by the R bucket 1824. Further, in this state, the R guide 1859 enters inside the deflector 1819 and the interior of the deflector 1819 is partitioned to the right and left by the R guide 1859. Thus, when water is jetted rearward from the nozzle 1018, the water flowing inside the deflector 1819 is divided to the right and left at equal flow rates by the R guide 1859. Water flowing to the right side of the R guide 1859 is jetted rearward from the F outlet 1022 and thereafter guided by the lid portion 1026 to the right inlet 1878. Water thus flows into the right flow passage 1871 and water is jetted obliquely forward to the right and downward from the R right outlet 1868. Likewise, water flowing to the left side of the R guide 1859 flows through the F outlet 1022 and into the left flow passage 1872 and is jetted obliquely forward to the left and downward from the R left outlet 1869.

Thus, in the state in which the R bucket 1824 is positioned at the closed position and the deflector 1819 is positioned at the straight drive position, the water flowing into the deflector 1819 from the nozzle 1018 is divided to the right and left at equal flow rates by the R guide 1859. A right branch stream flowing in an obliquely forward right direction and a left branch stream flowing in an obliquely forward left direction are thus generated by the R bucket 1824. The R guide 1859 is disposed, in a plan view, on the central axis Ad1 of the deflector 1819. The R guide 1859 thus generates the left branch stream from the water stream flowing to the left side relative to the central axis Ad1 of the deflector 1819 and generates the right branch stream from the water stream flowing to the right side relative to the central axis Ad1 of the deflector 1819. The obliquely forward right direction is a direction with which the obliquely forward left direction is right/left inverted, and in the above state, the right branch stream and the left branch stream are equal in flow rate. Thus, in this state, the right direction component and the left direction component of thrust cancel each other out and only the rear direction component remains.

On the other hand, in the state in which the R bucket 1824 is positioned at the closed position and the deflector 1819 is positioned at the left side, the front end of the R guide 1859 is positioned at the left side relative to the central axis An1 of the nozzle 1018 as shown in FIG. 29B. Thus, a region of no less than about half of the outlet 1012 is positioned at the right side relative to the front end of the R guide 1859. Thus, when water is jetted rearward from the nozzle 1018 in this state, a large portion of the water flowing into the deflector 1819 from the nozzle 1018 is guided by the R guide 1859 to the right side relative to the R guide 1859. The water flowing to the right side of the R guide 1859 flows through the F outlet 1022 and into the right flow passage 1871 and is jetted obliquely forward to the right and downward from the R right outlet 1868.

Thus, in the state in which the R bucket 1824 is positioned at the closed position and the deflector 1819 is positioned at the left side, a large portion of the water flowing into the deflector 1819 from the nozzle 1018 is jetted in the obliquely forward right direction from the R right outlet 1868. The right branch stream has a greater flow rate than the left branch stream. A reverse drive direction thrust that turns the hull 1002 rightward is thus generated. In a state in which the deflector 1819 is oppositely positioned at the right side, the left branch stream has a greater flow rate than the right branch stream. A reverse drive direction thrust that turns the hull 1002 leftward is thus generated.

By using the R bucket 1824, water flowing rearward inside the deflector 1819 is changed forward in direction and thereafter jetted in at least one of either of the obliquely forward right direction and the obliquely forward left direction. The obliquely forward right direction and the obliquely forward left direction are directions that are symmetrical with respect to the central axis Ad1 of the deflector 1819. The tilt angles of the obliquely forward right direction and the obliquely forward left direction with respect to the central axis An1 of the nozzle 1018 change in accordance with the movement of the deflector 1819 around the D axis D1. However, at any steering position, the tilt angles of the obliquely forward right direction and the obliquely forward left direction are greater than the tilt angle of the central axis Ad1 of the deflector 1819 with respect to the central axis An1 of the nozzle 1018. A thrust having a greater right/left direction component is thus generated. A force of turning the vessel 1001 in the reverse drive state can thus be made large.

FIG. 30A to 30E are schematic side views for describing an example of a relationship of the position of the lever 1006 and the positions of the R bucket 1824 and the F bucket 1025. In FIG. 30A to FIG. 30E, the vessel propulsion apparatus 1803 is shown in a transparent state. Thick line arrows shown in FIG. 30A to FIG. 30E indicate directions of water streams.

In the state in which the lever 1006 (see FIG. 1) is positioned in the R region, the ECU 1004 (see FIG. 1) positions both the R bucket 1824 and the F bucket 1025 at the closed positions as shown in FIG. 30A. When the R bucket 1824 is positioned at the closed position, the F outlet 1022 of the deflector 1819 is closed and thus the water flowing into the deflector 1819 from the nozzle 1018 is jetted forward and obliquely downward from at least one of either of the R right outlet 1868 and the R left outlet 1869. A thrust in the reverse drive direction is thereby generated.

As shown in FIG. 30B, in a state in which the lever 1006 is positioned in the N region, the ECU 1004 positions the R bucket 1824 at an intermediate position between the opened position and the closed position and positions the F bucket 1025 at the closed position. When the R bucket 1824 is positioned at an intermediate position, only a portion of the F outlet 1022 is closed. Thus, a portion of the water flowing into the deflector 1819 from the nozzle 1018 is jetted forward and obliquely downward from at least one of either of the R right outlet 1868 and the R left outlet 1869. The remaining portion is guided in at least one of either of the right guiding direction and the left guiding direction by the F bucket 1025.

In a state in which the R bucket 1824 and the F bucket 1025 are positioned at an intermediate position and the closed position, respectively, and the deflector 1819 is positioned at the straight drive position, the right branch stream and the left branch stream flowing in the obliquely forward right direction and the obliquely forward left direction from the R bucket 1824 are generated. The flow rates of the right branch stream and the left branch stream are equal in this state and thus the right direction component of thrust and the left direction component of thrust cancel each other out and only the rear direction component of thrust remains.

Likewise, in the state in which the R bucket 1824 and the F bucket 1025 are positioned at the intermediate position and the closed position, respectively, and the deflector 1819 is positioned at the straight drive position, a right branch stream and a left branch stream flowing in the right guiding direction and the left guiding direction from the F bucket 1025 are generated. The flow rates of the right branch stream and the left branch stream are equal in this state and thus the right direction component of thrust and the left direction component of thrust cancel each other out and only the front direction component of thrust remains.

The position of the R bucket 1824 in the state in which the lever 1006 is positioned in the N region is set so that the front direction component of thrust and the rear direction component of thrust cancel each other out when the deflector 1819 is positioned at the straight drive position. Thus, in the state in which the R bucket 1824 and the F bucket 1825 are positioned at the intermediate position and the closed position, respectively, and the deflector 1819 is positioned at the straight drive position, no thrust (resultant force) in any direction is generated. On the other hand, in the state in which the deflector 1819 is positioned at the right side or the left side, a thrust having a right direction component or a left direction component is generated. Thus, in this state, a force that rotates the hull 1002 around the vertical axis passing through the hull 1002 is generated and the vessel 1001 turns on the spot.

In a state in which the lever 1006 is positioned in the low speed region (position inside the F region), the ECU 1004 positions the R bucket 1824 at the opened position and positions the F bucket 1025 at the closed position as shown in FIG. 30C. When the R bucket 1824 is positioned at the opened position, the entire F outlet 1022 of the deflector 1819 is opened and thus all of the water jetted from the F outlet 1022 is guided in at least one of either of the right guiding direction and the left guiding direction by the F bucket 1025. A thrust in the forward drive direction is thereby generated.

In a state in which the lever 1006 is positioned in the medium speed region (position inside the F region), the ECU 1004 positions the R bucket 1824 at the opened position and positions the F bucket 1025 at an intermediate position as shown in FIG. 30D. A portion of the water jetted rearward from the deflector 1819 is thus guided in at least one of either of the right guiding direction and the left guiding direction by the F bucket 1025. The remaining portion passes below the F bucket 1025 and flows rearward. A thrust in the forward drive direction having a greater rear direction component than that generated when the lever 1006 is positioned in the low speed region is thus generated.

In a state in which the lever 1006 is positioned in the high speed region (position inside the F region), the ECU 1004 positions both the R bucket 1824 and the F bucket 1025 at the opened positions as shown in FIG. 30E. All of the water jetted rearward from the deflector 1819 thus passes below the F bucket 1025 and flows rearward. A thrust in the forward drive direction having a greater rear direction component than that generated when the lever 1006 is positioned in the medium speed region is thus generated.

Ninth Preferred Embodiment

A ninth preferred embodiment of the present invention shall now be described. In FIG. 31 to FIG. 34D below, elements and components equivalent to those shown in FIG. 1 to FIG. 30E are provided with the same reference symbols as in FIG. 1, etc., and description thereof shall be omitted.

Figure 31:
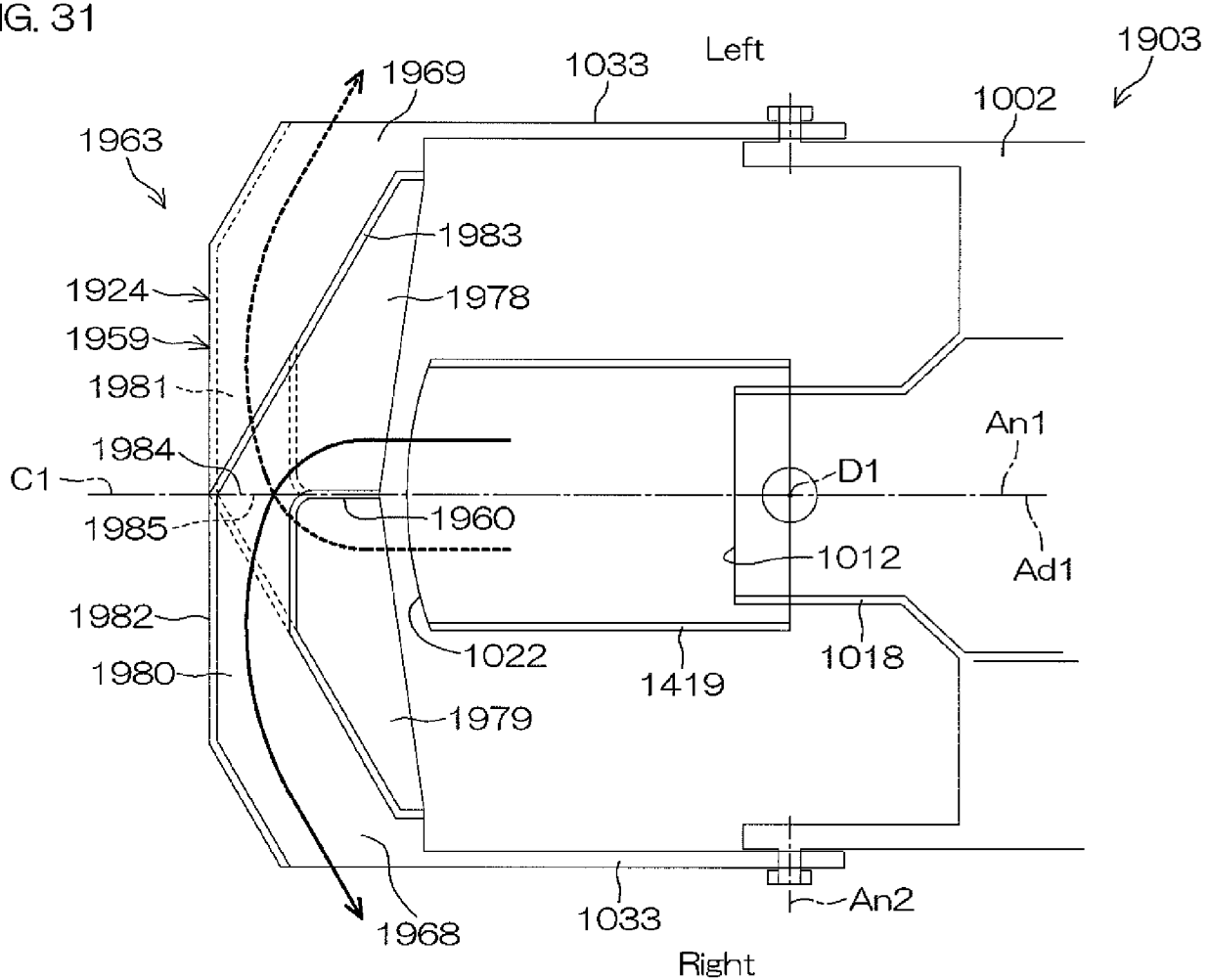
FIG. 31 is a schematic plan view of a vessel propulsion apparatus according to a ninth preferred embodiment of the present invention.
Figure 32A:
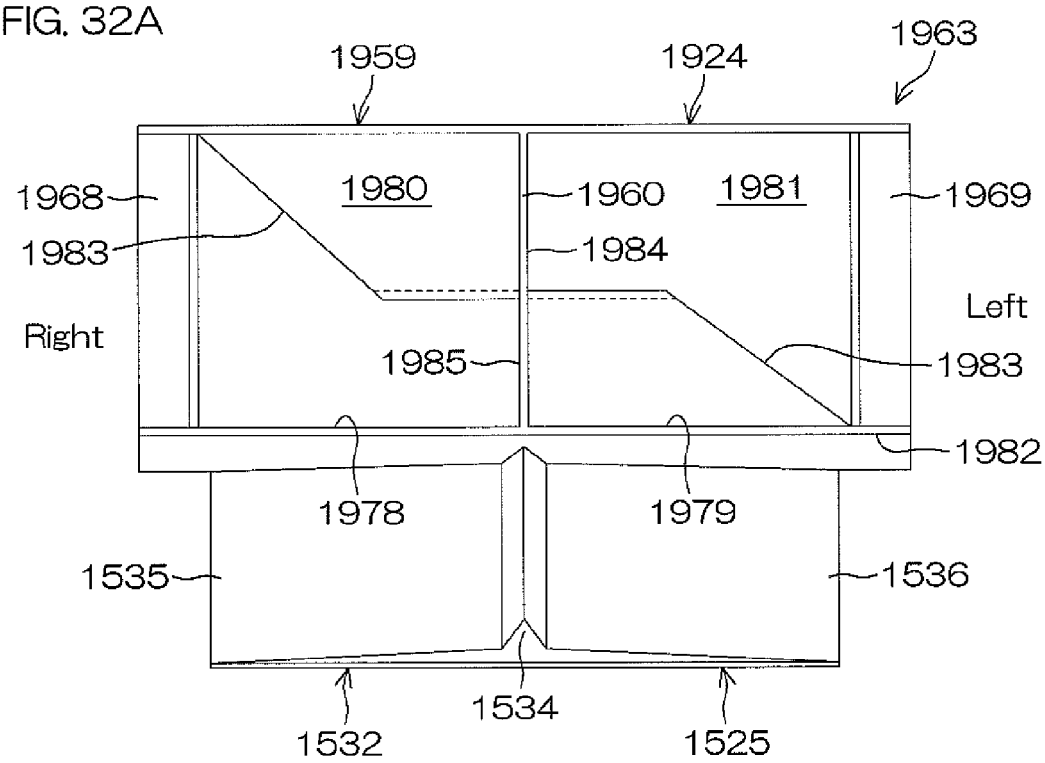
FIG. 32A is a schematic front view of a bucket.
Figure 32B:
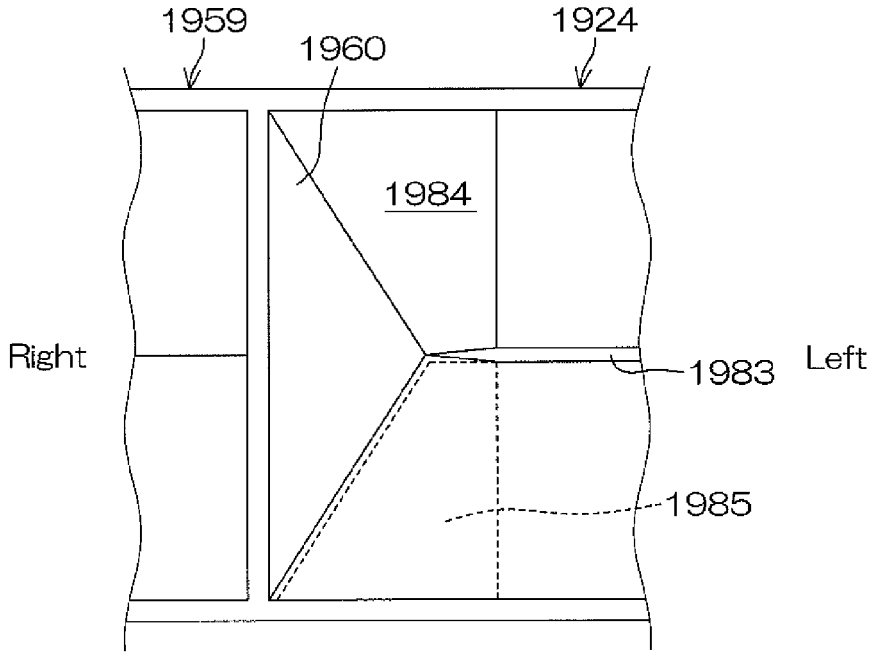
FIG. 32B is a schematic perspective view of a central portion of an R bucket.

FIG. 31 is a schematic plan view of a vessel propulsion apparatus 1903 according to the ninth preferred embodiment of the present invention. FIG. 32A is a schematic front view of a bucket 1963. FIG. 32B is a schematic perspective view of a central portion of an R bucket 1924.

With the exception of the deflector, the R bucket, and the F bucket, the vessel propulsion apparatus 1903 according to the ninth preferred embodiment preferably has the same arrangement as the vessel propulsion apparatus 1003 according to the first preferred embodiment. That is, as shown in FIG. 32A, the vessel propulsion apparatus 1903 includes a bucket 1963 in place of the R bucket 1024 and the F bucket 1025 according to the first preferred embodiment. Further, the vessel propulsion apparatus 1903 includes the deflector 1419 according to the fourth preferred embodiment in place of the deflector 1019 according to the first preferred embodiment.

As shown in FIG. 31, the bucket 1963 is coupled to the hull 1002. The bucket 1963 is rotatable up and down around the rotation axis An2 with respect to the hull 1002. The bucket 1963 is rotatable up and down around the rotation axis An2 and between a closed position at which the bucket 1963 covers the entire F outlet 1022 in a rear view and an opened position at which the bucket 1963 does not cover the F outlet 1022 in a rear view. The bucket 1963 is coupled to the F cable 1031 (see FIG. 1). The ECU 1004 (see FIG. 1) controls the F actuator 1030 (see FIG. 1) coupled to the F cable 1031 to rotate the bucket 1963 up and down around the rotation axis An2.

As shown in FIG. 32A, the bucket 1963 includes the R bucket 1924 by which water flowing rearward from the deflector 1419 is guided forward and the F bucket 1525 according to the fifth preferred embodiment. The R bucket 1924 is disposed above the F bucket 1525. The R bucket 1924 rotates up and down around the rotation axis An2 together with the F bucket 1525. The F bucket 1525 may be integral with the R bucket 1924 or may be a separate member from the R bucket 1924 that is fixed to the R bucket 1924.

As shown in FIG. 31, the bucket 1963 further includes the pair of right and left F arms 1033 that support the R bucket 1924 and the F bucket 1525. The pair of F arms 1033 are disposed across an interval in the right/left direction. The pair of F arms 1033 extend from a right end portion and a left end portion of the R bucket 1924. A front end portion of each F arm 1033 is coupled to the hull 1002. The front end portion of each F arm 1033 is rotatable up and down around the rotation axis An2 with respect to the hull 1002. The deflector 1419 is disposed between the pair of F arms 1033 in a plan view. The interval between the pair of F arms 1033 in the right/left direction is set so that regardless of which steering position the deflector 1419 is positioned at, the deflector 1419 does not contact the pair of F arms 1033.

As shown in FIG. 31, the R bucket 1924 includes an R guide 1959 by which water jetted rearward from the deflector 1419 is guided in at least one of either of an obliquely forward right direction or an obliquely forward left direction. The R guide 1959 is disposed further to the rear than the D axis D1 and the nozzle 1018. The R guide 1959 is right/left asymmetrical. The R guide 1959 includes a right inlet 1979 and a left inlet 1978 into which water flows and an R right outlet 1968 and an R left outlet 1969 that jet water. Further, the R guide 1959 includes a right flow passage 1980 connecting the left inlet 1978 and the R right outlet 1968 and a left flow passage 1981 connecting the right inlet 1979 and the R left outlet 1969. As shown in FIG. 32A, the R guide 1959 further includes a housing 1982 having a C-shaped vertical section that is opened forward, a partitioning plate 1983 partitioning an interior of the housing 1982, and an R separating portion 1960 partitioning the interior of the housing 1982 right and left at an equal interval.

As shown in FIG. 32B, the R separating portion 1960 is a plate-shaped member that is held in an upright attitude. As shown in FIG. 31, the R separating portion 1960 is disposed on the central axis Ad1 of the deflector 1419 positioned at the straight drive position. The left inlet 1978 is disposed at the left side of the R separating portion 1960, and the right inlet 1979 is disposed at the right side of the R separating portion 1960. The left inlet 1978 and the right inlet 1979 are opened forward. The R right outlet 1968 is opened obliquely forward to the right at a right end portion of the housing 1982, and the R left outlet 1969 is opened obliquely forward to the left at a left end portion of the housing 1982. The right flow passage 1980 extends from the left inlet 1978 to the R right outlet 1968, and the left flow passage 1981 extends from the right inlet 1979 to the R left outlet 1969. The right flow passage 1980 thus extends from a left side of the R separating portion 1960 to a right side of the R separating portion 1960, and the left flow passage 1981 extends from the right side of the R separating portion 1960 to the left side of the R separating portion 1960.

As shown in FIG. 32B, the right flow passage 1980 includes an upper intermediate opening 1984 that is opened leftward at the rear of the R separating portion 1960. Likewise, the left flow passage 1981 includes a lower intermediate opening 1985 that is opened rightward at the rear of the R separating portion 1960. The upper intermediate opening 1984 and the lower intermediate opening 1985 are aligned vertically. The right flow passage 1980 and the left flow passage 1981 thus cross vertically. The right flow passage 1980 and the left flow passage 1981 are mutually independent and are not connected. That is, the right flow passage 1980 and the left flow passage 1981 are partitioned by the partitioning plate 1983 and the R separating portion 1960. Water flowing into one of the right flow passage 1980 and the left flow passage 1981 thus does not flow into the other of the right flow passage 1980 and the left flow passage 1981.

Figure 33A:
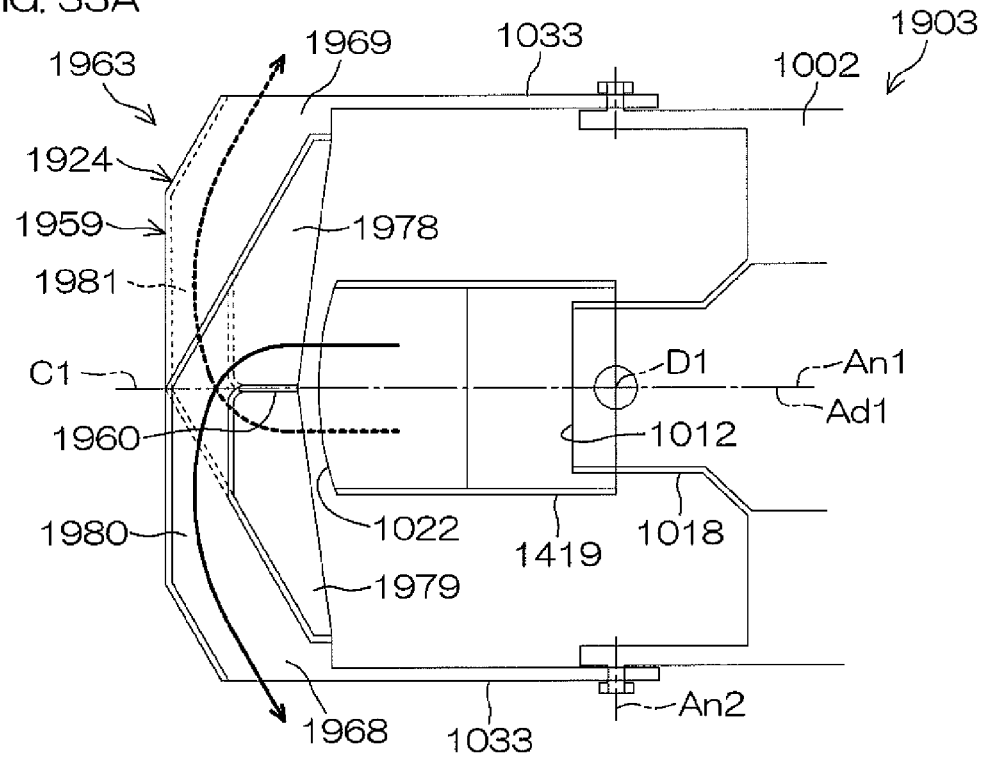
FIG. 33A is a schematic plan view for describing water flow in a state in which the R bucket is positioned at the rear of a deflector and the deflector is positioned at a straight drive position.
Figure 33B:
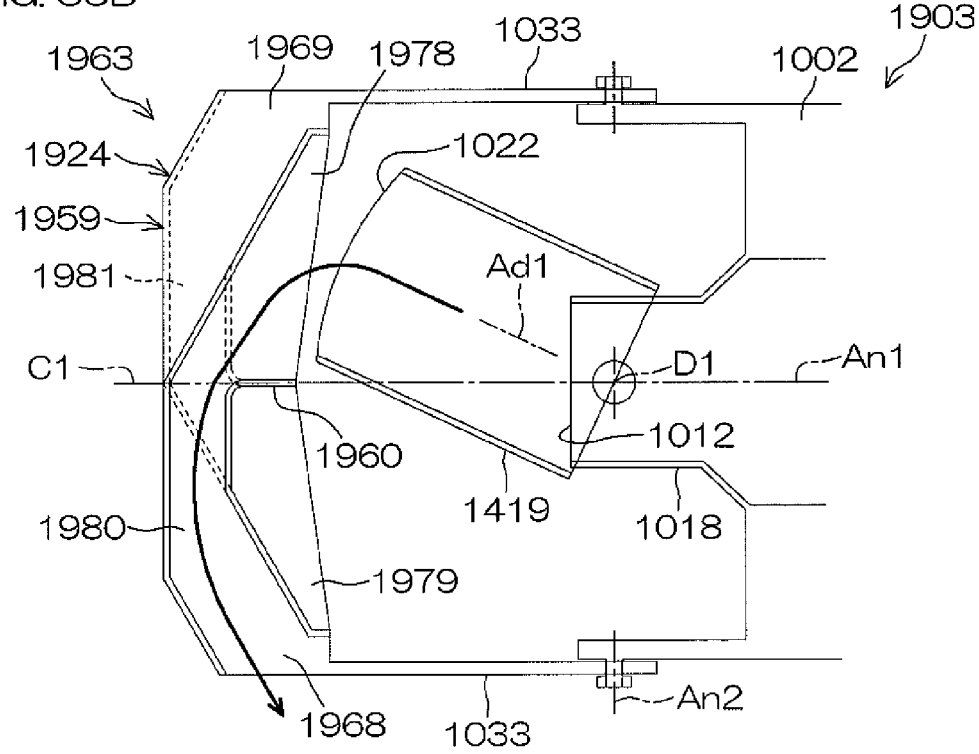
FIG. 33B is a schematic plan view for describing water flow in a state in which the R bucket is positioned at the rear of the deflector and the deflector is positioned at a left side.

FIG. 33A is a schematic plan view for describing water flow in a state in which the R bucket 1924 is positioned at the rear of the deflector 1419 and the deflector 1419 is positioned at a straight drive position. FIG. 33B is a schematic plan view for describing water flow in a state in which the R bucket 1924 is positioned at the rear of the deflector 1419 and the deflector 1419 is positioned at a left side. In FIG. 33A and FIG. 33B, the vessel propulsion apparatus 1903 is shown in a transparent state. Thick line arrows shown in FIG. 33A and FIG. 33B indicate directions of water streams.

In the state in which the R bucket 1924 is positioned at the rear of the deflector 1419 and the deflector 1419 is positioned at the straight drive position as shown in FIG. 33A, the water jetted rearward from the deflector 1419 is divided to the right and left at equal flow rates by the R separating portion 1960. Water of equal flow rates thus flow into the left inlet 1978 and the right inlet 1979. The water flowing into the left inlet 1978 is guided to the R right outlet 1968 by the right flow passage 1980 and is jetted in the obliquely forward right direction from the R right outlet 1968. Likewise, the water flowing into the right inlet 1979 is guided to the R left outlet 1969 by the left flow passage 1981 and is jetted in the obliquely forward left direction from the R left outlet 1969.

Thus, in the state in which the R bucket 1924 is positioned at the rear of the deflector 1419 and the deflector 1419 is positioned at the straight drive position, the water flowing into the deflector 1419 from the nozzle 1018 is divided to the right and left at equal flow rates by the R guide 1959. A right branch stream flowing in the obliquely forward right direction and a left branch stream flowing in the obliquely forward left direction are thus generated by the R bucket 1924. The R separating portion 1960 is disposed, in a plan view, on the central axis Ad1 of the deflector 1419 positioned at the straight drive position. The R separating portion 1960 thus generates the right branch stream from the water stream flowing to the left side relative to the central axis Ad1 of the deflector 1419 and generates the left branch stream from the water stream flowing to the right side relative to the central axis Ad1 of the deflector 1419. The obliquely forward right direction is a direction with which the obliquely forward left direction is right/left inverted, and in the above state, the right branch stream and the left branch stream are equal in flow rate. Thus, in this state, the right direction component and the left direction component of thrust cancel each other out and only the rear direction component remains.

On the other hand, in the state in which the R bucket 1924 is positioned at the rear of the deflector 1419 and the deflector 1419 is positioned at the left side, the front end of the R separating portion 1960 is positioned at the right side relative to the central axis Ad1 of the deflector 1419 as shown in FIG. 33B. Thus, when water is jetted rearward from the nozzle 1018 in this state, a large portion of the water flowing into the deflector 1419 from the nozzle 1018 is guided by the right flow passage 1980 to the R right outlet 1968. The water reaching the R right outlet 1968 is jetted in the obliquely forward right direction from the R right outlet 1968.

Thus, in the state in which the R bucket 1924 is positioned at the rear of the deflector 1419 and the deflector 1419 is positioned at the left side, a large portion of the water flowing into the deflector 1419 from the nozzle 1018 is jetted in the obliquely forward right direction from the R right outlet 1968. Thus, the right branch stream has a greater flow rate than the left branch stream. A reverse drive direction thrust that turns the hull 1002 rightward is thus generated. In a state in which the deflector 1419 is oppositely positioned at the right side, a left branch stream has a greater flow rate than the right branch stream. A reverse drive direction thrust that turns the hull 1002 leftward is thus generated.

The obliquely forward right direction and the obliquely forward left direction are directions that are symmetrical with respect to the central axis An1 of the nozzle 1018. The tilt angles of the obliquely forward right direction and the obliquely forward left direction with respect to the central axis An1 of the nozzle 1018 are fixed regardless of the steering position of the deflector 1419. In contrast, the tilt angle of the central axis Ad1 of the deflector 1419 with respect to the central axis An1 of the nozzle 1018 changes in accordance with the movement of the deflector 1419 around the D axis D1. However, at any steering position, the tilt angles of the obliquely forward right direction and the obliquely forward left direction are greater than the tilt angle of the central axis Ad1 of the deflector 1419. A thrust having a greater right/left direction component is thus generated. A force of turning the vessel 1001 in the reverse drive state can thus be made large.

FIG. 34A to FIG. 34D are schematic side views for describing an example of a relationship of the position of the lever 1006 and the positions of the R bucket 1924 and the F bucket 1525. In FIG. 34A to FIG. 34D, the vessel propulsion apparatus 1903 is shown in a transparent state. Thick line arrows shown in FIG. 34A to FIG. 34D indicate directions of water streams. The position of the R bucket 1924 shown in FIG. 34A is the closed position of the R bucket 1924, and the position of the R bucket 1924 shown in FIG. 34C is the opened position of the R bucket 1924. Also, the position of the F bucket 1525 shown in FIG. 34C is the closed position of the F bucket 1525, and the position of the F bucket 1525 shown in FIG. 34D is the opened position of the F bucket 1525.

In the state in which the lever 1006 (see FIG. 1) is positioned in the R region, the ECU 1004 (see FIG. 1) positions the bucket 1963 at a reverse position (corresponding to the closed position) as shown in FIG. 34A. The reverse position is a position at which the R bucket 1924 faces the F outlet 1022 across an interval in the front/rear direction and the entire F outlet 1022 is covered by the R bucket 1924 in a rear view. Thus, in this state, all of the water flowing into the deflector 1419 from the nozzle 1018 is jetted rearward from the F outlet 1022 and then guided in at least one of either of the obliquely forward right direction and the obliquely forward left direction by the R bucket 1924. A thrust in the reverse drive direction is thus generated.

As shown in FIG. 34B, in a state in which the lever 1006 is positioned in the N region, the ECU 1004 positions the bucket 1963 at a neutral position. The neutral position is a position at the opened position side relative to the reverse position, and at this position, only a portion of the F outlet 1022 faces the R bucket 1924 and the remaining portion of the F outlet 1022 faces the F bucket 1525. Thus, in this state, all of the water flowing into the deflector 1419 from the nozzle 1018 is jetted rearward from the F outlet 1022 and a portion of the jetted water is guided in at least one of either of the obliquely forward right direction and the obliquely forward left direction by the R bucket 1924. The remaining portion is guided in at least one of either of the right guiding direction and the left guiding direction by the F bucket 1525.

In a state in which the bucket 1963 is positioned at the neutral position and the deflector 1419 is positioned at the straight drive position, a right branch stream and a left branch stream flowing in the obliquely forward right direction and the obliquely forward left direction from the R bucket 1924 are generated. The flow rates of the right branch stream and the left branch stream are equal in this state and thus the right direction component of thrust and the left direction component of thrust cancel each other out and only the rear direction component of thrust remains.

Likewise, in the state in which the bucket 1963 is positioned at the neutral position and the deflector 1419 is positioned at the straight drive position, a right branch stream and a left branch stream flowing in the right guiding direction and the left guiding direction from the F bucket 1525 are generated. The flow rates of the right branch stream and the left branch stream are equal in this state and thus the right direction component of thrust and the left direction component of thrust cancel each other out and only the front direction component of thrust remains.

The position of the bucket 1963 in the state in which the lever 1006 is positioned in the N region is set so that the front direction component of thrust and the rear direction component of thrust cancel each other out when the deflector 1419 is positioned at the straight drive position. Thus, in this state, no thrust (resultant force) in any direction is generated. On the other hand, in the state in which the deflector 1419 is positioned at the right side or the left side, a thrust having a right direction component or a left direction component is generated. Thus, in this state, a force that rotates the hull 1002 around the vertical axis passing through the hull 1002 is generated and the vessel 1001 turns on the spot.

In a state in which the lever 1006 is positioned in the low speed region (position inside the F region), the ECU 1004 positions the bucket 1963 at a low speed position as shown in FIG. 34C. The low speed position is a position at the opened position side relative to the neutral position, and at this position, the R bucket 1924 does not face the F outlet 1022 and the F bucket 1525 faces only a portion of the F outlet 1022. Thus, in this state, all of the water flowing into the deflector 1419 from the nozzle 1018 is jetted rearward from the F outlet 1022 and a portion of the jetted water is guided in at least one of either of the right guiding direction and the left guiding direction by the F bucket 1525. The remaining portion passes below the bucket 1963. A thrust having a greater front direction component than that generated when the lever 1006 is positioned in the N region is thus generated.

In a state in which the lever 1006 is positioned in the high speed region (in the ninth preferred embodiment, a position inside the F region with which the movement amount of the lever 1006 is greater than in the low speed region), the ECU 1004 positions the bucket 1963 at a high speed position (corresponding to the opened position) as shown in FIG. 34D. At the high speed position, the bucket 1963 is positioned above the F outlet 1022 and the entire F outlet 1022 is opened. Thus, all of the water flowing into the deflector 1419 from the nozzle 1018 passes below the bucket 1963. A thrust having a greater front direction component than that generated when the lever 1006 is positioned in the low speed region is thus generated.

Tenth Preferred Embodiment

A tenth preferred embodiment of the present invention shall now be described. In the following description, "right/ left symmetrical" signifies symmetry with respect to the hull center (a vertical plane passing through the stem and a stern center).

Figure 35:
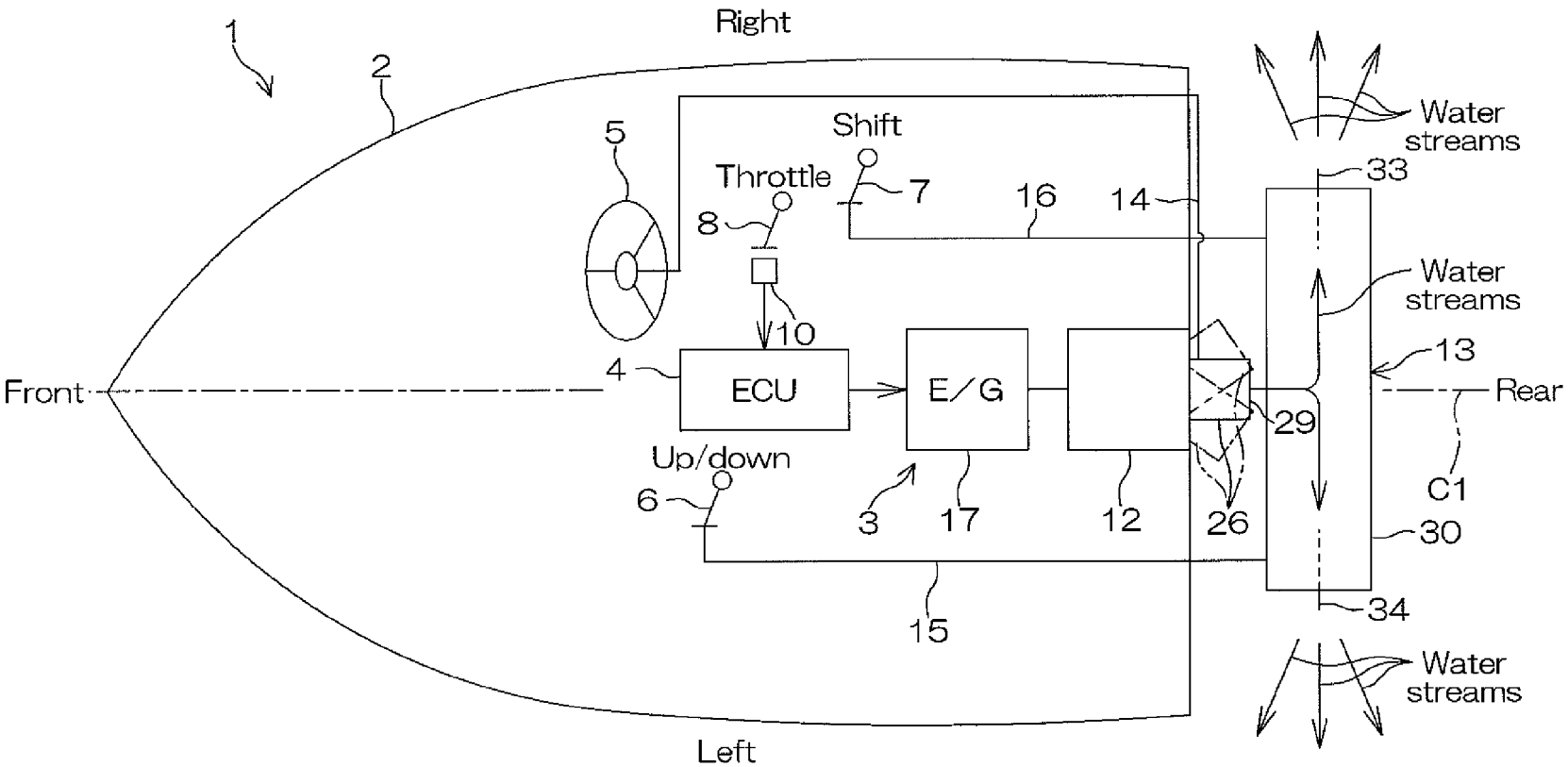
FIG. 35 is a schematic plan view of a vessel according to a tenth preferred embodiment of the present invention.
Figure 36:
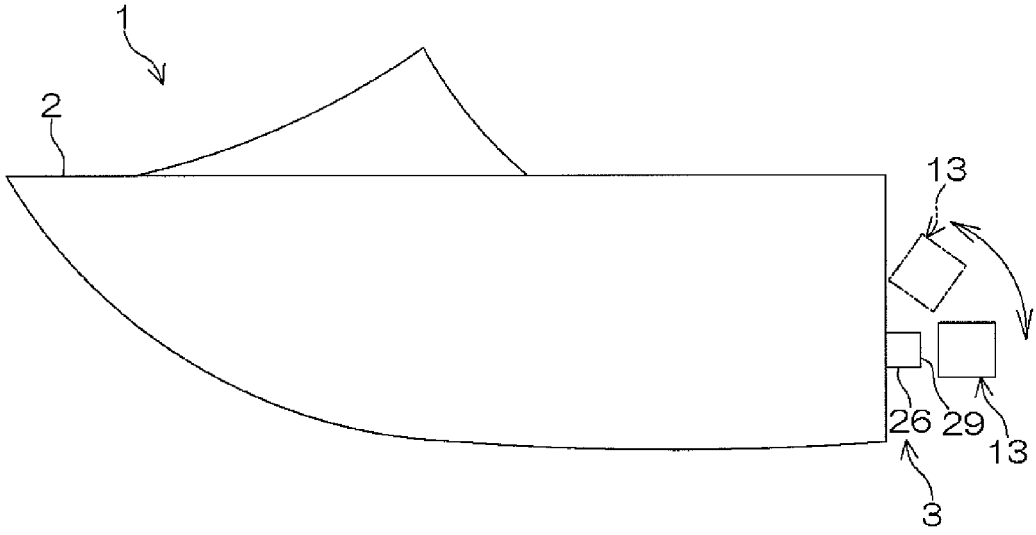
FIG. 36 is a schematic side view of the vessel according to the tenth preferred embodiment of the present invention.
Figure 37:
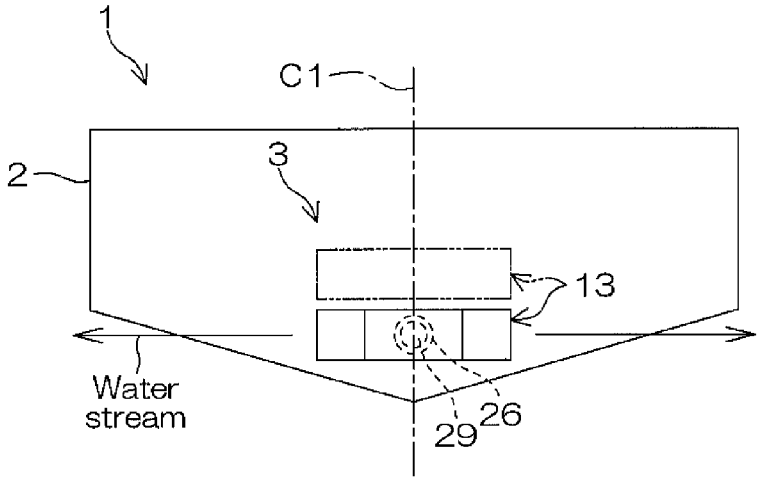
FIG. 37 is a schematic rear view of the vessel according to the tenth preferred embodiment of the present invention.

FIG. 35 is a schematic plan view of a vessel 1 according to the tenth preferred embodiment of the present invention. FIG. 36 is a schematic side view of the vessel 1 according to the tenth preferred embodiment of the present invention. FIG. 37 is a schematic rear view of the vessel 1 according to the tenth preferred embodiment of the present invention.

As shown in FIG. 35, the vessel 1 includes a hull 2, a vessel propulsion apparatus 3 that propels the vessel 1, and an ECU 4 (electronic control unit) that controls the vessel propulsion apparatus 3. Further, the vessel 1 includes a handle 5 operated between a right maximum steering position and a left maximum steering position by a vessel operator, a plurality of levers 6 to 8 operated by the vessel operator to operate the vessel 1, and a lever position detecting device 10 that detects a position of the lever 8. The vessel propulsion apparatus 3 is disposed at a central portion of a rear portion of the hull 2. A center in a right/left direction of the vessel propulsion apparatus 3 is matched with a hull center C1. The vessel propulsion apparatus 3 includes a jet pump 12 by which water sucked in from a hull bottom is jetted rearward and a bucket 13 that changes a direction of a water stream generated by the jet pump 12. The ECU 4 controls the vessel propulsion apparatus 3 to cause water be jetted from the jet pump 12. The jet pump 12 includes a deflector 26 that defines an outlet 29 from which water is jetted rearward.

As shown in FIG. 36 and FIG. 37, the bucket 13 is arranged to be movable up and down between a closed position (position indicated by solid lines) of covering the outlet 29 so that the entire outlet 29 cannot be seen when the outlet 29 is viewed from the rear and an opened position (position indicated by alternate long and two short dashed lines) of retreating from the outlet 29 so that the entire outlet 29 can be seen when the outlet 29 is viewed from the rear. In a state in which the bucket 13 is positioned at the opened position, the water jetted rearward from the outlet 29 flows rearward without being blocked by the bucket 13. On the other hand, in a state in which the bucket 13 is positioned at the closed position, the water jetted rearward from the outlet 29 collides against and is changed in direction by the bucket 13. That is, as shown in FIG. 35, the bucket 13 changes the direction of the water jetted rearward from the outlet 29 by guiding the water in the right/left direction. The water guided in the right/left direction is further guided in any one of an obliquely forward direction, right direction, left direction, and obliquely rearward direction by the bucket 13. Thereafter, the bucket 13 jets the water horizontally as shown in FIG. 37.

As shown in FIG. 35, the bucket 13 includes a pair of right and left movable guides 33 and 34 that guide the water stream, and the water guided in the right/left direction is guided in any one of an obliquely forward direction, right direction, left direction, and obliquely rearward direction by the movable guides 33 and 34. The movable guides 33 and 34 are movable between forward drive positions of guiding the water stream in an obliquely rearward direction and reverse drive positions of guiding the water stream in an obliquely forward direction (see FIG. 41). In FIG. 35, a state in which the movable guides 33 and 34 are positioned at neutral positions between the forward drive position and the neutral drive position is shown.

As shown in FIG. 35, the plurality of levers 6 to 8 include an up/down lever 6 that is operated by the vessel operator to move the bucket 13 up or down. The up/down lever 6 is coupled to the bucket 13 preferably by an up/down cable 15. The up/down cable 15 preferably is, for example, a push-pull cable. The up/down lever 6 is movable between an opened position and a closed position. Operation of the up/down lever 6 is transmitted to the bucket 13 by the up/down cable 15. The position of the bucket 13 is associated with the position of the up/down lever 6 and the bucket 13 is positioned at a position associated with the position of the up/down lever 6. That is, for example, when the up/down lever 6 is positioned at the opened position, the bucket 13 is also positioned at the opened position.

Also, as shown in FIG. 35, the plurality of levers 6 to 8 include a shift lever 7 that is operated by the vessel operator to move the pair of movable guides 33 and 34. The shift lever 7 is coupled to the movable guides 33 and 34 by a shift cable 16. The shift cable 16 is, for example, a push-pull cable. The shift lever 7 is movable between a forward drive position and a reverse drive position. Operation of the shift lever 7 is transmitted to the pair of movable guides 33 and 34 by the shift cable 16. The positions of the pair of movable guides 33 and 34 are associated with the position of the shift lever 7 and the pair of movable guides 33 and 34 are positioned at positions associated with the position of the shift lever 7. That is, for example, when the shift lever 7 is positioned at the forward drive position, the pair of movable guides 33 and 34 are also positioned at the forward drive positions.

Also, as shown in FIG. 35, the plurality of levers 6 to 8 include a throttle lever 8 that is operated by the vessel operator to perform speed adjustment of the vessel 1. The throttle lever 8 is movable between an idling position and a maximum output position. The position of the throttle lever 8 is detected by the lever position detecting device 10. The lever position detecting device 10 is connected to the ECU 4. The ECU 4 acquires a detection value of the lever position detecting device 10 and, based on the detection value, increases or decreases a flow rate of water jetted from the jet pump 12. A magnitude of a thrust generated by the vessel propulsion apparatus 3 is thereby adjusted and a speed of the vessel 1 is adjusted.

As shown in FIG. 35, the handle 5 is coupled to the deflector 26 preferably by a steering cable 14. The steering cable 14 is, for example, a push-pull cable. Operation of the handle 5 is transmitted to the deflector 26 by the steering cable 14. When the handle 5 is operated, the deflector 26 rotates to the right or left with a straight drive position (position indicated by solid lines), of jetting water in a direction extending along the hull center C1 in a plan view, as a center. That is, the deflector 26 moves, in accordance with the operation of the handle 5, between a right maximum steering position (position indicated by alternate long and short dashed lines) of jetting water in an obliquely rearward right direction and a left maximum steering position (position indicated by alternate long and two short dashed lines) of jetting water in an obliquely rearward left direction. When the deflector 26 is positioned at the right maximum steering position side relative to the straight drive position, water is jetted in an obliquely rearward right direction from the deflector 26. The closer the deflector 26 is to the right maximum steering position, the greater the tilt of the jetting direction with respect to the hull center C1. Likewise, when the deflector 26 is positioned at the left maximum steering position side relative to the straight drive position, water is jetted in an obliquely rearward left direction from the deflector 26. The closer the deflector 26 is to the left maximum steering position, the greater the tilt of the jetting direction with respect to the hull center C1.

Figure 38:
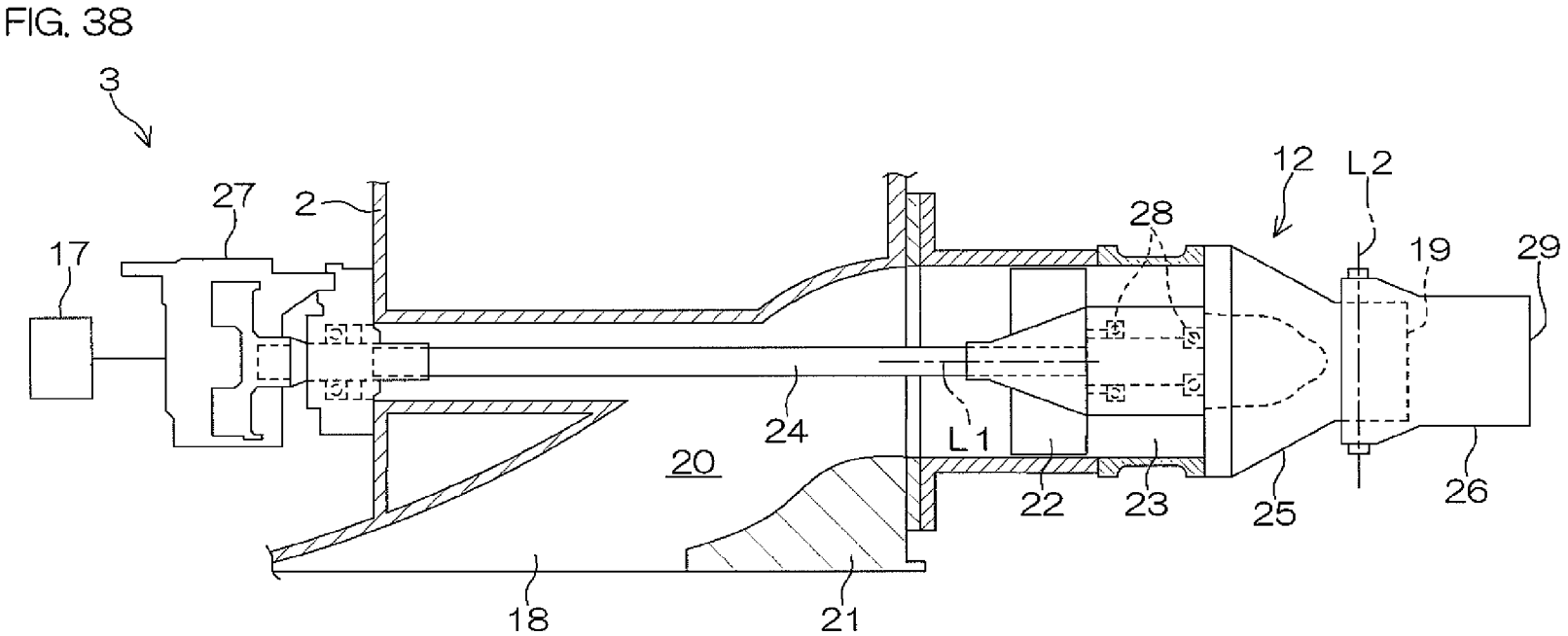
FIG. 38 is a partial sectional view of a vessel propulsion apparatus according to the tenth preferred embodiment of the present invention.

FIG. 38 is a partial sectional view of the vessel propulsion apparatus 3 according to the tenth preferred embodiment of the present invention. In FIG. 38, the bucket 13 is omitted for ease of illustration and understanding purposes.

The vessel propulsion apparatus 3 includes the jet pump 12 and an engine 17 that drives the jet pump 12. The engine 17 is disposed in an interior of the hull 2. The jet pump 12 is disposed at the rear of the engine 17. The jet pump 12 defines an inlet 18 opening at the hull bottom, an outlet 19 opening rearward further at the rear than the inlet 18, and a flow passage 20 connecting the inlet 18 and the outlet 19. The jet pump 12 includes a duct 21 defining the inlet 18 and a portion of the flow passage 20, an impeller that includes a moving vane 22 and stationary vane 23 disposed in the flow passage 20, and a driveshaft 24 coupled to the impeller. Further, the jet pump 12 includes a nozzle 25 defining the outlet 19 and a deflector 26 by which a direction of water jetted from the nozzle 25 is changed right and left.

The driveshaft 24 extends in the front/rear direction. A front end portion of the driveshaft 24 is coupled to the engine 17 via a coupling 27, and a rear end portion of the driveshaft 24 is rotatably supported via a plurality of bearings 28. The moving vane 22 is coupled to the driveshaft 24 at the front relative to the rear end portion of the driveshaft 24. The stationary vane 23 is disposed at the rear of the moving vane 22 and the nozzle 25 is disposed at the rear of the stationary vane 23. The moving vane 22 includes a plurality of blades disposed so as to surround the rotation axis L1 (central axis of the driveshaft 24). Likewise, the stationary vane 23 includes a plurality of blades disposed so as to surround the rotation axis L1. The moving vane 22 is rotatable around the rotation axis L1 with respect to the flow passage 20 and the stationary vane 23 is fixed with respect to the flow passage 20.

The moving vane 22 is driven around the rotation axis L1 together with the driveshaft 24 by the engine 17. When the moving vane 22 is driven to rotate, water is sucked into the flow passage 20 from the inlet 18 and the water sucked into the flow passage 20 is fed from the moving vane 22 to the stationary vane 23. By the water fed by the moving vane 22 passing through the stationary vane 23, water stream twisting resulting from the rotation of the moving vane 22 is reduced and the water stream is flow-rectified. The flow-rectified water is thus fed from the stationary vane 23 to the outlet 19. The nozzle 25 has a tubular shape extending in the front/rear direction and is arranged so that an inner diameter of a rear end portion is smaller than an inner diameter of a front end portion. The outlet 19 is defined by the rear end portion of the nozzle 25. Water fed into the nozzle 25 is thus jetted rearward from the outlet 19 after being accelerated by the nozzle 25.

The deflector 26 is coupled to the nozzle 25. The deflector 26 is hollow. The outlet 19 is disposed inside the deflector 26. The deflector 26 defines an outlet 29 that is opened rearward. The outlet 29 is disposed at the rear of the outlet 19. The deflector 26 is coupled to the nozzle 25 in a manner enabling rotation to the right and left around a deflector rotation axis L2 that extends in the up/down direction. The nozzle 25 does not move with respect to the hull 2. The deflector 26 is thus rotatable around the deflector rotation axis L2 with respect to the hull 2. The deflector 26 is rotated to the right or left around the deflector rotation axis L2 in accordance with operation of the handle 5 by the vessel operator. When the deflector 26 is rotated to the right or left around the deflector rotation axis L2, the jetting direction of water jetted from the outlet 29 is changed to the right or left. The deflector 26 is thus arranged to change the jetting direction of water jetted from the outlet 29 to the right or left in accordance with the operation of the handle 5. In a state in which the bucket 13 is positioned at the opened position, the vessel 1 is turned by the direction of jetting of water from the deflector 26 being tilted to the right or left with respect to the hull center C1.

Figure 39:
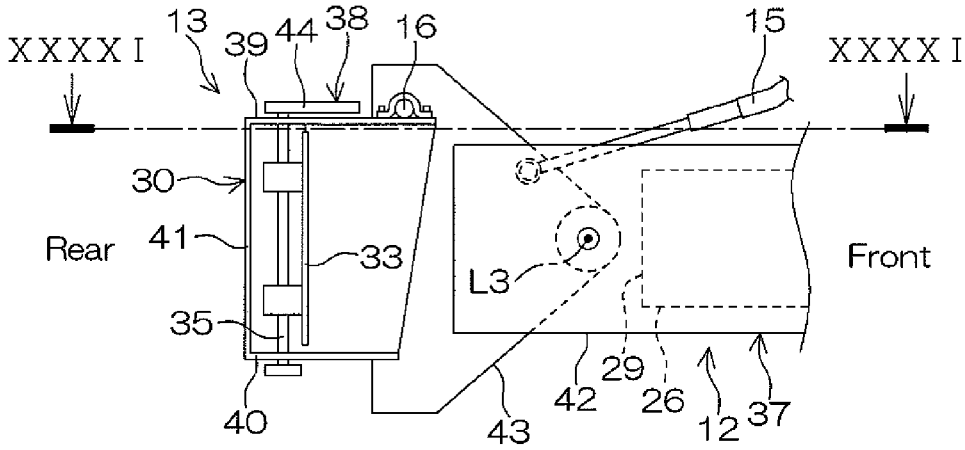
FIG. 39 is a side view of a bucket and an arrangement related thereto according to the tenth preferred embodiment of the present invention.
Figure 40:
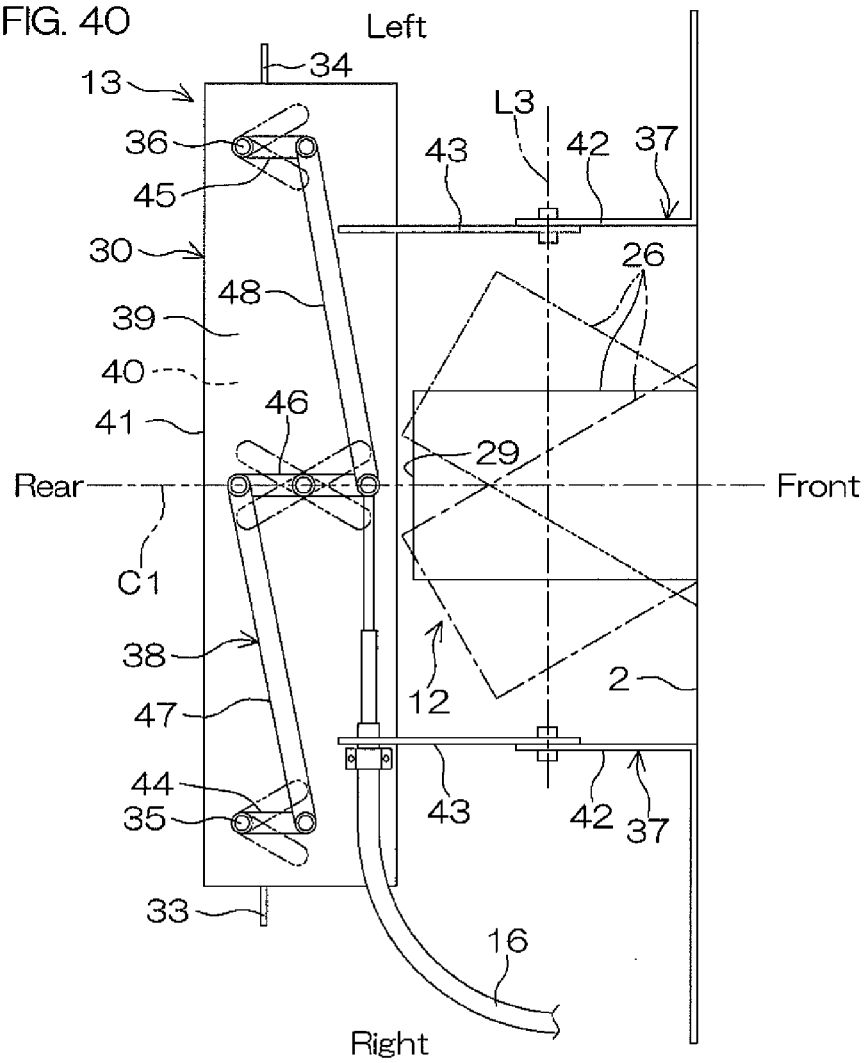
FIG. 40 is a plan view of the bucket and the arrangement related thereto according to the tenth preferred embodiment of the present invention.
Figure 41:
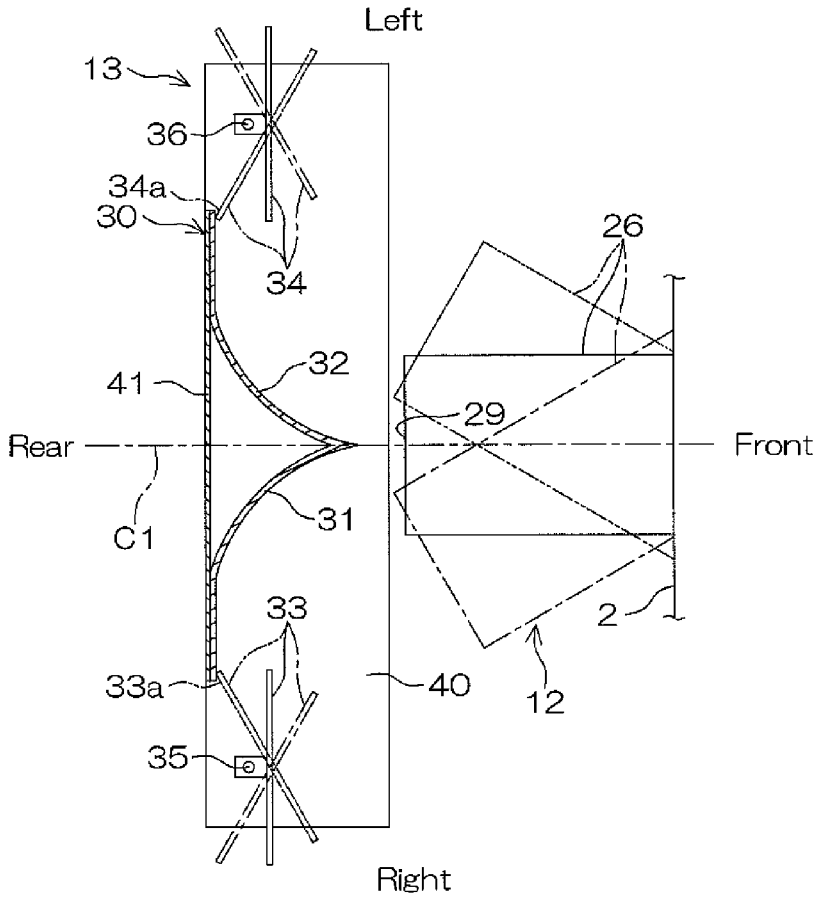
FIG. 41 is a sectional view taken along line XXXXI-XXXXI in FIG. 39.
Figure 42:
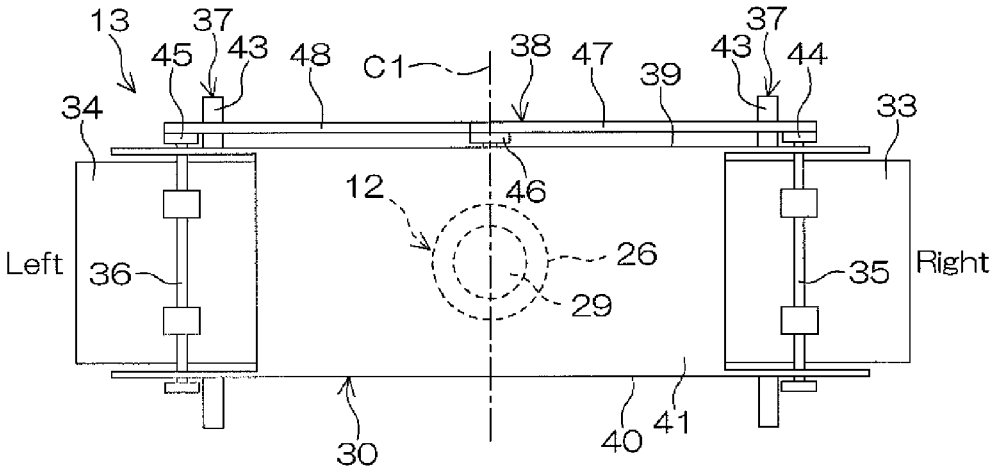
FIG. 42 is a rear view of the bucket and the arrangement related thereto according to the tenth preferred embodiment of the present invention.

FIG. 39 is a side view of the bucket 13 and an arrangement related thereto according to the tenth preferred embodiment of the present invention. FIG. 40 is a plan view of the bucket 13 and the arrangement related thereto according to the tenth preferred embodiment of the present invention. FIG. 41 is a sectional view taken along line XXXXI-XXXXI in FIG. 39. FIG. 42 is a rear view of the bucket 13 and the arrangement related thereto according to the tenth preferred embodiment of the present invention. In FIG. 39 to FIG. 42, a state in which the bucket 13 is positioned at the closed position is shown. The state in which the bucket 13 is positioned at the closed position shall now be described.

As shown in FIG. 39 and FIG. 40, the bucket 13 includes a box-shaped casing 30 that extends in the right/left direction. As shown in FIG. 41, the bucket 13 further includes a pair of right and left fixed guides 31 and 32, the pair of right and left movable guides 33 and 34, and a pair of right and left rotating shafts 35 and 36. Also, as shown in FIG. 40, the vessel propulsion apparatus 3 includes a pair of right and left brackets 37 coupling the bucket 13 and the hull 2 and a link mechanism 38 transmitting the operation of the shift lever 7 to the right movable guide 33 and the left movable guide 34.

As shown in FIG. 40 and FIG. 42, the casing 30 has a right/left symmetrical shape. Whereas a central portion of the casing 30 in the right/left direction has a C-shaped vertical section that is opened in the forward direction, a right end portion and a left end portion of the casing 30 are opened in the forward direction and the rear direction. As shown in FIG. 39, the casing 30 includes an upper wall 39 and a lower wall 40 that are disposed along a horizontal plane and a rear wall 41 disposed along a vertical plane. The upper wall 39, the lower wall 40, and the rear wall 41 preferably are, for example, rectangular plates. The upper wall 39 and the lower wall 40 are disposed in parallel across a vertical interval. The rear wall 41 is disposed between a rear end portion of the upper wall 39 and a rear end portion of the lower wall 40, and an upper end portion and a lower end portion of the rear wall 41 are respectively joined to the upper wall 39 and the lower wall 40. As shown in FIG. 42, a width (length in the right/left direction) of the upper wall 39 is equal to a width of the lower wall 40, and a width of the rear wall 41 is shorter than the width of each of the upper wall 39 and lower wall 40. Openings that are opened rearward are thus provided respectively at right and left sides of the rear wall 41. The rear wall 41 is positioned at the rear of the deflector 26.

As shown in FIG. 40, the casing 30 is coupled to the hull 2 by the pair of brackets 37. The pair of brackets 37 are disposed right/left symmetrically across an interval in the right/left direction. The deflector 26 is disposed between the pair of brackets 37. Each bracket 37 includes a fixed bracket 42 fixed to the hull 2 and a movable bracket 43 coupled to the fixed bracket 42. The movable bracket 43 is movable up and down around a bucket rotation axis L3 that extends in the right/left direction with respect to the fixed bracket 42. A rear end portion of the movable bracket 43 is coupled to the casing 30. As shown in FIG. 39, the up/down cable 15 is coupled to the movable bracket 43. When the up/down cable 15 is pushed or pulled by the up/down lever 6 being operated, the bucket 13 rotates up or down around the bucket rotation axis L3 together with the movable brackets 43. The bucket 13 is thereby rotated around the bucket rotation axis L3 and between the opened position and the closed position with respect to the jet pump 12.

As shown in FIG. 41, the respective fixed guides 31 and 32 are disposed inside the casing 30. The respective fixed guides 31 and 32 are, for example, curved plates in upright attitudes. An upper end portion and a lower end portion of each of the fixed guides 31 and 32 are respectively coupled to the upper wall 39 and the lower wall 40 of the casing 30. The right fixed guide 31 is disposed at a right side of the hull center C1 and the left fixed guide 32 is disposed at a left side of the hull center C1. The right fixed guide 31 and the left fixed guide 32 are disposed in a right/left symmetrical V-shaped configuration that is opened rearward in a plan view. Each of the fixed guides 31 and 32 preferably has, for example, an arcuate shape in a plan view that is recessed toward an inner side (hull center C1 side). A front end of each of the fixed guides 31 and 32 lies along the front/rear direction and a rear end of each of the fixed guides 31 and 32 lies along the right/left direction. One of the fixed guides 31 and 32 has a shape with which the other of the fixed guides 31 and 32 is right/left inverted. The front end of the right fixed guide 31 and the front end of the left fixed guide 32 are joined at the hull center C1. The front ends of the respective fixed guides 31 and 32 are positioned at the rear of the deflector 26 positioned at the straight drive position.

As shown in FIG. 41, in a state in which the deflector 26 is positioned at the straight drive position (position indicated by solid lines) and the bucket 13 is positioned at the closed position, the respective fixed guides 31 and 32 are positioned at the rear of the outlet 29. When water jetted from the outlet 29 collides against the right fixed guide 31, the water flows to an outer side (in a direction away from the hull center C1 in a plan view) along the right fixed guide 31 and is guided in the right direction. Also, when water jetted from the outlet 29 collides against the left fixed guide 32, the water flows to an outer side along the left fixed guide 32 and is guided in the left direction. The water streams guided in a lateral direction (right direction or left direction) by each of the fixed guides 31 and 32 is then guided in any one of an obliquely forward direction, lateral direction, and obliquely rearward direction by each of the movable guides 33 and 34.

As shown in FIG. 41 and FIG. 42, each of the movable guides 33 and 34 is, for example, a planar plate disposed in an upright attitude. Each of the movable guides 33 and 34 is, for example, rectangular or substantially rectangular. The right movable guide 33 is a right plate and the left movable guide 34 is a left plate. The right movable guide 33 and the left movable guide 34 are respectively disposed inside a right end portion and inside a left end portion of the casing 30. The right movable guide 33 is disposed at the right side relative to the right fixed guide 31 and the left movable guide 34 is disposed at the left side relative to the left fixed guide 32. The right movable guide 33 and the left movable guide 34 are disposed right/left symmetrically. An end portion at an outer side of each of the movable guides 33 and 34 (for example, a right end portion in the case of the right movable guide 33) projects outside from the casing 33. The right movable guide 33 and the left movable guide 34 are respectively coupled to the right rotating shaft 35 and the left rotating shaft 36. The right movable guide 33 and the left movable guide 34 are coupled to the casing 30 by the right rotating shaft 35 and the left rotating shaft 36.

As shown in FIG. 41, each of the right movable guides 33 and 34 is movable between a forward drive position (position indicated by alternate long and short dashed lines) and a reverse drive position (position indicated by alternate long and two short dashed lines). The forward drive position is a position at which the movable guides 33 and 34 are tilted with respect to the right/left direction in a manner such that the end portions at the outer sides of the respective movable guides 33 and 34 are positioned further rearward than end portions at inner sides of the respective movable guides 33 and 34. The reverse drive position is a position at which the movable guides 33 and 34 are tilted with respect to the right/left direction in a manner such that the end portions at the outer sides of the respective movable guides 33 and 34 are positioned further forward than end portions at inner sides of the respective movable guides 33 and 34. A neutral position (position indicated by solid lines) between the forward drive position and the reverse drive position is a position at which the movable guides 33 and 34 extend substantially parallel to the right/left direction in a plan view. At the reverse drive position, the end portion at the inner side (left end portion 33*a*) of the right movable guide 33 contacts the right fixed guide 31 and the end portion at the inner side (right end portion 34*a*) of the left movable guide 34 contacts the left fixed guide 32. Thus, at the reverse drive position, gaps between the end portions at the inner sides of the respective movable guides 33 and 34 and the corresponding fixed guides 31 and 32 are closed.

By the right movable guide 33, water guided by the right fixed guide 31, is guided in any one of an obliquely forward direction, right direction, and obliquely rearward direction. Likewise, by the left movable guide 34, water guided by the left fixed guide 32, is guided in any one of an obliquely forward direction, left direction, and obliquely rearward direction. Water is jetted in the direction guided by the right movable guide 33 from a right end portion of the bucket 13, and water is jetted in the direction guided by the left movable guide 34 from a left end portion of the bucket 13. Specifically, as shown in FIG. 42, the right movable guide 33 and the left movable guide 34 are positioned at the openings provided respectively at the right and left sides of the rear wall 41 when the bucket 13 is viewed from the rear. Thus, when the respective movable guides 33 and 34 guide water streams in the obliquely rearward directions, the guided water streams are jetted rearward from the respective openings at the right and left sides of the rear wall 41. Water is thus jetted in directions guided by the respective movable guides 33 and 34 and a thrust in an obliquely forward direction, lateral direction, or obliquely rearward direction is generated.

The forward drive positions and the reverse drive positions of the respective movable guides 33 and 34 are set so that the right/left direction component of thrust is greater than the front/rear direction component of thrust. That is, with a thrust generated by water being jetted from the right end portion of the bucket 13, the right/left direction component is greater than the front/rear direction component, and with a thrust generated by water being jetted from the left end portion of the bucket 13, the right/left direction component is greater than the front/rear direction component.

As shown in FIG. 42, the respective rotating shafts 35 and 36 extend in the up/down direction in the state in which the bucket 13 is positioned at the closed position. The right rotating shaft 35 and the left rotating shaft 36 respectively penetrate a right end portion and a left end portion of the casing 30 vertically. The link mechanism 38 is disposed above the casing 30 and upper end portions of the respective rotating shafts 35 and 36 are coupled to the link mechanism 38 above the casing 30. The respective rotating shafts 35 and 36 are held by the casing 30. The right movable guide 33 and the left movable guide 34 are respectively coupled to the right rotating shaft 35 and the left rotating shaft 36 inside the casing 30. The respective rotating shafts 35 and 36 are rotatable with respect to the casing 30 around its central axis. The respective movable guides 33 and 34 rotate between the forward drive position and the reverse drive position together with the corresponding rotating shafts 35 and 36. The respective movable guides 33 and 34 rotate together with the corresponding rotating shafts 35 and 36 by the operation of the shift lever 7 being transmitted to the respective movable guides 33 and 34 via the shift cable 16 and the link mechanism 38.

As shown in FIG. 40, the link mechanism 38 includes a right arm 44, a left arm 45, an intermediate arm 46, a right coupling arm 47, and a left coupling arm 48. The respective arms 44 to 48 extend along the upper wall 39 of the casing 30. The right arm 44 and the left arm 45 are respectively disposed above the right end portion and the left end portion of the casing 30, and the intermediate arm 46 is disposed above a central portion of the casing 30. The right arm 44 and the intermediate arm 46 are coupled by the right coupling arm 47. The left arm 45 and the intermediate arm 46 are coupled by the left coupling arm 48. The right arm 44 is rotatable around a rear end portion of the right arm 44 as a center, and the left arm 45 is rotatable around a rear end portion of the left arm 45 as a center. An upper end portion of the right rotating shaft 35 is coupled to the rear end portion of the right arm 44, and an upper end portion of the left rotating shaft 36 is coupled to the rear end portion of the left arm 45. The right rotating shaft 35 rotates together with the right arm 44 and the left rotating shaft 36 rotates together with the left arm 45. Also, the intermediate arm 46 is rotatable around an intermediate portion of the intermediate arm 46 as a center. The shift cable 16 is coupled to a front end portion of the intermediate arm 46.

As shown in FIG. 40, a distance from the intermediate portion of the intermediate arm 46 to the coupling portion of the intermediate arm 46 and the right coupling arm 47 is equal to a distance from the intermediate portion of the intermediate arm 46 to the coupling portion of the intermediate arm 46 and the left coupling arm 48. Also, a distance from the coupling portion of the intermediate arm 46 and the right coupling arm 47 to the coupling portion of the right coupling arm 47 and the right arm 44 is equal to a distance from the coupling portion of the intermediate arm 46 and the left coupling arm 48 to the coupling portion of the left coupling arm 48 and the left arm 45. Also, a distance from the coupling portion of the right coupling arm 47 and the right arm 44 to the coupling portion of the right arm 44 and the right rotating shaft 35 is equal to a distance from the coupling portion of the left coupling arm 48 and the left arm 45 to the coupling portion of the left arm 45 and the left rotating shaft 36. Thus, when the intermediate arm 46 rotates around its intermediate portion as the center, the right movable guide 33 and the left movable guide 34 rotate in mutually opposite directions at the same rotation angle. The right movable guide 33 and the left movable guide 34 can thus be moved symmetrically by rotating the intermediate arm 46.

Specifically, when the shift lever 7 is operated, the operation of the shift lever 7 is transmitted to the intermediate arm 46 by the shift cable 16. The intermediate arm 46 is thereby rotated around its intermediate portion as the center, and the rotation of the intermediate arm 46 is transmitted to the right arm 44 and the left arm 45 via the right coupling arm 47 and the left coupling arm 48. The right arm 44 and the left arm 45 thus rotate and at the same time, the rotating shafts 35 and 36 rotate around their respective central axes. That is, the right rotating shaft 35 and the left rotating shaft 36 rotate in mutually opposite directions at the same rotation angle. The right movable guide 33 and the left movable guide 34 thus move between the forward drive positions and the reverse drive positions with the right/left symmetrical positional relationship being maintained.

FIG. 43 shows schematic side views for describing an example of positional relationships of the bucket 13 and the deflector 26.

The bucket 13 is movable up and down between the opened position and the closed position. As shown in an upper stage of FIG. 43, the opened position of the bucket 13 is the position at which the bucket 13 is positioned above the deflector 26 and the bucket 13 is retreated from the outlet 29 so that the entire outlet 29 can be seen when the outlet 29 is viewed from the rear. In the state in which the bucket 13 is positioned at the opened position, water jetted rearward from the outlet 29 flows rearward without being blocked by the bucket 13. On the other hand, as shown in a lower stage of FIG. 43, the closed position of the bucket 13 is the position at which the bucket 13 is positioned at the rear of the deflector 26 and the bucket 13 covers the outlet 29 so that the entire outlet 29 cannot be seen when the outlet 29 is viewed from the rear. In the state in which the bucket 13 is positioned at the closed position, water jetted rearward from the outlet 29 collides against and is changed in direction by the bucket 13.

Also, as shown in a middle stage of FIG. 43, at the neutral position of the bucket 13 which is a position between the opened position and the closed position, a portion of the bucket 13 is positioned at the rear of the deflector 26 and the bucket 13 covers a portion of the outlet 29 so that a portion of the outlet 29 cannot be seen when the outlet 29 is viewed from the rear. In the state in which the bucket 13 is positioned at the neutral position, a portion of the water jetted rearward from the outlet 29 flows rearward without being blocked by the bucket 13 and the remaining portion collides against and is changed in direction by the bucket 13. Near the neutral position, an opening degree of the outlet 29 increases as the bucket 13 approaches the opened position and the opening degree of the outlet 29 decreases as the bucket 13 approaches the closed position. The vessel operator can thus change the opening degree of the outlet 29 by operating the up/down lever 6. That is, the vessel operator can increase or decrease the flow rate of water blocked by the bucket 13 by operating the up/down lever 6. The vessel operator can thus adjust a balance between a magnitude of a thrust in the forward direction and a magnitude of a thrust in the right/left direction by operating the up/down lever 6.

Figure 44:
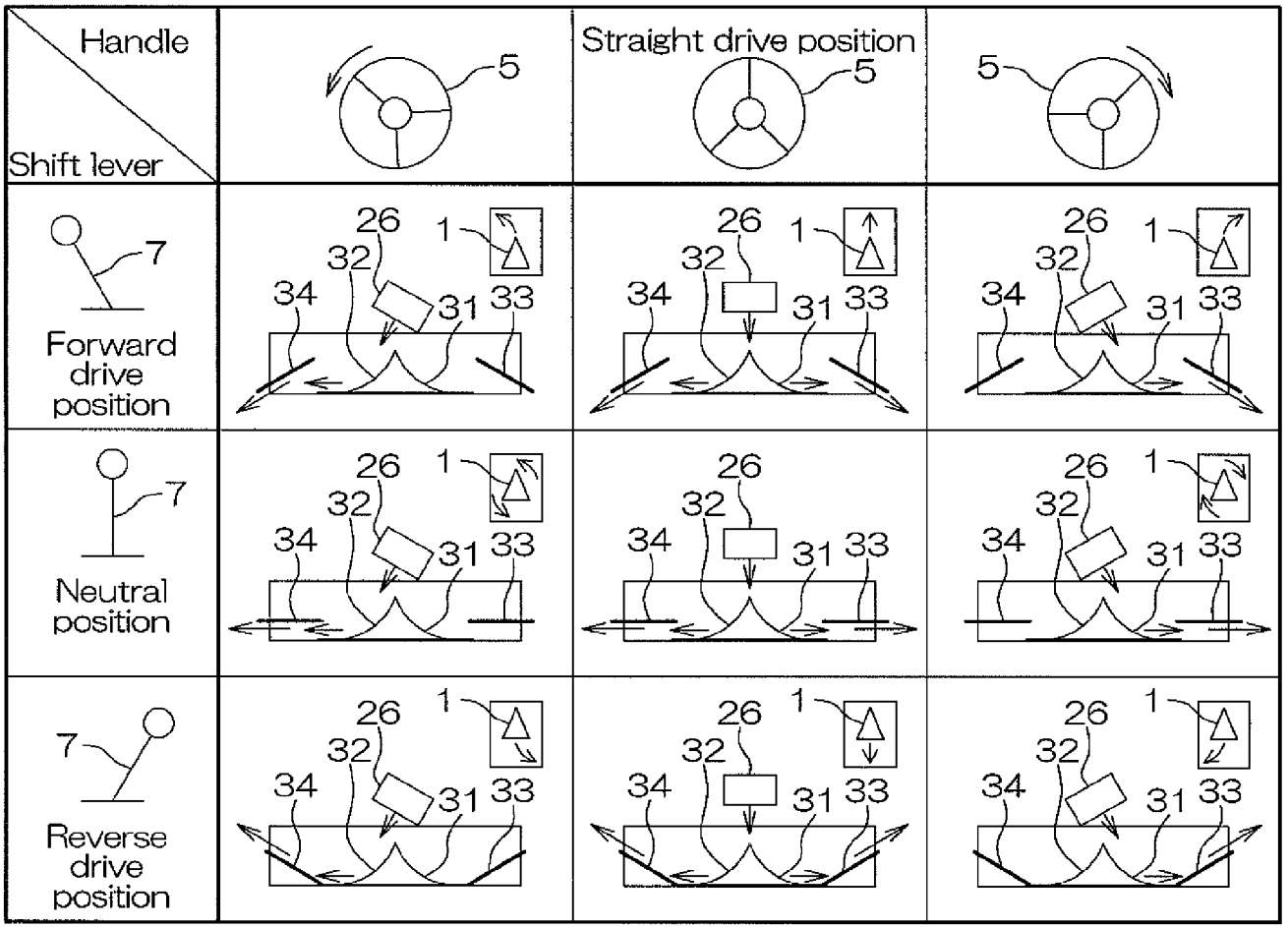
FIG. 44 shows schematic views for describing directions in which water jetted from the deflector is guided by the bucket.

FIG. 44 shows schematic views for describing directions in which the water jetted from the deflector 26 is guided by the bucket 13. States in which the bucket 13 is positioned at the closed position are shown in FIG. 44. Cases where the handle 5 is positioned at the straight drive position shall first be described.

As shown in an upper stage of a middle column of FIG. 44, in a state in which the handle 5 is positioned at the straight drive position and the shift lever 7 is positioned at the forward drive position, the deflector 26 jets water in a direction along the hull center C1 in a plan view. Water of equal flow rate is thus supplied to each of the fixed guides 31 and 32 from the deflector 26. The water supplied to the right fixed guide 31 is guided in the right direction by the right fixed guide 31 and water supplied to the left fixed guide 32 is guided in the left direction by the left fixed guide 32. A water stream from the outlet 29 is thereby branched right and left to form a right branch stream having a right direction component and a left branch stream having a left direction component. The right branch stream is guided in the obliquely rearward right direction by the right movable guide 33 and the left branch stream is guided in the obliquely rearward left direction by the left movable guide 34. Water is thereby jetted obliquely rearward to the right from the right end portion of the bucket 13 and obliquely rearward to the left from the left end portion of the bucket 13. The flow rates of water supplied respectively to the fixed guides 31 and 32 are equal and thus the flow rate of water jetted obliquely rearward to the right and the flow rate of water jetted obliquely rearward to the left are equal. Further, the direction of jetting of water jetted from the right end portion of the bucket 13 and the direction of jetting of water jetted from the left end portion of the bucket 13 are tilted in opposite directions at equal angles with respect to the hull center C1. The right direction component of one thrust and the left direction component of the other thrust thus cancel each other out so that only the front direction component remains and the vessel 1 is driven straight in the forward direction.

Also, as shown in a middle stage of the middle column of FIG. 44, in a state in which the handle 5 is positioned at the straight drive position and the shift lever 7 is positioned at the neutral position, the deflector 26 jets water in the direction along the hull center C1 in a plan view. Water of equal flow rate is thus supplied to each of the fixed guides 31 and 32 from the deflector 26. The water supplied to the right fixed guide 31 is guided in the right direction by the right fixed guide 31 and water supplied to the left fixed guide 32 is guided in the left direction by the left fixed guide 32. A right branch stream and a left branch stream are thereby generated. The right branch stream is guided in the right direction by the right movable guide 33 and the left branch stream is guided in the left direction by the left movable guide 34. Water is thereby jetted in the right direction from the right end portion of the bucket 13 and in the left direction from the left end portion of the bucket 13. The flow rates of water supplied respectively to the fixed guides 31 and 32 are equal and thus the flow rate of water jetted in the right direction and the flow rate of water jetted in the left direction are equal. The right direction component of one thrust and the left direction component of the other thrust thus cancel each other out so that the vessel 1 stays still on the spot.

Also, as shown in a lower stage of the middle column of FIG. 44, in a state in which the handle 5 is positioned at the straight drive position and the shift lever 7 is positioned at the reverse drive position, the deflector 26 jets water in the direction along the hull center C1 in a plan view. Water of equal flow rate is thus supplied to each of the fixed guides 31 and 32 from the deflector 26. The water supplied to the right fixed guide 31 is guided in the right direction by the right fixed guide 31 and water supplied to the left fixed guide 32 is guided in the left direction by the left fixed guide 32. A right branch stream and a left branch stream are thereby generated. The right branch stream is guided in the obliquely forward right direction by the right movable guide 33 and the left branch stream is guided in the obliquely forward left direction by the left movable guide 34. Water is thereby jetted obliquely forward to the right from the right end portion of the bucket 13 and obliquely forward to the left from the left end portion of the bucket 13. The flow rates of water supplied respectively to the fixed guides 31 and 32 are equal and thus the flow rate of water jetted obliquely forward to the right and the flow rate of water jetted obliquely forward to the left are equal. Further, the direction of jetting of water jetted from the right end portion of the bucket 13 and the direction of jetting of water jetted from the left end portion of the bucket 13 are tilted in opposite directions at equal angles with respect to the hull center C1. The right direction component of one thrust and the left direction component of the other thrust thus cancel each other out so that only the rear direction component remains and the vessel 1 is driven straight in the rearward direction.

Cases where the handle 5 is steered to the left shall now be described.

As shown in an upper stage of a left column of FIG. 44, in a state in which the handle 5 is positioned at the left maximum steering position side relative to the straight drive position and the shift lever 7 is positioned at the forward drive position, the deflector 26 jets water in a direction that is tilted to the left with respect to the hull center C1 in a plan view. The flow rate of water supplied to the left fixed guide 32 is thus greater than the flow rate of water supplied to the right fixed guide 31. The right fixed guide 31 and the left fixed guide 32 thus divide the water stream from the outlet 29 into a right branch stream and a left branch stream in a manner such that the flow rate of the left branch stream is greater than the flow rate of the right branch stream. The right branch stream is guided in the obliquely rearward right direction by the right movable guide 33 and the left branch stream is guided in the obliquely rearward left direction by the left movable guide 34. Water is thereby jetted obliquely rearward to the right from the right end portion of the bucket 13 and water is jetted obliquely rearward to the left from the left end portion of the bucket 13. The flow rate of water supplied to the left fixed guide 32 is greater than the flow rate of water supplied to the right fixed guide 31 and thus the flow rate of water jetted from the left end portion of the bucket 13 is greater than the flow rate of water jetted from the right end portion of the bucket 13. Particularly, in a state in which the handle 5 is positioned at the left maximum steering position, water is jetted only from the left end portion of the bucket 13. An obliquely forward thrust to the right is thus generated at the stern by the jetting of water obliquely rearward to the left from the bucket 13 and the vessel 1 is driven forward while turning to the left.

Also, as shown in a middle stage of the left column of FIG. 44, in a state in which the handle 5 is positioned at the left maximum steering position side relative to the straight drive position and the shift lever 7 is positioned at the neutral position, the deflector 26 jets water in a direction that is tilted to the left with respect to the hull center C1 in a plan view. The flow rate of water supplied to the left fixed guide 32 is thus greater than the flow rate of water supplied to the right fixed guide 31. The right fixed guide 31 and the left fixed guide 32 thus divide the water stream from the outlet 29 into a right branch stream and a left branch stream in a manner such that the flow rate of the left branch stream is greater than the flow rate of the right branch stream. The right branch stream is guided in the right direction by the right movable guide 33 and the left branch stream is guided in the left direction by the left movable guide 34. Water is thereby jetted in the right direction from the right end portion of the bucket 13 and water is jetted in the left direction from the left end portion of the bucket 13. The flow rate of water supplied to the left fixed guide 32 is greater than the flow rate of water supplied to the right fixed guide 31 and thus the flow rate of water jetted from the left end portion of the bucket 13 is greater than the flow rate of water jetted from the right end portion of the bucket 13. Particularly, in a state in which the handle 5 is positioned at the left maximum steering position, water is jetted only from the left end portion of the bucket 13. A thrust in the right direction is thus generated at the stern by the jetting of water in the left direction from the bucket 13 and the vessel 1 turns to the left on the spot. That is, the vessel 1 turns around.

Also, as shown in a lower stage of the left column of FIG. 44, in a state in which the handle 5 is positioned at the left maximum steering position side relative to the straight drive position and the shift lever 7 is positioned at the reverse drive position, the deflector 26 jets water in a direction that is tilted to the left with respect to the hull center C1 in a plan view. The flow rate of water supplied to the left fixed guide 32 is thus greater than the flow rate of water supplied to the right fixed guide 31. The right fixed guide 31 and the left fixed guide 32 thus divide the water stream from the outlet 29 into a right branch stream and a left branch stream in a manner such that the flow rate of the left branch stream is greater than the flow rate of the right branch stream. The right branch stream is guided in the obliquely forward right direction by the right movable guide 33 and the left branch stream is guided in the obliquely forward left direction by the left movable guide 34. Water is thereby jetted obliquely forward to the left from the left end portion of the bucket 13 and water is jetted obliquely forward to the right from the right end portion of the bucket 13. The flow rate of water supplied to the left fixed guide 32 is greater than the flow rate of water supplied to the right fixed guide 31 and thus the flow rate of water jetted from the left end portion of the bucket 13 is greater than the flow rate of water jetted from the right end portion of the bucket 13. Particularly, in a state in which the handle 5 is positioned at the left maximum steering position, water is jetted only from the left end portion of the bucket 13. An obliquely rearward thrust to the right is thus generated at the stern by the jetting of water obliquely forward to the left from the bucket 13 and the vessel 1 is driven in reverse while turning to the right.

Cases where the handle 5 is steered to the right shall now be described.

As shown in an upper stage of a right column of FIG. 44, in a state in which the handle 5 is positioned at the right maximum steering position side relative to the straight drive position and the shift lever 7 is positioned at the forward drive position, the deflector 26 jets water in a direction that is tilted to the right with respect to the hull center C1 in a plan view. The flow rate of water supplied to the right fixed guide 31 is thus greater than the flow rate of water supplied to the left fixed guide 32. The right fixed guide 31 and the left fixed guide 32 thus divide the water stream from the outlet 29 into a right branch stream and a left branch stream in a manner such that the flow rate of the right branch stream is greater than the flow rate of the left branch stream. The right branch stream is guided in the obliquely rearward right direction by the right movable guide 33 and the left branch stream is guided in the obliquely rearward left direction by the left movable guide 34. Water is thereby jetted obliquely rearward to the right from the right end portion of the bucket 13 and water is jetted obliquely rearward to the left from the left end portion of the bucket 13. The flow rate of water supplied to the right fixed guide 31 is greater than the flow rate of water supplied to the left fixed guide 32 and thus the flow rate of water jetted from the right end portion of the bucket 13 is greater than the flow rate of water jetted from the left end portion of the bucket 13. Particularly, in a state in which the handle 5 is positioned at the right maximum steering position, water is jetted only from the right end portion of the bucket 13. An obliquely forward thrust to the left is thus generated at the stern by the jetting of water obliquely rearward to the right from the bucket 13 and the vessel 1 is driven forward while turning to the right.

Also, as shown in a middle stage of the right column of FIG. 44, in a state in which the handle 5 is positioned at the right maximum steering position side relative to the straight drive position and the shift lever 7 is positioned at the neutral position, the deflector 26 jets water in a direction that is tilted to the right with respect to the hull center C1 in a plan view. The flow rate of water supplied to the right fixed guide 31 is thus greater than the flow rate of water supplied to the left fixed guide 32. The right fixed guide 31 and the left fixed guide 32 thus divide the water stream from the outlet 29 into a right branch stream and a left branch stream in a manner such that the flow rate of the right branch stream is greater than the flow rate of the left branch stream. The right branch stream is guided in the right direction by the right movable guide 33 and the left branch stream is guided in the left direction by the left movable guide 34. Water is thereby jetted in the right direction from the right end portion of the bucket 13 and water is jetted in the left direction from the left end portion of the bucket 13. The flow rate of water supplied to the right fixed guide 31 is greater than the flow rate of water supplied to the left fixed guide 32 and thus the flow rate of water jetted from the right end portion of the bucket 13 is greater than the flow rate of water jetted from the left end portion of the bucket 13. Particularly, in a state in which the handle 5 is positioned at the right maximum steering position, water is jetted only from the right end portion of the bucket 13. A thrust in the left direction is thus generated at the stern by the jetting of water in the right direction from the bucket 13 and the vessel 1 turns to the right on the spot.

Also, as shown in a lower stage of the right column of FIG. 44, in a state in which the handle 5 is positioned at the right maximum steering position side relative to the straight drive position and the shift lever 7 is positioned at the reverse drive position, the deflector 26 jets water in a direction that is tilted to the right with respect to the hull center C1 in a plan view. The flow rate of water supplied to the right fixed guide 31 is thus greater than the flow rate of water supplied to the left fixed guide 32. The right fixed guide 31 and the left fixed guide 32 thus divide the water stream from the outlet 29 into a right branch stream and a left branch stream in a manner such that the flow rate of the right branch stream is greater than the flow rate of the left branch stream. The right branch stream is guided in the obliquely forward right direction by the right movable guide 33 and the left branch stream is guided in the obliquely forward left direction by the left movable guide 34. Water is thereby jetted obliquely forward to the right from the right end portion of the bucket 13 and water is jetted obliquely forward to the left from the left end portion of the bucket 13. The flow rate of water supplied to the right fixed guide 31 is greater than the flow rate of water supplied to the left fixed guide 32 and thus the flow rate of water jetted from the right end portion of the bucket 13 is greater than the flow rate of water jetted from the left end portion of the bucket 13. Particularly, in a state in which the handle 5 is positioned at the right maximum steering position, water is jetted only from the right end portion of the bucket 13. An obliquely rearward thrust to the left is thus generated at the stern by the jetting of water obliquely forward to the right from the bucket 13 and the vessel 1 is driven in reverse while turning to the left.

The bucket 13 thus divides the water stream from the outlet 29 into a right branch stream and a left branch stream at the closed position in a manner such that the flow rate of the right branch stream and the flow rate of the left branch stream are equal in the case where the direction of jetting of water from the outlet 29 is not tilted. Also, in a case where the direction of jetting of water from the outlet 29 is tilted to the right, the bucket 13 divides the water stream from the outlet 29 into a right branch stream and a left branch stream at the closed position in a manner such that the flow rate of the right branch stream is greater than the flow rate of the left branch stream. Also, in a case where the direction of jetting of water from the outlet 29 is tilted to the left, the bucket 13 divides the water stream from the outlet 29 into a right branch stream and a left branch stream at the closed position in a manner such that the flow rate of the left branch stream is greater than the flow rate of the right branch stream. Also, at the closed position, the bucket 13 changes the directions of the right branch stream and the left branch stream to an obliquely forward direction having a front direction component, an obliquely rearward direction having a rear direction component, or a lateral direction (right direction or left direction) without a front/rear direction component via the right movable guide 33 and the left movable guide 34. Water is thereby jetted from the bucket 13 and the vessel 1 is propelled.

Figure 45:
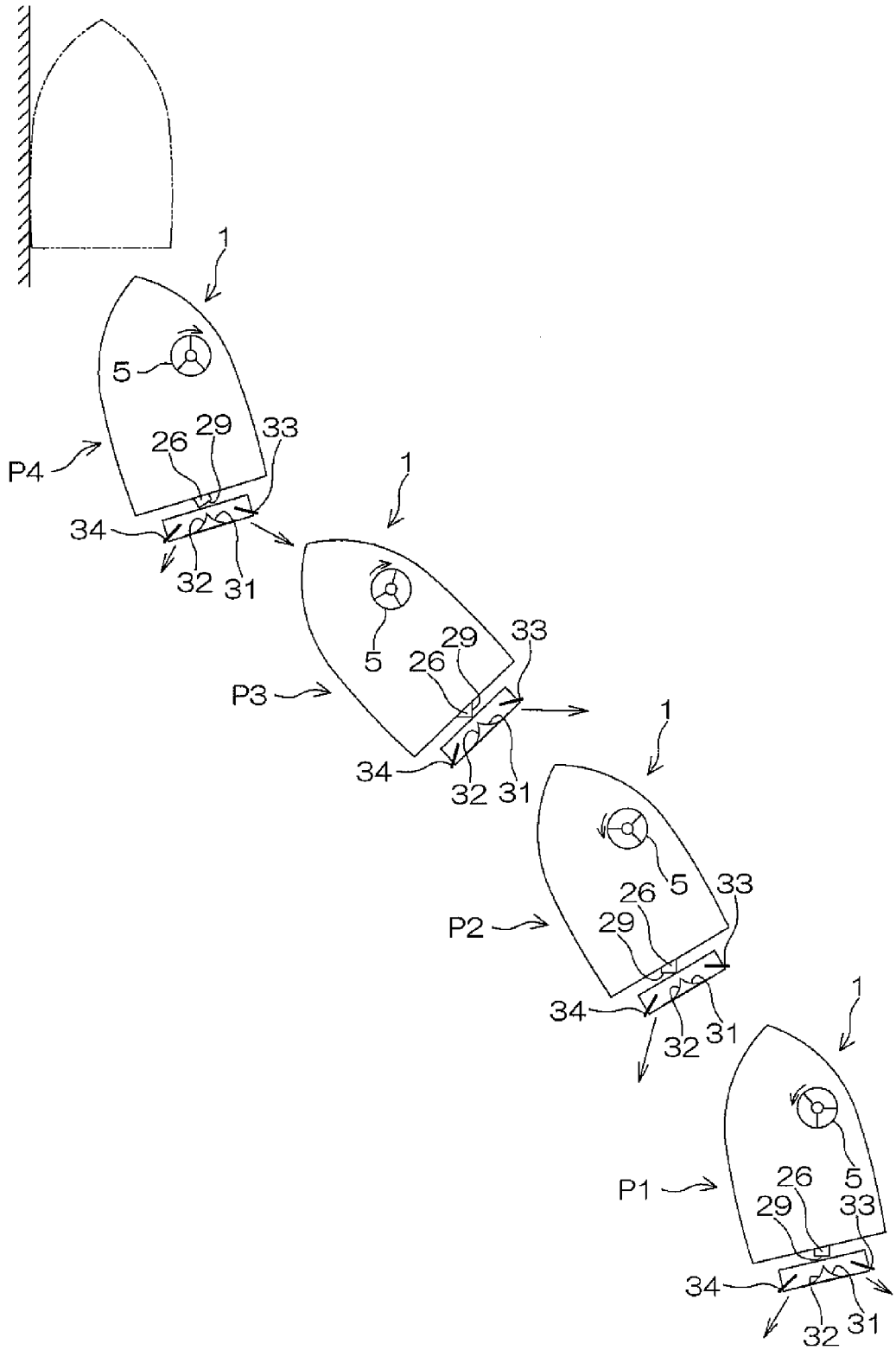
FIG. 45 shows schematic plan views for describing an example of operations during docking of the vessel according to the tenth preferred embodiment of the present invention.

FIG. 45 is a schematic plan view for describing an example of operations during docking of the vessel 1 according to the tenth preferred embodiment of the present invention. A state in which the bucket 13 is positioned at the closed position and the respective movable guides 33 and 34 are positioned at the forward drive positions is shown in FIG. 45.

As the vessel 1 approaches a shore, the vessel operator positions the bucket 13 at the closed position and positions the respective movable guides 33 and 34 at the forward drive positions. In this state, the vessel operator operates the throttle lever 8 to cause water to be jetted from the deflector 26 while steering the handle 5 further to the left than the straight drive position (see position P1). Water is thereby jetted obliquely rearward to the right from the right end portion of the bucket 13 and water is jetted obliquely rearward to the left from the left end portion of the bucket 13. In this state, the flow rate of water jetted from the left end portion of the bucket 13 is greater than the flow rate of water jetted from the right end portion of the bucket 13 and thus the vessel 1 is driven forward at low speed while turning to the left.

The vessel operator then steers the handle 5 further to the left (see position P2). That is, in the state in which the bucket 13 is positioned at the closed position and the respective movable guides 33 and 34 are positioned at the forward drive positions, the vessel operator makes water be jetted from the deflector 26 while steering the handle 5 further to the left. The direction of water jetted from the outlet 29 is tilted further to the left and the flow rate of water supplied to the left fixed guide 32 increases because the handle 5 is steered further to the left. The flow rate of water jetted from the rear end portion of the bucket 13 thus increases and the right/left direction component of thrust increases. The direction of the vessel 1 thus changes rapidly in the state in which the vessel 1 is driven forward at low speed.

Next, the vessel operator causes water to be jetted from the deflector 26 while steering the handle 5 further to the right than the straight drive position (see position P3). As a target position (position indicated by alternate long and two short dashed lines) is approached, the vessel operator causes the vessel 1 to advance forward at low speed while returning the handle 5 to the straight drive position (see position P4). The vessel operator thus operates the handle 5 and/or the throttle lever 8 in accordance with a positional relationship of a present position and the target position of the vessel 1 to cause the vessel 1 to approach the target position while adjusting the attitude of the vessel 1. The vessel 1 is thereby moved to and docked at the target position.

As described above, with the tenth preferred embodiment, in a state in which the bucket 13 is positioned at the opened position, the outlet 29 of the deflector 26 is not covered by the bucket 13 and thus the water jetted rearward from the jet pump 12 flows rearward without being blocked by the bucket 13. Thus, in this state, a thrust that turns the vessel 1, that is, a thrust having a lateral direction component is generated by the direction of jetting of water from the outlet 29 being changed to the right or left by the jet pump 12. On the other hand, in a state in which the bucket 13 is positioned at the closed position, the outlet 29 of the deflector 26 is covered by the bucket 13 and the water jetted rearward from the jet pump 12 is blocked by the bucket 13 and is guided in a direction among an obliquely forward direction, an obliquely rearward direction, and a direction between the two directions in a plan view.

Specifically, when water is jetted from the jet pump 12 in the state in which the bucket 13 is positioned at the closed position, the jetted water is guided in the right direction by the right fixed guide 31. The water guided by the right fixed guide 31 is then guided in a direction that is in accordance with the position of the right movable guide 33 between the forward drive position and the reverse drive position by the right movable guide 33 that is positioned further to the right than the right fixed guide 31. That is, the water guided by the right movable guide 33 is guided in a direction among an obliquely forward direction, an obliquely rearward direction, and a direction between the two directions. The bucket 13 then jets the water in the direction guided by the right movable guide 33. Likewise, the water guided by the left fixed guide 32 is guided in a direction that is in accordance with the position of the left movable guide 34 between the forward drive position and the reverse drive position by the left movable guide 34 that is positioned further to the left than the left fixed guide 32. The bucket 13 then jets the water in the direction guided by the left movable guide 34.

A thrust in an obliquely forward direction, an obliquely rearward direction, and a lateral direction (right direction or left direction) is thus generated by the fixed guides 31 and 32 and the movable guides 33 and 34 guiding the water streams. The vessel 1 can thereby be made turn to the right or left while driving it forward or in reverse at low speed. Further, the vessel 1 can be made to turn rightward or leftward on the spot. Moreover, a thrust having a lateral direction component is generated by the fixed guides 31 and 32 and the movable guides 33 and 34 guiding the water streams and thus in comparison to a case where thrusts cancel each other out, the thrust generated by the jet pump 12 can be used efficiently. The lateral direction component of thrust can thus be increased. Vessel maneuverability at low speed can thus be improved.

Also, with the tenth preferred embodiment, the right movable guide 33 is arranged to be rotatable around the right rotating shaft 35 and between the forward drive position and the reverse drive position and the left movable guide 34 is arranged to be rotatable around the left rotating shaft 36 and between the forward drive position and the reverse drive position. As shown in FIG. 41, in the state in which the right movable guide 33 is positioned at the reverse drive position, the left end portion 33*a* of the right movable guide 33 contacts the right fixed guide 31 and thus an amount of water flowing rearward from between the left end portion 33*a* of the right movable guide 33 and the right fixed guide 31 can be decreased. That is, the amount water leaking from between the left end portion 33*a* of the right movable guide 33 and the right fixed guide 31 can thus be decreased. In likewise manner, in the state in which the left movable guide 34 is positioned at the reverse drive position, the right end portion 34*a* of the left movable guide 34 contacts the left fixed guide 32 and thus an amount of water leaking from between the right end portion 34*a* of the left movable guide 34 and the left fixed guide 32 can be decreased. The energy loss can thus be reduced. The vessel maneuverability at low speed can thereby be improved by increasing the lateral direction component of thrust.

Eleventh Preferred Embodiment

Figure 46:
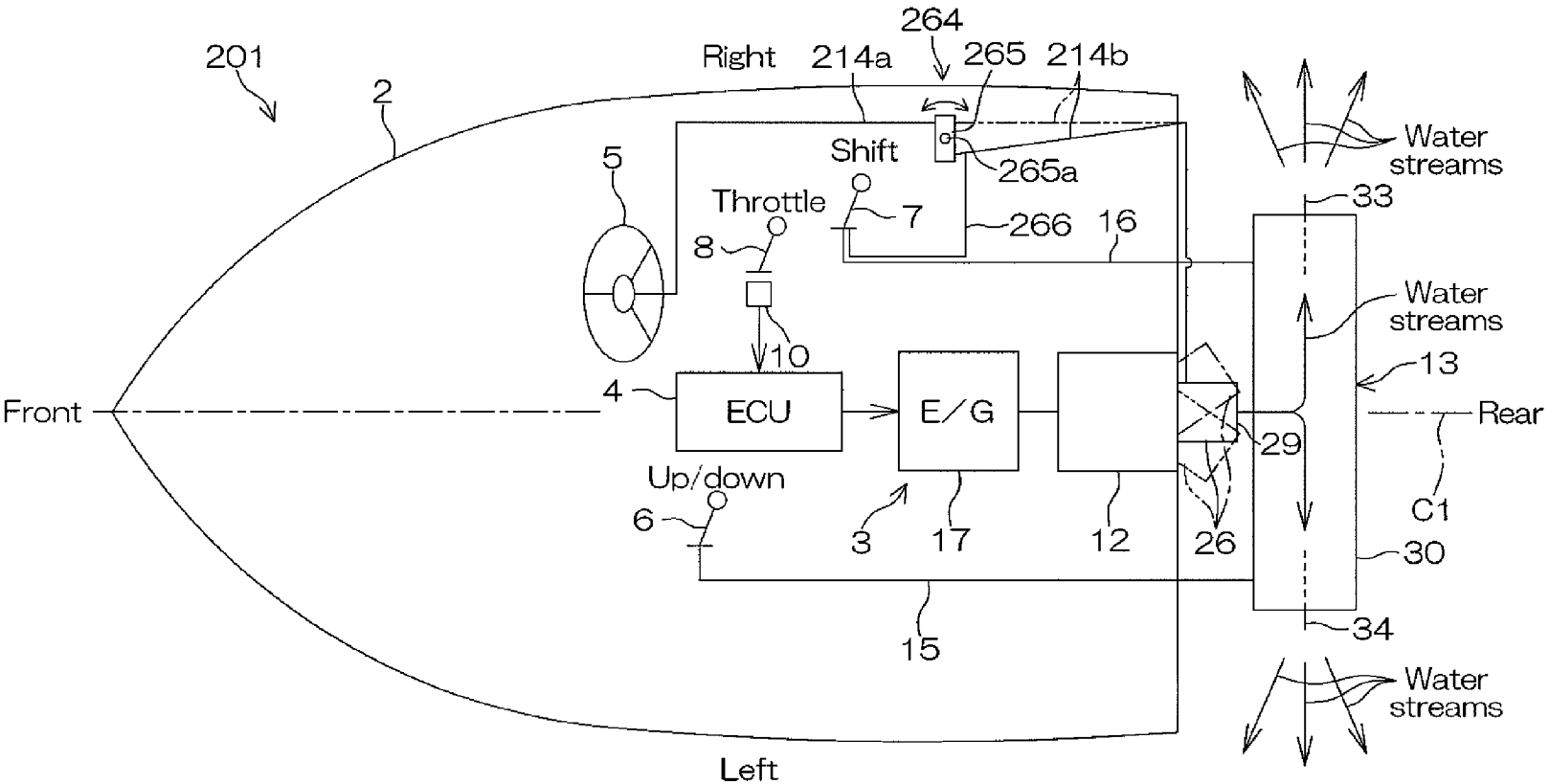
FIG. 46 is a schematic plan view of a vessel according to an eleventh preferred embodiment of the present invention.
Figure 47:
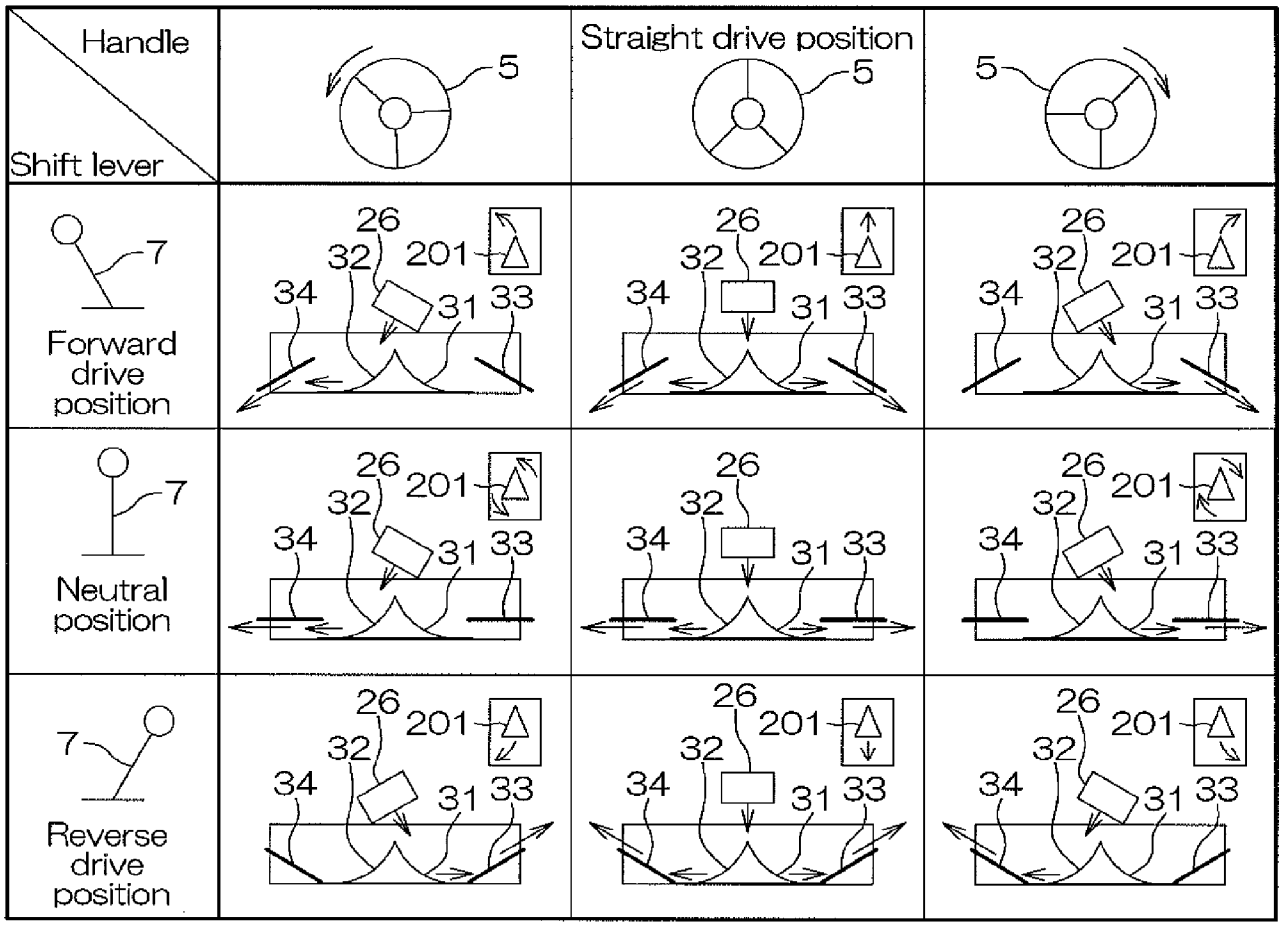
FIG. 47 shows schematic views for describing directions in which water jetted from a deflector is guided by a bucket.

An eleventh preferred embodiment of the present invention shall now be described. A principal point of difference between the eleventh preferred embodiment and the tenth preferred embodiment is that a steering position inverting mechanism that changes the steering position of the deflector is preferably provided between the handle and the deflector. In FIG. 46 and FIG. 47 below, elements and components equivalent to those shown in FIG. 35 to FIG. 45 are provided with the same reference symbols as in FIG. 35, etc., and description thereof shall be omitted.

FIG. 46 is a schematic plan view of a vessel 201 according to the eleventh preferred embodiment of the present invention. FIG. 47 shows schematic views for describing directions in which water jetted from the deflector 26 is guided by the bucket 13.

The vessel 201 according to the eleventh preferred embodiment preferably has the same arrangement as the vessel 1 according to the tenth preferred embodiment. That is, as shown in FIG. 46, the vessel 201 includes, in place of the steering cable 14 according to the tenth preferred embodiment, the steering direction inverting mechanism 264 that transmits the operation of the handle 5 to the deflector 26 and changes the steering direction of the deflector 26 in accordance with the position of the shift lever 7.

As shown in FIG. 46, the steering direction inverting mechanism 264 includes two transmission cables (a first transmission cable 214*a* and a second transmission cable 214*b*), a rotating member 265, and a switching cable 266. The rotating member 265 is held by the hull 2 and is rotatable around a rotating shaft 265*a* provided at an intermediate portion of the rotating member 265. The respective cables 214*a*, 214*b*, and 266 preferably are, for example, push-pull cables. One end portion of the first transmission cable 214*a* is coupled to the handle 5 and the other end portion of the first transmission cable 214*a* is coupled to one end portion of the rotating member 265. Also, one end portion of the second transmission cable 214*b* is coupled to the other end portion of the rotating member 265 and the other end portion of the second transmission cable 214*b* is coupled to the deflector 26.

When the handle 5 is steered, the movement of the handle 5 is transmitted to the rotating member 265 by the first transmission cable 214*a*. The rotating member 265 thereby rotates around the rotating shaft 265*a*. Specifically, when the handle 5 is steered to the right, the rotating member 265 rotates in one rotation direction, and when the handle 5 is steered to the left, the rotating member 265 rotates in the other rotation direction. The second transmission cable 214*b* is pushed or pulled by the rotating member 265 rotating. Thus, when the handle 5 is steered, the movement of the handle 5 is transmitted to the deflector 26 by the first transmission cable 214*a*, the rotating member 265, and the second transmission cable 214*b* and the deflector 26 rotates to the right or left.

As indicated by alternate long and two short dashed lines in FIG. 46, the one end portion of the second transmission cable 214*b* is movable between the one end portion of the rotating member 265 and the other end portion of the rotating member 265. One end portion of the switching cable 266 is coupled to the one end portion of the second transmission cable 214*b* and the other end portion of the switching cable 266 is coupled to the shift lever 7. When the shift lever 7 is operated, the movement of the shift lever 7 is transmitted to the one end portion of the second transmission cable 214*b* by the switching cable 266 and the one end portion of the second transmission cable 214*b* moves between the one end portion of the rotating member 265 and the other end portion of the rotating member 265. In a state in which the shift lever 7 is positioned at the forward drive position, the one end portion of the second transmission cable 214*b* is positioned at the one end portion of the rotating member 265, and in a state in which the shift lever 7 is positioned at the reverse drive position, the one end portion of the second transmission cable 214*b* is positioned at the other end portion of the rotating member 265.

Even when the steering direction of the handle 5 is the same, in the state in which the one end portion of the second transmission cable 214*b* is positioned at the one end portion of the rotating member 265, the deflector 26 is steered in a direction opposite that in the state in which the one end portion of the second transmission cable 214*b* is positioned at the other end portion of the rotating member 265. Specifically, in the state in which the shift lever 7 is positioned at the forward drive position, the one end portion of the second transmission cable 214*b* is positioned at the one end portion of the rotating member 265. As shown in an upper stage of a right column of FIG. 47, when the handle 5 is steered to the right in this state, the deflector 26 is steered to the right. On the other hand, in the state in which the shift lever 7 is positioned at the reverse drive position, the one end portion of the second transmission cable 214*b* is positioned at the other end portion of the rotating member 265. As shown in a lower stage of the right column of FIG. 47, when the handle 5 is steered to the right in this state, the deflector 26 is steered to the left. As can be understood from a comparison of the upper stage and the lower stage of a left column of FIG. 47, when the handle 5 is steered to the left, the deflector 26 is likewise steered, in the state in which the shift lever 7 is positioned at the reverse drive position, in a direction opposite that in the state in which shift lever 7 is positioned at the forward drive position.

Thus, in the state in which the shift lever 7 is positioned at the reverse drive position, the steering direction of the deflector 26 is inverted and the turning direction of the vessel 201 is also inverted. Specifically, as shown in the lower stage of the right column of FIG. 47, when water is jetted from the deflector 26 in the state in which the handle 5 is steered to the right and the shift lever 7 is positioned at the reverse drive position, the vessel 201 is driven in reverse while turning to the right. The turning direction of the vessel 201 can thus be matched in the case where the shift lever 7 is positioned at the forward drive position and in the case where the shift lever 7 is positioned at the reverse drive position.

Twelfth Preferred Embodiment

Figure 48:
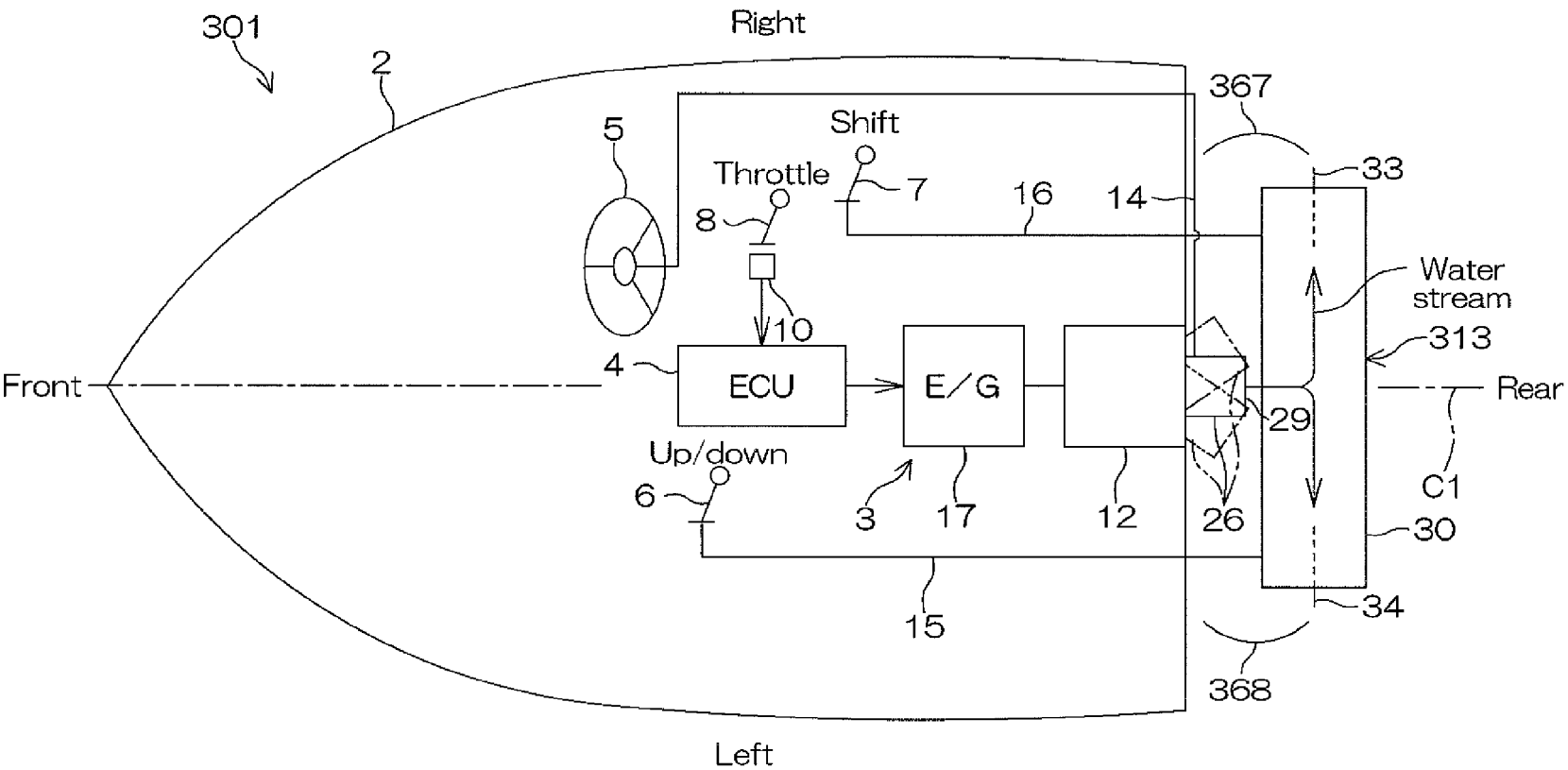
FIG. 48 is a schematic plan view of a vessel according to a twelfth preferred embodiment of the present invention.
Figure 49:
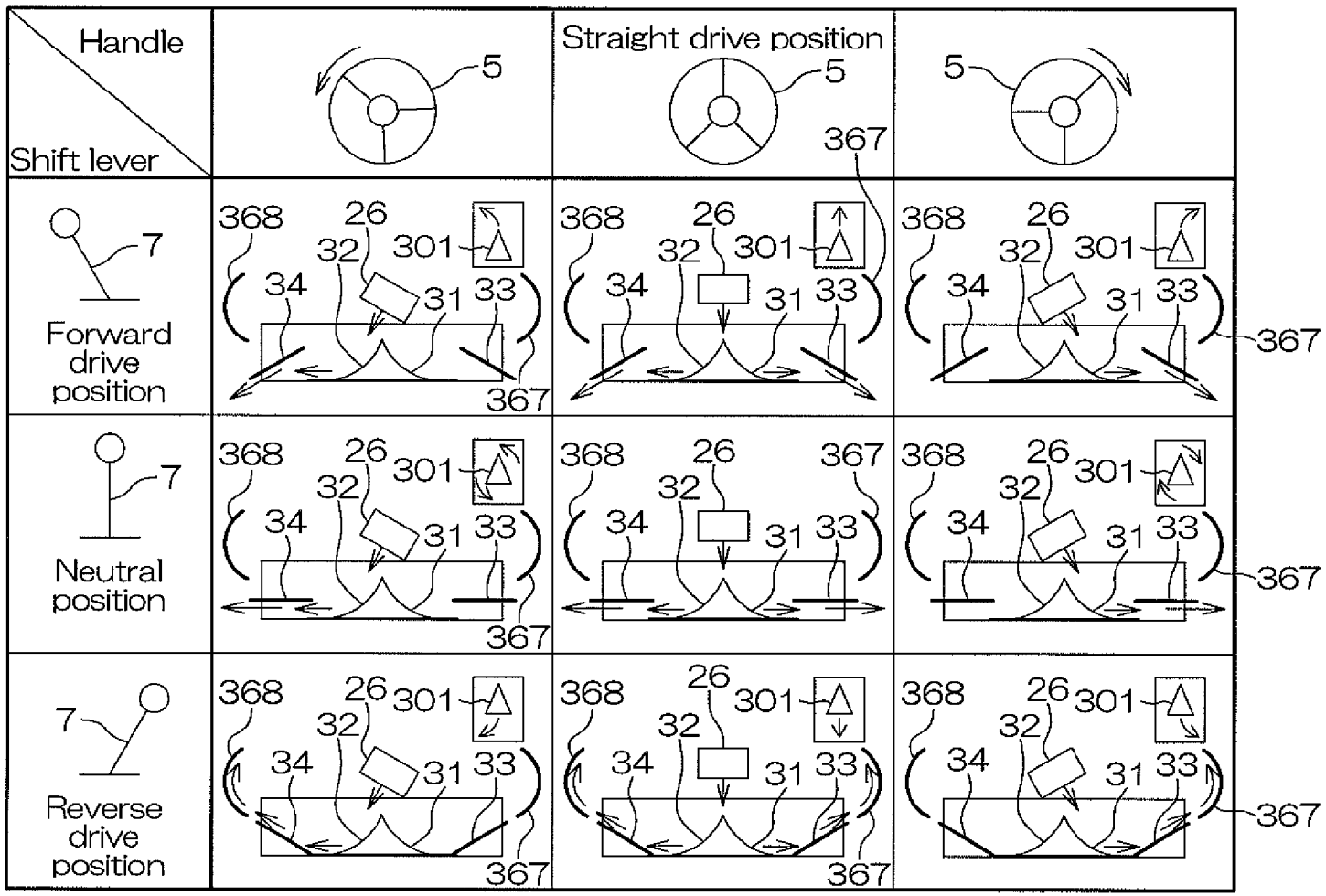
FIG. 49 shows schematic views for describing directions in which water jetted from a deflector is guided by a bucket.

A twelfth preferred embodiment of the present invention shall now be described. A principal point of difference between the twelfth preferred embodiment and the tenth preferred embodiment is that a bucket preferably further includes inverting guides that guide the water guided in obliquely forward directions by the movable guides. In FIG. 48 and FIG. 49 below, elements and components equivalent to those shown in FIG. 35 to FIG. 47 are provided with the same reference symbols as in FIG. 35, etc., and description thereof shall be omitted.

FIG. 48 is a schematic plan view of a vessel 301 according to the twelfth preferred embodiment of the present invention. FIG. 49 shows schematic views for describing directions in which water jetted from the deflector 26 is guided by the bucket 313.

The vessel 301 according to the twelfth preferred embodiment preferably has the same arrangement as the vessel 1 according to the tenth preferred embodiment. That is, as shown in FIG. 48, the vessel 301 includes the bucket 313 in place of the bucket 13 according to the tenth preferred embodiment. In addition to the arrangement included in the bucket 13 according to the tenth preferred embodiment, the bucket 313 includes the pair of right and left inverting guides (right inverting guide 367 and left inverting guide 368) that guide the water guided in obliquely forward directions by the movable guides 33 and 34.

As shown in FIG. 48, the right inverting guide 367 and the left inverting guide 368 are disposed at outer sides relative to the casing 30. The right inverting guide 367 and the left inverting guide 368 may be held by the casing 30 or may be held by the hull 2. Each of the right inverting guide 367 and the left inverting guide 368 preferably has an outwardly protruding arcuate shape in a plan view. A rear end portion of right inverting guide 367 is disposed at an outer side of the right end portion of the casing 30 and a rear end portion of the left inverting guide 368 is disposed at an outer side of the left end portion of the casing 30.

As shown in lower stages of respective columns of FIG. 49, water guided in an obliquely forward right direction by the right movable guide 33 is guided in an obliquely forward left direction by the right inverting guide 367 and water guided in an obliquely forward left direction by the left movable guide 34 is guided in an obliquely forward right direction by the left inverting guide 368. That is, the water guided in the obliquely forward right direction by the right movable guide 33 is right/left inverted by the right inverting guide 367 and water guided in the obliquely forward left direction by the left movable guide 34 is right/left inverted by the left inverting guide 368. Thus, as shown in the lower stage of the right column of FIG. 49, when water is jetted from the deflector 26 in a state in which the handle 5 is steered to the right and the shift lever 7 is positioned at the reverse drive position, the vessel 301 is driven in reverse while turning to the right. The turning direction of the vessel 301 can thus be matched in the case where the shift lever 7 is positioned at the forward drive position and in the case where the shift lever 7 is positioned at the reverse drive position.

Thirteenth Preferred Embodiment

Figure 50:
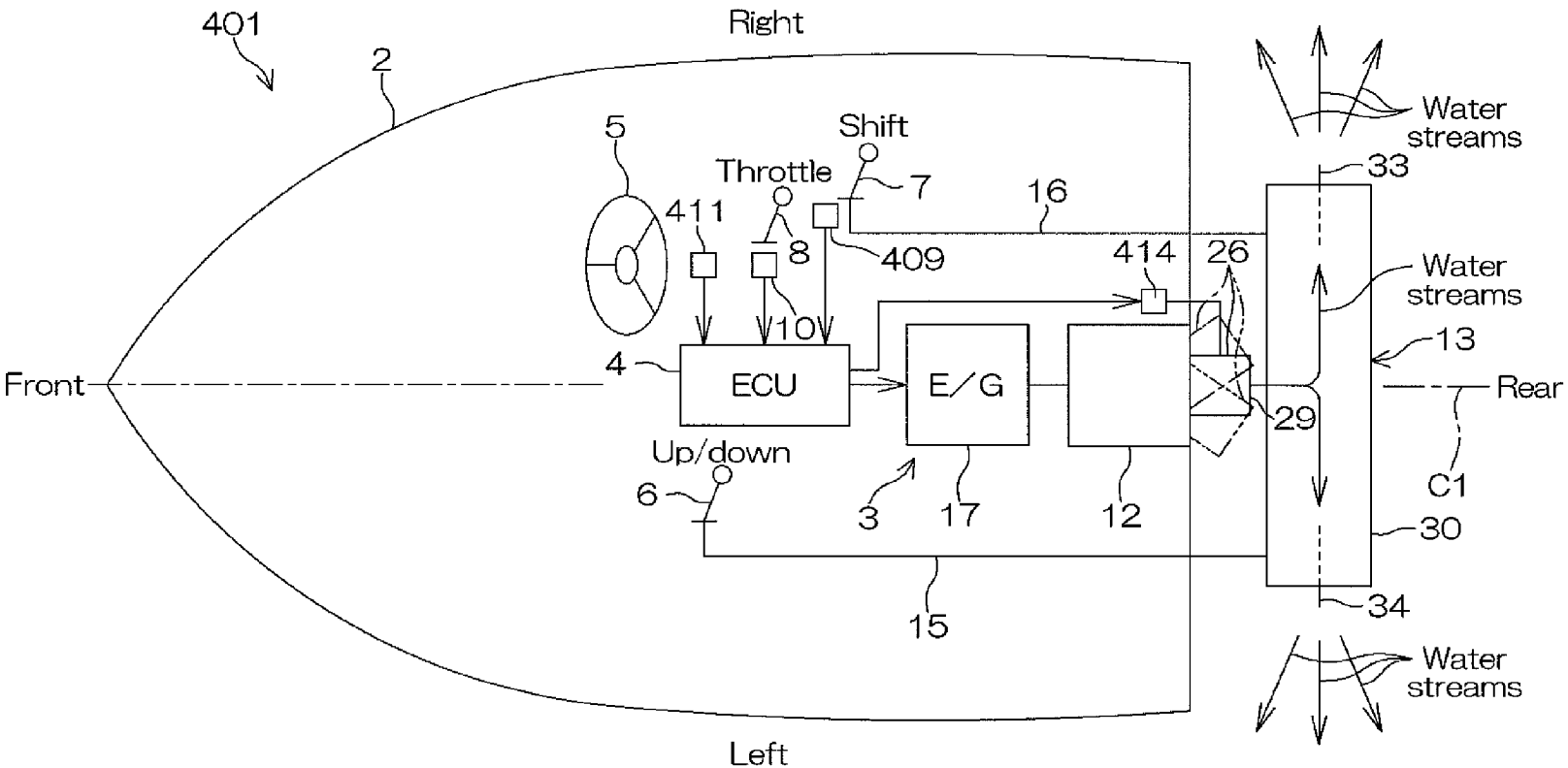
FIG. 50 is a schematic plan view of a vessel according to a thirteenth preferred embodiment of the present invention.

A thirteenth preferred embodiment of the present invention shall now be described. A principal point of difference between the thirteenth preferred embodiment and the tenth preferred embodiment is that an arrangement of the mechanism that rotates the deflector to the right and left differs. That is, whereas the handle and the deflector are connected mechanically in the tenth preferred embodiment, the handle and the deflector are preferably connected electrically in the thirteenth preferred embodiment. In FIG. 50 below, elements and components equivalent to those shown in FIG. 35 to FIG. 49 are provided with the same reference symbols as in FIG. 35, etc., and description thereof shall be omitted.

FIG. 50 is a schematic plan view of a vessel 401 according to the thirteenth preferred embodiment of the present invention.

The vessel 401 according to the thirteenth preferred embodiment preferably has the same arrangement as the vessel 1 according to the tenth preferred embodiment. That is, the vessel 401 preferably includes, in place of the steering cable 14, an electrical actuator 414 that rotates the deflector 26 to the right and left. Further, the vessel 401 includes a handle position detecting device 411 detecting the position of the handle 5 and a lever position detecting device 409 detecting the position of the shift lever 7. The electric actuator 414, the handle position detecting device 411, and the lever position detecting device 409 are connected to the ECU 4.

The ECU 4 acquires detection values of the handle position detecting device 411 and the lever position detecting device 409. The ECU 4 controls the electric actuator 414 based on the detection value of the handle position detecting device 411 to rotate the deflector 26 to the right and left between the right maximum steering position (position indicated by alternate long and short dashed lines) and the left maximum steering position (position indicated by alternate long and two short dashed lines). Further, the ECU 4 controls the direction of rotation of the deflector 26 based on the detection value of the lever position detecting device 409. That is, in the case where the shift lever 7 is positioned at the reverse drive position, the ECU 4 may cause the deflector 26 to rotate in a direction opposite that in the case where shift lever 7 is not positioned at the reverse drive position even when the steering direction of the handle 5 is the same. In this case, the turning direction of the vessel 401 can be matched in the case where the shift lever 7 is positioned at the forward drive position and in the case where the shift lever 7 is positioned at the reverse drive position.

Fourteenth Preferred Embodiment

Figure 51:
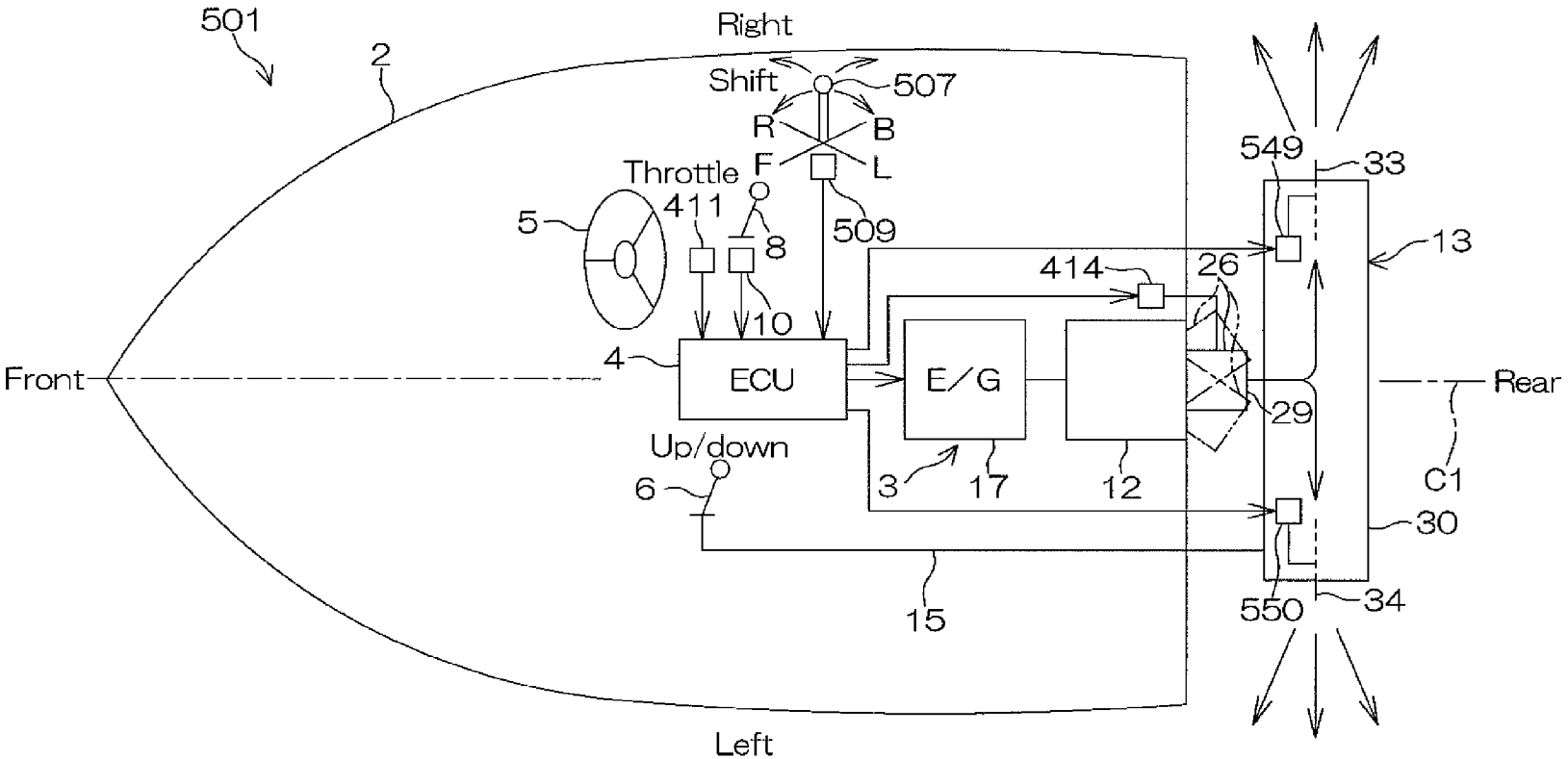
FIG. 51 is a schematic plan view of a vessel according to a fourteenth preferred embodiment of the present invention.
Figure 52:
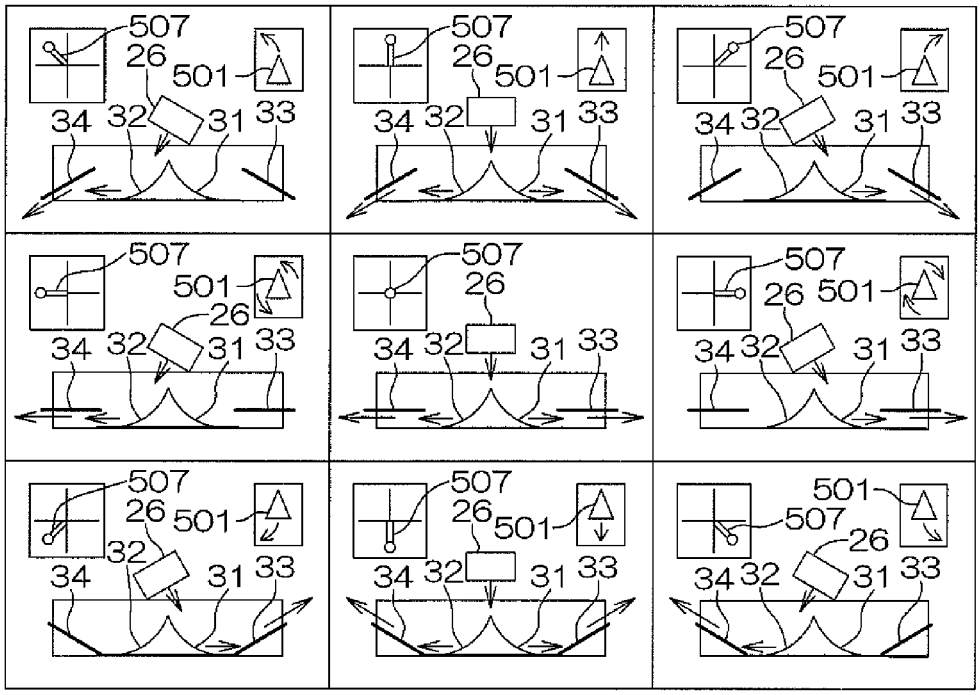
FIG. 52 shows schematic views for describing relationships between an operation direction of a shift lever and a heading direction of the vessel according to the fourteenth preferred embodiment of the present invention.

A fourteenth preferred embodiment of the present invention shall now be described. A principal point of difference between the fourteenth preferred embodiment and the thirteenth preferred embodiment is that an arrangement of the shift lever differs. That is, the shift lever in the fourteenth preferred embodiment is arranged to be tiltable to the front, rear, right, and left. In FIG. 51 and FIG. 52 below, elements and components equivalent to those shown in FIG. 35 to FIG. 50 are provided with the same reference symbols as in FIG. 35, etc., and description thereof shall be omitted.

FIG. 51 is a schematic plan view of a vessel 501 according to the fourteenth preferred embodiment of the present invention.

The vessel 501 according to the fourteenth preferred embodiment preferably has the same arrangement as the vessel 1 according to the thirteenth preferred embodiment. That is, the vessel 501 includes, in place of the shift lever 7, a shift lever 507 arranged to be tiltable forward, rearward, rightward and leftward and a lever position detecting device 509 detecting the tilting of the shift lever 507. Further, the vessel 501 includes, in place of the shift cable 16 and the link mechanism 38, a right electric actuator 549 moving the right movable guide 33 between the forward drive position and the reverse drive position and a left electric actuator 550 moving the left movable guide 34 between the forward drive position and the reverse drive position.

The shift lever 507 preferably is a joystick that extends in the up/down direction and is arranged to be tiltable forward, rearward, rightward, and leftward with its lower end portion as a center. The ECU 4 acquires the detection value of the lever position detecting device 509 and controls the right electric actuator 549 and the left electric actuator 550 based on the detection value. The respective movable guides 33 and 34 are thereby driven based on the position of the shift lever 507. Further, the ECU 4 controls the electric actuator 414 based on the detection value of the lever position detecting device 509. That is, the ECU 4 moves the movable guides 33 and 34 and the deflector 26 in accordance with the operation of the shift lever 507. In a case where the ECU 4 is to move the respective movable guide 33 and 34, the ECU 4 may move the right movable guide 33 and the left movable guide 34 while maintaining a right/left symmetrical positional relationship as in the tenth preferred embodiment or may move the right movable guide 33 and the left movable guide 34 individually.

FIG. 52 shows schematic views for describing relationships between the operation direction of the shift lever 507 and a heading direction of the vessel 501 according to the fourteenth preferred embodiment of the present invention.

When the shift lever 507 is tilted in the right direction or the left direction, the ECU 4 moves the deflector 26 and the movable guides 33 and 34 in a manner such that the vessel 501 turns on the spot. Also, when the shift lever 507 is tilted in a direction other than the right direction or the left direction, the ECU 4 moves the deflector 26 and the movable guides 33 and 34 in a manner such that the vessel 501 travels in the direction in which the shift lever 507 is tilted.

Specifically, as shown at a right end or a left end of a middle stage of FIG. 52, when the shift lever 507 is tilted in the right direction or the left direction, the ECU 4 causes the deflector 26 to be positioned at the right side or the left side relative to the straight dive position and positions the respective movable guides 33 and 34 at the neutral positions. Thus, when water is jetted from the deflector 26 in the state in which shift lever 507 is tilted in the right direction or the left direction, the vessel 501 turns rightward or leftward on the spot.

Also, as shown in an upper stage or a lower stage of a middle column of FIG. 51, when the shift lever 507 is tilted in the forward direction or the rearward direction, the ECU 4 causes the deflector 26 to be positioned at the straight drive position and causes the respective movable guides 33 and 34 to be positioned at the forward drive positions or the reverse drive positions. Thus, when water is jetted from the deflector 26 in the state in which the shift lever 507 is tilted in the forward direction or the rearward direction, the vessel 501 is driven straight in the forward direction or the rearward direction. The vessel 501 is thereby caused to travel in the direction in which the lever 507 is tilted.

Also, as shown in any one of right ends and left ends of the upper stage and the lower stage of FIG. 51, when the shift lever 507 is tilted in an oblique direction (a direction between any two directions among the forward direction, rearward direction, right direction, and left direction), the ECU 4 causes the deflector 26 to be positioned at the right side or the left side relative to the straight drive position and causes the respective movable guides 33 and 34 to be positioned at the forward drive positions or the reverse drive positions. Thus, when water is jetted from the deflector 26 in the state in which the shift lever 507 is tilted in the oblique direction, the vessel 501 is driven forward or in reverse while turning rightward or leftward. The vessel 501 is thereby caused to travel in the direction in which the shift lever 507 is tilted.

Fifteenth Preferred Embodiment

Figure 53:
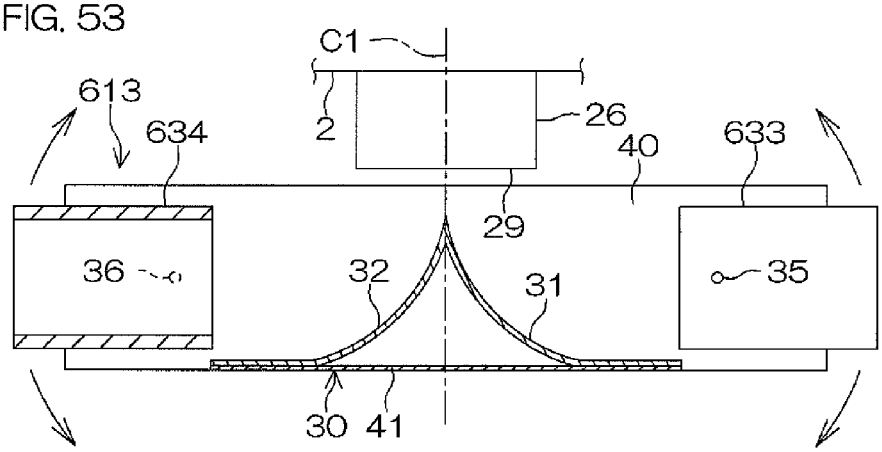
FIG. 53 is a schematic view for describing an internal structure of a bucket according to a fifteenth preferred embodiment of the present invention.
Figure 54:
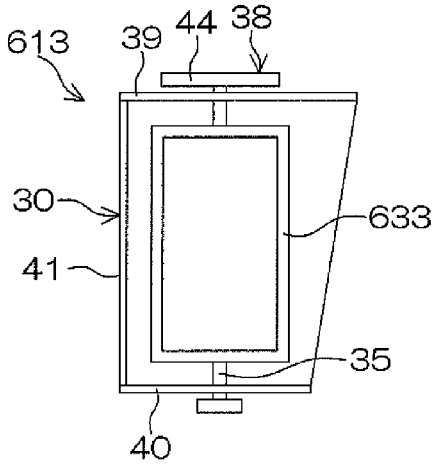
FIG. 54 is a side view of the bucket according to the fifteenth preferred embodiment of the present invention.

A fifteenth preferred embodiment of the present invention shall now be described. A principal point of difference between the fifteenth preferred embodiment and the tenth preferred embodiment is that an arrangement of the movable guides differs. That is, whereas the movable guides according to the tenth preferred embodiment preferably are plates, the movable guides according to the fifteenth preferred embodiment preferably are tubular nozzles that extend rectilinearly. In FIG. 53 and FIG. 54 below, elements and components equivalent to those shown in FIG. 35 to FIG. 52 are provided with the same reference symbols as in FIG. 35, etc., and description thereof shall be omitted.

FIG. 53 is a schematic view for describing an internal structure of a bucket 613 according to the fifteenth preferred embodiment of the present invention. FIG. 54 is a side view of the bucket 613 according to the fifteenth preferred embodiment of the present invention. A state in which the bucket 613 is positioned at a closed position is shown in FIG. 53 and FIG. 54. The state in which the bucket 613 is positioned at the closed position shall be described below. Also, one of movable guides 633 and 634 has a shape that is a right/left inversion of that of the other of the movable guides 633 and 634 and thus in FIG. 53, the right movable guide 633 is shown in a plan view and the left movable guide 634 is shown in cross section.

With the exception of the movable guides 33 and 34, the bucket 613 according to the fifteenth preferred embodiment preferably has the same arrangement as the bucket 13 according to the tenth preferred embodiment. That is, the bucket 613 includes the casing 30, the pair of right and left fixed guides 31 and 32, the pair of right and left movable guides 633 and 634, and the pair of right and left rotating shafts 35 and 36.

The movable guides 633 and 634 preferably are tubular nozzles that extend rectilinearly. The right movable guide 633 is a right nozzle and the left movable guide 634 is a left nozzle. The respective movable guides 633 and 634 extend in the right/left direction at the forward drive position. As shown in FIG. 54, for example, openings preferably having a rectangular or substantially rectangular shape are provided at one end and the other end of each of the movable guides 633 and 634. The right movable guide 633 and the left movable guide 634 are respectively disposed inside the right end portion and inside the left end portion of the casing 30. The right movable guide 633 is disposed at the right side relative to the right fixed guide 31 and the left movable guide 634 is disposed at the left side relative to the left fixed guide 32. An end portion at an outer side of each of the movable guides 633 and 634 projects outside from the casing 33. The end portion at an outer side of each of the movable guides 633 and 634 may be housed inside the casing 33. The right movable guide 633 is coupled to the right rotating shaft 35 that extends in the up/down direction at the closed position of the bucket 613, and the left movable guide 634 is coupled to the left rotating shaft 36 that extends in the up/down direction at the closed position of the bucket 613. The respective movable guides 633 and 634 rotate together with the corresponding rotating shafts 35 and 36. The respective movable guides 633 and 634 are rotatable around the corresponding rotating shafts 35 and 36 and between forward drive positions and reverse drive positions. The respective movable guides 633 and 634 are driven between the forward drive positions and the reverse drive positions in linkage with the operation of the shift lever 7 (see FIG. 35).

Sixteenth Preferred Embodiment

Figure 55:
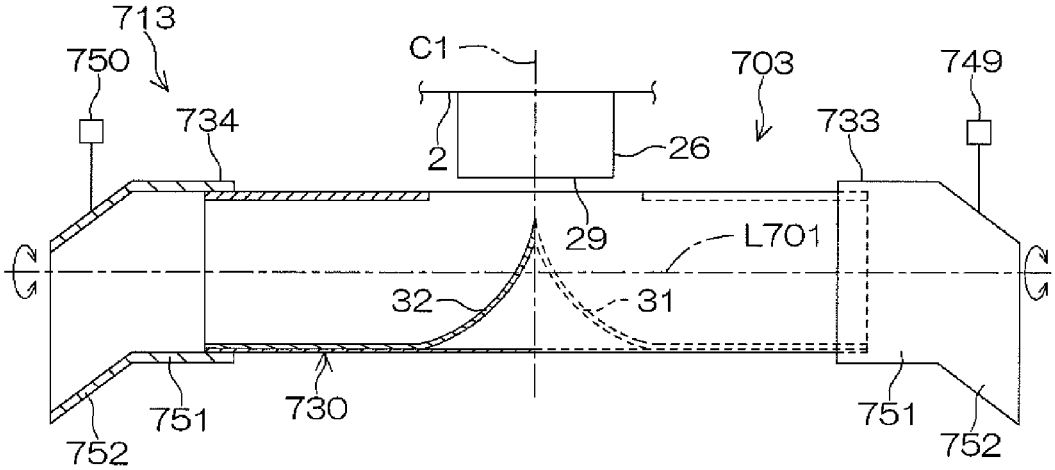
FIG. 55 is a schematic view for describing an internal structure of a bucket according to a sixteenth preferred embodiment of the present invention.

A sixteenth preferred embodiment of the present invention shall now be described. A principal point of difference between the sixteenth preferred embodiment and the fifteenth preferred embodiment is that an arrangement of the movable guides differs. That is, whereas the movable guides according to the fifteenth preferred embodiment preferably are tubular nozzles that extend rectilinearly, the movable guides according to the sixteenth preferred embodiment preferably are tubular nozzles that are bent into L shapes. In FIG. 55 below, elements and components equivalent to those shown in FIG. 35 to FIG. 54 are provided with the same reference symbols as in FIG. 35, etc., and description thereof shall be omitted.

FIG. 55 is a schematic view for describing an internal structure of a bucket 713 according to the sixteenth preferred embodiment of the present invention. A state in which the bucket 713 is positioned at a closed position is shown in FIG. 55. The state in which the bucket 713 is positioned at the closed position shall be described below. Also, one of movable guides 733 and 734 has a shape with which the other of the movable guides 733 and 734 is right/left inverted and thus in FIG. 55, a portion of the bucket 713 at the right side relative to the hull center C1 is shown in a plan view and a portion of the bucket 713 at the left side relative to the hull center C1 is shown in cross section.

With the exception of the movable guides 633 and 634, the casing 30, and the rotating shafts 35 and 36, the bucket 713 according to the sixteenth preferred embodiment preferably has the same arrangement as the bucket 613 according to the fifteenth preferred embodiment. That is, the bucket 713 includes a casing 730, the pair of right and left fixed guides 31 and 32, and the pair of right and left movable guides 733 and 734.

The casing 730 has a cylindrical shape that extends in the right/left direction. The casing 730 has a right/left symmetrical shape. The casing 730 houses the right fixed guide 31 and the left fixed guide 32. An opening positioned at the rear of the outlet 29 of the deflector 26 is provided at a front end portion of the casing 730. Water jetted from the outlet 29 enters into the casing 730 from the opening. Water that enters into the casing 730 is guided in the right and left directions by the respective fixed guides 31 and 32. The respective movable guides 733 and 734 change the directions of the water streams guided in the right and left directions by the fixed guides 31 and 32.

The movable guides 733 and 734 preferably are cylindrical nozzles that are bent into L shapes. The right movable guide 733 is a right nozzle and the left movable guide 734 is a left nozzle. The respective movable guides 733 and 734 extend in the right/left direction along a central axis L701 of the casing 730. Openings are provided at an outer end portion and an inner end portion of each of the movable guides 733 and 734. Each of the movable guides 733 and 734 includes a cylindrical insertion portion 751 extending in the right/left direction and a cylindrical jetting portion 752 extending obliquely with respect to the inserted portion 751 from an outer end portion of the inserted portion 751. A right end portion of the casing 730 is inserted inside the insertion portion 751 of the right movable guide 733 and a left end portion of the casing 730 is inserted inside the insertion portion 751 of the left movable guide 734. The right movable guide 733 is disposed at the right side relative to the right fixed guide 31 and the left movable guide 734 is disposed at the left side relative to the left fixed guide 32. The respective movable guides 733 and 734 are rotatable around the central axis L701 of the casing 730 and between forward drive positions and reverse drive positions.

That is, a state in which the respective movable guides 733 and 734 are positioned at the forward drive positions is shown in FIG. 55. The forward drive position of the right movable guide 733 is a position at which water is jetted obliquely rearward to the right from the jetting portion 752 of the right movable guide 733, and the forward drive position of the left movable guide 734 is a position at which water is jetted obliquely rearward to the left from the jetting portion 752 of the left movable guide 734. The forward drive position and the reverse drive position of the right movable guide 733 are positions that are front/rear symmetrical with respect to the central axis L701 of the casing 730. Likewise, the forward drive position and the reverse drive position of the left movable guide 734 are positions that are front/rear symmetrical with respect to the central axis L701 of the casing 730. Neutral positions between the forward drive positions and the reverse drive positions are positions at which water is jetted obliquely downward from the jetting portions 752 of the respective movable guides 733 and 734.

The vessel propulsion apparatus 703 includes aright electric actuator 749 that rotates the right movable guide 733 around the central axis L701 of the casing 730 and between the forward drive position and the reverse drive position, and a left electric actuator 750 that rotates the left movable guide 734 around the central axis L701 of the casing 730 and between the forward drive position and the reverse drive position. The ECU 4 drives the right electric actuator 749 and the left electric actuator 750 based on the detection value of the lever position detecting device 409 (see FIG. 50) to cause the respective movable guides 733 and 734 to rotate around the central axis L701 of the casing 730. The respective movable guides 733 and 734 are driven between the forward drive positions and the reverse drive positions in linkage with the operation of the shift lever 7.

Seventeenth Preferred Embodiment

Figure 56:
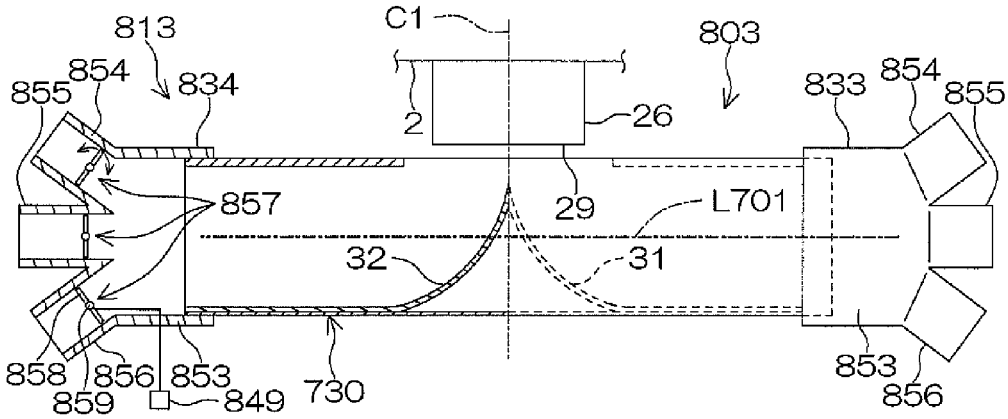
FIG. 56 is a schematic view for describing an internal structure of a bucket according to a seventeenth preferred embodiment of the present invention.

A seventeenth preferred embodiment of the present invention shall now be described. A principal point of difference between the seventeenth preferred embodiment and the sixteenth preferred embodiment is that an arrangement of the movable guides differs. That is, whereas the movable guides according to the sixteenth preferred embodiment preferably are tubular nozzles that are bent into L shapes, the movable guides according to the seventeenth preferred embodiment preferably are tubular nozzles that are branched into a plurality of branch portions. In FIG. 56 below, elements and components equivalent to those shown in FIG. 35 to FIG. 55 are provided with the same reference symbols as in FIG. 35, etc., and description thereof shall be omitted.

FIG. 56 is a schematic view for describing an internal structure of a bucket 813 according to the seventeenth preferred embodiment of the present invention. A state in which the bucket 813 is positioned at a closed position is shown in FIG. 56. The state in which the bucket 813 is positioned at the closed position shall be described below. Also, one of movable guides 833 and 834 has a shape with which the other of the movable guides 833 and 834 is right/left inverted and thus in FIG. 56, a portion of the bucket 813 at the right side relative to the hull center C1 is shown in a plan view and a portion of the bucket 813 at the left side relative to the hull center C1 is shown in cross section.

With the exception of the movable guides 733 and 734, the bucket 813 according to the seventeenth preferred embodiment preferably has the same arrangement as the bucket 713 according to the sixteenth preferred embodiment. That is, the bucket 813 includes the casing 730, the pair of right and left fixed guides 31 and 32, and the pair of right and left movable guides 833 and 834.

The movable guides 833 and 834 preferably are cylindrical nozzles that extend in the right/left direction along the central axis L701 of the casing 730. The right movable guide 833 is a right nozzle and the left movable guide 834 is a left nozzle. The right movable guide 833 is disposed at the right side relative to the right fixed guide 31 and the left movable guide 834 is disposed at the left side relative to the left fixed guide 32. An opening into which the casing 730 is inserted is provided at an end portion at an inner side of each of the movable guides 833 and 834, and three openings from which water is jetted is provided at an end portion at an outer side of each of the movable guides 833 and 834. That is, the end portion at the outer side of each of the movable guides 833 and 834 is preferably branched into three, for example.

Each of the movable guides 833 and 834 includes a cylindrical collective portion 853, three branch portions 854 to 856 branching from the collective portion 853, and three opening/closing valves 857 respectively disposed inside the three branch portions 854 to 856. The right end portion of the casing 730 is inserted in the collective portion 853 of the right movable guide 833 and the left end portion of the casing 730 is inserted in the collective portion 853 of the left movable guide 834. The three branch portions 854 to 856 include the reverse drive portion 854 extending outward and obliquely forward from the collective portion 853, a neutral portion 855 extending to the right direction or the left direction from the collective portion 853, and a forward drive portion 856 extending outward and obliquely rearward from the collective portion 853. An interior of each of the branch portions 854 to 856 is opened and closed by the corresponding opening/closing valve 857. Each opening/closing valve 857 includes a disk-shaped valve element 858 disposed in the corresponding branch portion among the branch portions 854 to 856 and a valve stem 859 extending along a diameter of the valve element 858. The valve element 858 is rotatable around the valve stem 859 and between an opened position and a closed position. The interior of each of the branch portions 854 to 856 is opened and closed by the valve element 858 rotating around the valve stem 859.

The vessel propulsion apparatus 803 preferably includes six electric actuators 849 (of which only one electric actuator 849 is shown in FIG. 56) respectively corresponding to the six opening/closing valves 857, for example. Each electric actuator 849 rotates the valve element 858 of the corresponding opening/closing valve 857 between the opened position and the closed position. Each electric actuator 849 is connected to the ECU 4. The ECU 4 drives the respective electric actuators 849 to rotate the respective valve elements 858 based on the detection value of the lever position detecting device 409 (see FIG. 50). That is, for example, when the shift lever 7 (see FIG. 50) is positioned at the forward drive position, the ECU 4 causes the valve elements 858 disposed inside the respective forward drive portions 856 to be positioned the opened positions and causes the valve elements 858 disposed inside the respective reverse drive portions 854 and inside the respective neutral portions 855 to be positioned at the closed positions. Thus, when water is jetted from the outlet 29 of the deflector 26 in this state, the water streams guided in the right direction and the left direction by the fixed guides 31 and 32 are guided obliquely rearward by the movable guides 833 and 834 and water is jetted obliquely rearward from the respective forward drive portions 856. The respective movable guides 833 and 834 are driven between forward drive positions and reverse drive positions in linkage with the operation of the shift lever 7.

Eighteenth Preferred Embodiment

Figure 57:
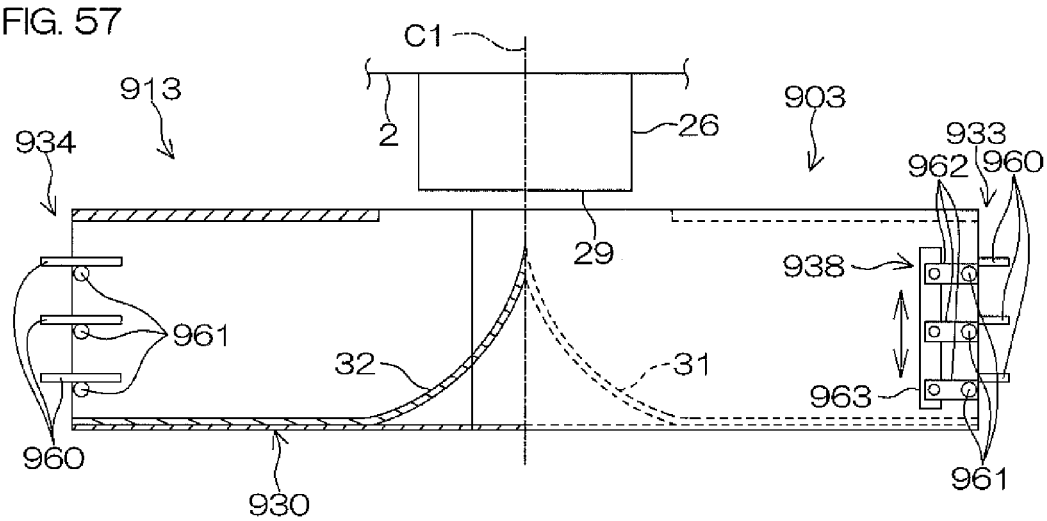
FIG. 57 is a schematic view for describing an internal structure of a bucket according to an eighteenth preferred embodiment of the present invention.
Figure 58:
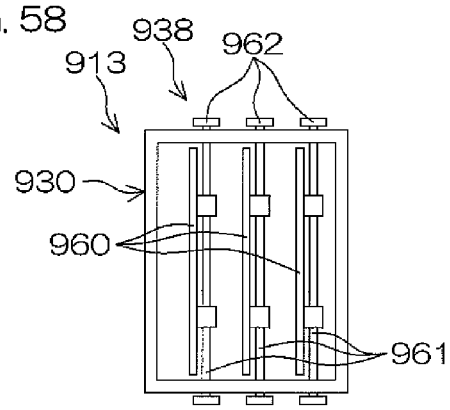
FIG. 58 is a side view of a bucket according to the eighteenth preferred embodiment of the present invention.
Figure 59:
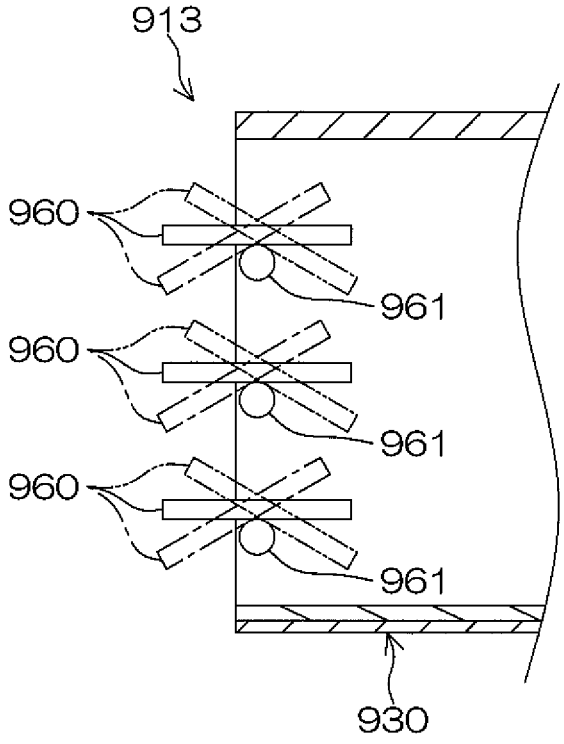
FIG. 59 is a partially enlarged view of FIG. 57.

An eighteenth preferred embodiment of the present invention shall now be described. A principal point of difference between the eighteenth preferred embodiment and the seventeenth preferred embodiment is that an arrangement of the movable guides differs. That is, whereas the movable guides according to the seventeenth preferred embodiment preferably are tubular nozzles that are branched into a plurality of branch portions, the movable guides according to the eighteenth preferred embodiment preferably define louvers. In FIG. 57 to FIG. 59 below, elements and components equivalent to those shown in FIG. 35 to FIG. 56 are provided with the same reference symbols as in FIG. 35, etc., and description thereof shall be omitted.

FIG. 57 is a schematic view for describing an internal structure of a bucket 913 according to the eighteenth preferred embodiment of the present invention. FIG. 58 is a side view of the bucket 913 according to the eighteenth preferred embodiment of the present invention. FIG. 59 is a partially enlarged view of FIG. 57. A state in which the bucket 913 is positioned at a closed position is shown in FIG. 57 and FIG. 58. The state in which the bucket 913 is positioned at the closed position shall be described below. Also, a casing 930 has a right/left symmetrical shape and thus in FIG. 57, a portion of the casing 930 at the right side relative to the hull center C1 is shown in a plan view and a portion of the casing 930 at the left side relative to the hull center C1 is shown in cross section.

With the exception of the movable guides 833 and 834 and the casing 730, the bucket 913 according to the eighteenth preferred embodiment preferably has the same arrangement as the bucket 813 according to the seventeenth preferred embodiment. That is, the bucket 913 includes the casing 930, the pair of right and left fixed guides 31 and 32, and the pair of right and left movable guides 933 and 934.

The casing 930 preferably has a tubular shape that extends in the right/left direction and has a rectangular cross-sectional shape, for example. The casing 930 has a right/left symmetrical shape. The casing 930 houses the right fixed guide 31 and the left fixed guide 32. An opening positioned at the rear of the outlet 29 of the deflector 26 is provided at a front end portion of the casing 930. Water jetted from the outlet 29 enters into the casing 930 from the opening. Water that enters into the casing 930 is guided in the right and left directions by the respective fixed guides 31 and 32. The respective movable guides 933 and 934 change the directions of the water streams guided in the right and left directions by the fixed guides 31 and 32.

The movable guides 933 and 934 define louvers that change the directions of water jetted from the right end portion and the left end portion of the casing 930. That is, each of the movable guides 933 and 934 includes a plurality of blades 960 disposed in parallel or substantially in parallel and a plurality of rotating shafts 961 respectively corresponding to the plurality of blades 960. Each blade 960 preferably has a rectangular or substantially rectangular shape and extends in the up/down direction. The plurality of blades 960 of the right movable guide 933 are disposed across intervals in the front/rear direction. Likewise, the plurality of blades 960 of the left movable guide 934 are disposed across intervals in the front/rear direction. The plurality of blades 960 of the right movable guide 933 are disposed in the right end portion of the casing 930 and the plurality of blades 960 making up the left movable guide 934 are disposed in the left end portion of the casing 930. Thus, the right movable guide 933 is disposed at the right side relative to the right fixed guide 31 and the left movable guide 934 is disposed at the left side relative to the left fixed guide 32. Each blade 960 is coupled to the corresponding rotating shaft 961. Each rotating shaft 961 extends in the up/down direction along the corresponding blade 960 and penetrates through the casing 930 in the up/down direction. As shown in FIG. 59, each blade 960 is rotatable around the corresponding rotating shaft 961 between a forward drive position (position indicated by alternate long and short dashed lines) and a reverse drive position (position indicated by alternate long and two short dashed lines). In FIG. 57, FIG. 58, and FIG. 59, a state in which the respective movable guides 933 and 934 are positioned at neutral positions between the forward drive positions and the reverse drive positions is indicated by solid lines.

As shown in FIG. 57, the vessel propulsion apparatus 903 includes a link mechanism 938 that transmits the operation of the shift lever 7 (see FIG. 35) to the right movable guide 933 and the left movable guide 934. The link mechanism 938 includes rotating arms 962 and a coupling arm 963 corresponding to the right movable guide 933. The rotating arms 962 and the coupling arm 963 are disposed above the right end portion of the casing 930. Although not illustrated, rotating arms 962 and a coupling arm 963 corresponding to the left movable guide 934 are also disposed above the left end portion of the casing 930.

As shown in FIG. 57, each rotating arm 962 extends in the right/left direction and the coupling arm 963 extends in the front/rear direction. The plurality of rotating arms 962 are disposed at outer sides relative to the coupling arm 963. Outer end portions of the plurality of rotating arms 962 are respectively coupled to upper end portions of the plurality of rotating shafts 961. Each rotating arm 962 rotates together with the corresponding rotating shaft 961. Also, inner end portions of the plurality of rotating arms 962 are coupled to the corresponding coupling arm 963. The respective rotating arms 962 and the corresponding coupling arm 963 are rotatable in a relative manner around an axis extending in the up/down direction. Although not illustrated, the coupling arm 963 corresponding to the right movable guide 933 and the coupling arm 963 corresponding to the left movable guide 934 are coupled to the shift lever 7 via the shift cable 16 (see FIG. 35).

When the shift lever 7 is operated, the operation of the shift lever 7 is transmitted to the respective coupling arms 963 by the shift cable 16. Each coupling arm 963 thereby moves along the front/rear direction and the respective rotating arms 962 rotate together with the corresponding rotating shafts 961. That is, the rotating shafts 961 of the right movable guide 933 and the rotating shafts 961 of the left movable guide 934 rotate in mutually opposite directions at the same rotation angle. The blade 960 of the right movable guide 933 and the blade 960 of the left movable guide 934 thus rotate in mutually opposite directions at the same rotation angle. The right movable guide 933 and the left movable guide 934 thus move between the forward drive position and the reverse drive position with the right/left symmetrical positional relationship being maintained. The respective movable guides 933 and 934 are driven between forward drive positions and reverse drive positions in linkage with the operation of the shift lever 7.

Other Preferred Embodiments

Although various preferred embodiments of the present invention have been described above, the present invention is not restricted to the contents of the above-described first to eighteenth preferred embodiments and various modifications are possible within the scope of the claims.

For example, with the first to ninth preferred embodiments described above, a case where the vessel propulsion apparatus preferably includes the R bucket and the F bucket was described. However, the vessel propulsion apparatus may include only the F bucket and the vessel propulsion apparatus does not have to include an R bucket.

Also, with the first to ninth preferred embodiments described above, a case where output adjustment of the vessel propulsion apparatus and movements of the R bucket and the F bucket are performed preferably by operation of a lever in common. However, two dedicated levers may be provided instead. That is, a throttle lever operated to adjust the output of the vessel propulsion apparatus and a shift lever operated to adjust the positions of the R bucket and the F bucket may be provided. Obviously, an R shift lever operated to adjust the position of the R bucket and an F shift lever operated to adjust the position of the F bucket may be provided.

Also, with the first to sixth, eighth, and ninth preferred embodiments described above, a case where the number of jet pumps included in the vessel propulsion apparatus preferably is one was described. However, the vessel propulsion apparatus may include a plurality of jet pumps.

Figure 60:
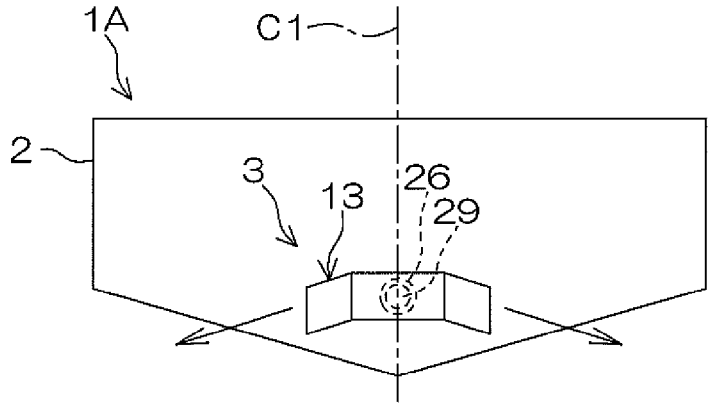
FIG. 60 is a schematic rear view of a vessel according to a nineteenth preferred embodiment of the present invention.

Also, with the tenth preferred embodiment described above, a case where water is jetted horizontally from the right end portion and the left end portion of the bucket 13 was described. However, when water is jetted horizontally from an underwater position close to a water surface, a portion of the water stream may splash out from the water surface. In this case, a portion of the thrust generated by the vessel propulsion apparatus 3 is not transmitted to the hull 2 and energy is wasted. Water may thus be jetted obliquely downward from the right end portion and the left end portion of the bucket 13 as in a vessel 1 according to a nineteenth preferred embodiment shown in FIG. 60. In this case, water streams are directed obliquely downward and splashing out of a portion of a water stream from the water surface can be prevented. The thrust generated by the vessel propulsion apparatus 3 can thus be used efficiently.

Figure 61:
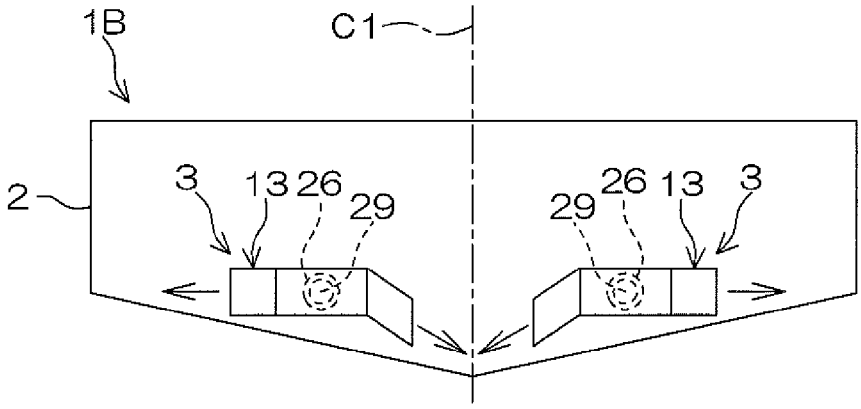
FIG. 61 is a schematic rear view of a vessel according to a twentieth preferred embodiment of the present invention.
Figure 62:
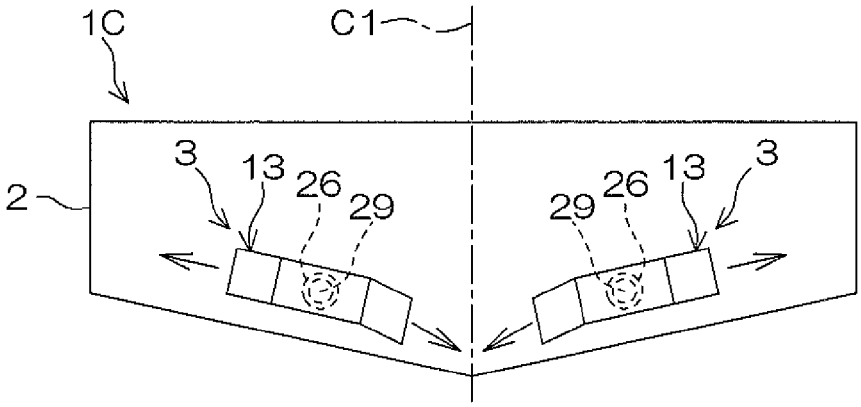
FIG. 62 is a schematic rear view of a vessel according to a twenty first preferred embodiment of the present invention.

Also, with the tenth preferred embodiment described above, a case where a single vessel propulsion apparatus 3 is preferably provided in the vessel 1 was described. However, a plurality of vessel propulsion apparatuses 3 may be provided in the vessel 1. Specifically, as shown in FIG. 61 and FIG. 62, two vessel propulsion apparatuses 3 may be provided in each of vessels 1B and 1C and two buckets 13 may be disposed right/left symmetrically.

When in a case where two vessel propulsion apparatuses are provided in a vessel and the bucket 13 at the right side and the bucket 13 at the left side are disposed at the same height, water is jetted horizontally from an end portion at an inner side of each bucket 13, water streams collide against each other. Thus, as in the vessel 1B according to a twentieth preferred embodiment shown in FIG. 61, each bucket 13 may be arranged to jet water horizontally from an end portion at an outer side and jet water obliquely downward from the end portion at the inner side. Or as in the vessel 1C according to a twenty first preferred embodiment shown in FIG. 62, each bucket 13 may be arranged to jet water obliquely upward from the end portion at the outer side and jet water obliquely downward from the end portion at the inner side.

Also, with the tenth preferred embodiment described above, a case where water is preferably jetted from the deflector 26 in the state in which the bucket 13 is positioned at the closed position was described. However, water may instead be jetted from the deflector 26 in a state in which the bucket 13 is positioned at the neutral position. In this case, a portion of the water jetted from the deflector 26 flows rearward without being blocked by the bucket 13 and thus the amount of water supplied to the bucket 13 from the deflector 26 decreases in comparison to that when the bucket 13 is positioned at the closed position. The right/left direction component of thrust is thus made small. However, a portion of the water jetted from the deflector 26 is guided by the bucket 13 and thus the right/left direction component of thrust can be increased in comparison to the case where the bucket 13 is positioned at the opened position. Vessel maneuverability can thus be improved in comparison to the case where the bucket 13 is positioned at the opened position.

Also, with the preferred embodiments described above, a case where the vessel preferably is a boat was described. However, the vessel may instead be a personal watercraft that includes a saddle type seat, for example, or other suitable vessel or vehicle.

The present application corresponds to Japanese Patent Application No. 2011-101756 and 2012-050906 respectively filed on Apr. 28, 2011 and Mar. 7, 2012 in the Japan Patent Office, the entire disclosures of these applications are incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

a nozzle that jets water rearward;

a deflector rotatable to the right and to the left around a substantially vertical axis D and between a right maximum steering position and a left maximum steering position, the deflector including an outlet which jets water jetted rearward from the nozzle in a rearward direction or an obliquely rearward direction tilted to the right or to the left with respect to the rearward direction; and a forward bucket rotatable up and down around a substantially horizontal axis F and between a closed position covering at least a portion of the outlet in a rear view of the vessel propulsion apparatus and an opened position not covering the outlet, the forward bucket guiding water jetted obliquely rearward to the right from the outlet in a right guiding direction extending in a right direction or an obliquely rearward right direction that is tilted further to the right than a direction of jetting of water from the outlet in a state in which the forward bucket is positioned at the closed position and the deflector is positioned at a right side relative to a straight drive position between the right maximum steering position and the left maximum steering position, the forward bucket guiding water jetted obliquely rearward to the left from the outlet in a left guiding direction extending in a left direction or an obliquely rearward left direction that is tilted further to the left than the direction of jetting of water from the outlet in a state in which the forward bucket is positioned at the closed position and the deflector is positioned at a left side relative to the straight drive position.

2. The vessel propulsion apparatus according to claim 1, wherein the substantially horizontal axis F is an axis that is fixed with respect to the nozzle.

3. The vessel propulsion apparatus according to claim 1, wherein the forward bucket generates a right branch stream flowing in the right guiding direction and a left branch stream flowing in the left guiding direction by dividing water jetted rearward from the outlet to the right and to the left at equal flow rates in a state in which the forward bucket is positioned at the closed position and the deflector is positioned at the straight drive position;

the forward bucket generates the right branch stream to have a greater flow rate than the left branch stream in the state in which the forward bucket is positioned at the closed position and the deflector is positioned at the right side relative to the straight drive position; and the forward bucket generates the left branch stream to have a greater flow rate than the right branch stream in the state in which the forward bucket is positioned at the closed position and the deflector is positioned at the left side relative to the straight drive position.

4. The vessel propulsion apparatus according to claim 1, wherein the forward bucket includes an apex portion disposed on a central axis of the deflector positioned at the straight drive position, a right guide extending obliquely rearward to the right from the apex portion, and a left guide extending obliquely rearward to the left from the apex portion.

5. The vessel propulsion apparatus according to claim 1, further comprising a reverse bucket rotatable up and down around a substantially horizontal axis R independently of the forward bucket, the reverse bucket guiding water flowing into the deflector from the nozzle forward.

6. The vessel propulsion apparatus according to claim 5, wherein the reverse bucket is disposed in front of the forward bucket and is rotatable up and down around the substantially horizontal axis R that is fixed with respect to the deflector.

7. The vessel propulsion apparatus according to claim 1, further comprising a reverse bucket disposed above the forward bucket, the reverse bucket being rotatable up and down around the substantially horizontal axis F together with the forward bucket, the reverse bucket guiding water flowing into the deflector from the nozzle forward.

8. The vessel propulsion apparatus according to claim 1, wherein the forward bucket includes a right guide that guides water jetted rearward from a right end portion of the outlet in the left guiding direction in a state in which the forward bucket is positioned at the closed position, and a left guide that guides water jetted rearward from a left end portion of the outlet in the right guiding direction in a state in which the forward bucket is positioned at the closed position.

9. The vessel propulsion apparatus according to claim 8, further comprising a reverse bucket that is rotatable up and down around the substantially horizontal axis F together with the right guide and the left guide, the reverse bucket guiding water flowing into the deflector from the nozzle forward.

10. A vessel propulsion apparatus comprising:

a jet pump including a nozzle that jets water rearward and a deflector rotatable to the right and to the left around a substantially vertical axis D and between a right maximum steering position and a left maximum steering position, the deflector including an outlet that jets water jetted rearward from the nozzle rearward;

a power source that drives the jet pump;

a forward bucket rotatable up and down around a substantially horizontal axis F and between a closed position covering at least a portion of the outlet in a rear view of the vessel propulsion apparatus and an opened position not covering the outlet, the forward bucket guiding water flowing into the deflector from the nozzle; and a reverse bucket rotatable up and down, independently of the forward bucket, around a substantially horizontal axis R and between a closed position covering at least a portion of the outlet in a rear view of the vessel propulsion apparatus and an opened position not covering the outlet, the reverse bucket guiding water flowing into the deflector from the nozzle such that a thrust in a reverse drive direction is generated.

11. The vessel propulsion apparatus according to claim 10, wherein the reverse bucket is disposed in front of the forward bucket;

the substantially horizontal axis F is an axis that is fixed with respect to the nozzle; and the substantially horizontal axis R is an axis that is fixed with respect to the deflector.

12. The vessel propulsion apparatus according to claim 10, wherein the forward bucket guides water jetted obliquely rearward to the right from the outlet in a right guiding direction extending in a right direction or an obliquely rearward right direction that is tilted further to the right than a direction of jetting of water from the outlet in a state in which the forward bucket is positioned at the closed position and the deflector is positioned at a right side relative to a straight drive position between the right maximum steering position and the left maximum steering position, and the forward bucket guides water jetted obliquely rearward to the left from the outlet in a left guiding direction extending in a left direction or an obliquely rearward left direction that is tilted further to the left than a direction of jetting of water from the outlet in a state in which the forward bucket is positioned at the closed position and the deflector is positioned at a left side relative to the straight drive position.

13. The vessel propulsion apparatus according to claim 12, wherein the forward bucket generates a right branch stream flowing in the right guiding direction and a left branch stream flowing in the left guiding direction by dividing water jetted rearward from the outlet to the right and to the left at equal flow rates in a state in which the forward bucket is positioned at the closed position and the deflector is positioned at the straight drive position;

the forward bucket generates the right branch stream to have a greater flow rate than the left branch stream in the state in which the forward bucket is positioned at the closed position and the deflector is positioned at the right side relative to the straight drive position; and the forward bucket generates the left branch stream to have a greater flow rate than the right branch stream in a state in which the forward bucket is positioned at the closed position and the deflector is positioned at the left side relative to the straight drive position.

14. The vessel propulsion apparatus according to claim 10, further comprising an actuator that rotates the forward bucket up or down around the substantially horizontal axis F; and a controller that is arranged and programmed to control the actuator based on a parameter related to operation of the power source.

15. The vessel propulsion apparatus according to claim 14, further comprising an operation member operated by a vessel operator to adjust an output of the power source; wherein the parameter includes a position of the operation member; and the controller controls the actuator based on the position of the operation member.

16. The vessel propulsion apparatus according to claim 14, wherein the power source includes an internal combustion engine including a throttle valve that changes a supply flow rate of intake air;

the parameter includes an opening degree of the throttle valve; and the controller controls the actuator based on the opening degree of the throttle valve.

17. The vessel propulsion apparatus according to claim 14, wherein the parameter includes a rotation speed of the power source, and the controller controls the actuator based on the rotation speed of the power source.

18. The vessel propulsion apparatus according to claim 10, wherein the forward bucket is arranged to rotate to an opened position by receiving water jetted rearward from the outlet.

19. The vessel propulsion apparatus according to claim 18, further comprising an urging member that generates a restorative force that corresponds to a movement amount of the forward bucket from the closed position and returns the forward bucket to the closed position.

20. The vessel propulsion apparatus according to claim 10, further comprising an operation member that is movable among a first position, a second position, and a third position and operated by a vessel operator; and a bucket moving device that moves at least one of the forward bucket and the reverse bucket based on a position of the operation member such that the reverse bucket moves from the closed position to the opened position when the operation member moves from the first position to the second position and the forward bucket moves from the closed position to the opened position when the operation member moves from the second position to the third position.

21. The vessel propulsion apparatus according to claim 20, further comprising a controller that is arranged and programmed to keep an output of the power source fixed regardless of an operation of the operation member in a state in which the operation member is positioned between the first position and the second position, and to increase the output of the power source in accordance with a movement amount of the operation member from the second position in a state in which the operation member is positioned between the second position and the third position.

22. A vessel propulsion apparatus comprising:

a pair of nozzles respectively disposed at a right side and a left side of a width direction center of a hull and that jet water rearward;

a pair of deflectors respectively coupled to the pair of nozzles, being rotatable to the right and to the left around substantially vertical axes D and between right maximum steering positions and left maximum steering positions, the pair of deflectors including outlets that jet water jetted rearward from the nozzles in rearward directions or in obliquely rearward directions that are tilted to the right or to the left with respect to the rearward directions; and a pair of forward buckets respectively disposed at right and left sides of the width direction center of the hull, being rotatable up and down around substantially horizontal axes F and between closed positions covering at least a portion of the outlets in a rear view of the vessel propulsion apparatus and opened positions not covering the outlets, generating thrusts in forward drive directions by guiding water flowing into the respective deflectors from the nozzles, being arranged such that in a state in which the pair of forward buckets are positioned at the closed positions and the pair of deflectors are positioned at right sides relative to straight drive positions between the right maximum steering positions and the left maximum steering positions, the forward bucket at the right side guides water jetted obliquely rearward to the right from the outlet at the right side in a right guiding direction extending in a right direction or an obliquely rearward right direction that is tilted further to the right than a direction of jetting of water from the outlet, and the forward bucket at the left side guides water jetted obliquely rearward to the right from the outlet at the left side in a direction between a direction of jetting of water from the outlet at the straight drive position and the right direction, and being arranged such that in a state in which the pair of forward buckets are positioned at the closed positions and the pair of deflectors are positioned at left sides relative to the straight drive positions, the forward bucket at the left side guides water jetted obliquely rearward to the left from the outlet at the left side in a left guiding direction extending in a left direction or an obliquely rearward left direction that is tilted further to the left than a direction of jetting of water from the outlet, the forward bucket at the right side guides water jetted obliquely rearward to the left from the outlet at the right side in a direction between a direction of jetting of water from the outlet at the straight drive position and the left direction.

23. The vessel propulsion apparatus according to claim 22, wherein the forward bucket at the right side is rotatable up and down around the substantially horizontal axis F that is fixed with respect to the nozzle at the right side, and the forward bucket at the left side is rotatable up and down around the substantially horizontal axis F that is fixed with respect to the nozzle at the left side.

24. The vessel propulsion apparatus according to claim 22, wherein the forward bucket at the right side generates a right branch stream flowing in the right guiding direction by guiding at least a portion of the water jetted rearward from the outlet at the right side in the state in which the pair of forward buckets are positioned at the closed positions and the pair of deflectors are positioned at the right sides relative to the straight drive positions;

the forward bucket at the left side generates a left branch stream flowing in the left guiding direction by guiding at least a portion of the water jetted rearward from the outlet at the left side in the state in which the pair of forward buckets are positioned at the closed positions and the pair of deflectors are positioned at the left sides relative to the straight drive positions; and the pair of forward buckets generates the right branch stream and the left branch stream that have an equal flow rate in a state in which the pair of forward buckets are positioned at the closed positions and the pair of deflectors are positioned at the straight drive positions, the pair of forward buckets generates the right branch stream to have a greater flow rate than the left branch stream in the state in which the pair of forward buckets are positioned at the closed positions and the pair of deflectors are positioned at the right sides relative to the straight drive positions, and the pair of forward buckets generates the left branch stream greater in flow rate than the right branch stream in the state in which the pair of forward buckets are positioned at the closed positions and the pair of deflectors are positioned at the left sides relative to the straight drive positions.

25. The vessel propulsion apparatus according to claim 22, further comprising a pair of reverse buckets respectively disposed at right and left sides of the width direction center of the hull and generating thrusts in reverse drive directions by guiding water flowing into the respective deflectors from the nozzles; wherein the forward bucket and the reverse bucket that are disposed at the same side with respect to the width direction center of the hull are aligned in an up/down direction such that the forward bucket is positioned below the reverse bucket and are integrally rotatable around the substantially horizontal axis F.

26. The vessel propulsion apparatus according to claim 22, wherein each of the pair of forward buckets has a shape that is right/left asymmetrical and the pair of forward buckets are disposed symmetrically with respect to the width direction center of the hull.

27. The vessel propulsion apparatus according to claim 26, wherein an entirety of the pair of forward buckets has a shape that is right-left symmetrical.

* * * * *